US006639555B1

(12) United States Patent
Kane et al.

(10) Patent No.: US 6,639,555 B1
(45) Date of Patent: Oct. 28, 2003

(54) ANTENNA UNIT, COMMUNICATION SYSTEM AND DIGITAL TELEVISION RECEIVER

(75) Inventors: Joji Kane, Nara (JP); Takasi Yosida, Ikoma (JP); Noboru Nomura, Kyoto (JP); Michio Sasaki, Yokohama (JP); Akinori Yanase, Yokohama (JP); Satoshi Yamada, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/486,332

(22) PCT Filed: Dec. 10, 1998

(86) PCT No.: PCT/JP98/05577

§ 371 (c)(1),
(2), (4) Date: May 31, 2000

(87) PCT Pub. No.: WO00/02287

PCT Pub. Date: Jan. 13, 2000

(30) Foreign Application Priority Data

Jul. 2, 1998 (JP) ..... 10-187967

(51) Int. Cl.[7] ..... H01Q 1/38

(52) U.S. Cl. ..... 343/700 MS; 343/815; 725/70

(58) Field of Search ..... 343/700 MS, 713, 343/702, 815, 860, 861; 725/70, 52; 348/563; 455/3.02; 375/261, 321

(56) References Cited

U.S. PATENT DOCUMENTS

| | | | | |
|---|---|---|---|---|
| 3,031,665 A | | 4/1962 | Marie | 343/770 |
| 3,624,658 A | | 11/1971 | Voronoff | 343/895 |
| 3,982,243 A | * | 9/1976 | Gustavsson et al. | 342/50 |
| 5,420,596 A | * | 5/1995 | Burrell et al. | 343/700 MS |
| 5,576,718 A | | 11/1996 | Buralli et al. | 343/700 |

(List continued on next page.)

FOREIGN PATENT DOCUMENTS

| | | |
|---|---|---|
| JP | 56-713 | 1/1981 |
| JP | 56-31235 | 3/1981 |
| JP | 60-51008 | 3/1985 |

(List continued on next page.)

*Primary Examiner*—Tan Ho
(74) *Attorney, Agent, or Firm*—Smith, Gambrell & Russell, LLP

(57) ABSTRACT

An antenna device comprising a conductive earth substrate, a receiving element located in the proximity of said conductive earth substrate and having a receiving terminal, and a transmitting element located in the proximity of said receiving element and having a transmitting terminal, characterized in that an end of said receiving element and an end of said transmitting element are connected to said conductive earth substrate for grounding through a common portion and the frequency band of said receiving element is different from that of said transmitting element.

46 Claims, 150 Drawing Sheets

U.S. PATENT DOCUMENTS

| | | | | | |
|---|---|---|---|---|---|
| 5,585,807 | A | * | 12/1996 | Takei | 343/700 MS |
| 5,627,550 | A | * | 5/1997 | Sanad | 343/700 MS |
| 5,874,919 | A | | 2/1999 | Rawnick et al. | 343/700 |
| 5,874,926 | A | * | 2/1999 | Tsuru et al. | 343/713 |
| 5,963,181 | A | | 10/1999 | Abe | 343/895 |
| 5,966,097 | A | * | 10/1999 | Fukasawa et al. | 343/700 MS |
| 6,061,024 | A | * | 5/2000 | McGirr et al. | 343/700 MS |
| 6,295,030 | B1 | * | 9/2001 | Kozakai et al. | 343/700 MS |
| 6,339,402 | B1 | * | 1/2002 | McKivergan | 343/700 MS |
| 6,343,208 | B1 | * | 1/2002 | Ying | 343/702 |
| 6,353,443 | B1 | * | 3/2002 | Ying | 343/700 MS |

FOREIGN PATENT DOCUMENTS

| | | |
|---|---|---|
| JP | 64-38845 | 3/1989 |
| JP | 1-158808 | 6/1989 |
| JP | 3-53014 | 5/1991 |
| JP | 4-207303 | 7/1992 |
| JP | 4-282903 | 10/1992 |
| JP | 5-41211 | 6/1993 |
| JP | 5-175727 | 7/1993 |
| JP | 5-70013 | 9/1993 |
| JP | 5-299935 | 11/1993 |
| JP | 6-69771 | 3/1994 |
| JP | 6-261019 | 9/1994 |
| JP | 7-336130 | 12/1995 |
| JP | 8-78943 | 3/1996 |
| JP | 8-321820 | 12/1996 |
| JP | 8-340315 | 12/1996 |
| JP | 9-181699 | 7/1997 |
| JP | 9-260925 | 10/1997 |
| JP | 10-107777 | 4/1998 |

* cited by examiner (Only the element circuit is shown.)

Example of receiving element

Reactance characteristics of band-pass circuit

Selectivity of antenna

| Without ferroelectric | With ferroelectric |
| --- | --- |
| • Vertical component → large<br>• Horizontal component → small<br>5605<br>Electric field<br>5604 | • Vertical component → small<br>• Horizontal component → large<br>Ferroelectric 5606<br>5605<br>Electric field<br>5606<br>Ferroelectric<br>5604 |

Fig. 88 (a)
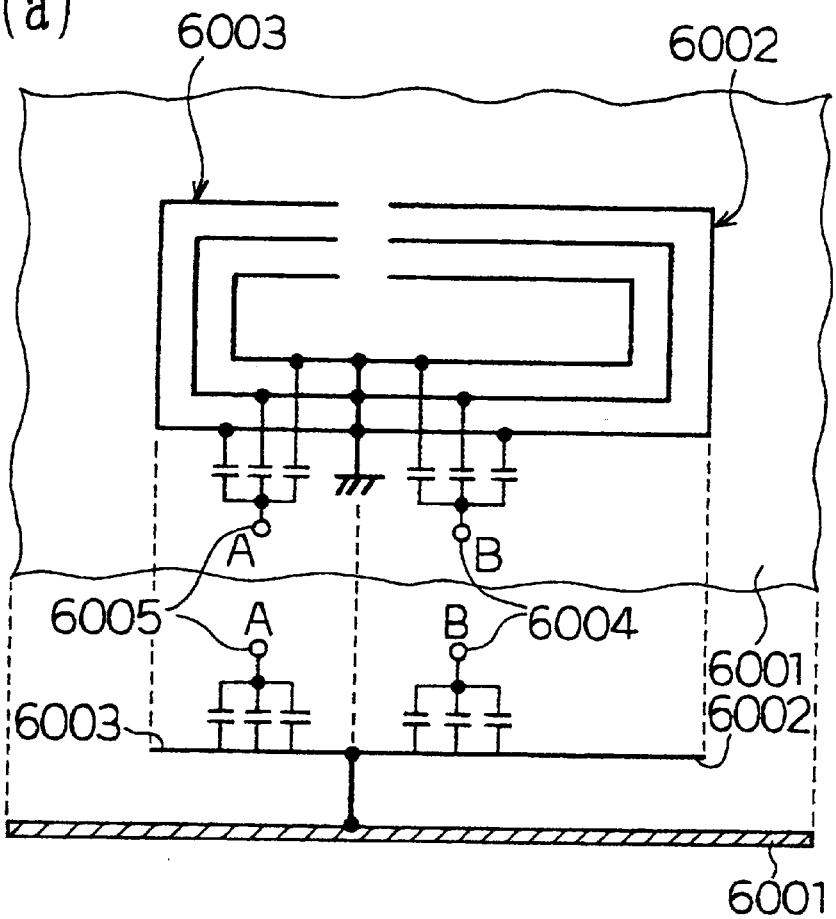
Fig. 88 (b)
Fig. 88 (c)
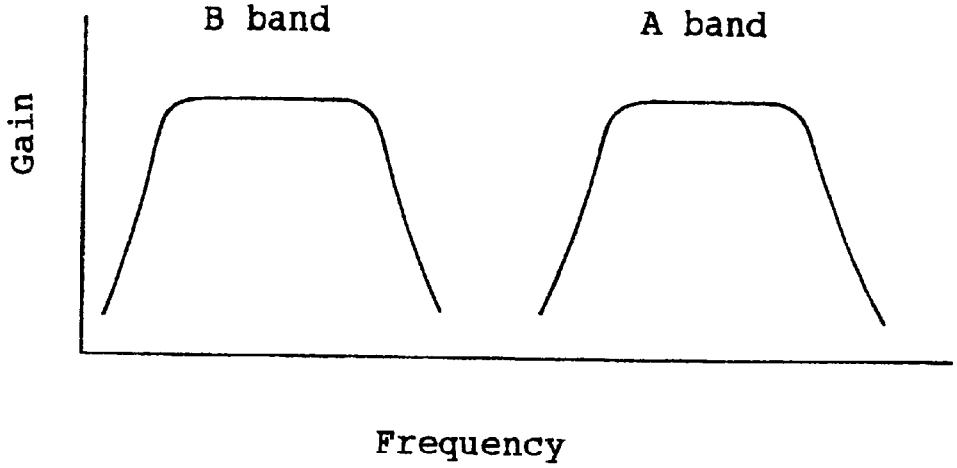

Fig. 89 (a)
Fig. 89 (b)
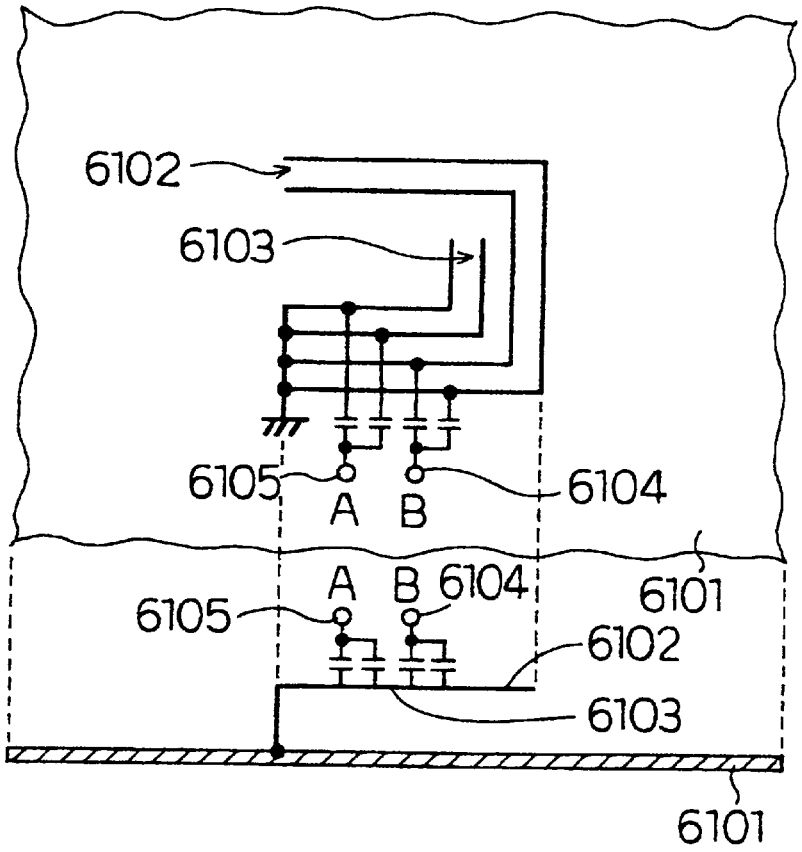
Fig. 89 (c)
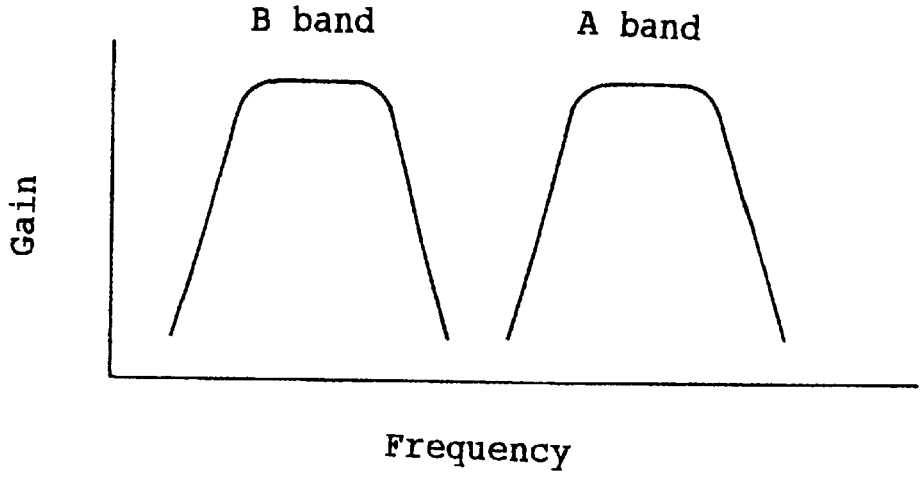

Fig. 90 (a)
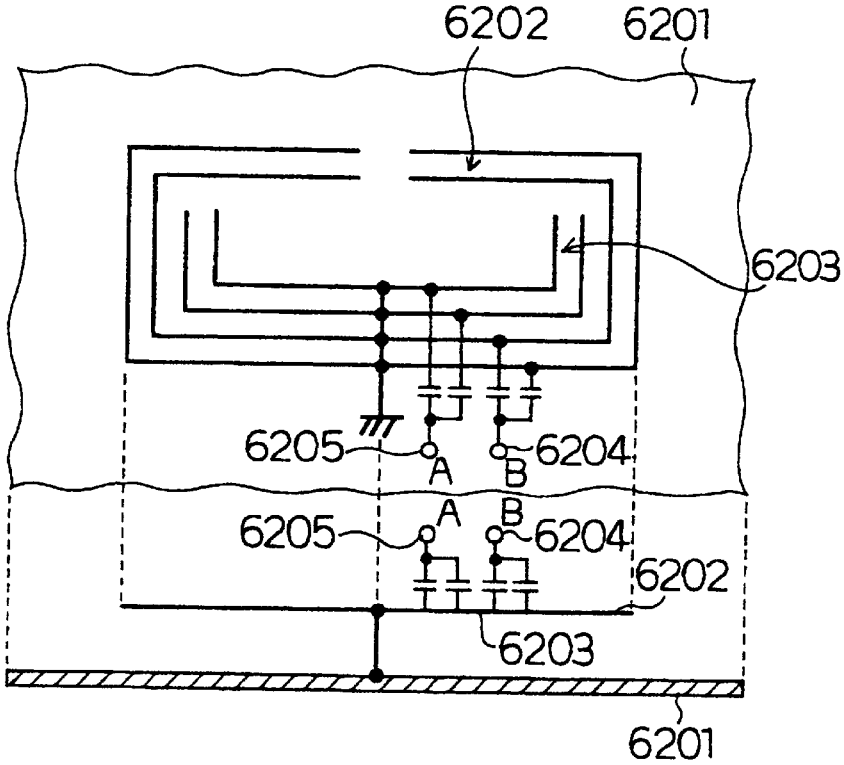
Fig. 90 (b)
Fig. 90 (c)
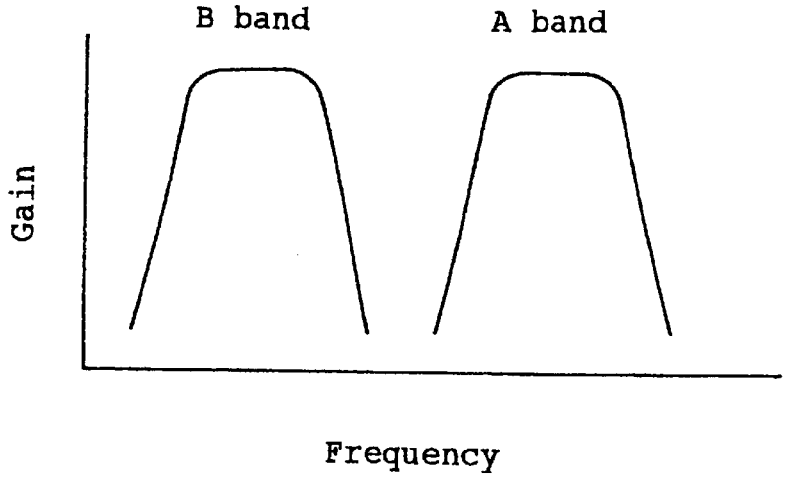

(a) Impedance characteristics (b) VSWR characteristics

Vertically polarized wave

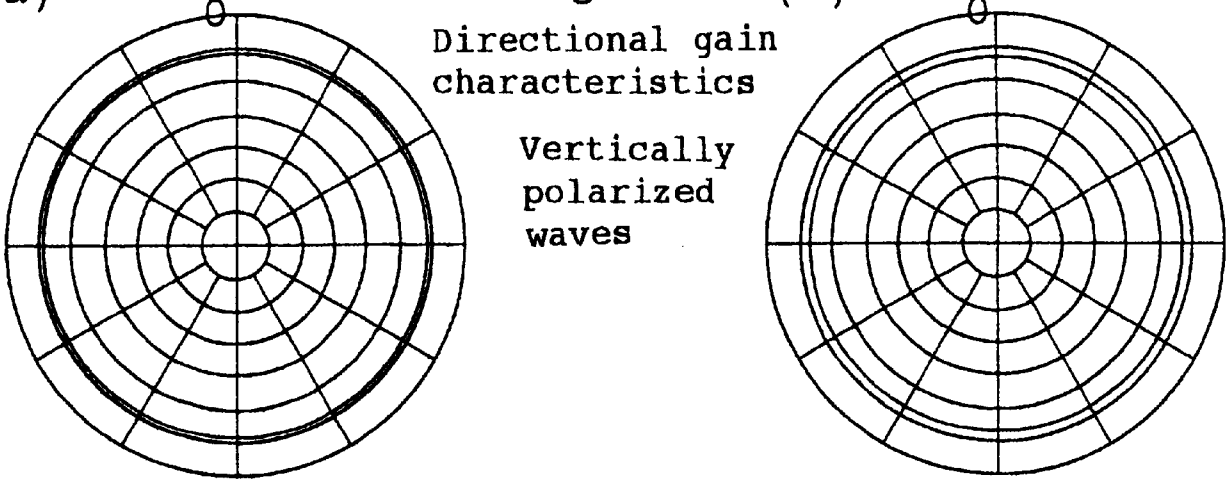
Fig. 122 (a)
Fig. 122 (b)
Directional gain characteristics
Vertically polarized waves
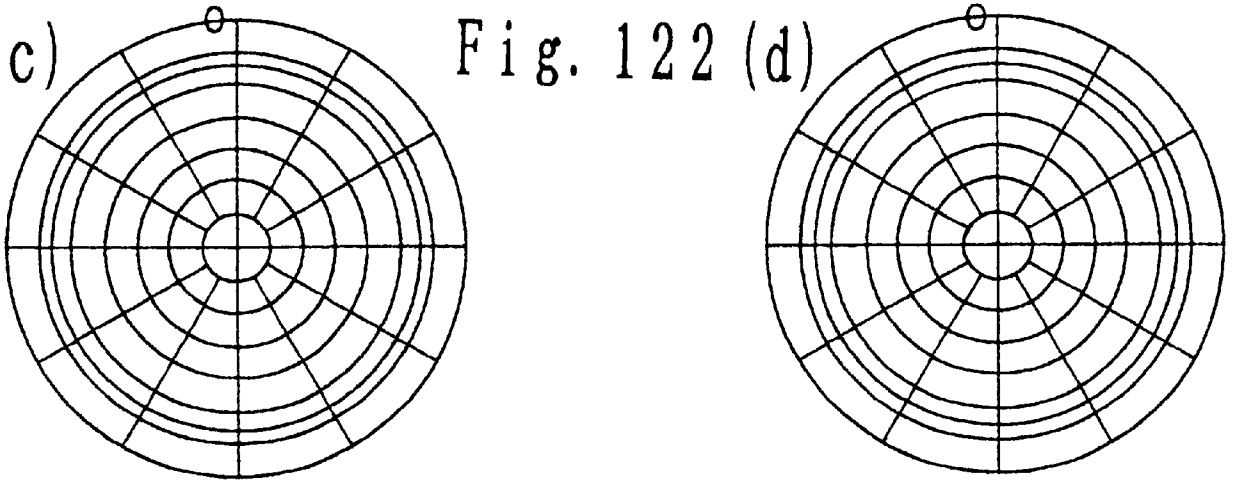
Fig. 122 (c)
Fig. 122 (d)

Directional gain characteristics

Vertically polarized waves

Horizontally polarized waves

Directional gain characteristics

Vertically polarized waves

Horizontally polarized waves

The structure can be simplified by using a single vertical portion to connect both of the elements and the conductive earth substrate Gain improvement ——— Developed antenna (two-element)

------ Developed basic antenna (one-element)

Tx (451MHz)

ANTENNA UNIT, COMMUNICATION SYSTEM AND DIGITAL TELEVISION RECEIVER

TECHNICAL FIELD

The present invention relates, in particular, to an antenna device to be attached to a body of an automobile for receiving, for example, AM, FM, or TV broadcasting or wireless telephone, etc. and to a communication system using such an antenna device.

BACKGROUND ART

With the advance of the car multimedia era, in addition to an AM/FM radio, various radio equipments such as a TV receiver, a wireless telephone set, and a navigation system have been recently installed in the automobile. Also hereafter, information and services may be increasingly provided through radio wave and the importance of an antenna will grow accordingly.

Generally, in the wireless telephone set or any other communication devices which are used for mobile communication and are capable of transmitting and receiving, the antenna is used for both transmitting and receiving and a single terminal connected to that antenna performs a double function of an input terminal for the receiving section and an output terminal for the transmitting section through a common component such as a divider, a mixer, a circulator, or a switch or the like. During the receiving operation, such a common component prevents a received signal from entering the transmitting section through the antenna and allows it to enter the receiving section properly. On the contrary, during the transmitting operation, that component prevents a transmission signal from entering the receiving section from the transmitting section and allows it to be emitted through the antenna.

As described above, however, when an antenna is used for both transmitting and receiving with a common component in a communication device, it may generally require a high costcommon component and the communication device itself may become very expensive. In addition, there is a problem that the reception sensitivity may be degraded with an increased transmission loss by using a single antenna with a common component.

Moreover, since a receiving amplifier and a transmitting amplifier are certainly installed at the side of the communication device, there is a problem that a cable connecting between the antenna and the communication device may degrade the reception level and the transmission power.

DISCLOSURE OF THE INVENTION

In view of these problems of conventional antennas, the present invention aims to provide an antenna device and a communication system which can improve the reception sensitivity with a reduced transmission loss and which can be implemented at a lower cost.

Also, the present invention aims to provide an antenna device which can further improve its gain.

In addition, the present invention aims to provide a digital television broadcasting receiving device and a receiving method which can reduce reception disturbance during the mobile reception of digital data.

A 1st invention of the present invention (corresponding to claim 1) is an antenna device comprising:

a conductive earth substrate;

a receiving element located in the proximity of said conductive earth substrate and having a receiving terminal; and a transmitting element located in the proximity of said receiving element and having a transmitting terminal, characterized in that an end of said receiving element and an end of said transmitting element are connected to said conductive earth substrate for grounding through a common portion and the frequency band of said receiving element is different from that of said transmitting element.

A 2nd invention of the present invention (corresponding to claim 2) is an antenna device comprising:

a conductive earth substrate;

a receiving element located in the proximity of said conductive earth substrate and having a receiving terminal; and a transmitting element located in the proximity of said receiving element and having a transmitting terminal, characterized in that an end of said receiving element and an end of said transmitting element are connected to said conductive earth substrate for grounding at separate locations and the frequency band of said receiving element is different from that of said transmitting element.

A 3rd invention of the present invention( corresponding to claim 12) is an antenna device comprising:

a conductive earth substrate;

an antenna element having an end connected to said conductive earth substrate for grounding and formed on a common circuit board; and a feeding terminal pulled out of said antenna element, characterized in that a resonant circuit is inserted between said feeding terminal and the other end of said antenna element which is not grounded.

A 4th invention of the present invention (corresponding to claim 18) is a communication system comprising:

an antenna device having a conductive earth substrate, an antenna element formed on a common circuit board located in the proximity of said conductive earth substrate, and a receiving amplifier provided on said common circuit board between said antenna element and a feeding terminal;

a receiver having a power supply section to supply electric power to said receiving amplifier of said antenna device; and a feeding line for connecting said feeding terminal of said antenna device to a signal input section of said receiver, characterized in that a direct-current blocking capacitor is provided between said receiving amplifier of said antenna device and said feeding terminal and at the input terminal of a receiving amplifier of said receiver, respectively, and electric power is supplied by said power supply section to said receiving amplifier of said antenna device through said feeding line.

A 5th invention of the present invention (corresponding to claim 20) is a communication system comprising:

an antenna device of the present invention (corresponding to claim 15);

a receiver having a receiving channel setting circuit which generates a bias voltage for said voltage-variable capacitor element of said antenna device; and a feeding line for connecting a signal input section of said receiver to a feeding terminal of said antenna device, characterized in that said voltage-variable capacitor element of said antenna device is connected to said feeding terminal, a direct-current blocking capacitor is provided between said antenna element and said feeding terminal and at the input terminal of a receiving amplifier of said receiver, respectively, and a receiving channel is established by varying the bias voltage generated by said receiving channel setting circuit.

A 6th invention of the present invention (corresponding to claim 21) is a communication system comprising:

an antenna device of the present invention (corresponding to any one of claims 1 through 10);

a communication device having a receiving amplifier and a transmitting amplifier;

a receiving connection line for connecting the receiving terminal of said antenna device to said receiving amplifier of said communication device; and a transmitting connection line for connecting the transmitting terminal of said antenna device to said transmitting amplifier of said communication device.

A 7th invention of the present invention (corresponding to claim 22) is a communication system comprising:

an antenna device having a conductive earth substrate, a receiving element having a receiving terminal formed on a common circuit board located in the proximity of said conductive earth substrate, a transmitting element having a transmitting terminal formed on said common circuit board located in the proximity of said receiving element, and a transmitting/receiving changeover circuit provided on said common circuit board and capable of switching said receiving terminal and said transmitting terminal;

a feeding line connected to said transmitting/receiving changeover circuit; and a communication device connected to said feeding line and capable of both transmitting and receiving, characterized in that said transmitting/receiving changeover circuit of said antenna device is controlled by using a switch signal to change over to the transmission operation in said communication device.

A 8th invention of the present invention (corresponding to claim 23) is a communication system comprising:

an antenna device of the present invention (corresponding to claim 11);

a communication device having a power supply section to supply electric power to said receiving amplifier of said antenna device and capable of both transmitting and receiving; and a feeding line for connecting a common terminal of said antenna device to a signal input/output section of said communication device, characterized in that a direct-current blocking capacitor is provided between a common component of said antenna element and said common terminal and at the input/output terminal of said communication device, respectively, and electric power is supplied by said power supply section to a receiving amplifier of said antenna device through said feeding line.

A 9th invention of the present invention (corresponding to claim 30) is an antenna device comprising:

a conductive earth substrate;

a main antenna element connected to said conductive earth substrate through a first ground connection to be substantially parallel to said conductive earth substrate; and a passive element connected to said conductive earth substrate through a second ground connection along said main antenna element.

A 10th invention of the present invention (corresponding to claim 38) is a digital television broadcasting receiving device comprising:

input means which is an antenna device of the present invention (corresponding to any one of claims 1 through 37) and converts electromagnetic waves into electric signals;

delay means for receiving a signal from said input means and delaying it;

synthesis means for synthesizing a signal from said delay means and a signal from said input means;

reception means for performing frequency conversion on a signal from said synthesis means; and demodulation means for converting a signal from said reception means into a baseband signal, characterized in that the delay time used in said delay means and the synthesis ratio used in said synthesis means can be established arbitrarily.

A 11th invention of the present invention (corresponding to claim 39) is a digital television broadcasting receiving device comprising:

input means which is an antenna device of the present invention( corresponding to any one of claims 1 through 37) and converts electromagnetic waves into electric signals;

delay means for receiving a signal from said input means and delaying it;

synthesis means for synthesizing a signal from said delay means and a signal from said input means;

reception means for performing frequency conversion on a signal from said synthesis means;

demodulation means for converting a signal from said reception means into a baseband signal;

delayed wave estimation means for receiving a signal indicating the demodulation conditions from said demodulation means and estimating a delayed wave contained in a signal from said input means; and synthesis control means for controlling said synthesis means and said delay means in accordance with a signal from said delayed wave estimation means, characterized in that either the signal synthesis ratio used in said synthesis means or the delay time used in said delay means can be controlled in accordance with a signal from said synthesis control means.

A 12th invention of the present invention (corresponding to claim 40) is a digital television broadcasting receiving device comprising:

input means which is an antenna device of the present invention (corresponding to any one of claims 1 through 37) and converts electromagnetic waves into electric signals;

reception means for performing frequency conversion on a signal from said input means;

delay means for receiving a signal from said reception means and delaying it;

synthesis means for synthesizing a signal from said delay means and a signal from said reception means; and demodulation means for converting a signal from said synthesis means into a baseband signal, characterized in that the delay time used in said delay means and the synthesis ratio used in said synthesis means can be established arbitrarily.

A 13th invention of the present invention (corresponding to claim 41) is a digital television broadcasting receiving device comprising:

input means which is an antenna device of the present invention( corresponding to any one of claims 1 through 37) and converts electromagnetic waves into electric signals, a reception means for performing frequency conversion on a signal from said input means;

delay means for receiving a signal from said reception means and delaying it;

synthesis means for synthesizing a signal from said delay means and a signal from said reception means;

demodulation means for converting a signal from said synthesis means into a baseband signal;

delayed wave estimation means for receiving a signal indicating the demodulation conditions from said demodulation means and estimating a delayed wave contained in a signal from said input means; and synthesis control means for controlling said synthesis means and said delay means in accordance with a signal from said delayed wave estimation means, characterized in that either the signal synthesis ratio used in said synthesis means or the delay time used in said delay means can be controlled in accordance with a signal from said synthesis control means.

A 14th invention of the present invention (corresponding to claim 42) is a digital television broadcasting receiving device comprising:

input means which is an antenna device of the present invention (corresponding to any one of claims 1 through 37) and converts electromagnetic waves into electric signals;

reception means for performing frequency conversion on a signal from said input means;

demodulation means for converting a signal from said reception means into a baseband signal;

delayed wave estimation means for receiving information on the demodulation conditions from said demodulation means and estimating a delayed wave contained in a signal from said input means; and demodulation control means for controlling said demodulation means based on delayed wave information from said delayed wave estimation means, characterized in that a transfer function to be handled by said demodulation means is controlled based on a control signal from said demodulation control means.

BRIEF DESCRIPTION OF THE DRAWINGS

FIGS. 88(*a*) and 88(*b*) are schematic diagrams showing the configuration of an example of an antenna according to the present invention and FIG. 88(*c*) is a graph for explaining the frequency characteristics thereof;

FIGS. 89(*a*) and 89(*b*) are schematic diagrams showing the configuration of an example of an antenna according to the present invention and FIG. 89(*c*) is a graph for explaining the frequency characteristics thereof;

FIGS. 90(*a*) and 90(*b*) are schematic diagrams showing the configuration of an example of an antenna according to the present invention and FIG. 90(*c*) is a graph for explaining the frequency characteristics thereof;

FIG. 120 shows the VSWR characteristics after band synthesis of the 4-element antenna shown in FIGS. 116 through 119;

FIG. 121 shows the VSWR characteristics when the range of ordinates in FIG. 120 is extended;

FIG. 122 shows the directional gain characteristics when the antenna ground is located at different distances from the device ground in the antenna of FIG. 72(*b*);

FIG. 123 shows the directional gain characteristics in the antenna of FIG. 83(*a*);

FIG. 124 shows the directional gain characteristics in the antenna of FIG. 83(*b*);

FIG. 125(*a*) shows that a low-pass circuit is provided near a feeding terminal in an antenna device according to the present invention and FIG. 125(*b*) shows that a high-pass circuit is provided near a feeding terminal in a similar manner;

FIG. 126 is a schematic diagram showing an example of an antenna device according to the present invention;

FIG. 127 is a schematic diagram showing an example of an antenna device according to the present invention;

FIG. 128 is a schematic diagram showing an example of an antenna device according to the present invention;

FIG. 129 is a schematic diagram showing an example of an antenna device according to the present invention;

FIG. 130 is a schematic diagram showing an example of an antenna device according to the present invention;

FIG. 131 is a schematic diagram showing an example of an antenna device according to the present invention;

Figure 132:
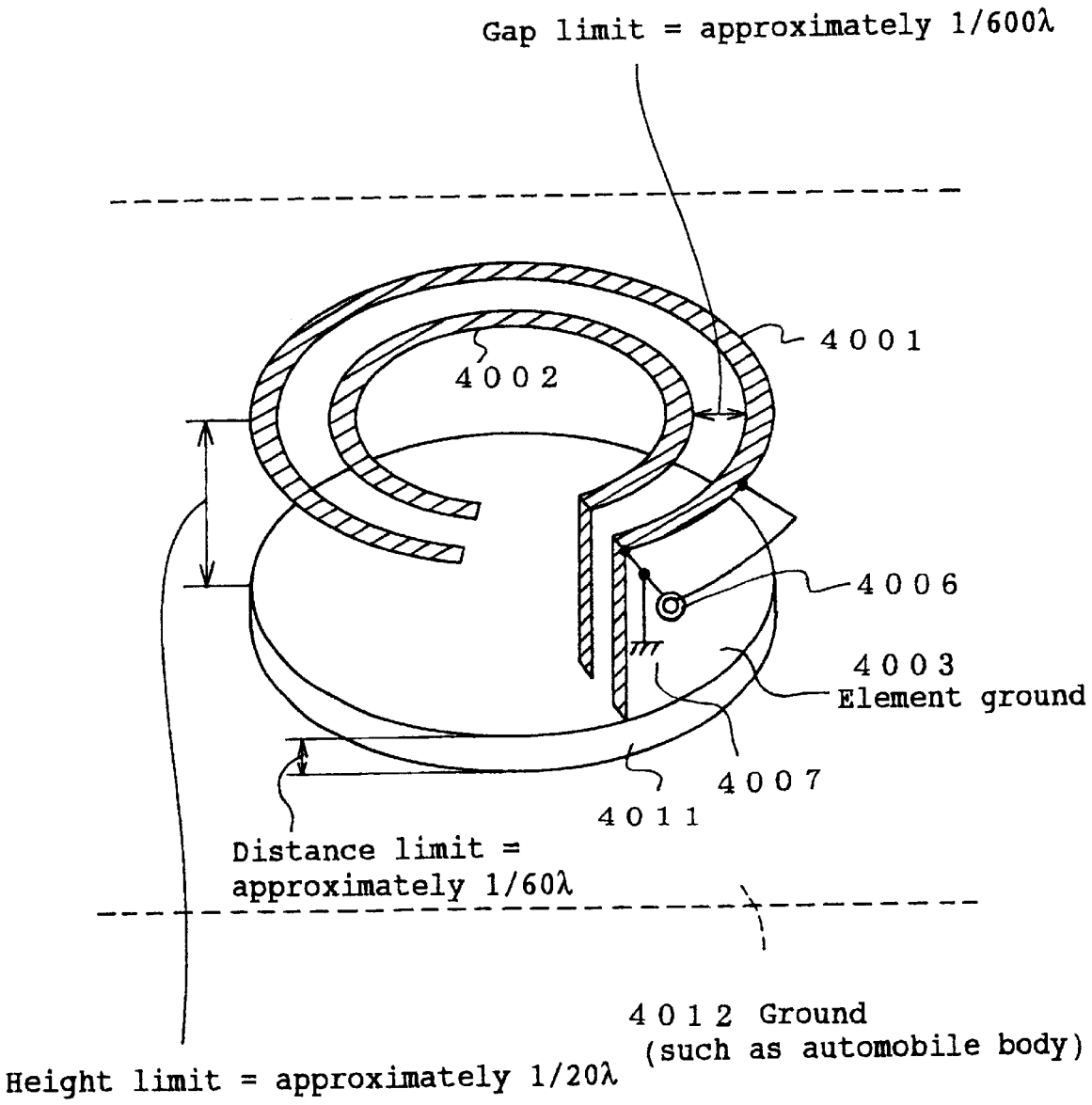
Figure 133:
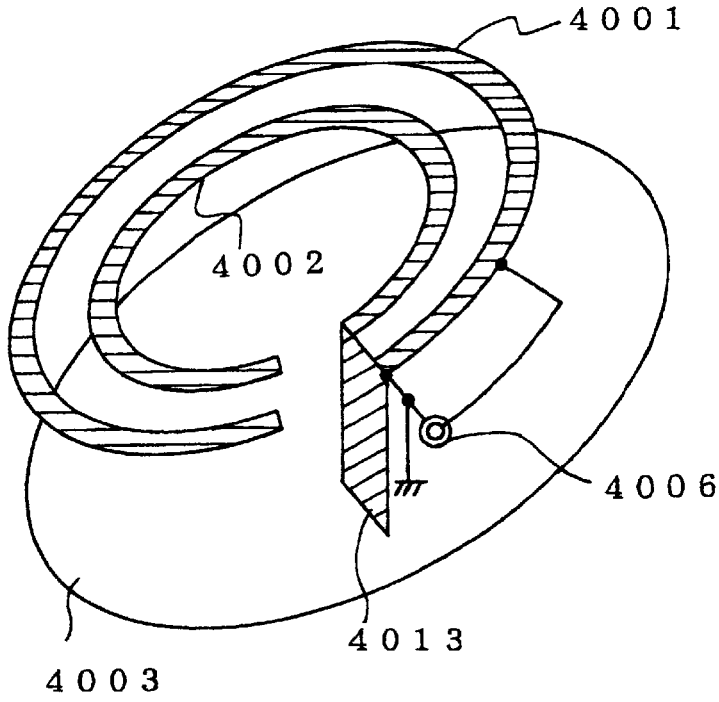
Figure 134:
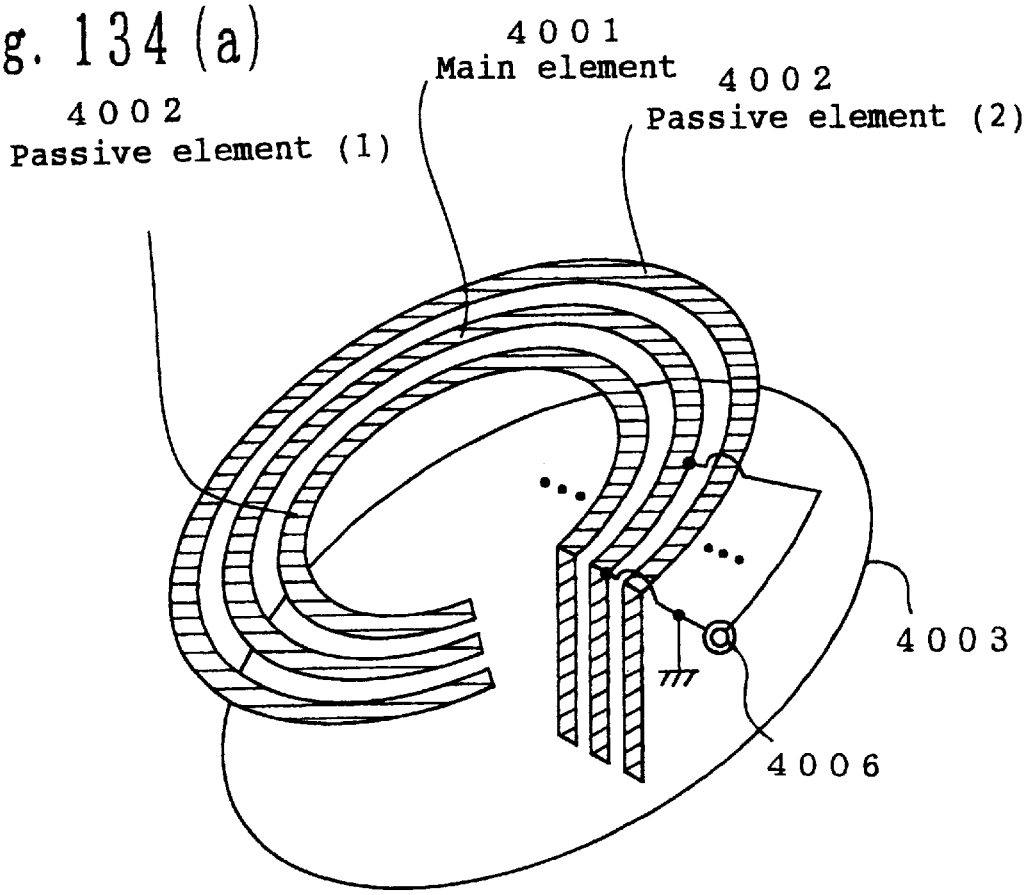
Figure 134:
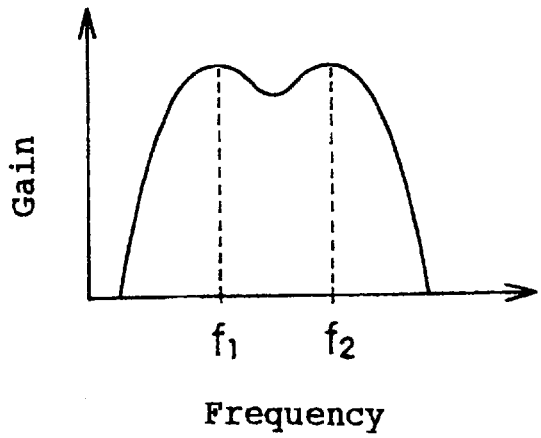
Figure 135:
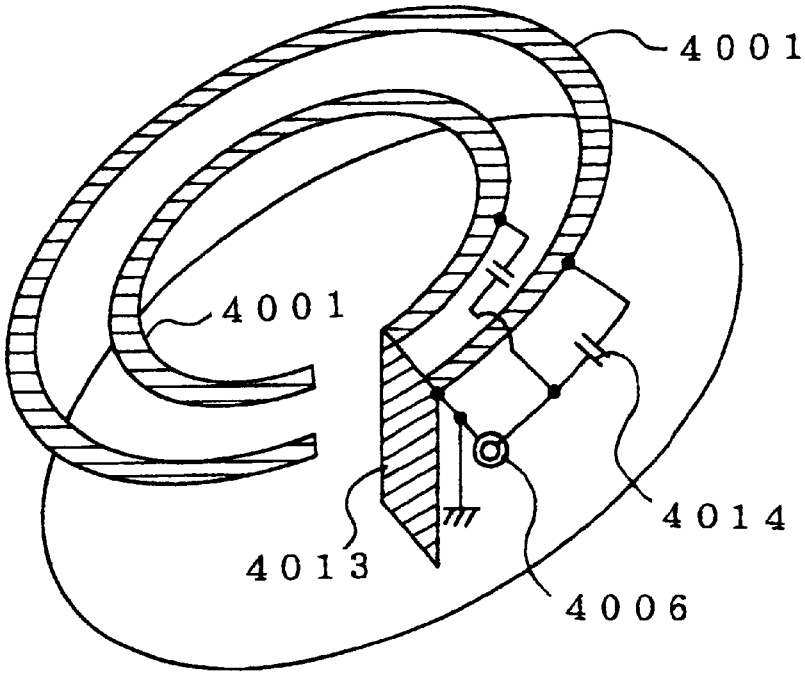
Figure 135:
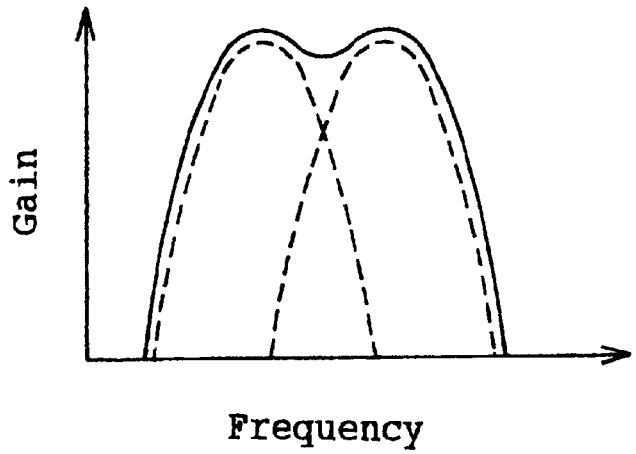
Figure 136:
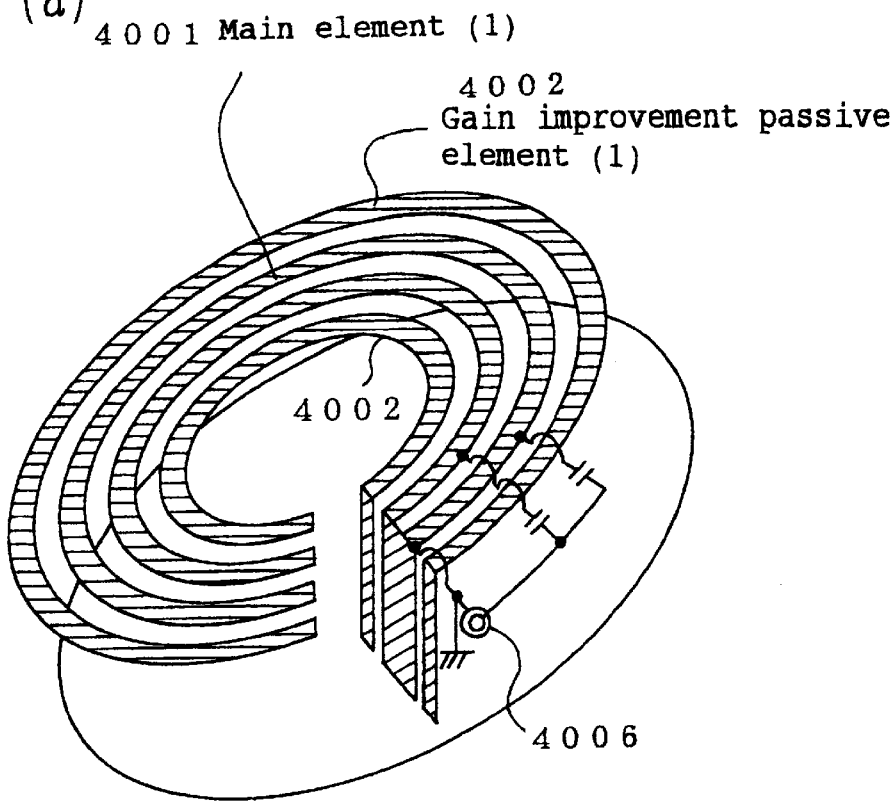
Figure 136:
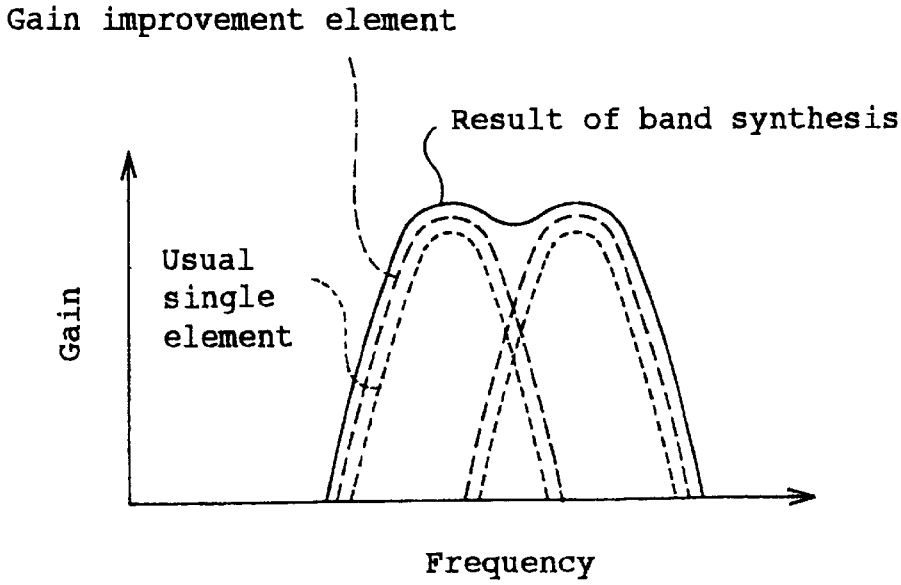
Figure 137:
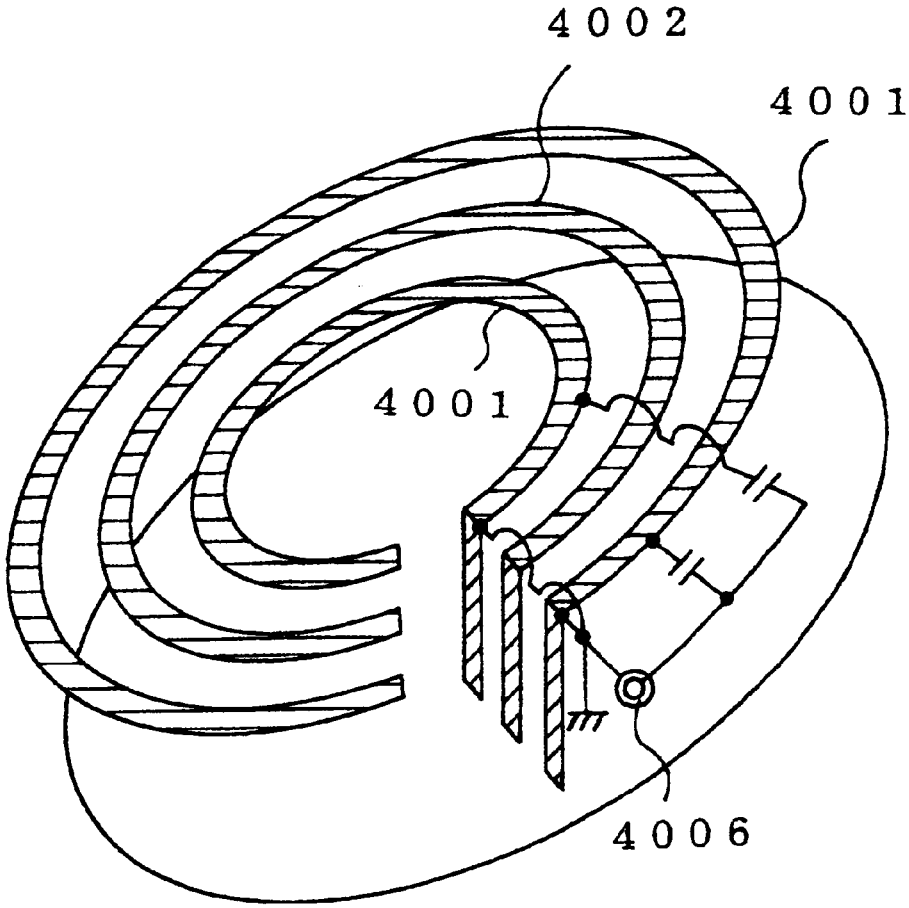
Figure 138:
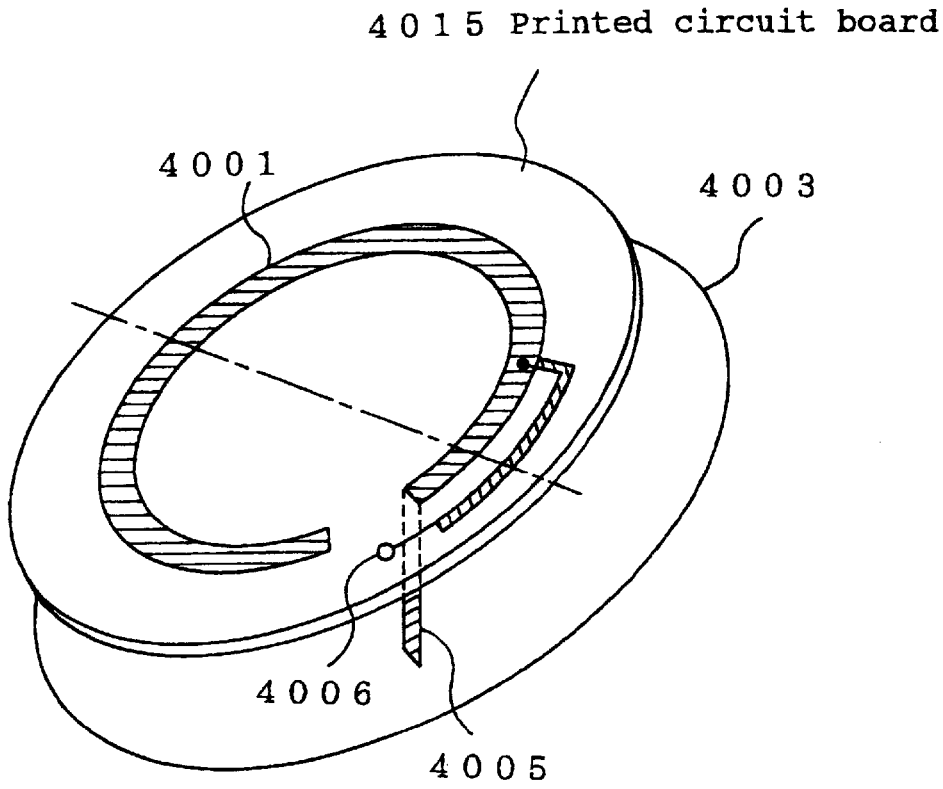
Figure 138:
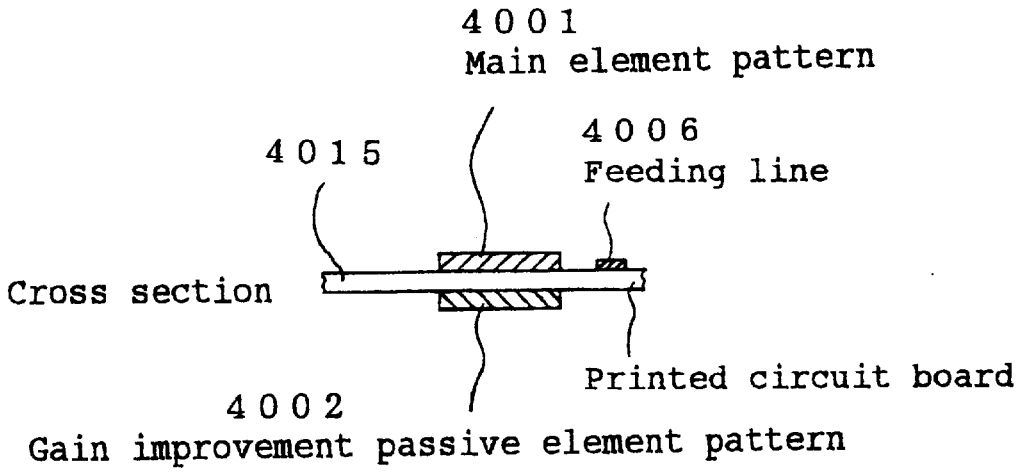
Figure 139:
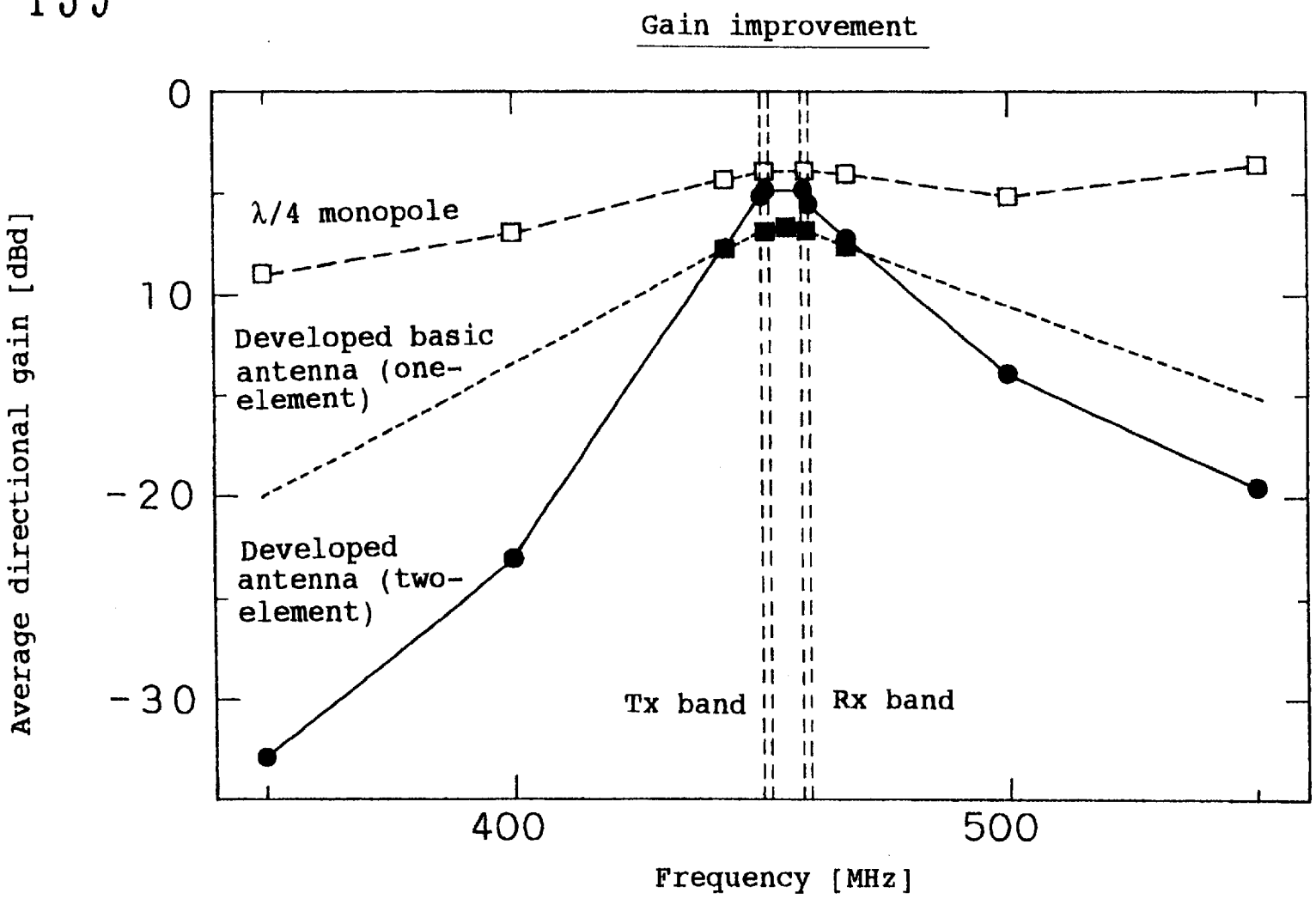
Figure 140:
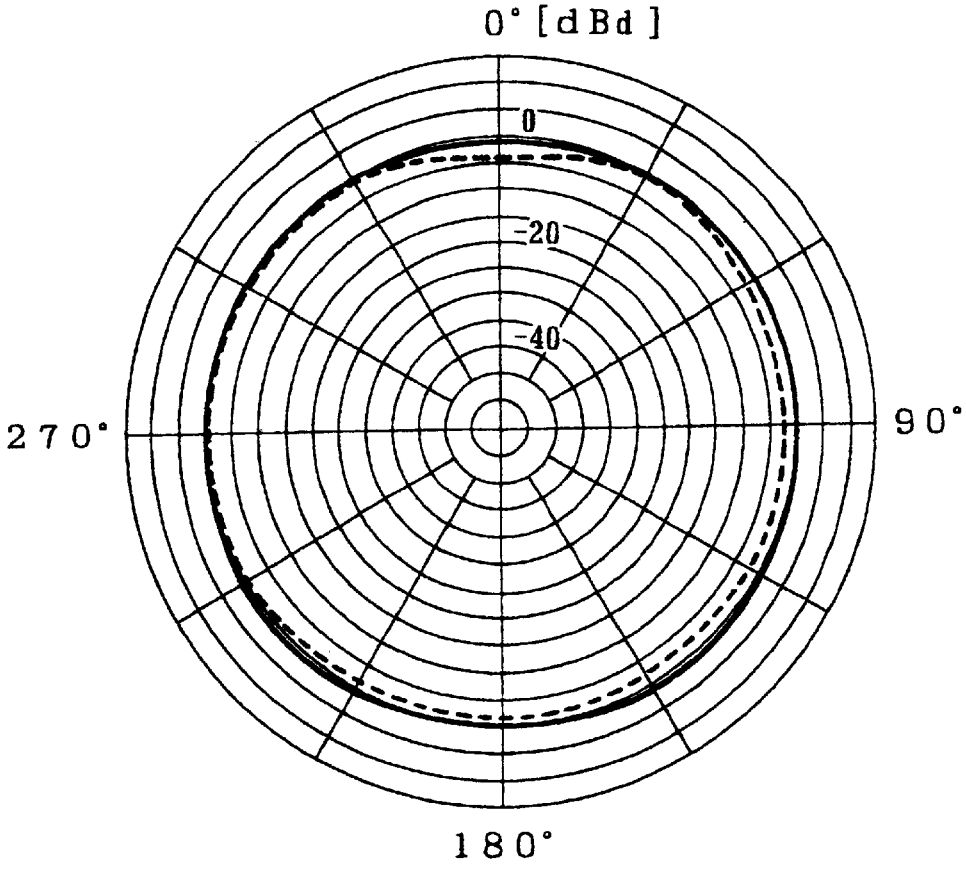
Figure 141:
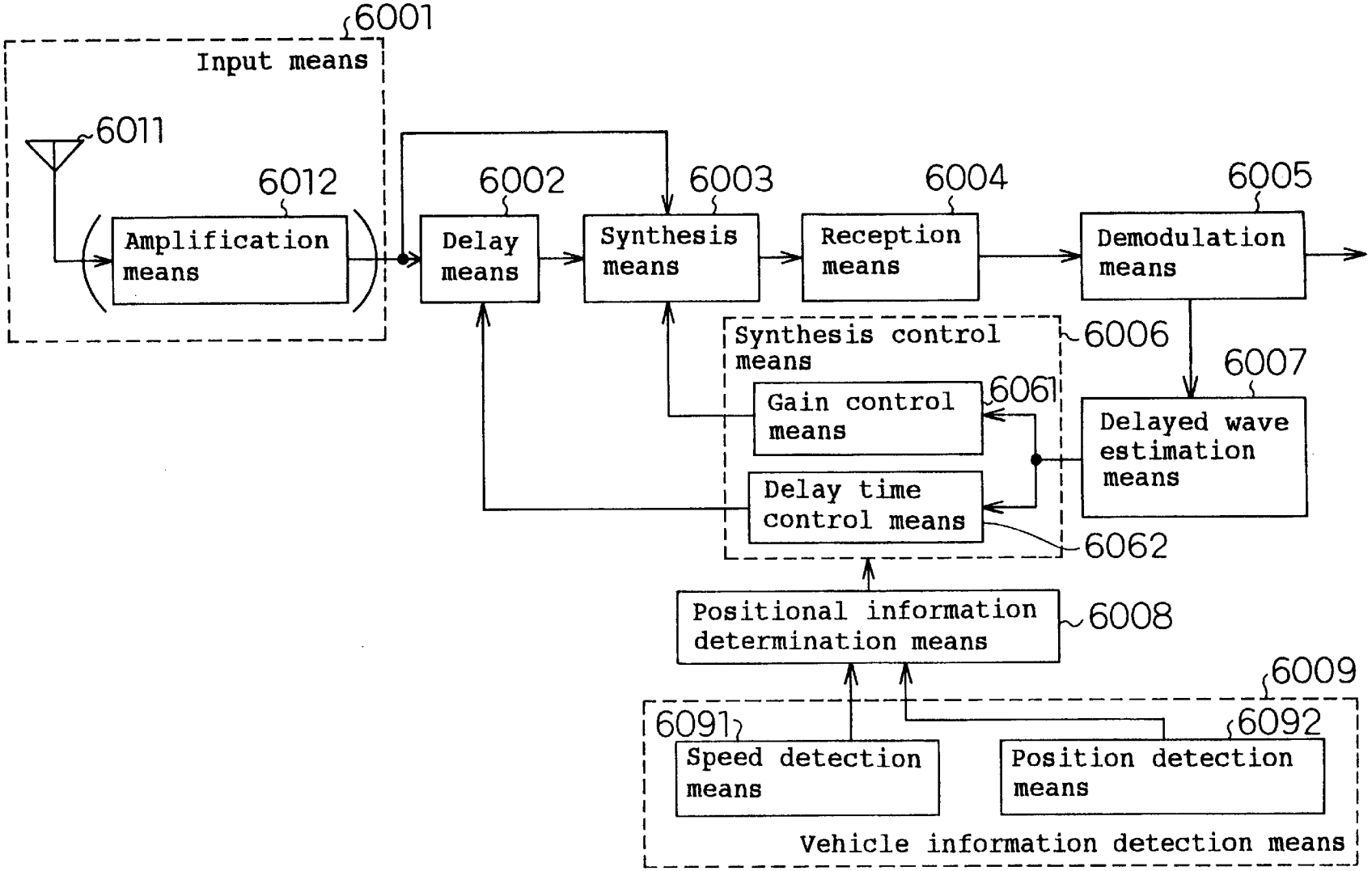
Figure 142:
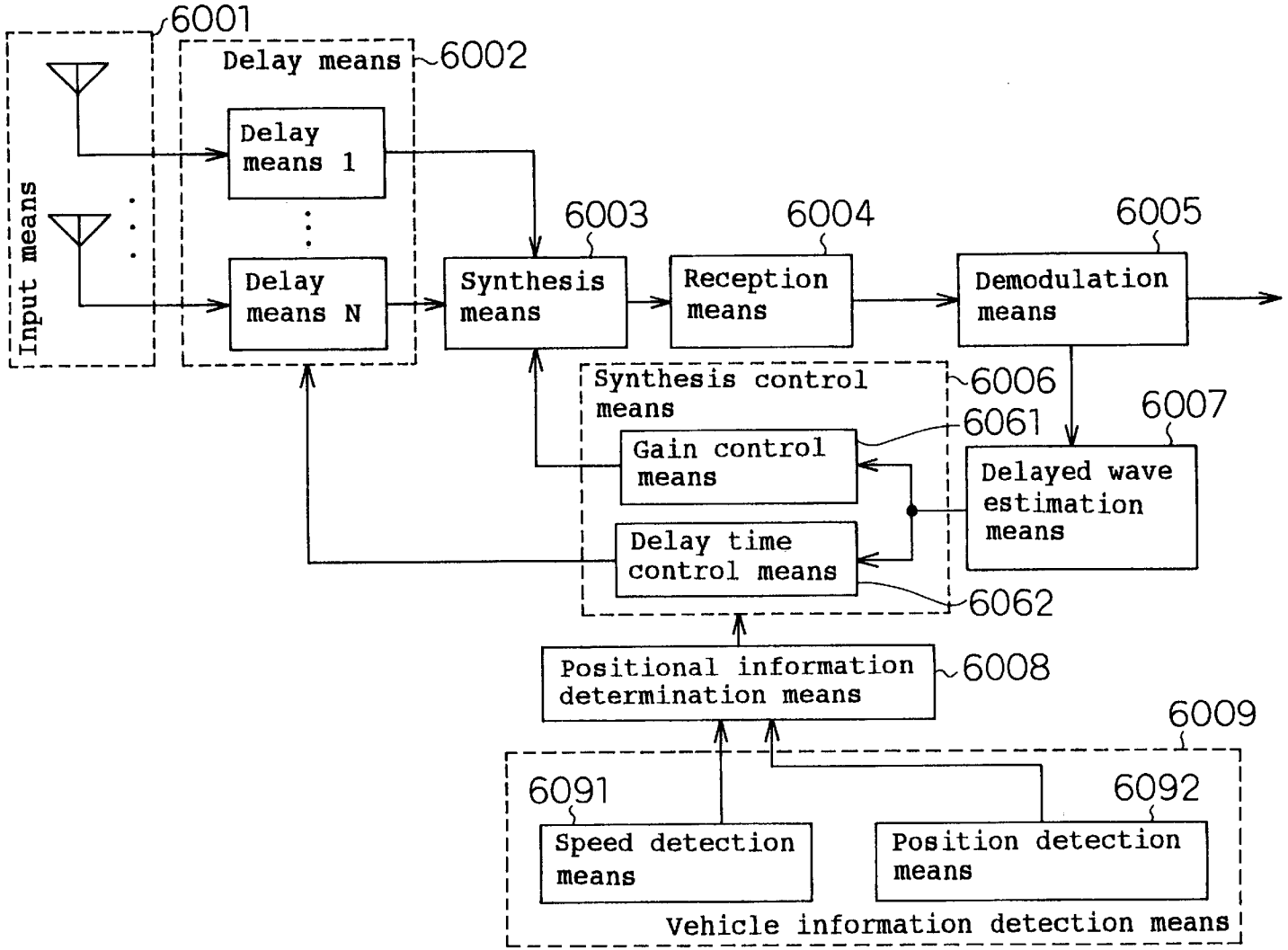
Figure 143:
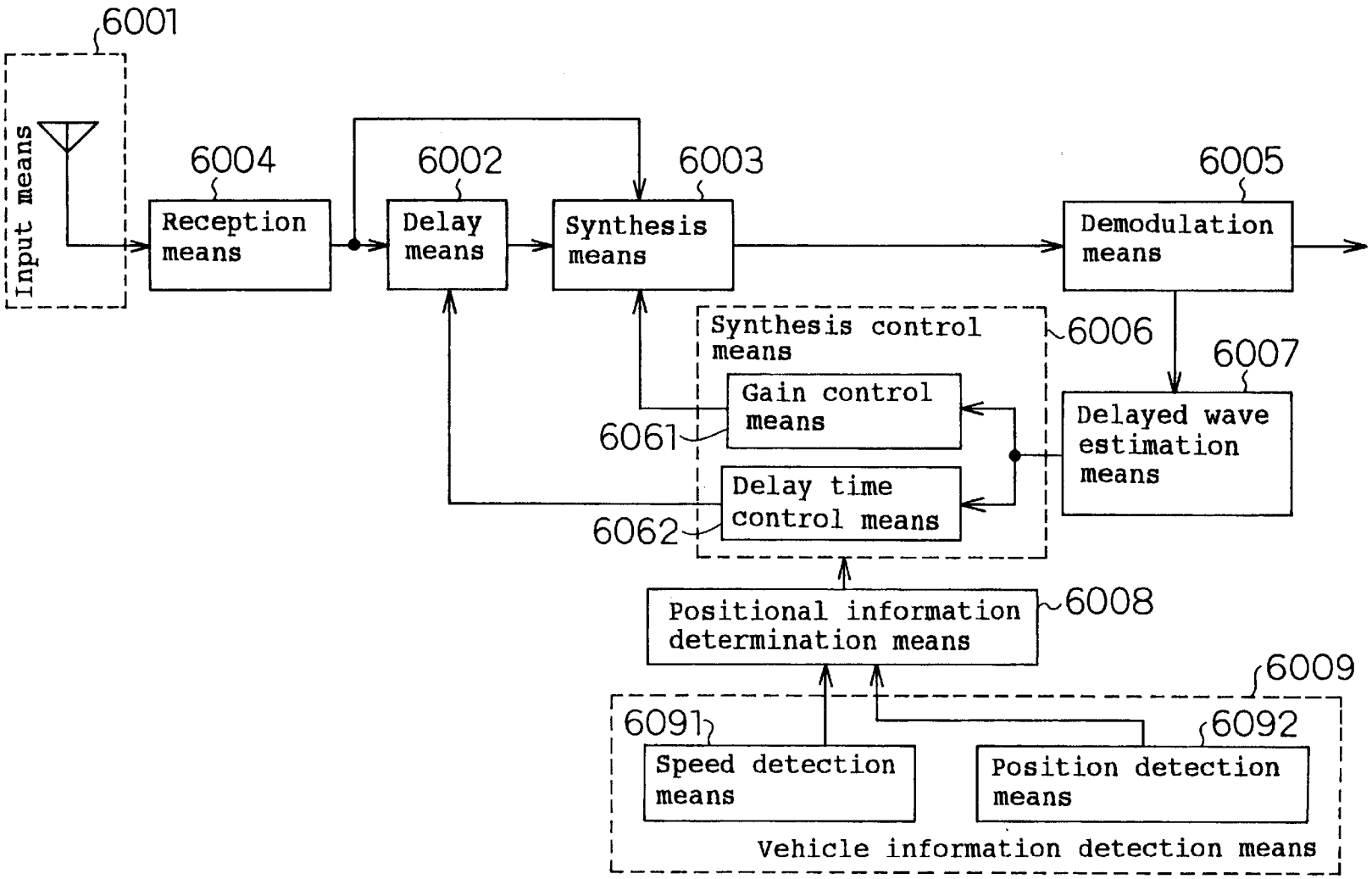
Figure 144:
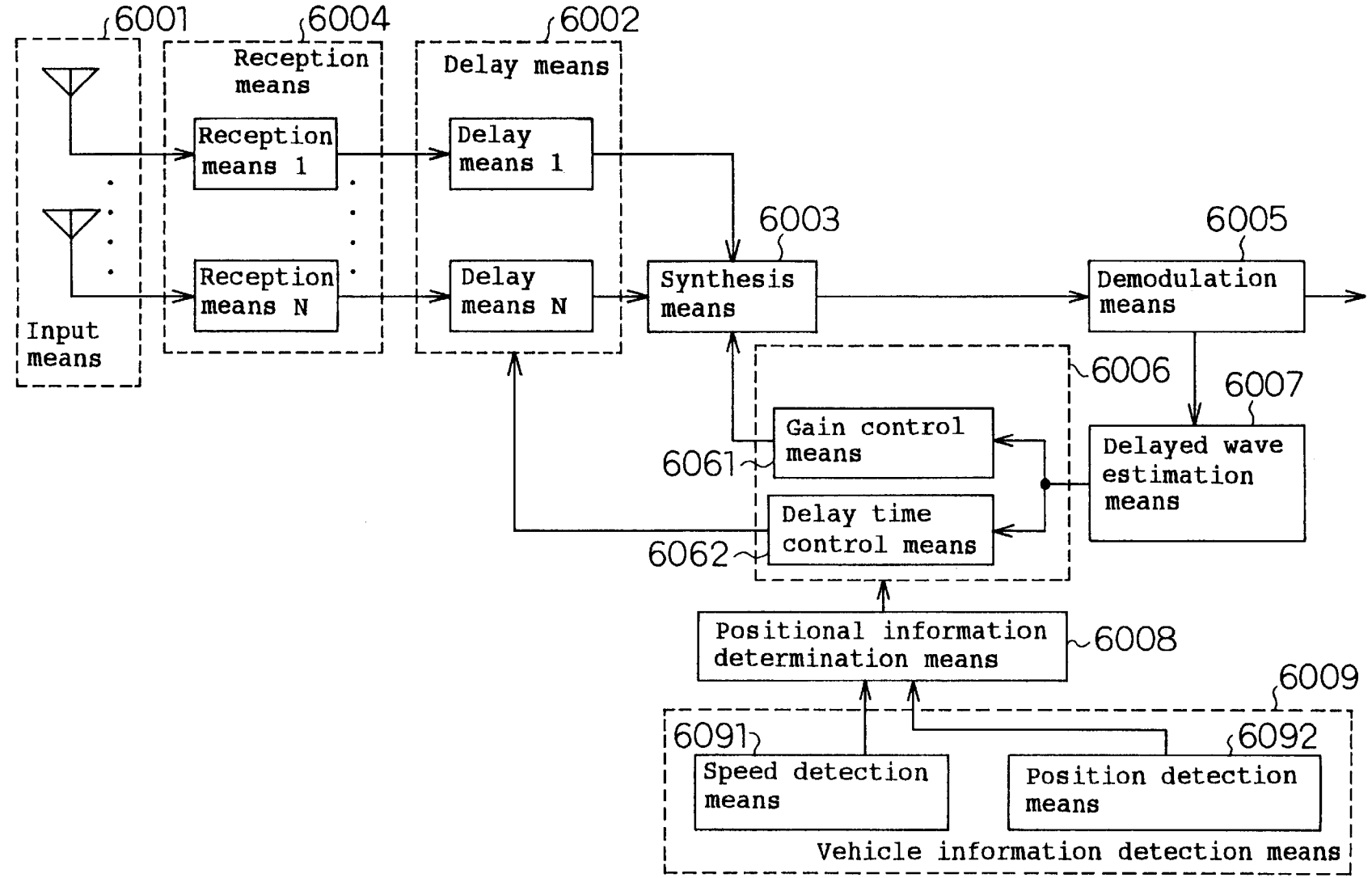
Figure 145:
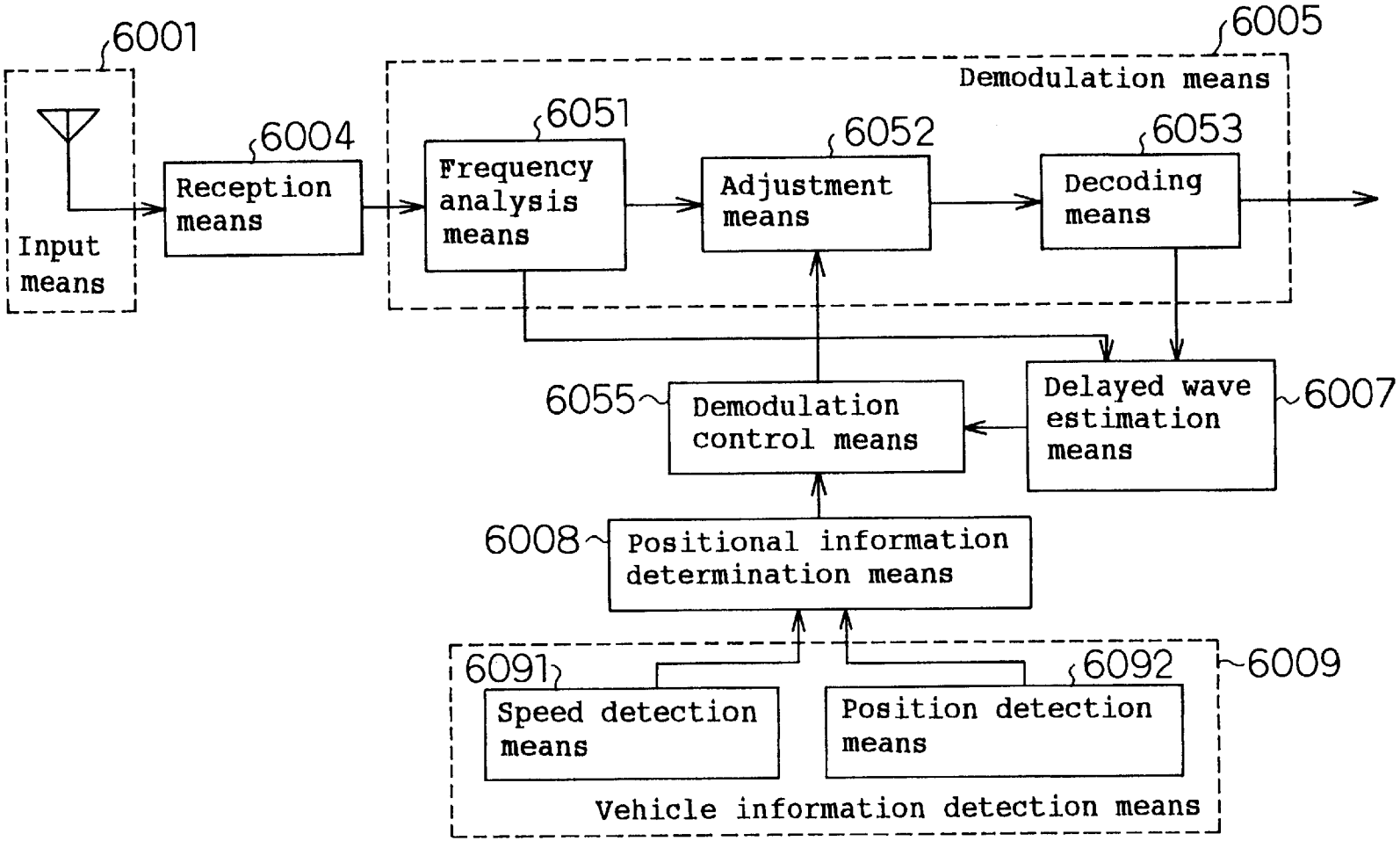
Figure 146:
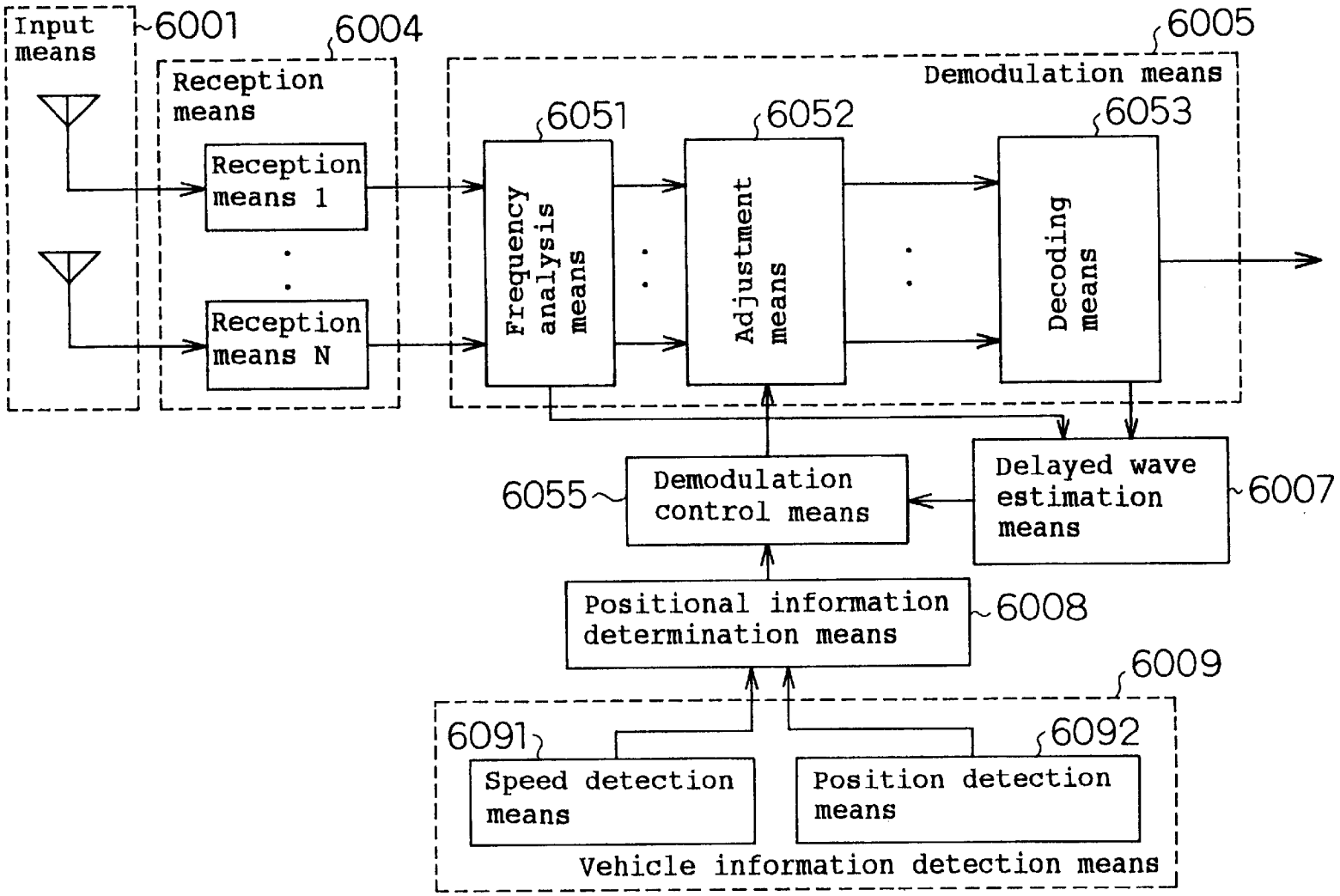
Figure 147:
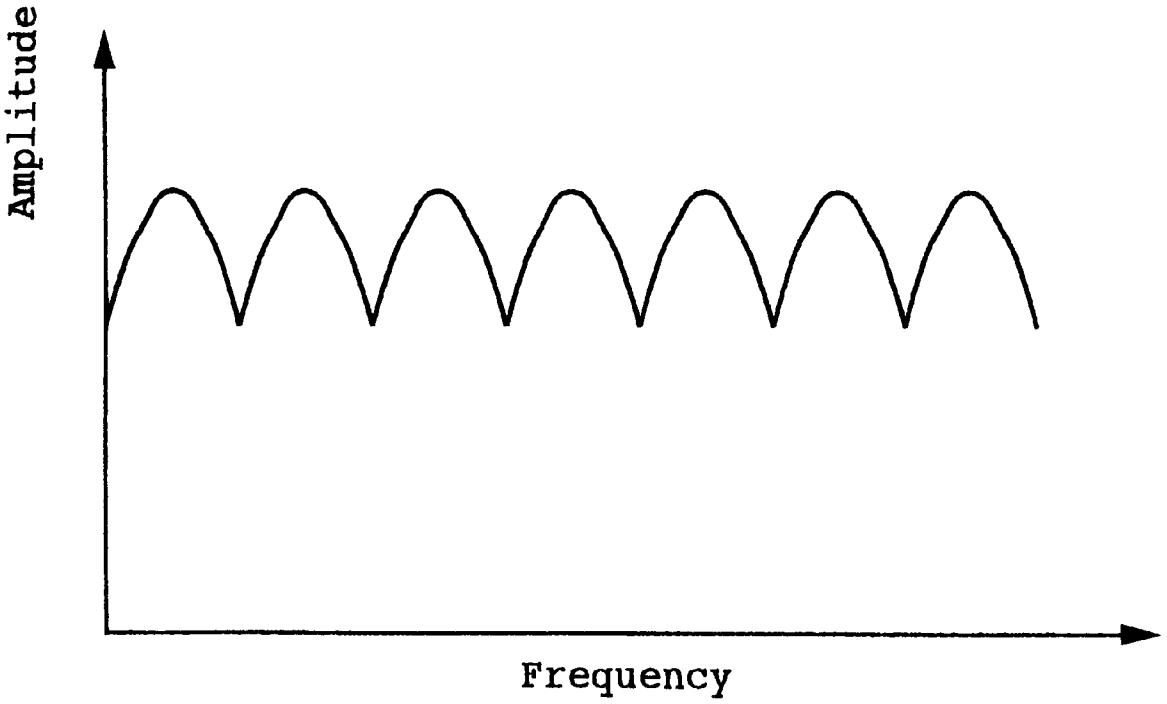
Figure 148:
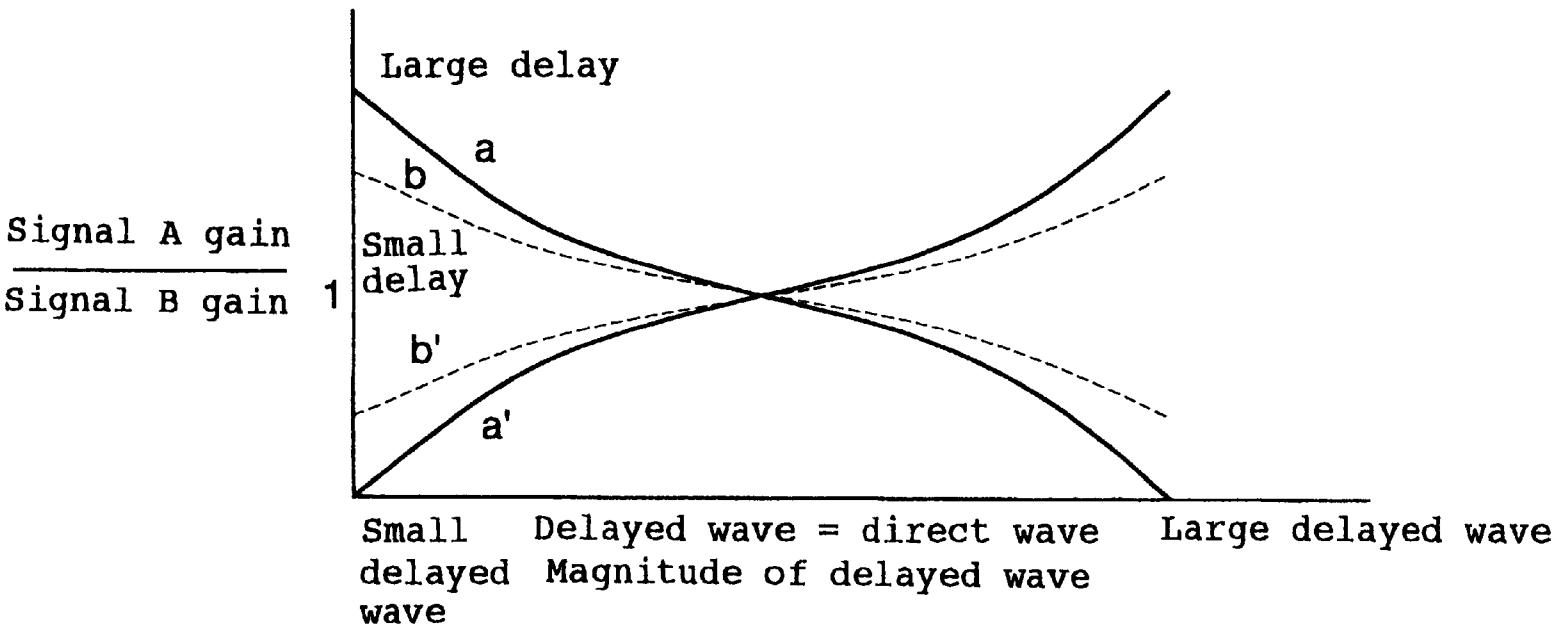
Figure 149:
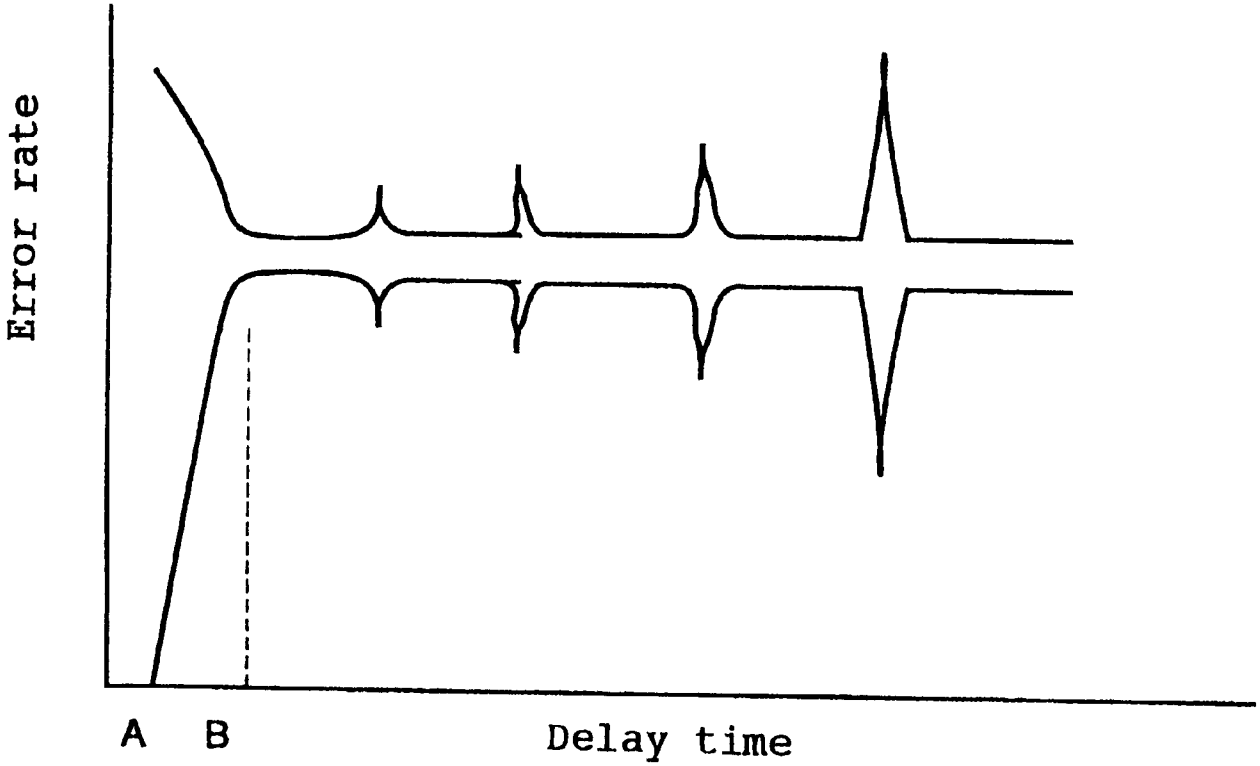
Figure 150:
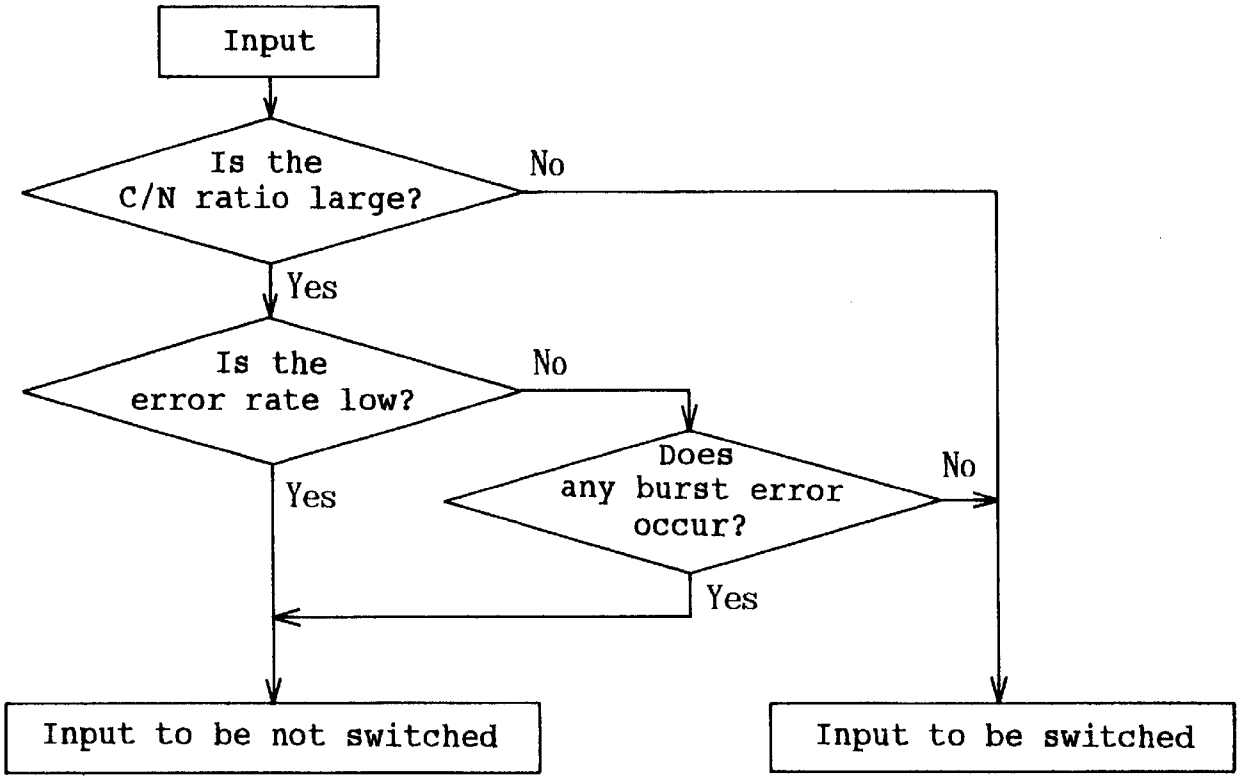

FIG. 132 is a schematic diagram showing an example of an antenna device according to the present invention;

FIG. 133 is a schematic diagram showing an example of an antenna device according to the present invention;

FIG. 134 is a schematic diagram showing an example of an antenna device according to the present invention;

FIG. 135 is a schematic diagram showing an example of an antenna device according to the present invention;

FIG. 136 is a schematic diagram showing an example of an antenna device according to the present invention;

FIG. 137 is a schematic diagram showing an example of an antenna device according to the present invention;

FIG. 138 is a schematic diagram showing an example of an antenna device according to the present invention;

FIG. 139 shows the gain characteristics o f an example of an antenna device according to the present invention;

FIG. 140 shows the gain characteristics of an example of an antenna device according to the present invention;

FIG. 141 is a block diagram showing the configuration of a digital television broadcasting receiving device according to an embodiment of the present invention;

FIG. 142 is a block diagram showing the configuration of a digital television broadcasting receiving device according to another embodiment of the present invention;

FIG. 143 is a block diagram showing the configuration of a digital television broadcasting receiving device according to another embodiment of the present invention;

FIG. 144 is a block diagram showing the configuration of a digital television broadcasting receiving device according to another embodiment of the present invention;

FIG. 145 is a block diagram showing the configuration of a digital television broadcasting receiving device according to another embodiment of the present invention;

FIG. 146 is a block diagram showing the configuration of a digital television broadcasting receiving device according to another embodiment of the present invention;

FIG. 147 is a conceptual diagram showing the result of frequency analysis performed on a received signal which is affected by disturbance of a delayed wave;

FIG. 148 is a conceptual diagram showing the gain control performed by a synthesis means;

FIG. 149 is a conceptual diagram showing the delay time and error rate of a delayed wave; and FIG. 150 is a flow chart for explaining antenna switching conditions for changing over from one antenna to another.

DESCRIPTION OF SYMBOLS

| | |
|---|---|
| 101, 104 | Antenna element (linear conductor) |
| 102 | Feeding terminal |
| 151 | Antenna ground |
| 152 | Receiving element |
| 153 | Transmitting element |
| 205 | Conductive earth substrate |
| 356 | Common circuit board |
| 502, 504 | Reactance element |
| 1304 | Printed circuit board |
| 1357 | Receiving amplifier |
| 1458 | Transmitting amplifier |
| 1505 | Recess |
| 1655 | Common component |
| 1806 | Multilayer printed circuit board |
| 1853 | Resonant circuit loading section |
| 1901 | Feeding point |
| 2760 | Direct-current power supply section |
| 2961 | Receiving channel setting circuit |
| 3003 | Dielectric |
| 3203 | Coil |
| 3355 | Transmitting/receiving element changeover relay switch |
| 3362 | Handset |
| 3365 | Voice modulator |
| 3503 | Diversity changeover switch |
| 3804 | Communication device |
| 3805 | Body |
| 3902 | Shielding case |
| 4603 | High-permittivity material |
| 5603, 5606 | Ferroelectric |
| 4001 | Main element |
| 4002 | Passive element |

-continued

| | |
|---|---|
| 4003 | Conductive earth substrate |
| 4004 | Ground connection |
| 4005 | Ground connection |
| 4006 | Feeding terminal |
| 6001 | Input means |
| 6002 | Delay means |
| 6003 | Synthesis means |
| 6004 | Reception means |
| 6005 | Demodulation means |
| 6006 | Synthesis control means |
| 6007 | Delayed wave estimation means |
| 6008 | Positional information determination means |
| 6009 | Vehicle information detection means |
| 6011 | Antenna |
| 6012 | Amplification means |
| 6061 | Gain control means |
| 6062 | Delay time control means |
| 6091 | Speed detection means |
| 6092 | Position detection means |

BEST MODE FOR CARRYING OUT THE INVENTION

Now, the present invention will be described below with respect to the accompanying drawings which show embodiments thereof.

(Embodiment 1)

Figure 1:
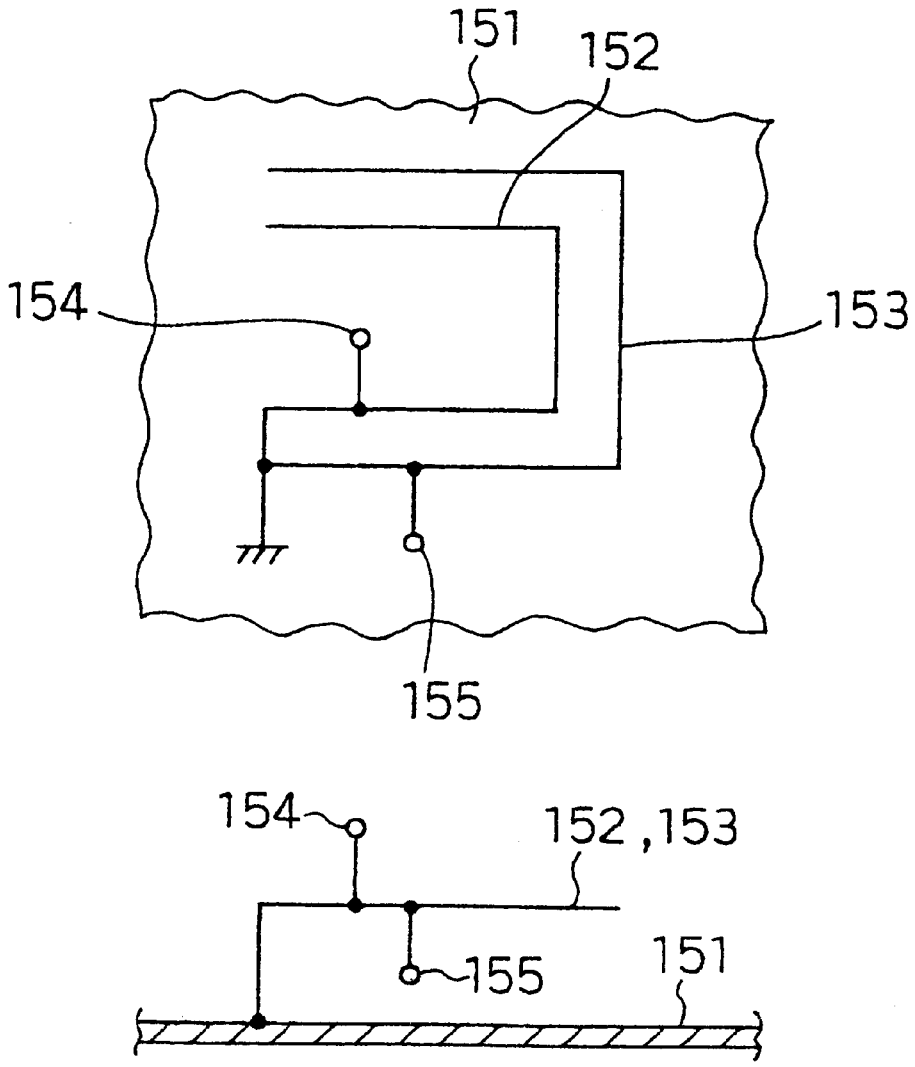
FIG. 1 is a schematic diagram showing an example of an antenna device according to a first embodiment of the present invention.
Figure 2:
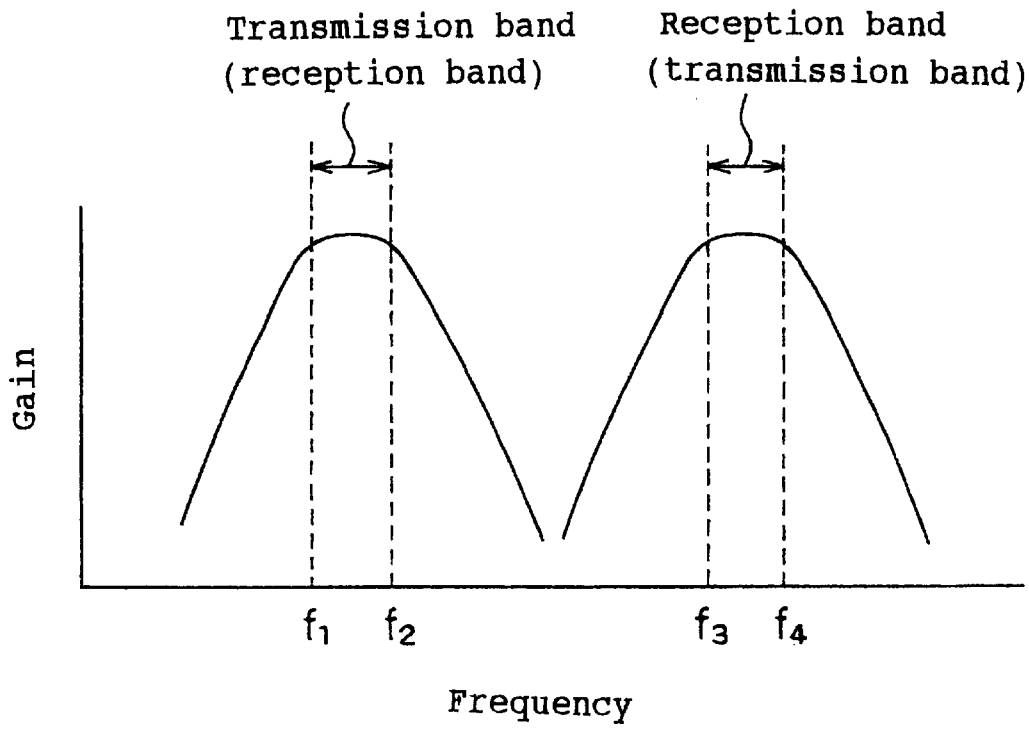
FIG. 2 is a schematic diagram showing frequency bands achieved in the antenna device according to the first embodiment.

FIG. 1 includes a plan view and a sectional view showing an antenna device according to a first embodiment of the present invention. The antenna device comprises a receiving element 152 and a transmitting element 153 with their antenna planes facing an antenna ground (conductive earth substrate) 151, and the receiving element 152 is provided with a receiving terminal 154 and the transmitting element 153 is provided with a transmitting terminal 155. As shown in FIG. 2, the resonance frequencies of the receiving element 152 and the transmitting element 153 are different from each other, depending on the element lengths, and thus, the isolation between a received signal and a transmission signal can be improved. In addition, the receiving element 152 and the transmitting element 153 have an end connected to the antenna ground 151 for grounding, respectively. Since the receiving element 152 and the transmitting element 153 operate separately from each other, the antenna device can be optimized for receiving and transmitting, respectively and the reception sensitivity and the transmission efficiency can be improved.

It should be noted that in the Figure, the words in parentheses indicate the case where the resonance frequencies for transmission and reception are set inversely but the setting of those frequencies may be accomplished optionally. This may apply to succeeding examples.

Figure 3:
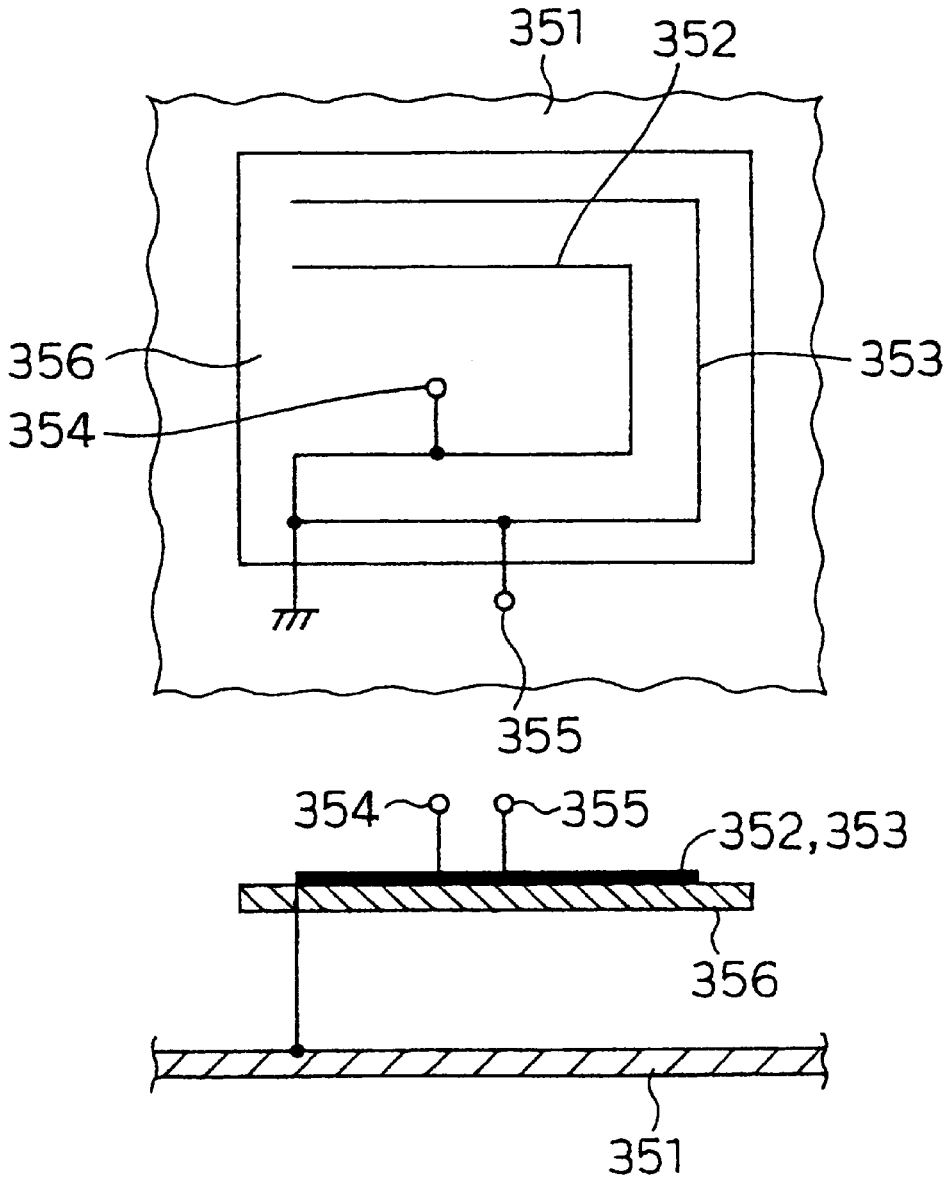
FIG. 3 is a schematic diagram showing another example of the antenna device according to the first embodiment.

FIG. 3 shows that in an antenna device having the configuration similar to that described above, a receiving element 352 and a transmitting element 353 are formed on a common circuit board 356 provided to face an antenna ground 351, by using a printed-wiring technique or the like. This antenna device is functionally equivalent to the antenna device described above, but the stability -can be improved because the elements are fixed on the common circuit board 356.

Figure 4:
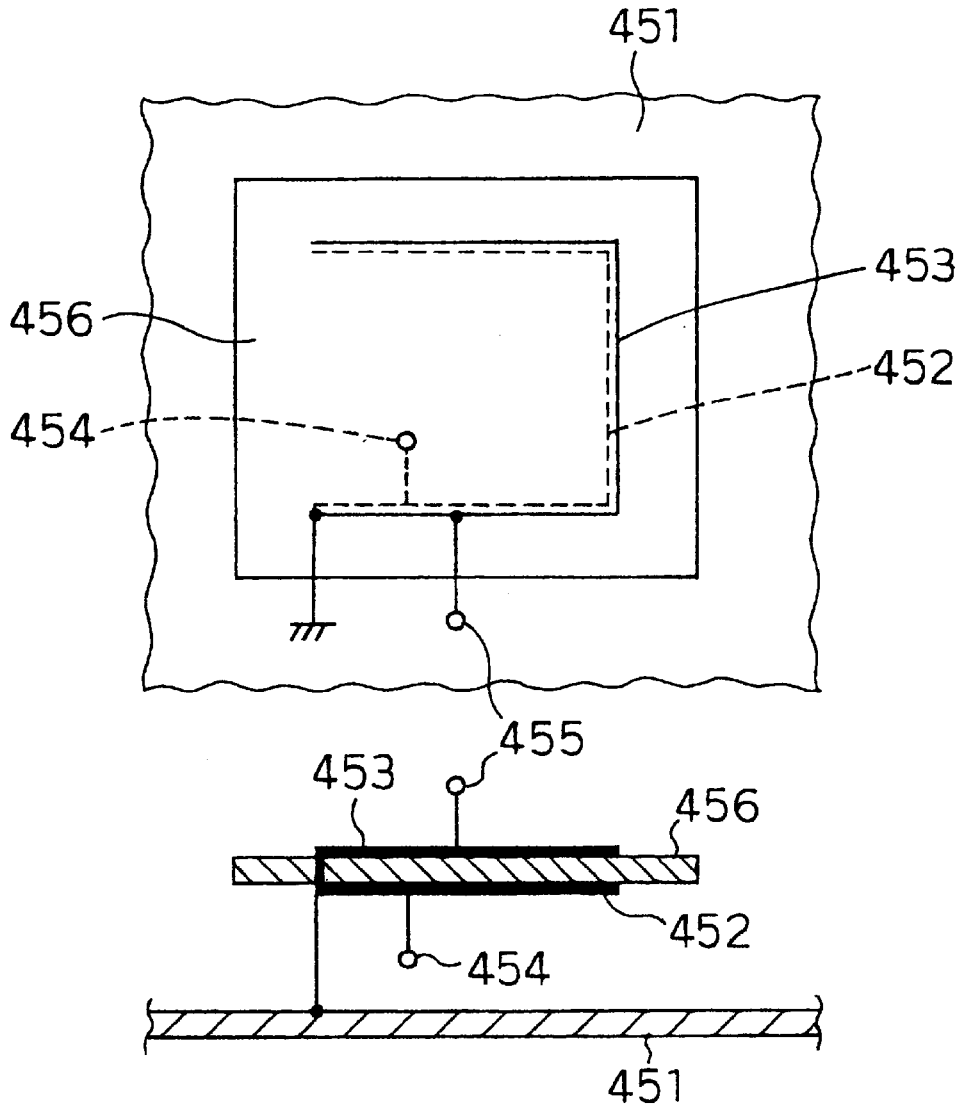
FIG. 4 is a schematic diagram showing still another example of the antenna device according to the first embodiment.

FIG. 4 shows an example that in the configuration of FIG. 3, a receiving element 452 is formed on the opposite side of a common double-sided circuit board 456 to a transmitting element 453, that is, on the side closer to an antenna ground 451. Of course, it should be noted that the receiving element 452 and the transmitting element 453 may be formed inversely.

Figure 5:
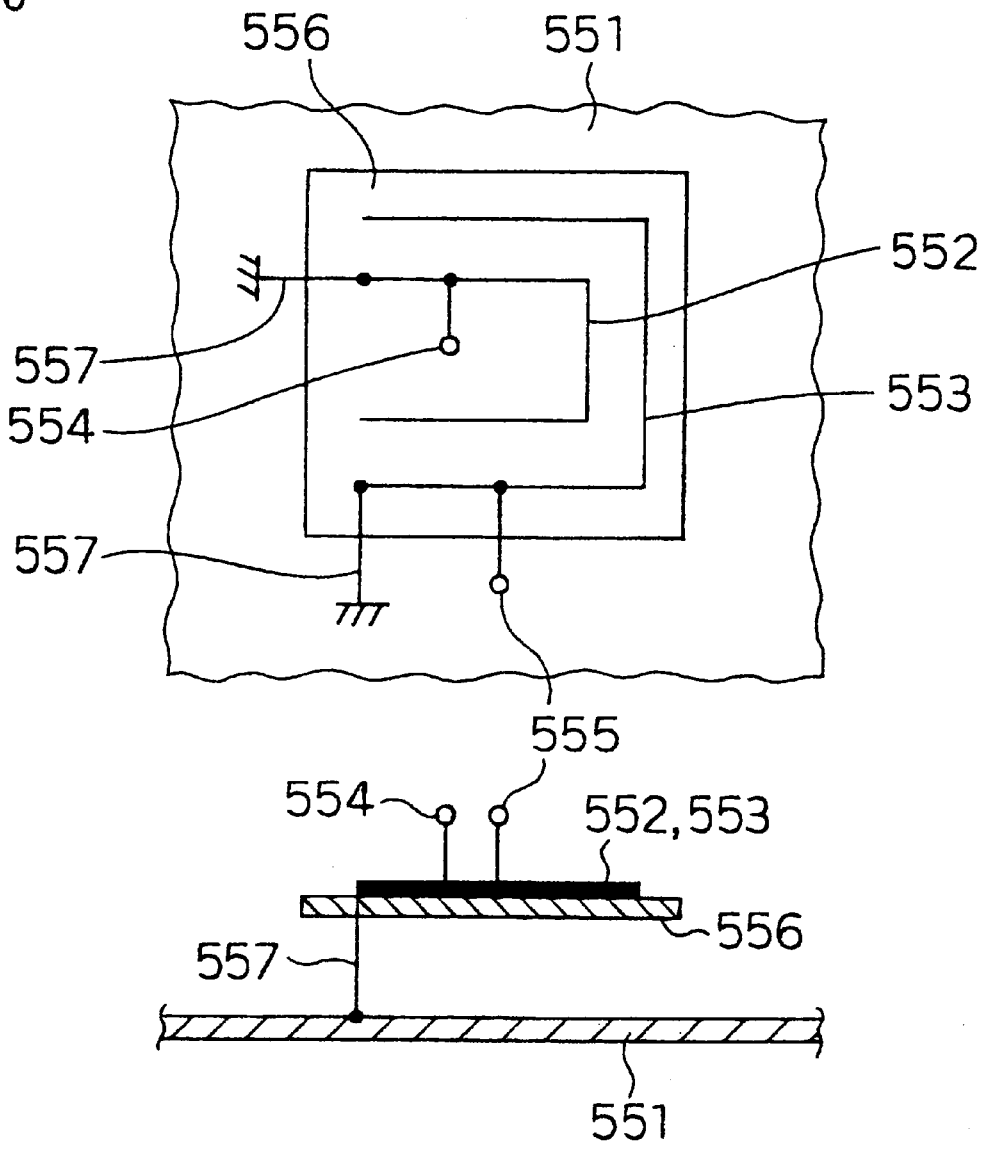
FIG. 5 is a schematic diagram showing still another example of the antenna device according to the first embodiment.
Figure 6:
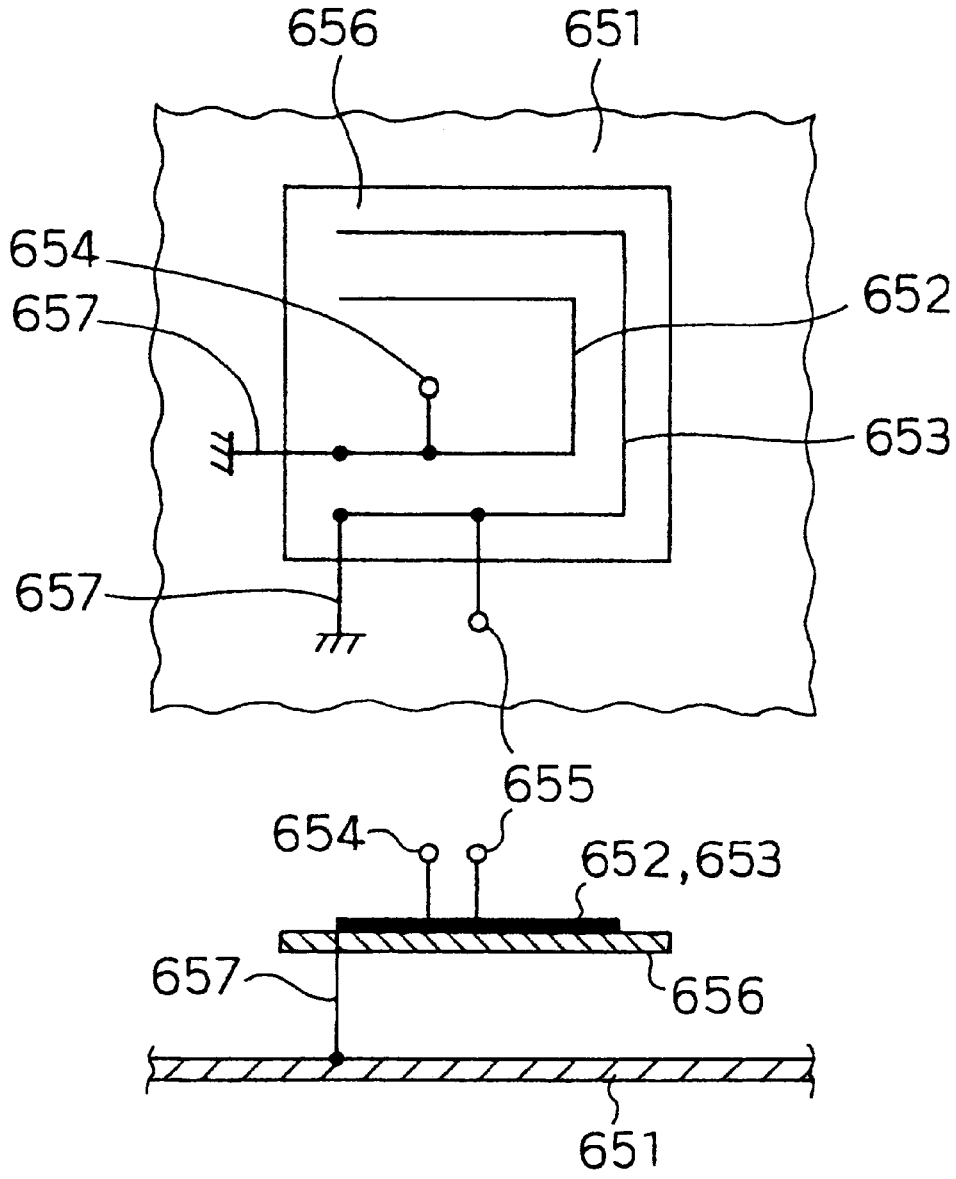
FIG. 6 is a schematic diagram showing still another example of the antenna device according to the first embodiment.

FIG. 5 shows an example that in the configuration of FIG. 3, a receiving element 552 and a transmitting element 553 are connected to an antenna ground 551 through separate ground connections (at different locations) 557. In this example, the receiving element 552 and the transmitting element 553 are separately grounded at one of their ends farther from each other. Such a configuration can improve the isolation between a received signal and a transmission signal as compared with an antenna device with a common ground. FIG. 6 also shows that separate ground connections are provided but in this configuration, a receiving element 652 and a transmitting element 653 are separately grounded at one of their ends closer to each other.

Figure 7:
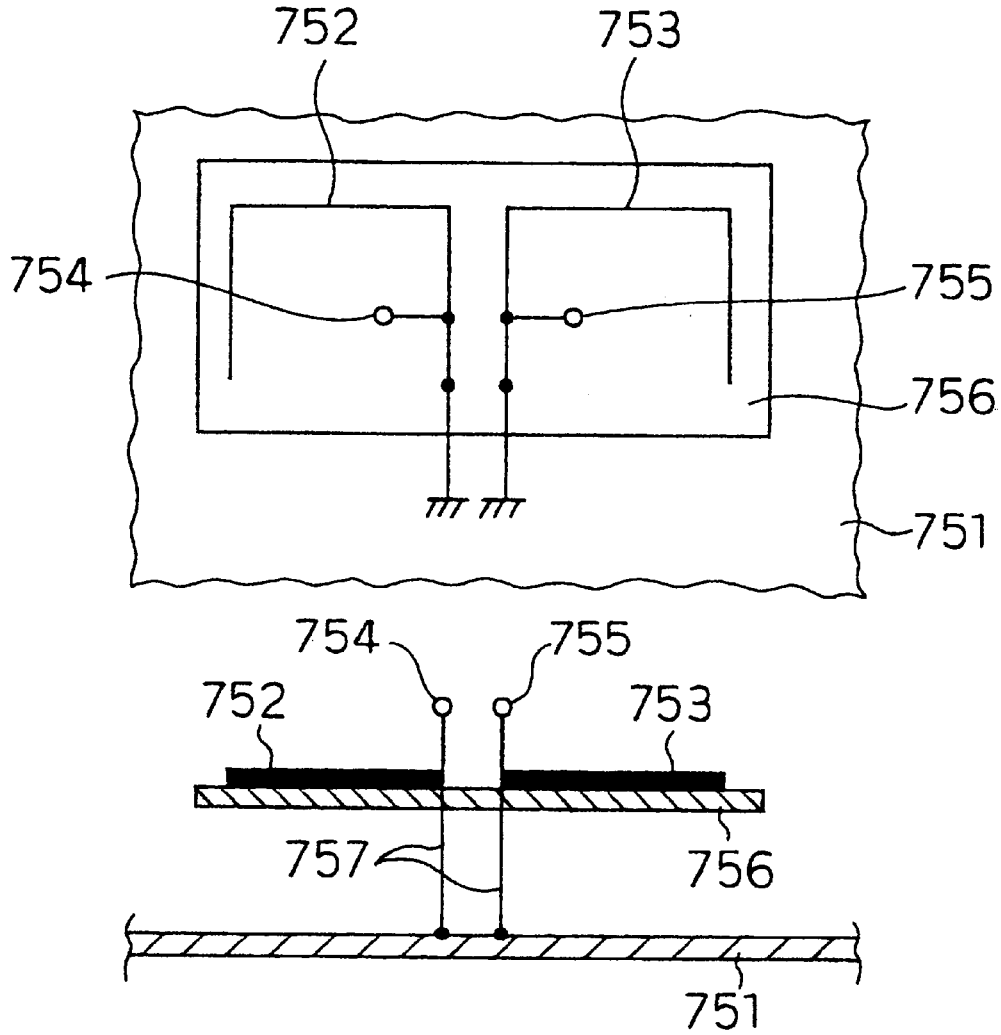
FIG. 7 is a schematic diagram showing still another example of the antenna device according to the first embodiment.
Figure 8:
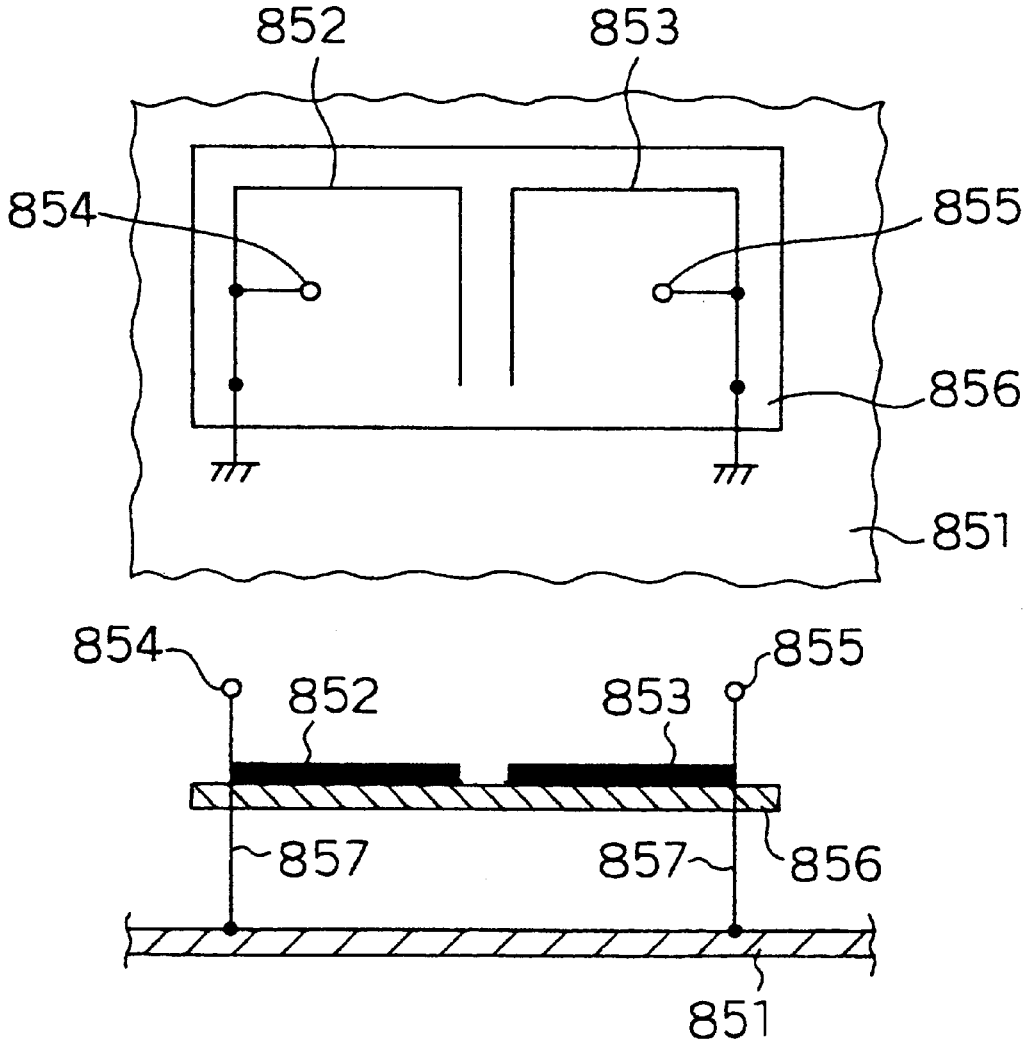
FIG. 8 is a schematic diagram showing still another example of the antenna device according to the first embodiment.
Figure 9:
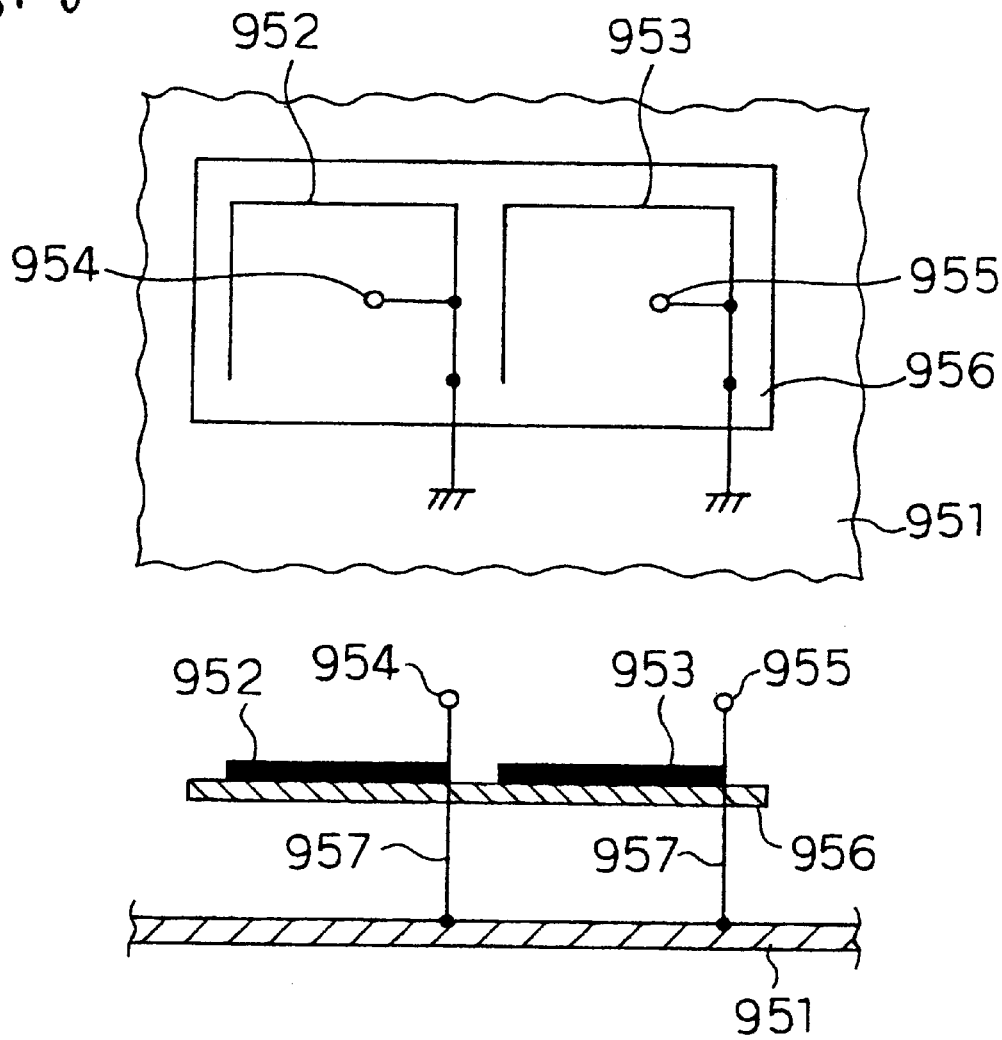
FIG. 9 is a schematic diagram showing still another example of the antenna device according to the first embodiment.

FIG. 7 shows that an antenna device comprises a receiving element 752 and a transmitting element 753 arranged so that their antenna planes do not overlap one another, and these elements are separately grounded at one of their ends closer to each other. The isolation can be further improved depending on the locations of these elements. FIG. 8 shows that in the configuration of FIG. 7, a receiving element 852 and a transmitting element 853 are separately grounded at one of their ends farther from each other. Moreover, FIG. 9 shows an example that a receiving element 952 and a transmitting element 953 are arranged in the same direction and this antenna device can have the same functions as those described above.

Figure 10:
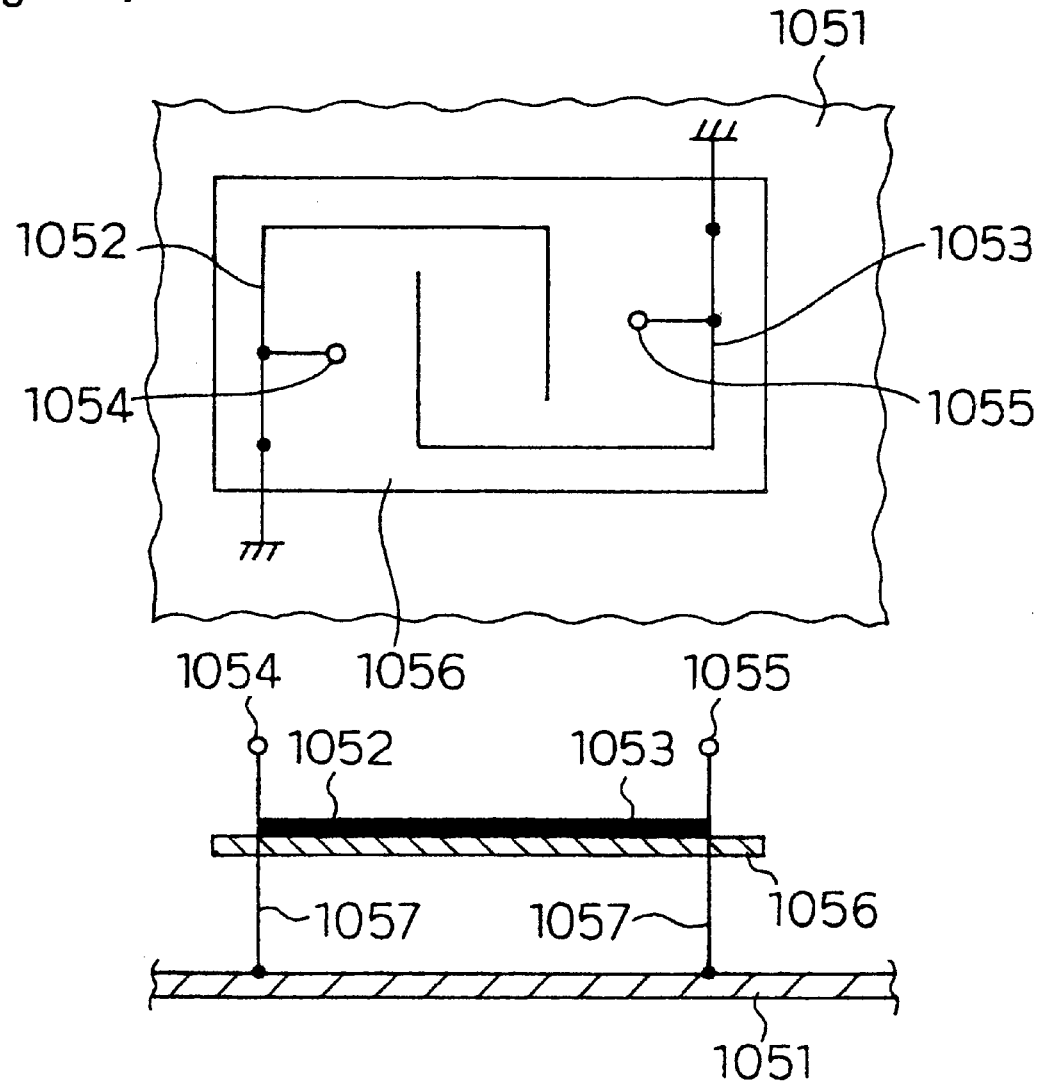
FIG. 10 is a schematic diagram showing still another example of the antenna device according to the first embodiment.
Figure 11:
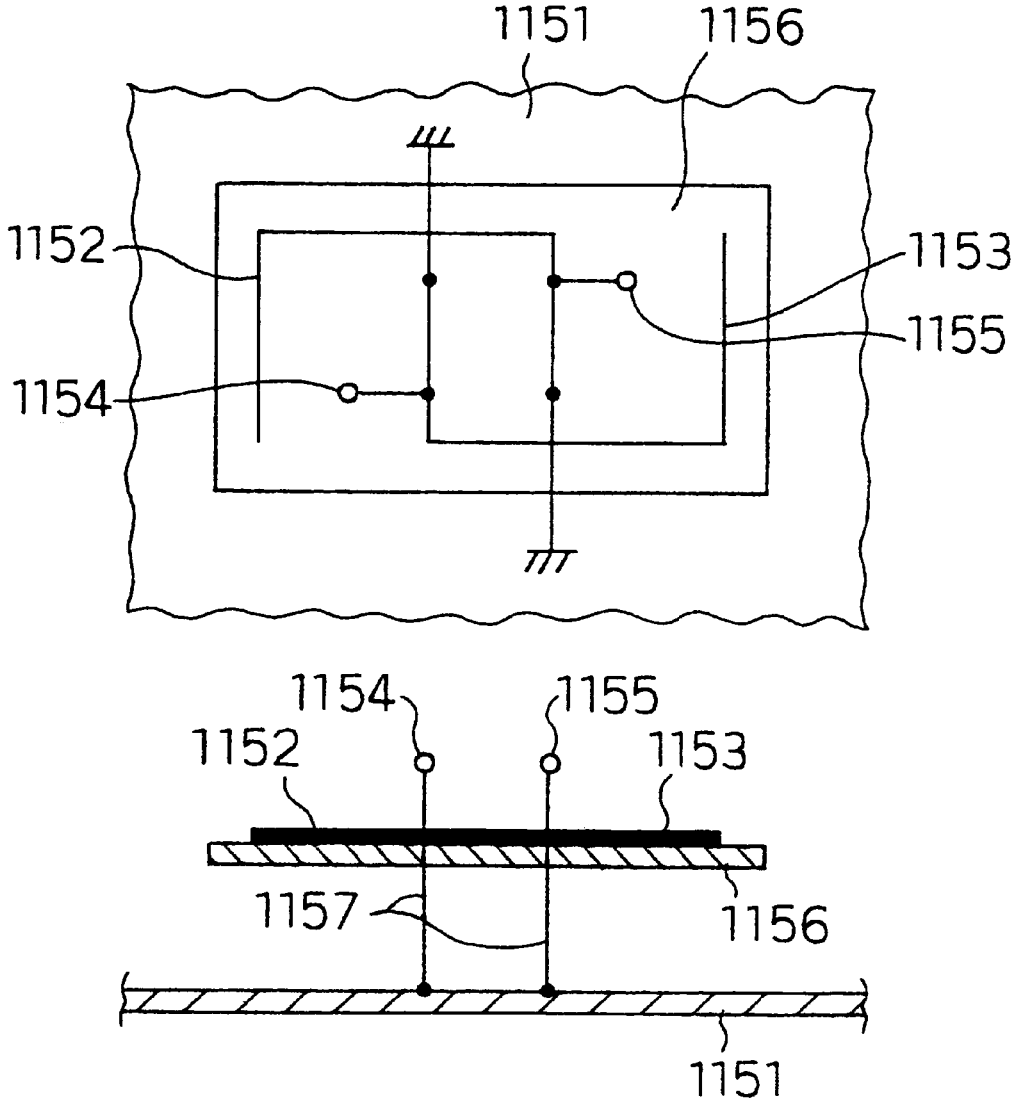
FIG. 11 is as schematic diagram showing still another example of the antenna device according to the first embodiment.
Figure 12:
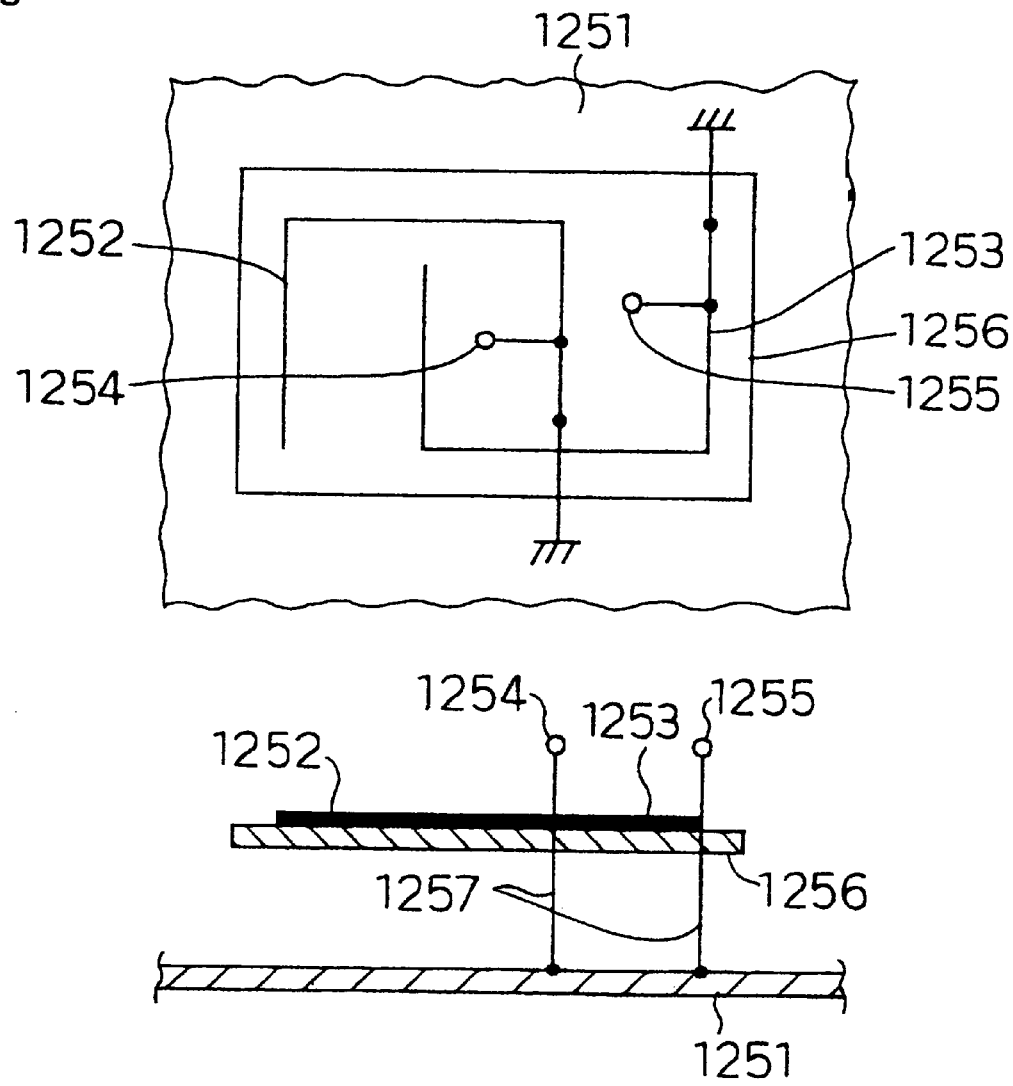
FIG. 12 is a schematic diagram showing still another example of the antenna device according to the first embodiment.

FIG. 10 shows an example that a receiving element 1052 and a transmitting element 1053 are arranged symmetrically with respect to a predetermined point and these elements are separately grounded at one of their ends farther from each other. FIG. 11 shows that in the configuration of FIG. 10, a receiving element and a transmitting element are separately grounded at one of their ends closer to each other. Moreover, FIG. 12 shows that in the configuration of FIG. 10, a receiving element 1252 is grounded at its inner end and a transmitting element 1253 is grounded at its outer end.

(Embodiment 2)

Figure 13:
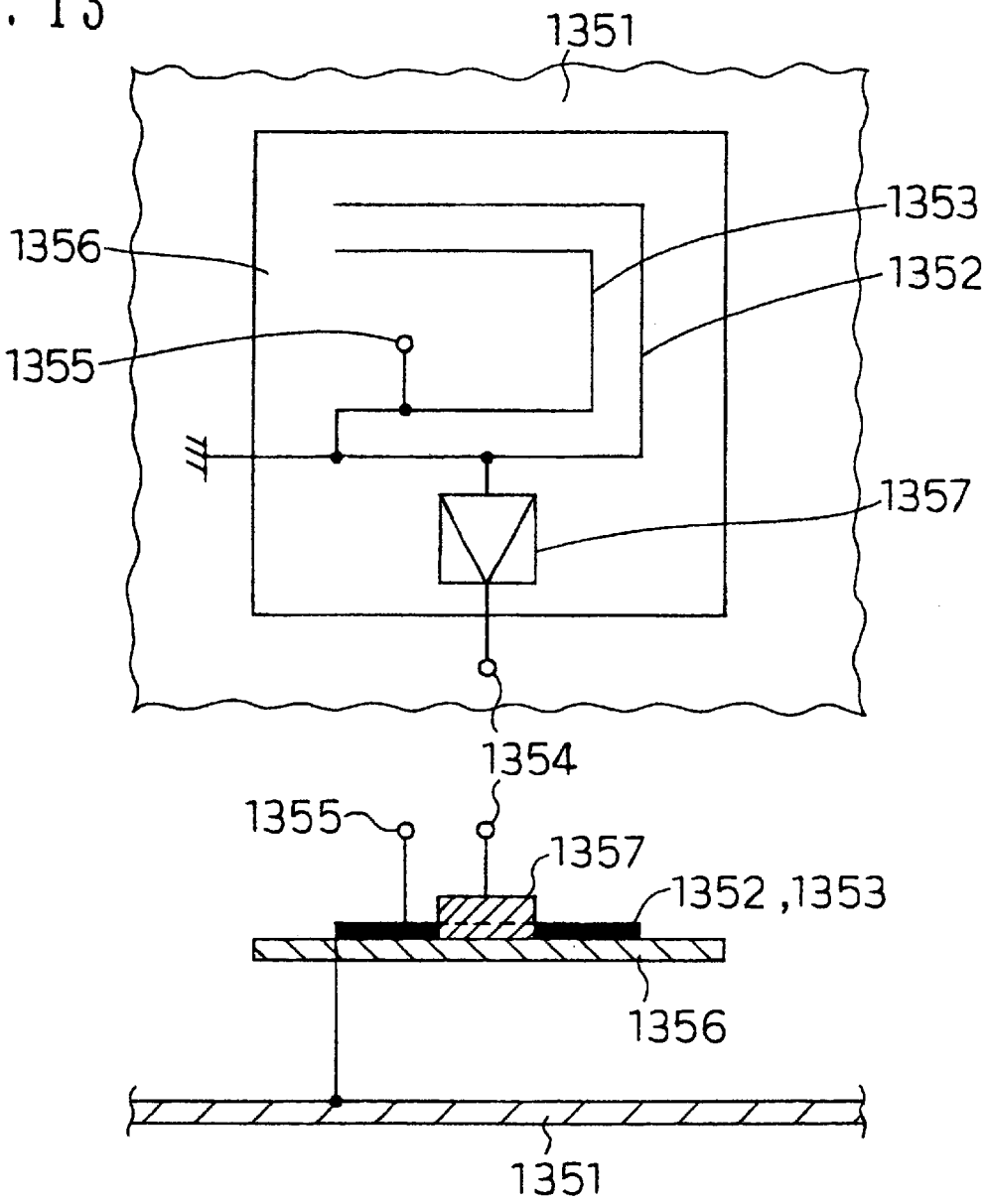
FIG. 13 is a schematic diagram showing an example of an antenna device according to a second embodiment of the present invention.

FIG. 13 includes a plan view and a sectional view showing an antenna device according to a second embodiment of the present invention. The antenna device has the configuration of FIG. 3 and a receiving amplifier 1357 is connected between a receiving element 1352 and a receiving terminal 1354. Since the receiving amplifier 1357 is provided near the receiving element 1352 on a common circuit board 1356, it can amplify a received signal and then provide it to the appropriate section through the receiving terminal 1354. The antenna device can withstand any noise coming into the feeder and enjoy an improved reception sensitivity.

Figure 14:
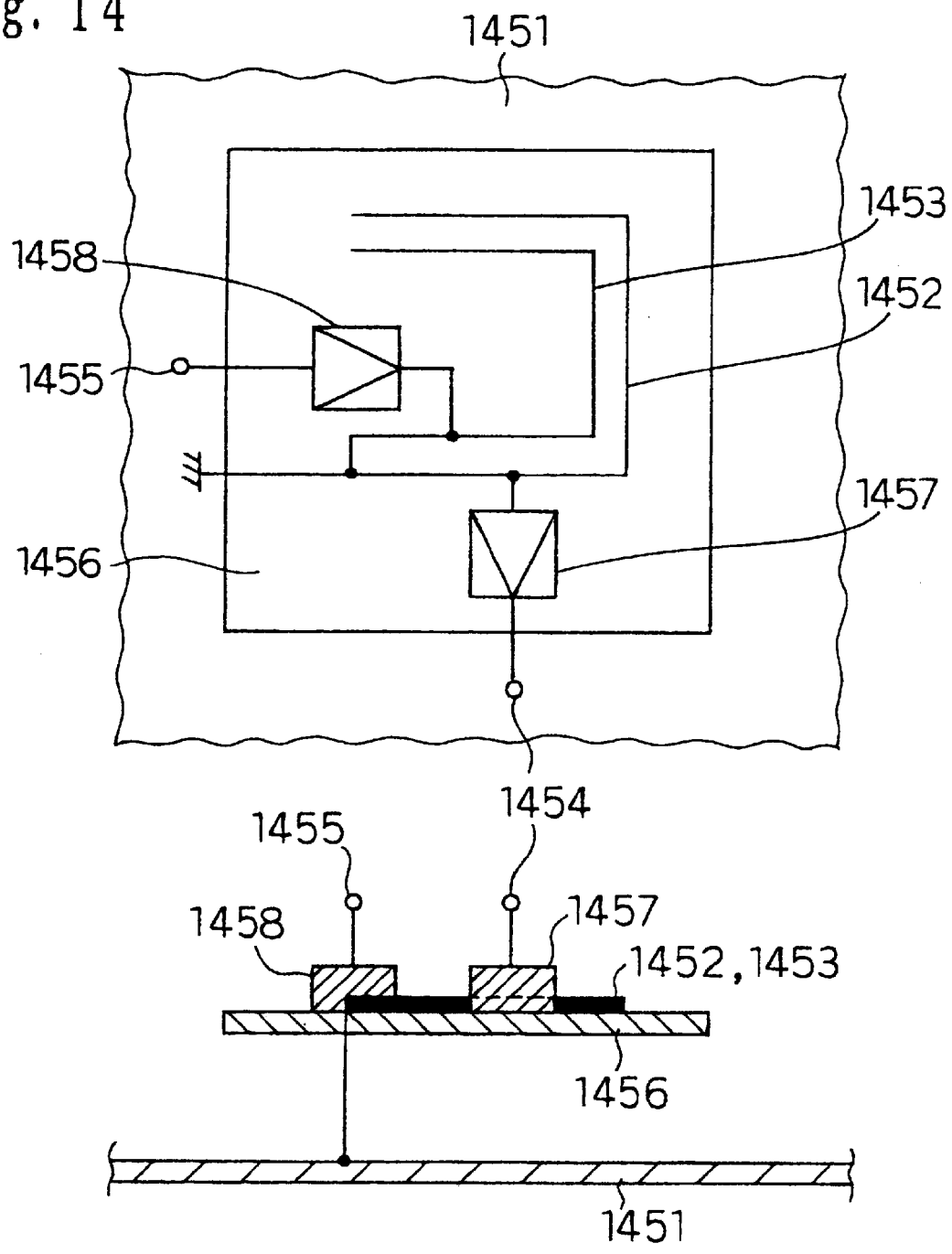
FIG. 14 is a schematic diagram showing another example of the antenna device according to the second embodiment.

FIG. 14 shows an example that in addition to the components shown in FIG. 13, a transmitting amplifier 1458 is provided between a transmitting element 1453 and a transmitting terminal 1455 on a common circuit board 1456. This configuration can provide an improved reception sensitivity as well as a reduced power loss in the feeder and an improved transmission efficiency.

Figure 15:
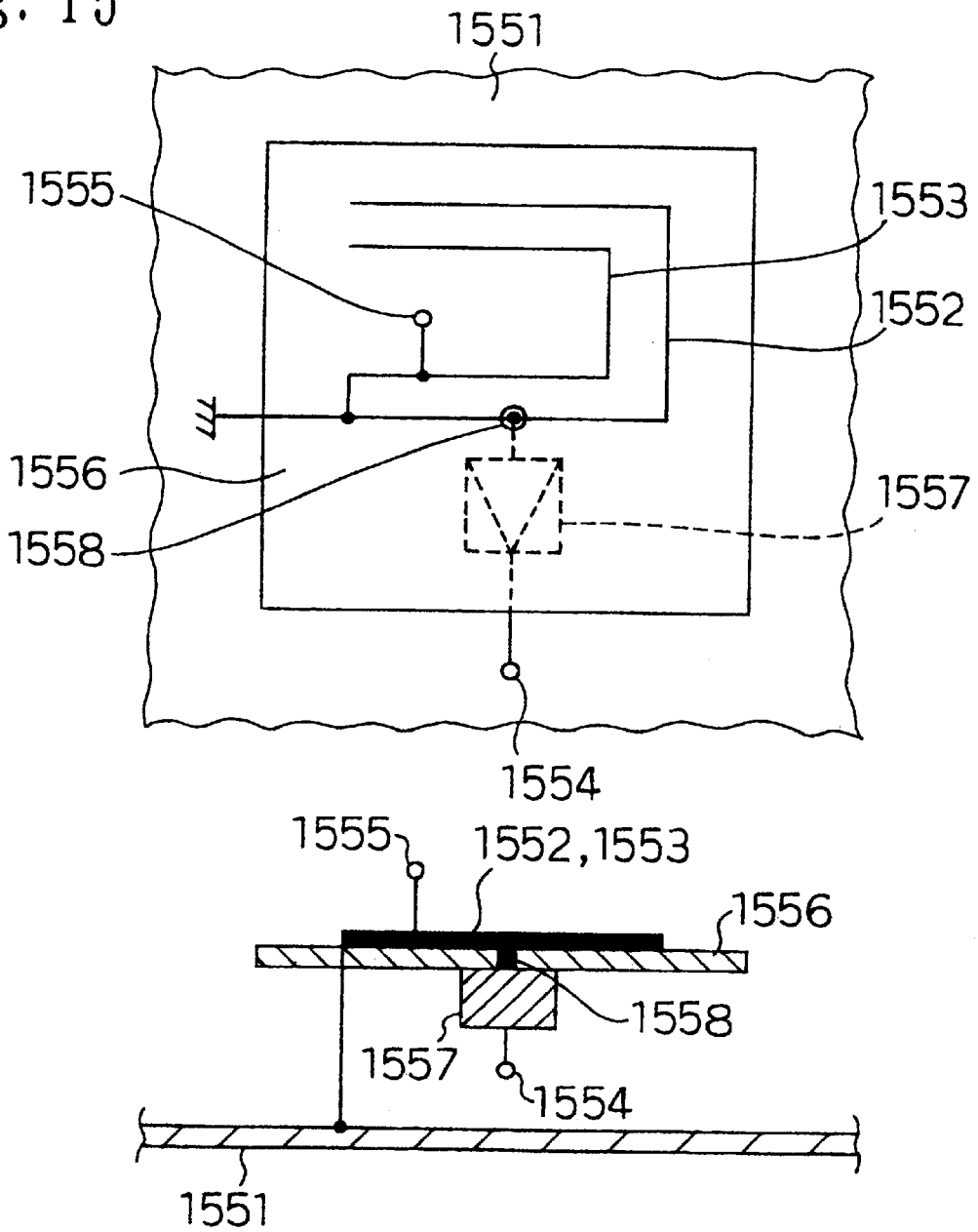
FIG. 15 is a schematic diagram showing still another example of the antenna device according to the second embodiment.

FIG. 15 shows that in the configuration similar to that of FIG. 13, a common double-sided circuit board 1556 is used to form a receiving amplifier 1557 on the opposite side of that board to antenna elements 1552 and 1553 and the receiving amplifier 1557 is connected to the receiving element 1552 by the cable running through a through-hole 1558. This configuration can save the space because the receiving amplifier 1557 is located between the common double-sided circuit board 1556 and an antenna ground 1551.

Figure 16:
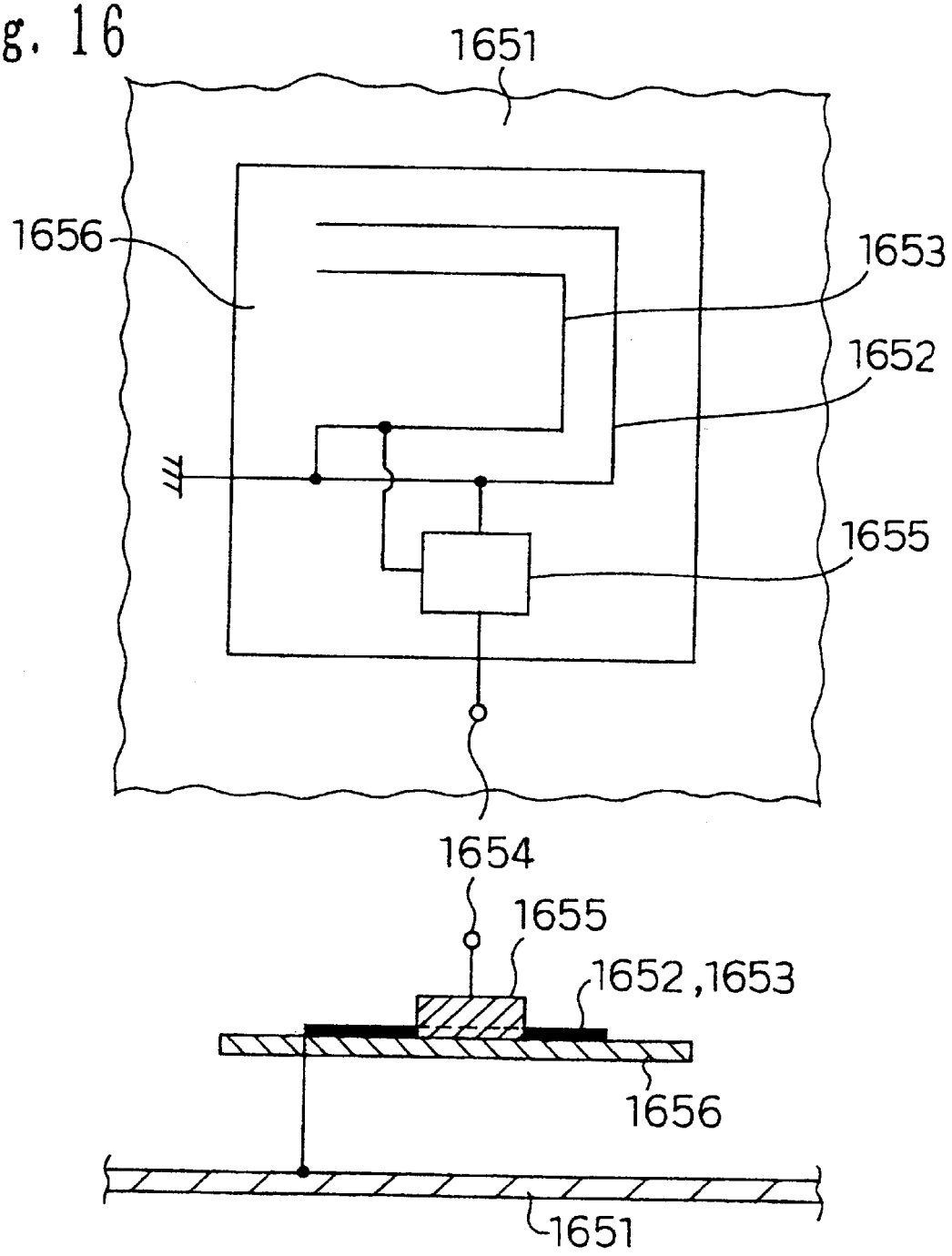
FIG. 16 is a schematic diagram showing still another example of the antenna device according to the second embodiment.
Figure 17:
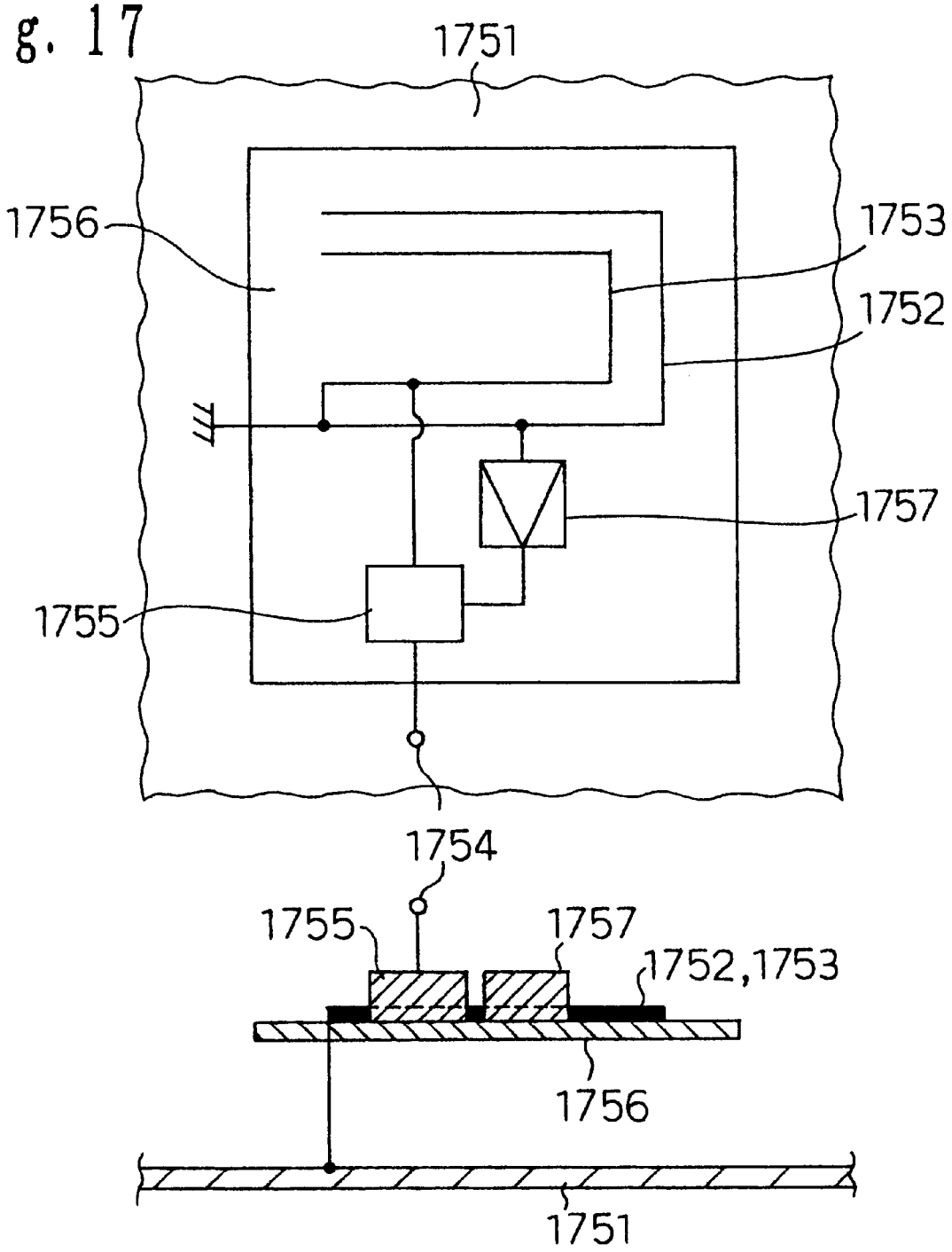
FIG. 17 is a schematic diagram showing still another example of the antenna device according to the second embodiment.

FIG. 16 shows that a common component 1655 is used to provide a common terminal 1654 which performs a double function of a receiving terminal and a transmitting terminal and the common component 1655 such as a divider, mixer, circulator, or switch is provided on a common circuit board 1656 so that the common terminal 1654 can operate as a feeding terminal for both a receiving element 1652 and a transmitting element 1653. FIG. 17 shows an example that in addition to the components described above, a receiving amplifier 1757 is inserted between a receiving element 1752 and a common component 1755. This configuration can allow simple connection to a communication device through a single cable because only one feeding terminal is required.

(Embodiment 3)

Figure 18:
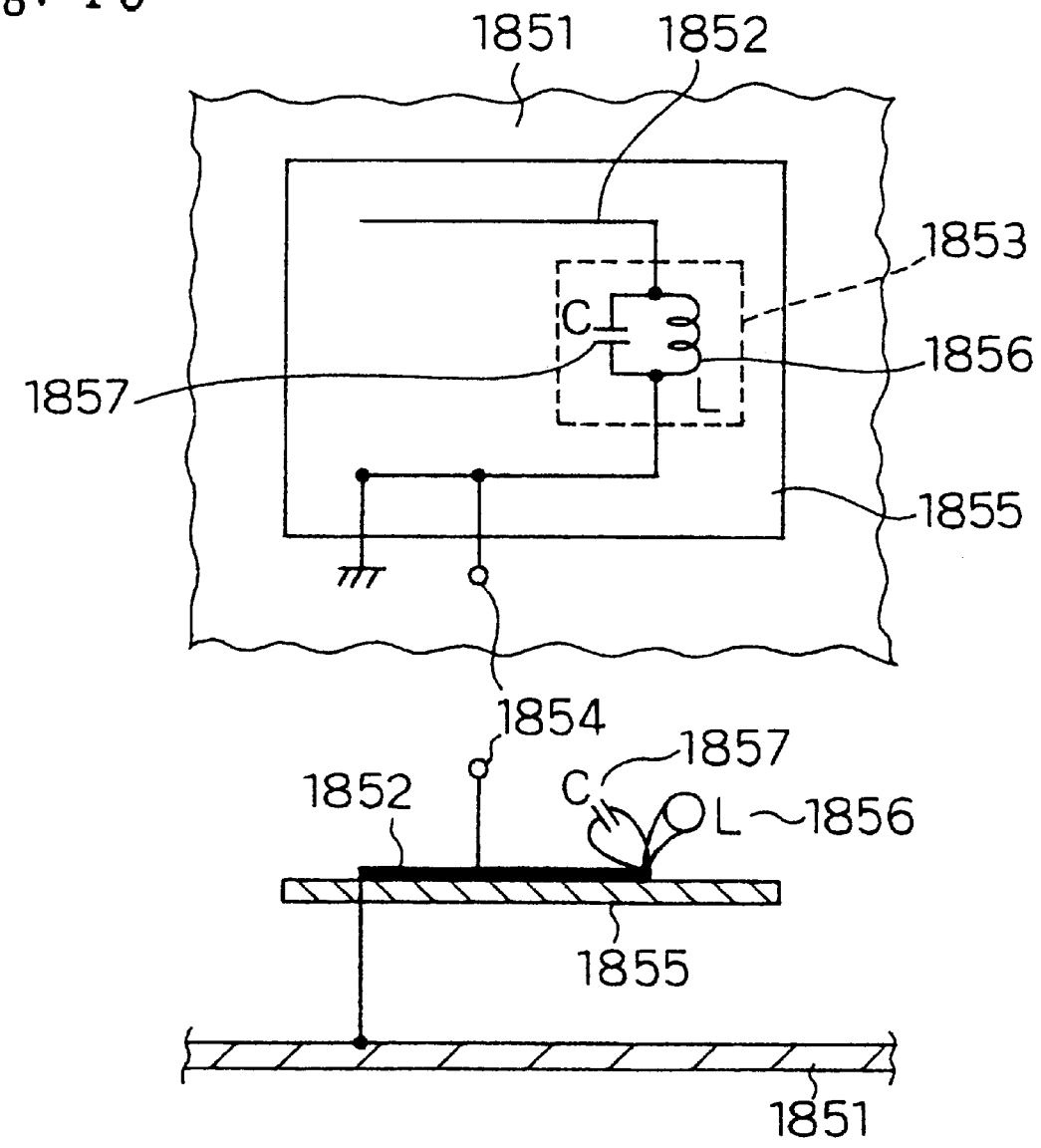
FIG. 18 is a schematic diagram showing an example of an antenna device according to a third embodiment of the present invention.
Figure 19:
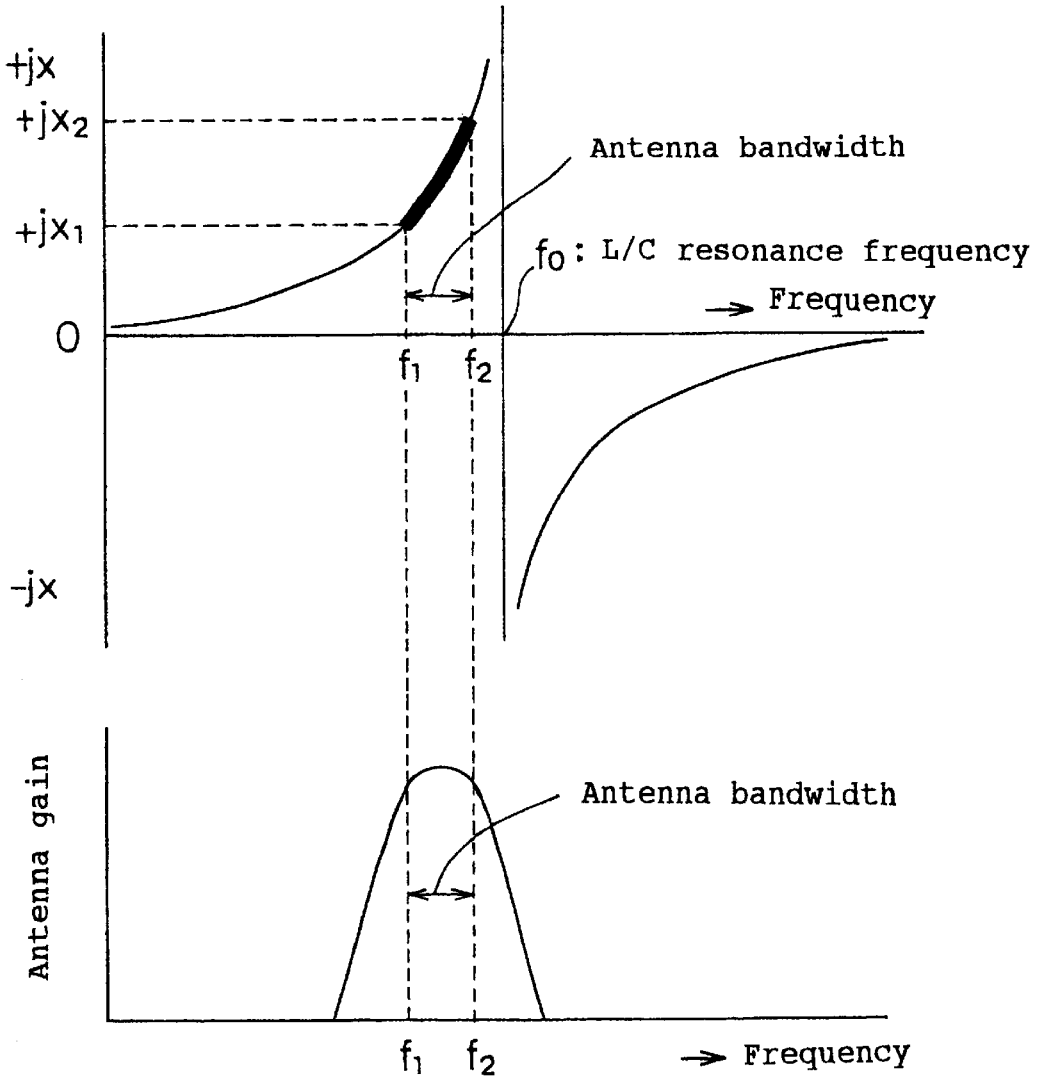
FIG. 19 is a schematic diagram for explaining the frequency characteristics of the antenna device shown in FIG. 18.

FIG. 18 includes a plan view and a sectional view showing an antenna device according to a third embodiment of the present invention. In the antenna device, an antenna element 1852 having an end connected to an antenna ground 1851 for grounding and also having a feeding terminal 1854 connected thereto is formed on a common circuit board 1855 located parallel to the antenna ground 1851 and a resonant circuit 1853 is inserted within the antenna element 1852. The resonant circuit 1853 has an appropriate inductor 1856 and a capacitor 1857 connected in parallel so that the circuit can have an impedance jX1~jX2 for a frequency f1~f2. As shown in FIG. 19, the resonant circuit 1853 can provide an antenna which has a bandwidth of f1~f2, because the circuit has an impedance varying within the range of jX1~jX2 and a gain peak at a frequency f1~f2 when the L/C resonance frequency is set to f0.

Figure 20:
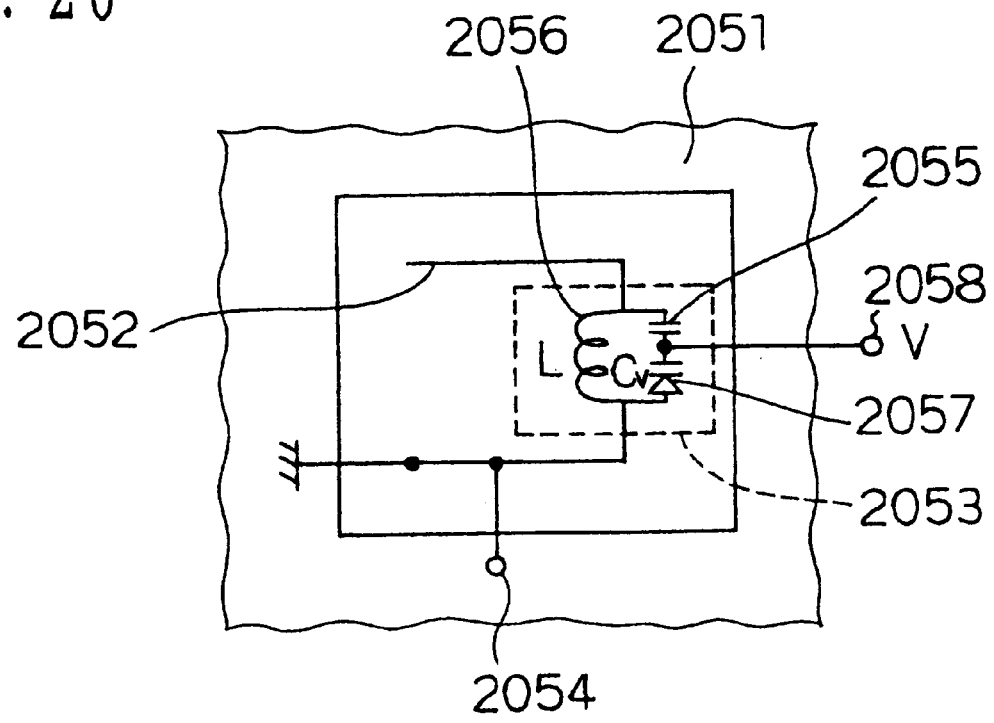
FIG. 20 is a schematic diagram showing another example of the antenna device according to the third embodiment.
Figure 20:
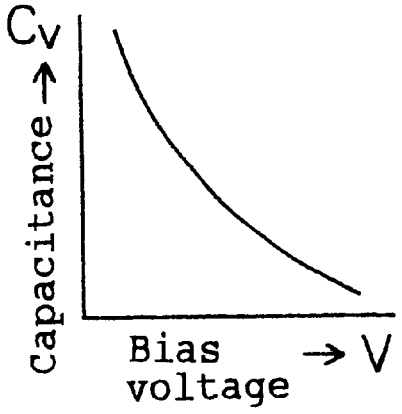
Figure 21:
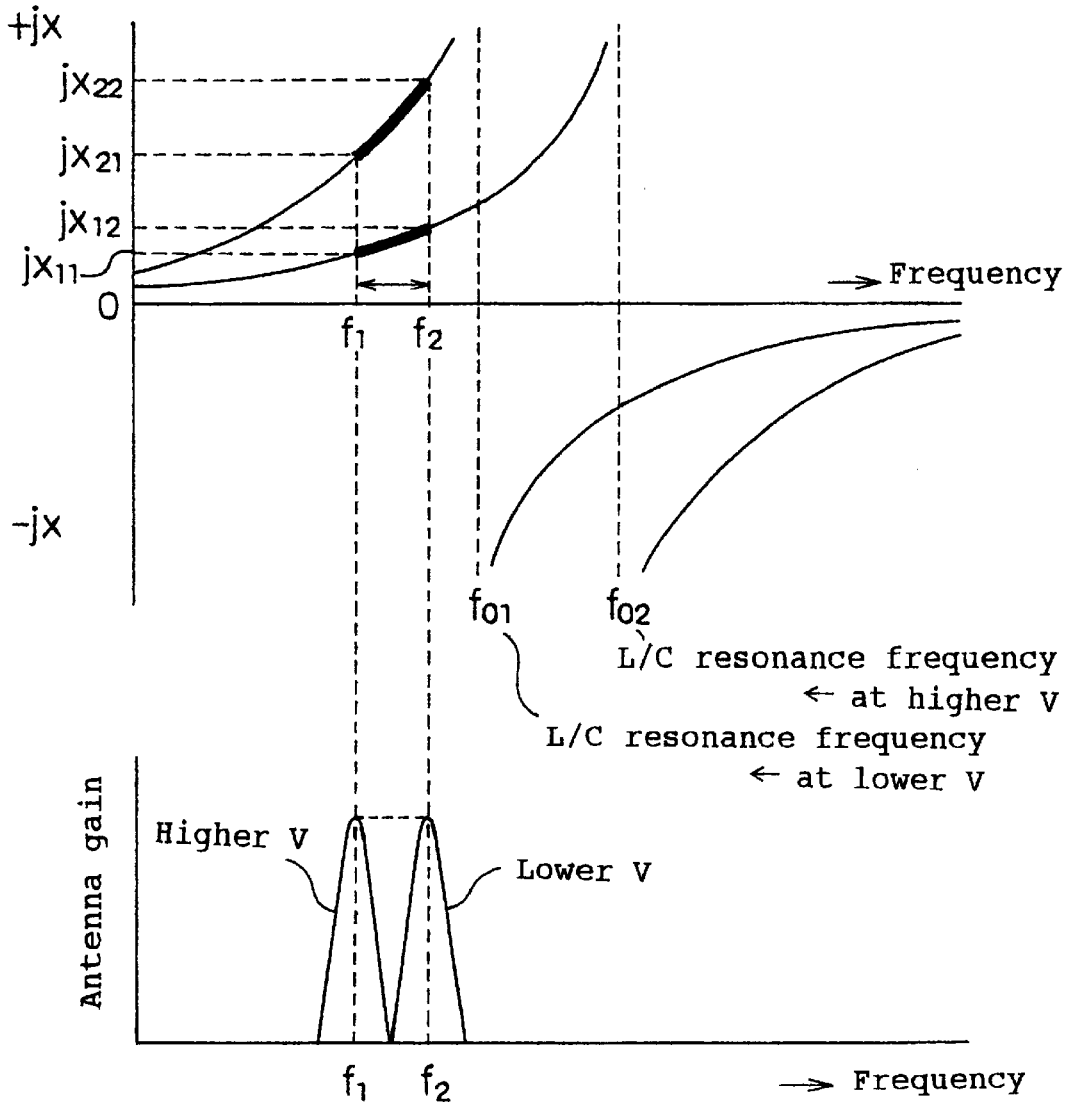
FIG. 21 is a schematic diagram for explaining the frequency characteristics of the antenna device shown in FIG. 20.

FIG. 20 shows that the capacitor of the resonant circuit in FIG. 18 is replaced by a series connection of a fixed direct-current blocking capacitor 2055 and a voltage-variable capacitance element (varicap) 2057. As shown in the right of the figure, the voltage-variable capacitance element 2057 has a capacitance Cv varying with the bias voltage V and the capacitance and thus the resonance frequency can be controlled by varying the bias voltage. As shown in FIG. 21, at a lower bias voltage of the varicap, the L/C resonance frequency is lowered (f01), the loading reactance jX increases (jX21~jX22), and the antenna tuning frequency is lowered (f1). On the contrary, at a higher bias voltage of the varicap, the L/C resonance frequency is raised (f02), the loading reactance jX decreases (jX11~jX12), and the antenna tuning frequency is raised (f2). Like this, according to the present embodiment, the tuning frequency can be changed by controlling the bias voltage of the voltage-variable capacitance element (varicap) 2057.

(Embodiment 4)

Figure 22:
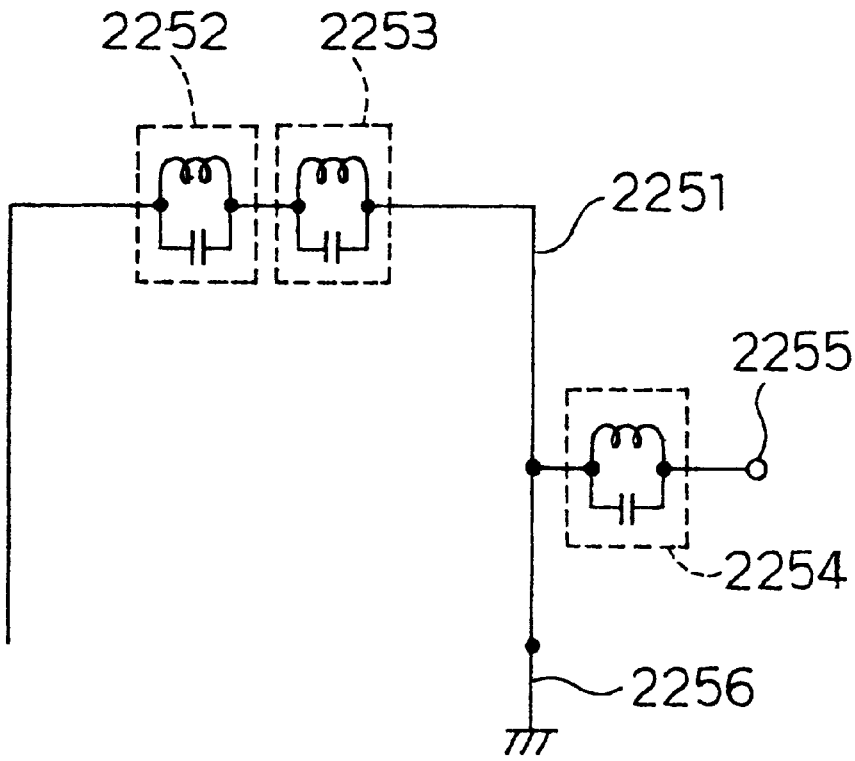
FIG. 22 is a schematic diagram showing an example of the main components in an antenna device according to a fourth embodiment of the present invention.
Figure 23:
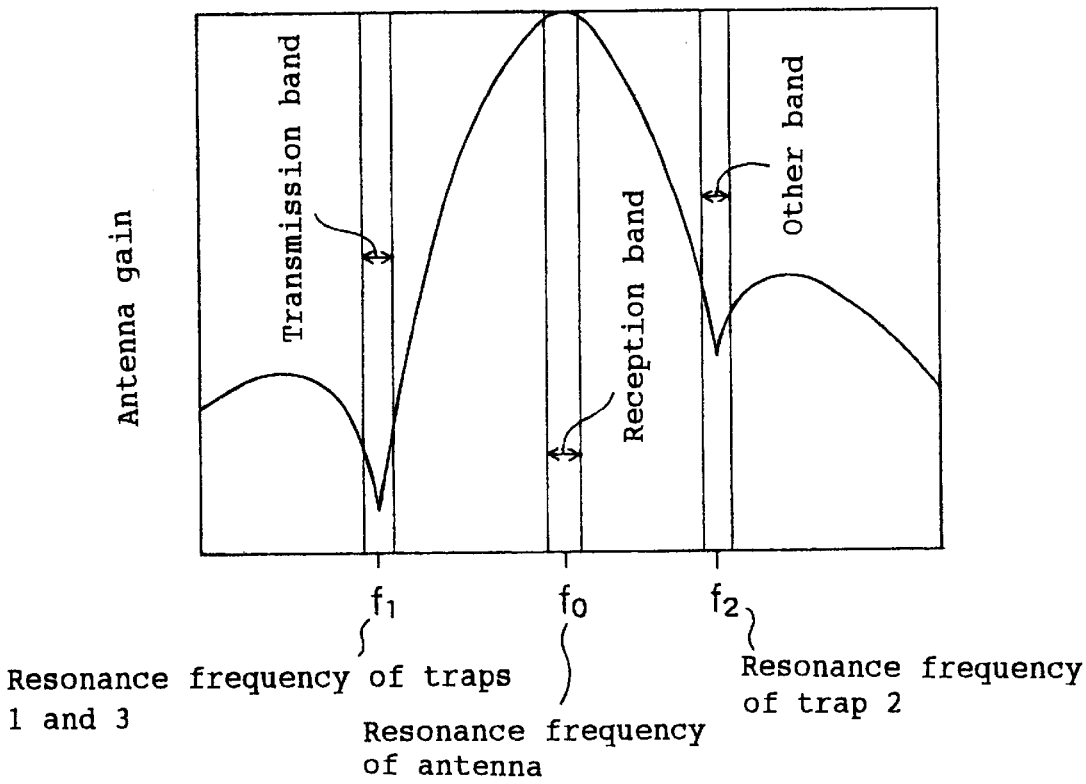
FIG. 23 is a schematic diagram for explaining the frequency characteristics of the antenna device shown in FIG. 22.

FIG. 22 is a schematic diagram showing the configuration of the main components in an antenna device according to a fourth embodiment of the present invention. Namely, in the present embodiment, a resonant circuit (trap circuit) having a predetermined resonance frequency is inserted in an antenna element and near a feeding terminal in each antenna device described above. In FIGS. 22 and 23, a trap circuit 1 (f1) 2252 inserted in an antenna element 2251 and a trap circuit 3 (f1) 2254 inserted near a feeding terminal 2255 have a resonance frequency in the transmission band and another trap circuit 2 (f2) 2253 inserted in the antenna element 2251 has a resonance frequency in the other band f2 opposite to the transmission band f1 with respect to the reception band f0. Therefore, the isolation between antenna elements with in a certain band can be improved by providing trap circuits each having a resonance frequency in the frequency band on each side of the reception frequency.

Figure 24:
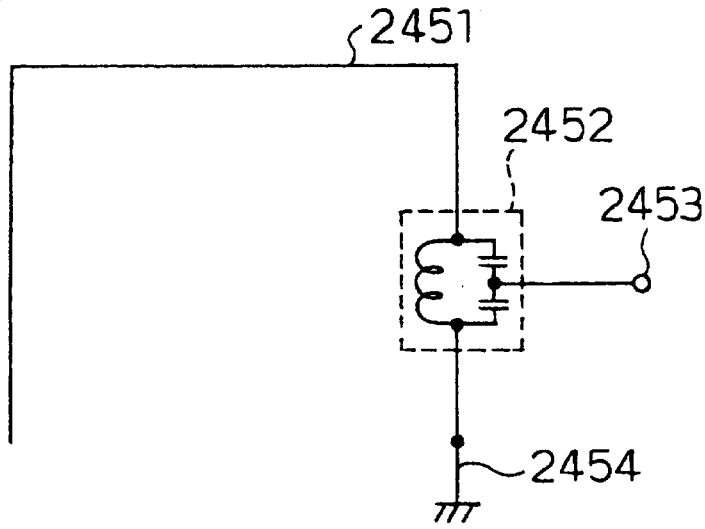
FIG. 24 is a schematic diagram showing another example of the main components in the antenna device according to the fourth embodiment.
Figure 24:
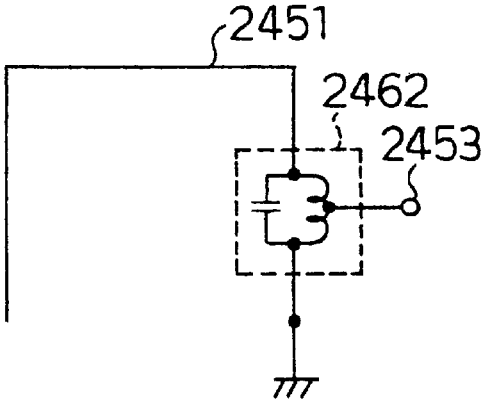
Figure 24:
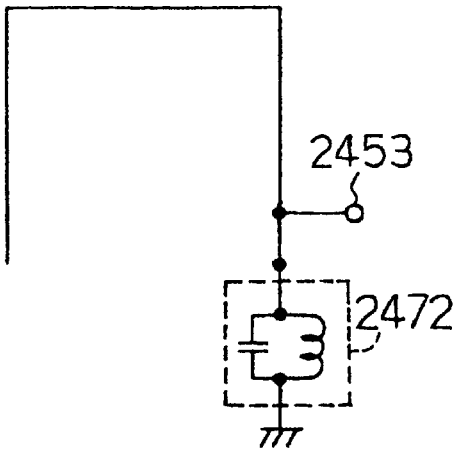

The trap circuit near the feeding terminal is inserted between the feeding terminal and the antenna element in FIG. 22 but as shown in FIGS. 24(*a*) and (*b*), a feeding terminal 2453 may be pulled out of a point between capacitors or in an inductor of a trap circuit 2452 or 2462 inserted in an antenna element 2451. Also, as shown in FIG. 24(*c*), a trap circuit 2472 may be inserted between a feeding terminal 2453 and an antenna ground and at a location closer to the ground. Therefore, when the trap circuit is located closer and closer to the ground, the inductor value and thus the size of the trap circuit can be reduced and thereby, a more compact and lightweight antenna can be provided.

(Embodiment 5)

Figure 25:
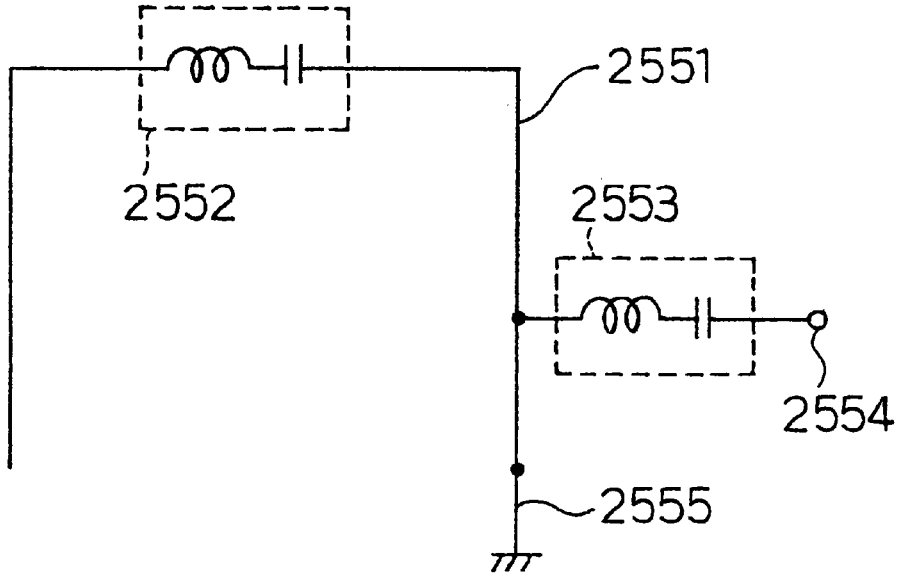
FIG. 25 is a schematic diagram showing an example of the main components in an antenna device according to a fifth embodiment of the present invention.
Figure 26:
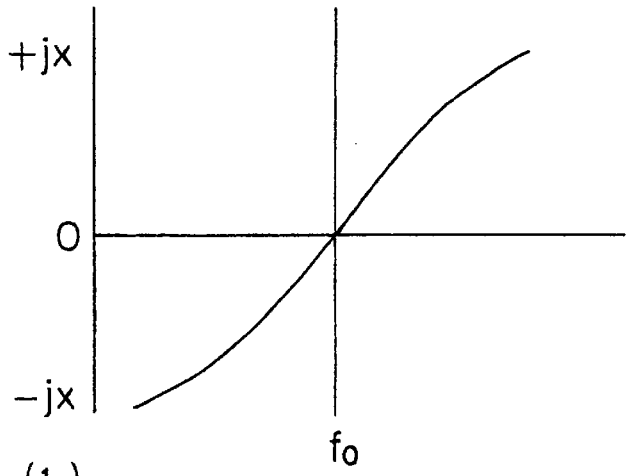
FIG. 26 is a schematic diagram for explaining the frequency characteristics of the antenna device shown in FIG. 25.
Figure 26:
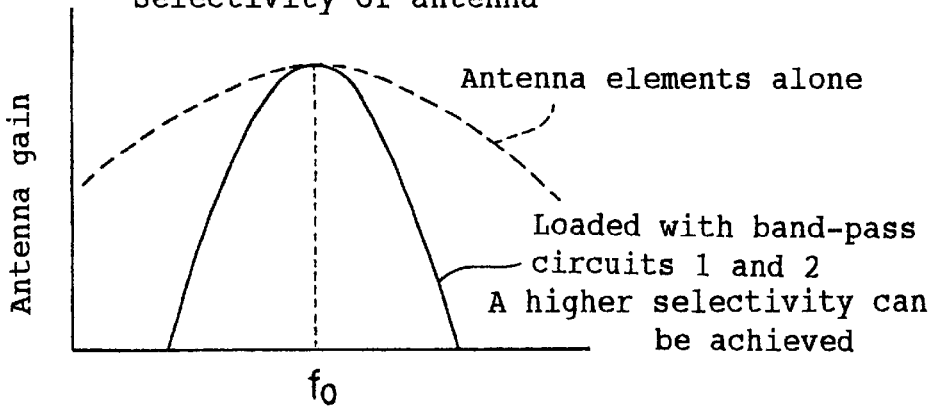

FIG. 25 is a schematic diagram showing the configuration of the main components in an antenna device according to a fifth embodiment of the present invention. Namely, in the present embodiment, a band-pass circuit having the same resonance frequency as that of the resonance frequency of the antenna (f0) is inserted in an antenna element and near a feeding terminal in each antenna device described above. The band-pass circuit comprises a series connection of an inductor and a capacitor and both a band-pass circuit 1 (f0) 2552 inserted in an antenna element 2551 and a band-pass circuit 2 (f0) 2553 inserted near a feeding terminal 2554 have a reactance characteristic as shown in FIG. 26(*a*). Thus, as shown in FIG. 26(*b*), when a band-pass circuit is inserted, the selectivity of the antenna can be improved as compared with the antenna having antenna elements alone and thereby, a higher selectivity can be achieved.

Figure 125:
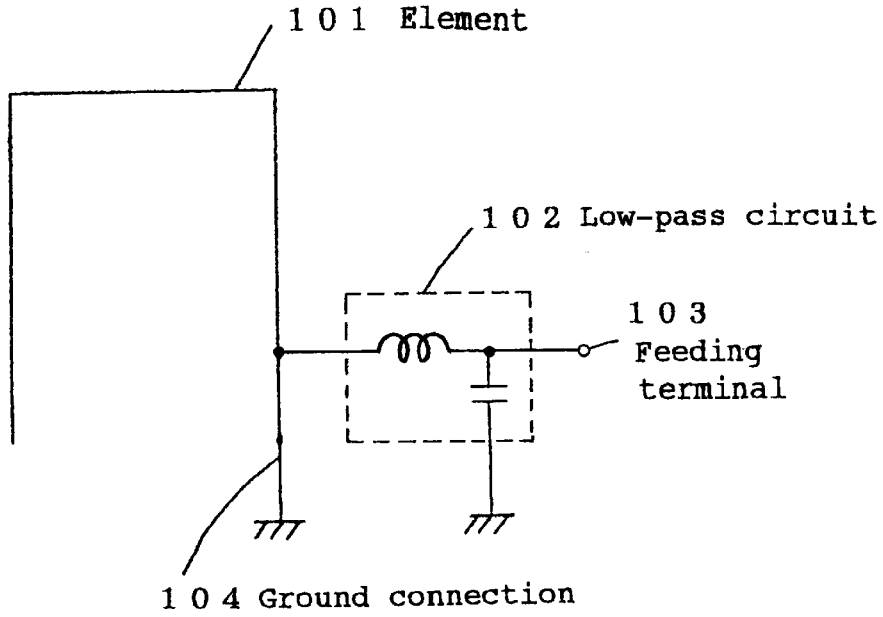
Figure 125:
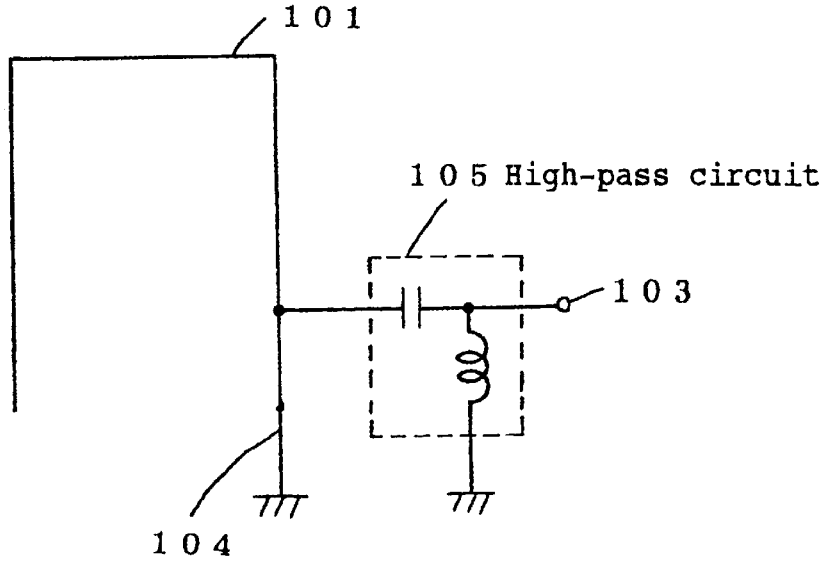

As shown in FIGS. 125(*a*) and (*b*), a low-pass circuit or a high-pass circuit may be inserted between an antenna element and a feeding terminal.

In FIG. 125(*a*), a low-pass circuit 102 is provided between an antenna element 101 and a feeding terminal 103. When the low-pass circuit 102 passes signals of lower frequencies including a tuning frequency of the antenna and blocks signals of frequencies higher than the tuning frequency of the antenna, the antenna can be protected against any interference with those signals of frequencies higher than the tuning frequency of the antenna. Therefore, any interference can be avoided if the tuning frequency of another element located in the proximity of the above-mentioned element is higher than that of the latter element. In FIG. 125(*b*), a high-pass circuit 105 is provided between an antenna element 101 and a feeding terminal 103. When the high-pass circuit 105 passes signals of higher frequencies including a tuning frequency of the antenna and blocks signals of frequencies lower than the tuning frequency of the antenna, the antenna can be protected against any interference with those signals of frequencies lower than the tuning frequency of the antenna. Therefore, any interference can be avoided if the tuning frequency of another element located in the proximity of the above-mentioned element is lower than that of the latter element.

It should be noted that the low-pass circuit or the high-pass circuit comprises a capacitor and an inductor in FIG. 125 but other configurations may be used if similar characteristics can be accomplished.

(Embodiment 6)

Figure 27:
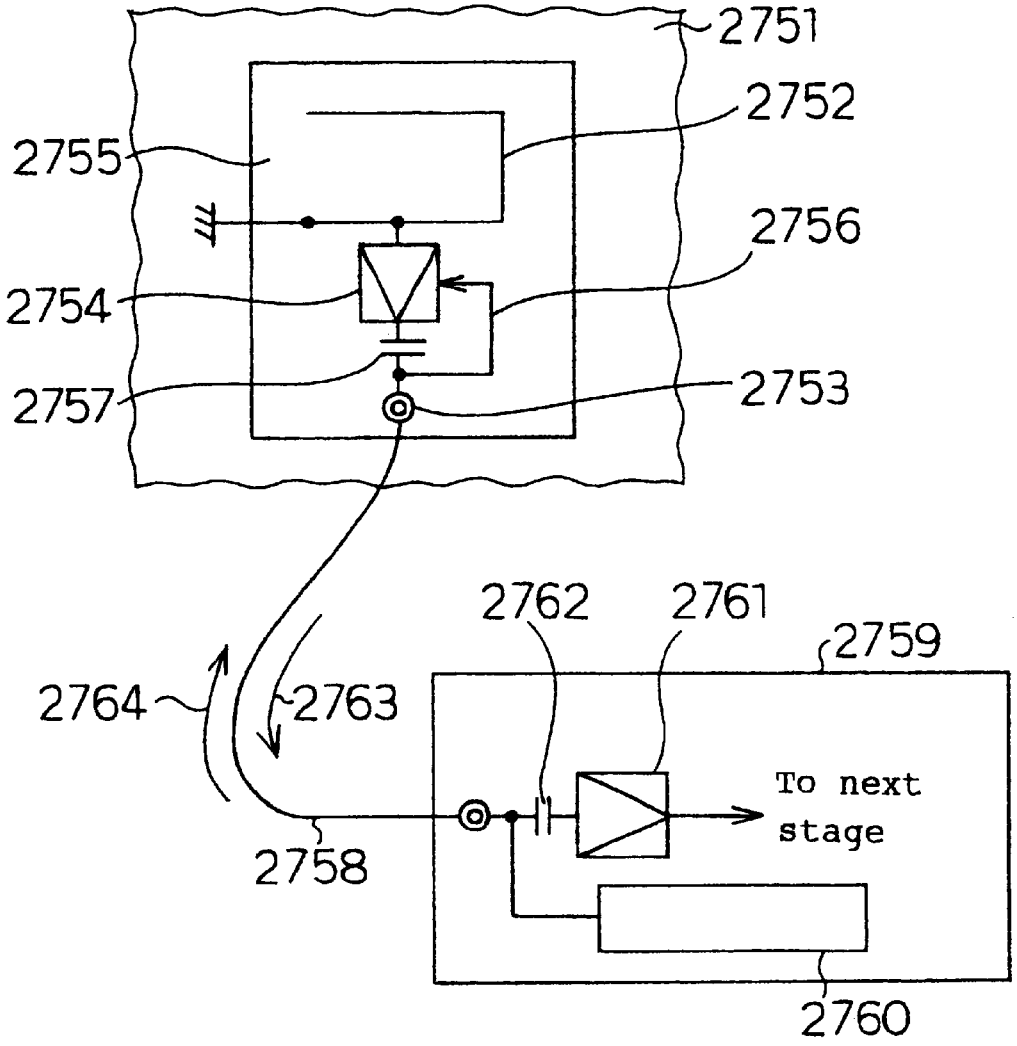
FIG. 27 is a schematic diagram showing the configuration of an example of a communication system which uses an antenna device according to a sixth embodiment of the present invention.

FIG. 27 is a schematic diagram showing the configuration of a communication system which uses an antenna device according to a sixth embodiment of the present invention. In the antenna device of FIG. 27, an antenna element 2752 is formed on a common circuit board 2755 located parallel to an antenna ground 2751 and a receiving amplifier 2754 and a direct-current blocking capacitor 2757 are provided between the antenna element 2752 and a feeding terminal 2753 on the common circuit board 2755. The feeding terminal 2753 and the power terminal of the receiving amplifier 2754 are connected through a direct-current power supply line 2756.

On the other hand, in a receiver 2759 which is a communication device, a direct-current power supply section 2760, a receiving amplifier 2761 and the like are provided to supply a direct-current power to the receiving amplifier 2754 of the antenna and a direct-current blocking capacitor 2762 is provided near the input terminal of the receiving amplifier 2761. The feeding terminal 2753 of the antenna and the receiver 2759 are connected through a coaxial cable 2758.

In this configuration, a DC signal 2764 is supplied by the direct-current power supply section 2760 of the receiver 2759 to the receiving amplifier 2754 of the antenna through the coaxial cable 2758. At this time, the direct-current blocking capacitors 2757 and 2762 prevent any DC signal from going into the output terminal of the receiving amplifier 2754 and the input terminal of the receiving amplifier 2761, respectively. A wave received by the antenna element 2752 is amplified by the receiving amplifier 2754 and its RF signal 2763 is supplied to the receiving amplifier 2761 of the receiver 2759 through the coaxial cable 2758.

From the foregoing, since the received signal is amplified by the receiving amplifier 2754 before being supplied to the receiver, the RF signal passing through the coaxial cable 2758 will have a sufficient strength and any influence of out side noise can be reduced to improve the receiving sensitivity. In addition, since the antenna has the receiving amplifier 2754, the amplifier of the receiver 2759 can be simplified.

Figure 28:
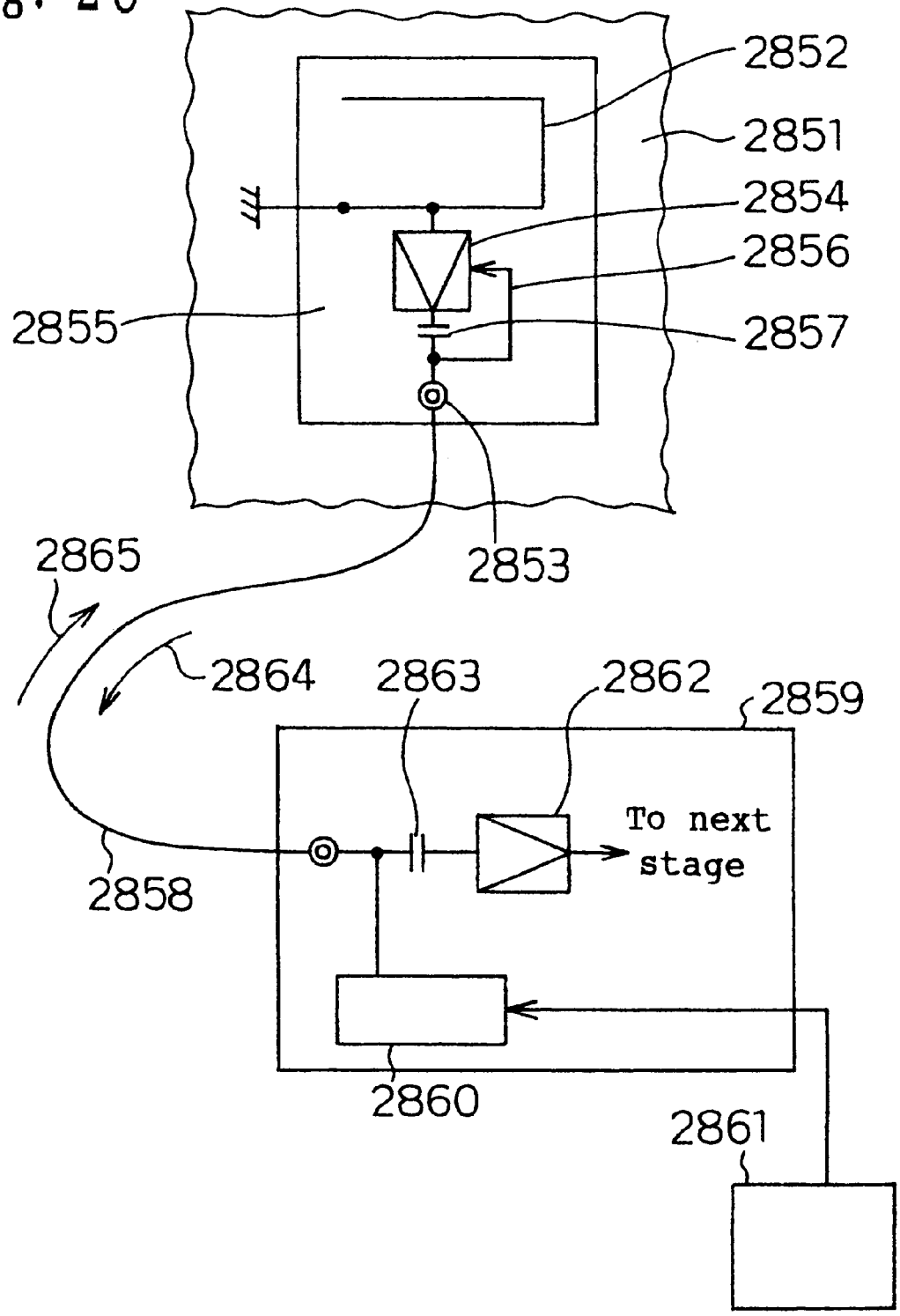
FIG. 28 is a schematic diagram showing the configuration of another example of a communication system which uses the antenna device according to the sixth embodiment.

FIG. 28 shows that in addition to the components shown in FIG. 27 described above, a receiving amplifier controller 2861 is provided to control the power supply from a direct-current power supply section 2860 to a receiving amplifier 2854 of the antenna. Other components are identical to those shown in FIG. 27. Therefore, since the power supply from the direct-current power supply section 2860 to the receiving amplifier 2854 of the antenna can be controlled by the receiving amplifier controller 2861 to continue or stop, this configuration can prevent an undesired jamming signal, if any, from being amplified and supplied to the receiver 2859.

(Embodiment 7)

Figure 29:
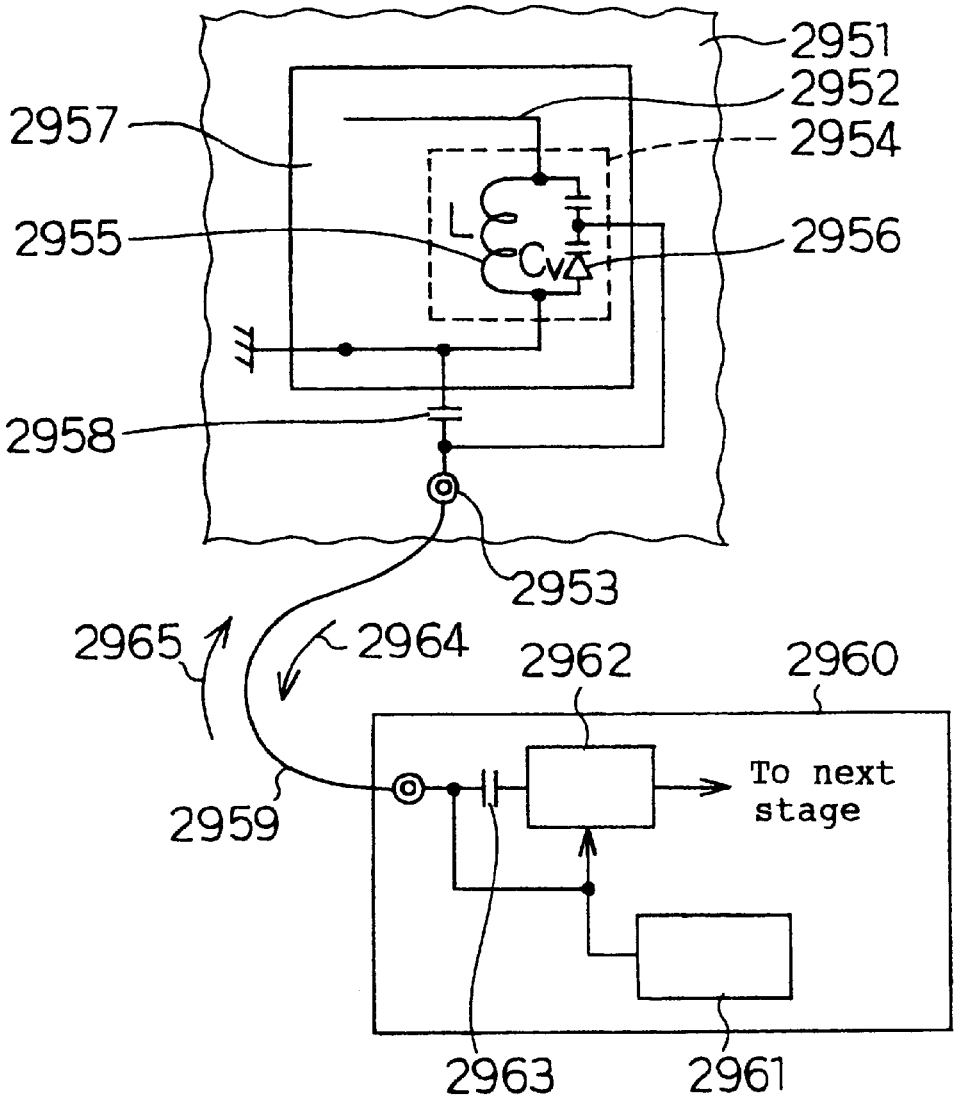
FIG. 29 is a schematic diagram showing the configuration of an example of a communication system which uses an antenna device according to a seventh embodiment of the present invention.

FIG. 29 is a schematic diagram showing the configuration of a communication system which uses an antenna device according to a seventh embodiment of the present invention. In the antenna device of FIG. 29, an antenna element 2952 is formed on a common circuit board 2957 located parallel to an antenna ground 2951 and a variable resonant circuit loading section 2954 consisting of an inductor 2955, a (voltage) variable capacitance element 2956 and the like (see FIG. 20) are inserted in the antenna element 2952. The cathode of the variable capacitance element 2956 and a feeding terminal 2953 are connected and a direct-current blocking capacitor 2958 is provided near the feeding terminal 2953.

On the other hand, in a receiver 2960 which is a communication device, a receiving channel setting circuit (tuning channel control direct-current voltage generator) 2961, a tuner 2962 and the like are provided to supply a bias voltage to the variable capacitance element 2956 of the antenna and a direct-current blocking capacitor 2963 is provided near the input terminal of the tuner 2962. The feeding terminal 2953 of the antenna and the receiver 2960 are connected through a coaxial cable 2959. It should be noted that the receiving channel setting circuit 2961 has a function to generate a voltage corresponding to a capacitance which can provide a desired tuning frequency and that, for example, it has a predetermined voltage setting for each channel to generate a voltage according to a selected channel.

In such a configuration, a variable capacitance element bias voltage 2965 determined for each channel is applied by the receiving channel setting circuit 2961 to the variable capacitance element 2956 through the coaxial cable 2959. Thus, as described above for FIG. 21, the capacitance varies and the tuning frequency of the antenna is adjusted to the frequency of the selected channel. Then a channel signal matching the tuning frequency of the antenna is supplied to the receiver 2960 through the coaxial cable 2959 as a received RF signal 2964 at the maximum gain.

(Embodiment 8)

Figure 30:
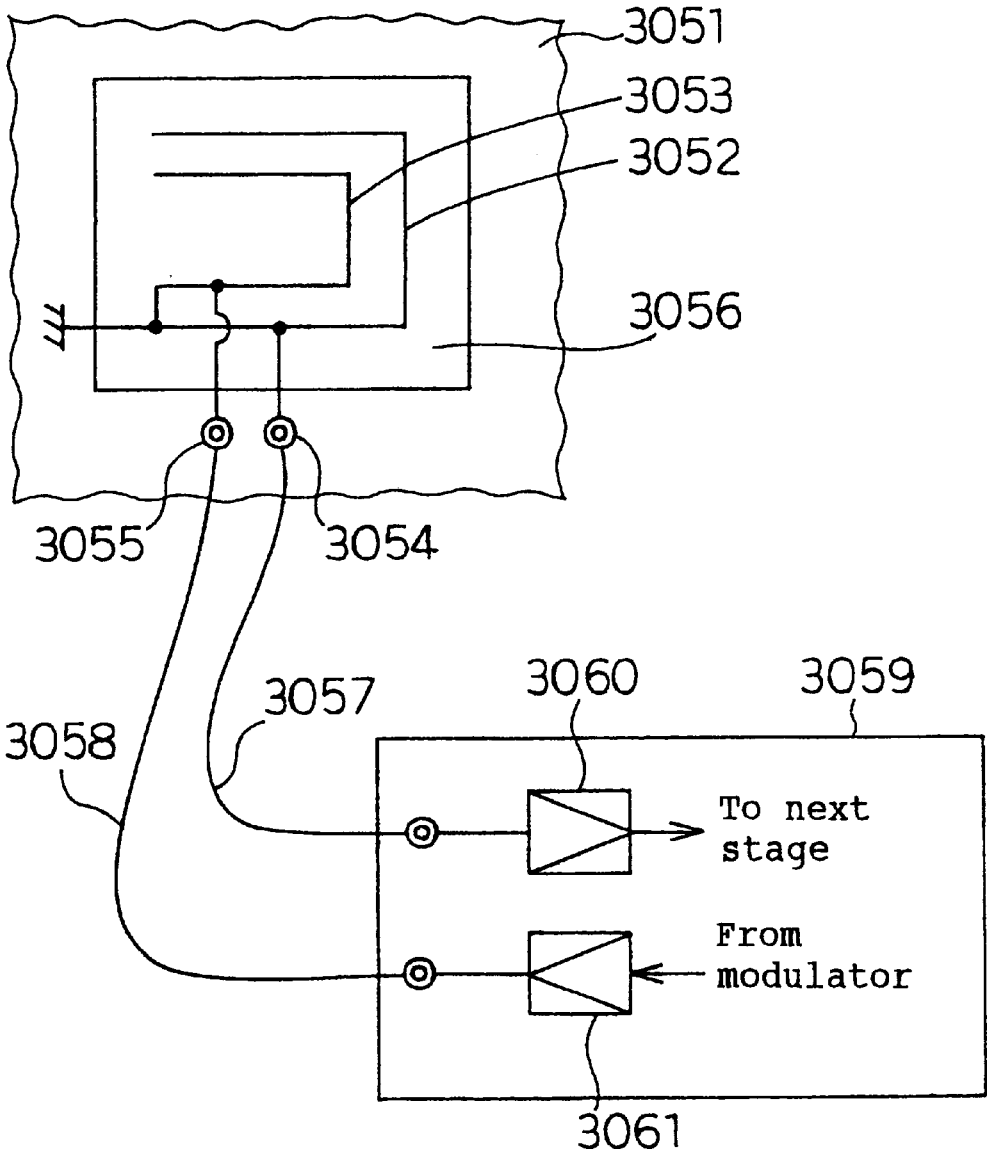
FIG. 30 is a schematic diagram showing the configuration of an example of a communication system which uses an antenna device according to an eighth embodiment of the present invention.

FIG. 30 is a schematic diagram showing the configuration of a communication system which uses an antenna device according to an eighth embodiment of the present invention. The antenna device of FIG. 30 is identical to that of FIG. 3 described above. Namely, in the antenna device, a receiving element 3052 and a transmitting element 3053 are formed on a common circuit board 3056 located parallel to an antenna ground 3051 and the receiving element 3052 and the transmitting element 3053 are provided with a receiving terminal 3054 and a transmitting terminal 3055, respectively.

On the other hand, a communication device 3059 comprises receiving amplifier 3060, a transmitting amplifier 3061 and the like and the receiving terminal 3054 of the antenna and the receiving amplifier 3060 are connected through a receiving coaxial cable 3057 as well as the transmitting terminal 3055 and the transmitting amplifier 3061 are connected through a transmitting coaxial cable 3058.

This configuration can eliminate a generally expensive and heavy common component which may cause a large passage loss and it can provide a lightweight and sensitive device at a lower cost.

Figure 31:
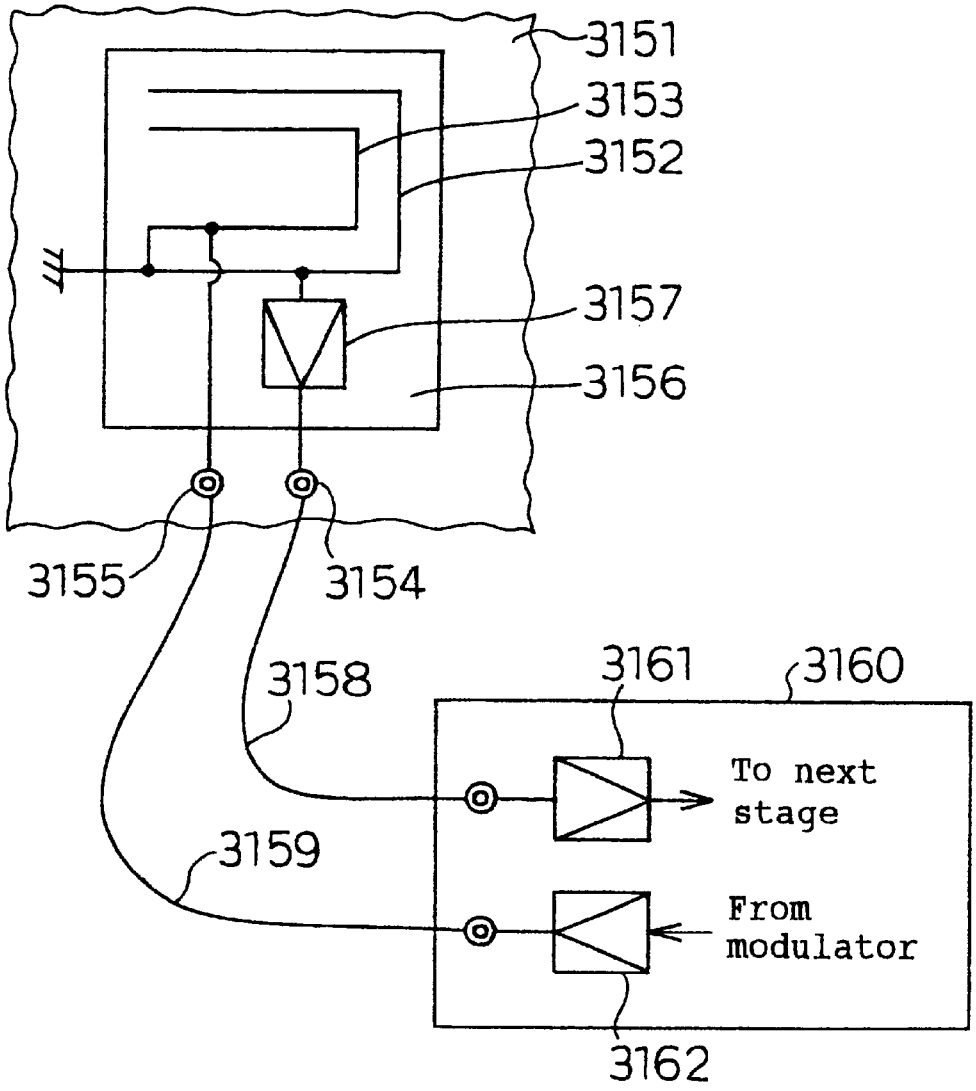
FIG. 31 is a schematic diagram showing the configuration of another example of a communication system which uses the antenna device according to the eighth embodiment.

FIG. 31 shows that in the configuration similar to that of FIG. 30 described above, a receiving amplifier is provided near a receiving terminal in an antenna device and other components are identical to those of FIG. 30. Namely, this example uses the same antenna device as shown in FIG. 13 to use no common component. In addition, the receiving sensitivity can be improved (for example, more than approximately 6 dB) and a receiving amplifier which would be otherwise provided at the initial stage of a communication device can be eliminated.

Figure 32:
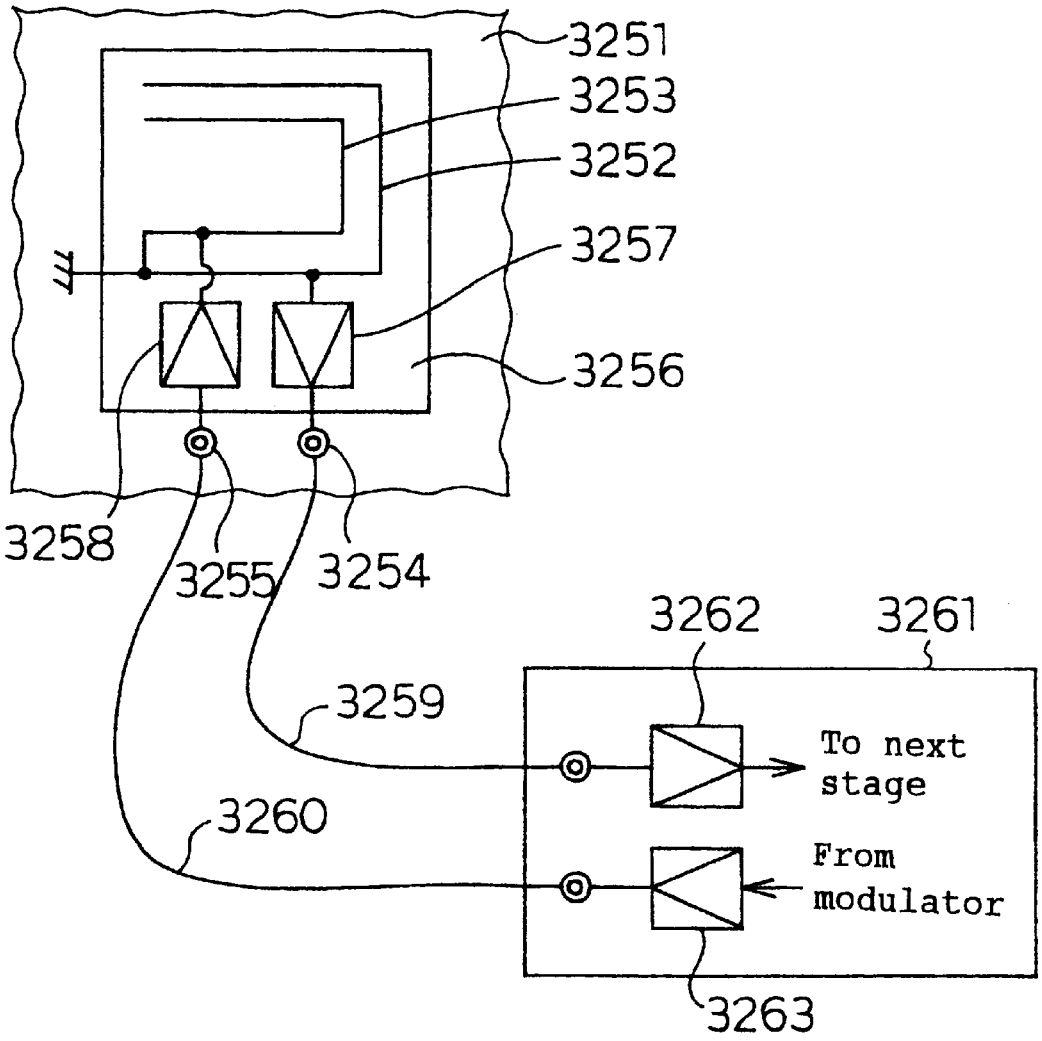
FIG. 32 is a schematic diagram showing the configuration of still another example of a communication system which uses the antenna device according to the eighth embodiment.

FIG. 32 shows that in the configuration of FIG. 31 described above, a transmitting amplifier is provided near a transmitting terminal in an antenna device and other components are identical to those of FIG. 31. Namely, this example uses the same antenna device as shown in FIG. 14 to use no common component. In addition, the receiving sensitivity can be improved (for example, more than approximately 6 dB) and a receiving amplifier which would be otherwise provided at the initial stage of a communication device can be eliminated. Moreover, a reduced transmission loss can be achieved and a transmitting amplifier in the communication device can be also eliminated.

(Embodiment 9)

Figure 33:
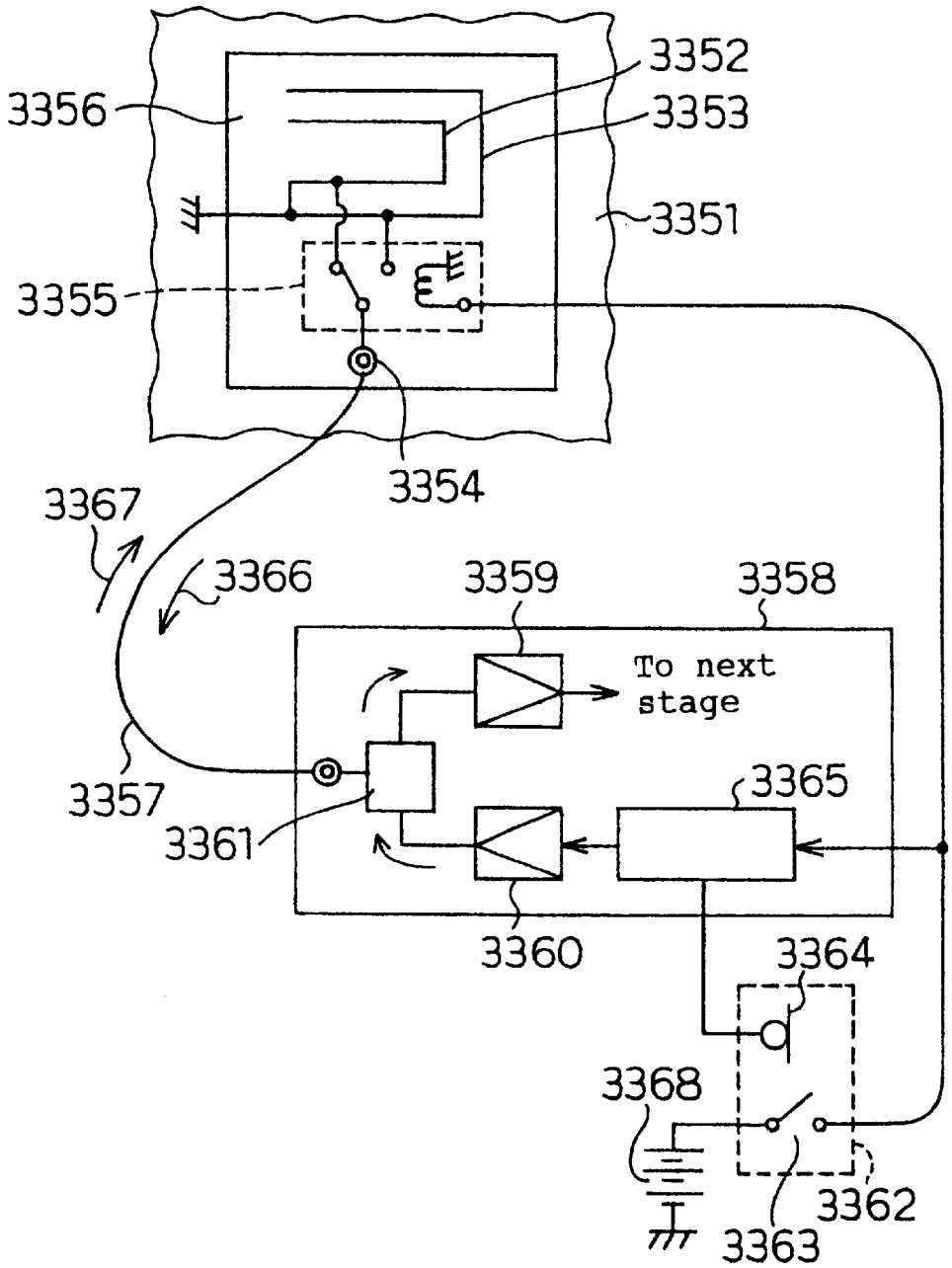
FIG. 33 is a schematic diagram showing the configuration of an example of a communication system which uses an antenna device according to a ninth embodiment of the present invention.

FIG. 33 is a schematic diagram showing the configuration of a communication system which uses an antenna device according to a ninth embodiment of the present invention. The antenna device of FIG. 33 is basically identical to that of FIG. 3 described above but a transmitting/receiving element changeover relay switch 3355 is additionally provided. Namely, in the antenna device, a receiving element 3352 and a transmitting element 3353 are formed on a common circuit board 3356 located parallel to an antenna g round 3351 and the receiving terminal of the receiving element 3352 and the transmitting terminal of the transmitting element 3353 are connected to a feeding terminal 3354 through the transmitting/receiving element changeover relay switch 3355.

On the other hand, a communication device 3358 comprises a voice modulator 3365, a common component 3361, a receiving amplifier 3359, a transmitting amplifier 3061 [sic] and the like, and it has also a handset 3362 used for transmission. The handset 3362 comprises a microphone 3364 and a press-to-talk switch 3363, which is connected to the voice modulator 3365 and a drive coil of the transmitting/receiving element changeover relay switch 3355 in the antenna and which is pressed to connect to a direct-current power supply 3368. The feeding terminal 3354 of the antenna and an input/output terminal of the communication device 3358 (a common terminal of the common component 3361) are connected through a coaxial cable 3357.

In this configuration, the transmitting/receiving element changeover relay switch 3355 is connected to the receiving element 3352 during a receiving operation and it becomes the transmitting element 3353 during a transmitting operation, that is, when the press-to-talk switch 3363 is pressed to energize the coil of the transmitting/receiving element changeover relay switch 3355. Since both a received RF signal 3366 and a transmission RF signal 3367 pass through the coaxial cable 3357, the antenna and the communication device can be connected through such a single coaxial cable. It should be noted that the common component 3361 of the communication device 3358 may be implemented by a switch similar to the transmitting/receiving element changeover relay switch 3355 for interlocking. It should be also noted that a general signal input device (such as a digital signal input device) and a modulator (such as a digital modulator) may be substituted for the microphone 3364 and the voice modulator 3365.

(Embodiment 10)

Figure 34:
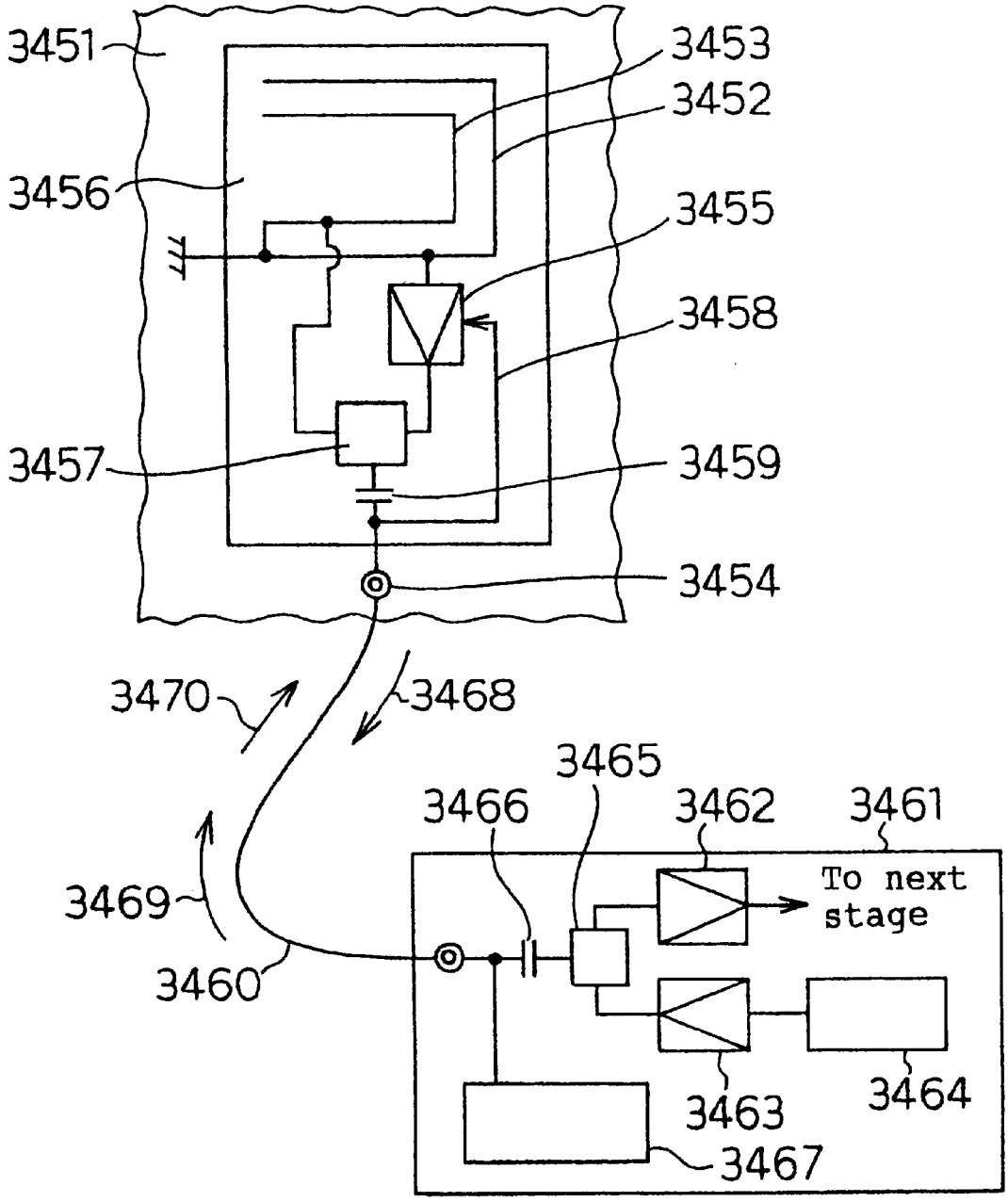
FIG. 34 is a schematic diagram showing the configuration of an example of a communication system which uses an antenna device according to the tenth embodiment of the present invention.

FIG. 34 is a schematic diagram showing the configuration of a communication system which uses an antenna device according to a tenth embodiment of the present invention. The antenna device of FIG. 34 is basically identical to that of FIG. 17 described above. Namely, in the antenna device, a receiving element 3452 and a transmitting element 3453 are formed on a common circuit board 3456 located parallel to an antenna ground 3451 and the transmitting terminal of the transmitting element 3453 is connected to a common component 3457 provided on the common circuit board 3456. Similarly, the receiving element 3452 is connected to the common component 3457 through a receiving amplifier 3455 provided on the common circuit board 3456. In addition, the common terminal of the common component 3457 is connected to a feeding terminal 3454 through a direct-current blocking capacitor 3459. The power terminal of the receiving amplifier 3455 is connected to the feeding terminal 3454 through a direct-current power supply line 3458.

On the other hand, a communication device 3461 comprises a common component 3465, a receiving amplifier 3462 and a transmitting amplifier 3463 connected to the common component 3465, a modulator 3464 connected to the transmitting amplifier 3463, a receiving amplifier direct-current power supply section 3467 and the like, and a direct-current blocking capacitor 3466 is provided between the common terminal of the common component 3465 and the input/output terminal of the communication device 3461. The feeding terminal 3454 of the antenna and the communication device 3461 are connected through a coaxial cable 3460.

In this configuration, receiving amplifier direct-current power 3470 of the receiving amplifier 3455 of the antenna is supplied from the receiving amplifier direct-current power supply section 3467 through the coaxial cable 3460. A received RF signal 3468 amplified by the receiving amplifier 3455 is supplied to the communication device 3461 through the coaxial cable 3460 and then to the receiving amplifier 3462 of the communication device 3461 through the common component 3465. A transmission RF signal 3469 from the transmitting amplifier 3463 of the communication device 3461 is supplied to the feeding terminal 3454 of the antenna through the common component 3465 and then emitted by the transmitting element 3453 through the common component 3457.

Figure 35:
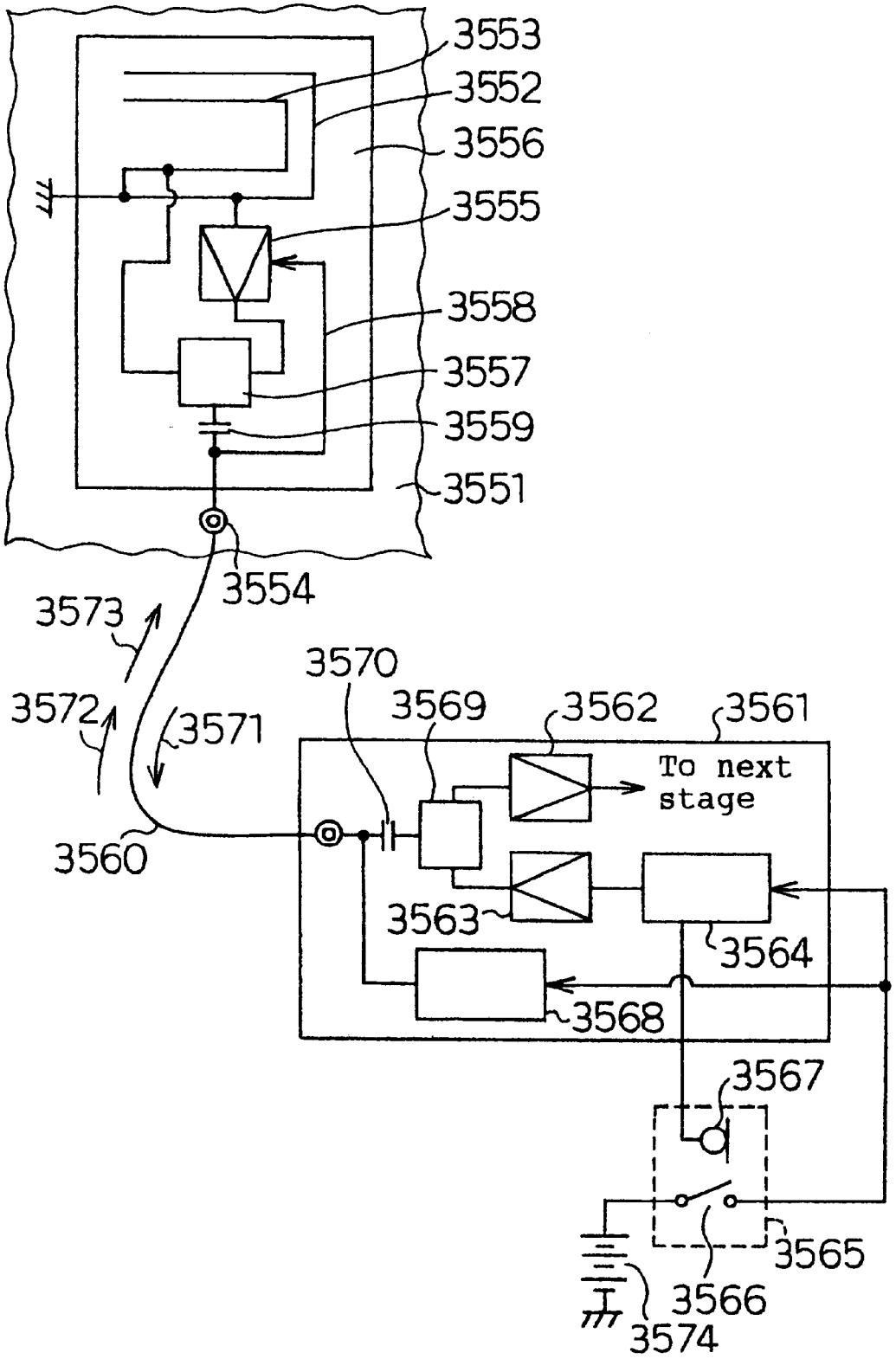
FIG. 35 is a schematic diagram showing the configuration of another example of a communication system which uses the antenna device according to a tenth embodiment.

FIG. 35 shows that a handset 3565 used for transmission is added to the configuration of FIG. 34 described above and the handset 3565 comprises a microphone 3567 and a press-to-talk switch 3566, which is connected to a voice modulator 3564 and a receiving amplifier direct-current power supply section 3568 and which is pressed to connect to a direct-current power supply 3574.

In this configuration, during a receiving operation, receiving amplifier direct-current power 3573 is supplied from the receiving amplifier direct-current power supply section 3568 to a receiving amplifier 3555 of the antenna to operate the receiving amplifier 3555. During a transmitting operation, when the press-to-talk switch 3566 is pressed, the power supply from the receiving amplifier direct-current power supply section 3568 is stopped or decreased to a lower level to stop the operation of the receiving amplifier 3555 of the antenna or to reduce the degree of amplification. This can prevent the power from being supplied when unnecessary and the like.

It should be noted that, according to the present embodiment, the area of the antenna ground facing the antenna elements is shown to be smaller than the external area of the antenna elements but it is preferable that the area of the antenna ground is almost equal to the external area of the antenna elements.

It should be also noted that, according to the present embodiment, how or where the antenna device is to be installed is not described above. However, the antenna device may be installed with the antenna ground located in the proximity of and facing the body ground of any of various stationary devices, mobile devices, automotive vehicles or the like as long as appropriate insulation can be kept. For example, stationary devices include a house or a building, a fixed communication device and the like, mobile devices include a portable communication device, a portable telephone set and the like, and automotive vehicles include an automobile, a train, an airplane, a ship and the like.

It should be further noted that the shape and number of elements in the antenna device described above according to the present embodiment are shown for exemplary purpose only and they are not limited to those shown in the figures.

Now, how and where the antenna devices described above are to be installed or the shape, number of antennas and the like applicable to the antenna devices according to the present invention will be specifically described below with reference to the drawings.

Figure 36:
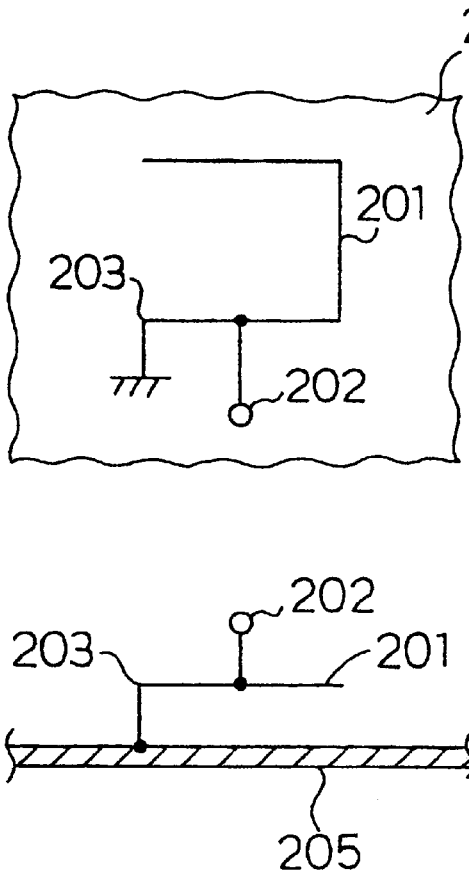
FIG. 36 is a schematic diagram showing an example of an antenna device according to the present invention.
Figure 36:
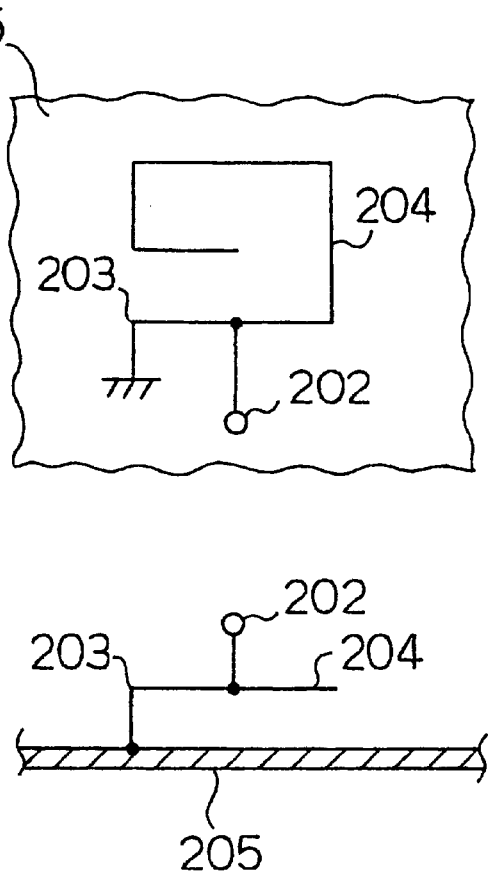

FIG. 36(*a*) shows an antenna device which comprises an antenna element 201 configured by a linear conductor with two bends and located in the proximity to a conductive earth substrate 205 with the antenna plane parallel to the substrate, a feeding terminal 202 provided in place on the antenna element 201, and an end 203 connected to the conductive earth substrate 205 for grounding. FIG. 36(*b*) shows another antenna device which comprises an antenna element 204 configured by a linear conductor with four bends and located in the proximity to a conductive earth substrate 205 with the antenna plane parallel to the substrate, a feeding terminal 202 provided in place on the antenna element 204, and an end 203 connected to th conductive earth substrate 5 for grounding. In this way, the antenna devices can reduce the installation area as well as improve their directional gain performance because the antenna devices are located in the proximity to the conductive earth substrates 205 with their antenna planes parallel to the conductive earth substrates 205. It should be noted that the number of bends in an antenna element is not limited to that described with respect to the above example. This may also apply to succeeding embodiments described below.

Figure 113:
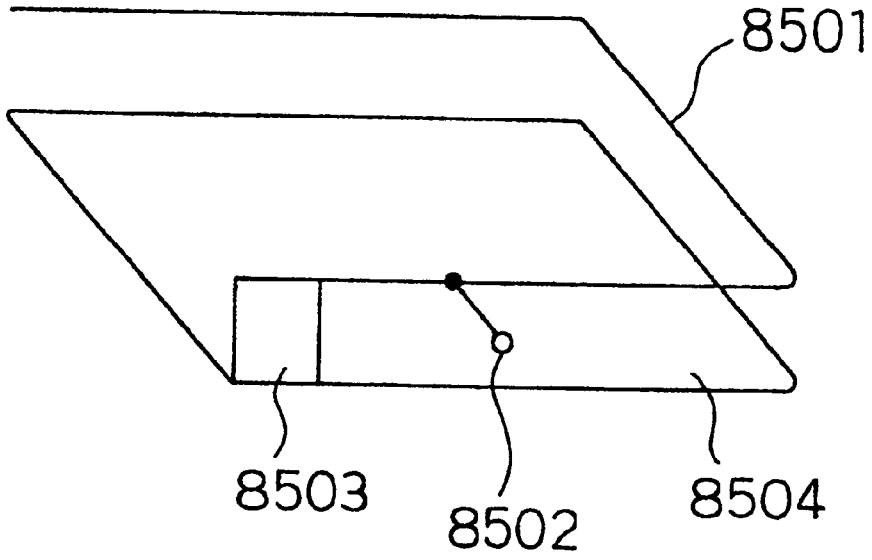
FIG. 113 is a perspective view showing a specific configuration of an antenna device according to the present invention.

A specific configuration of the antenna device of FIG. 36(*a*) is shown in FIG. 113. In FIG. 113, an antenna element 8501 configured by a linear conductor with two bends is located at a distance from a conductive earth substrate 8504 with the antenna plane almost parallel to the substrate and an end of the antenna element 8501 is connected to an end of a conductive plate 8503 provided almost perpendicular to the conductive earth substrate 8504 for antenna grounding. It should be noted that, in this case, the area formed by the antenna element 8501 is almost equal to that of the conductive earth substrate 8504. It should be also noted that a feeding section 8502 is provided in the way of the antenna element 8501.

The conductive plate 8503 has a width sufficiently larger than that of the antenna element 8501, that is, a width which may not be practically affected by any reactance determined from the tuning frequency of the antenna element 8501. This allows the conductive plate to serve as a ground. A smaller width may cause the conductive plate to couple to the antenna element 8501 and thus to form a single antenna element as a whole together with the antenna element 8501, which will deviate from the scope of the present invention. The antenna element 8501 is, for example, 220 mm long and 2 mm wide for a wavelength of 940 mm and this may make the antenna device more compact. It should be noted that the antenna plane and the conductive earth substrate plane may be tilted to the extent that there exists an effective potential difference between the antenna element and the substrate. It should be also noted that if the area of the conductive earth substrate is larger than that of the antenna plane (for example, by quadruple), the gain may remain unchanged for a vertically polarized wave but decrease for a horizontally polarized wave.

The antenna described above differs from conventional antennas in that, for example, a smaller distance between the antenna element and the ground plate may degrade the performance of a conventional inverted F-shaped antenna, while such a smaller distance may improve the performance of the antenna device according to the present invention.

Figure 114:
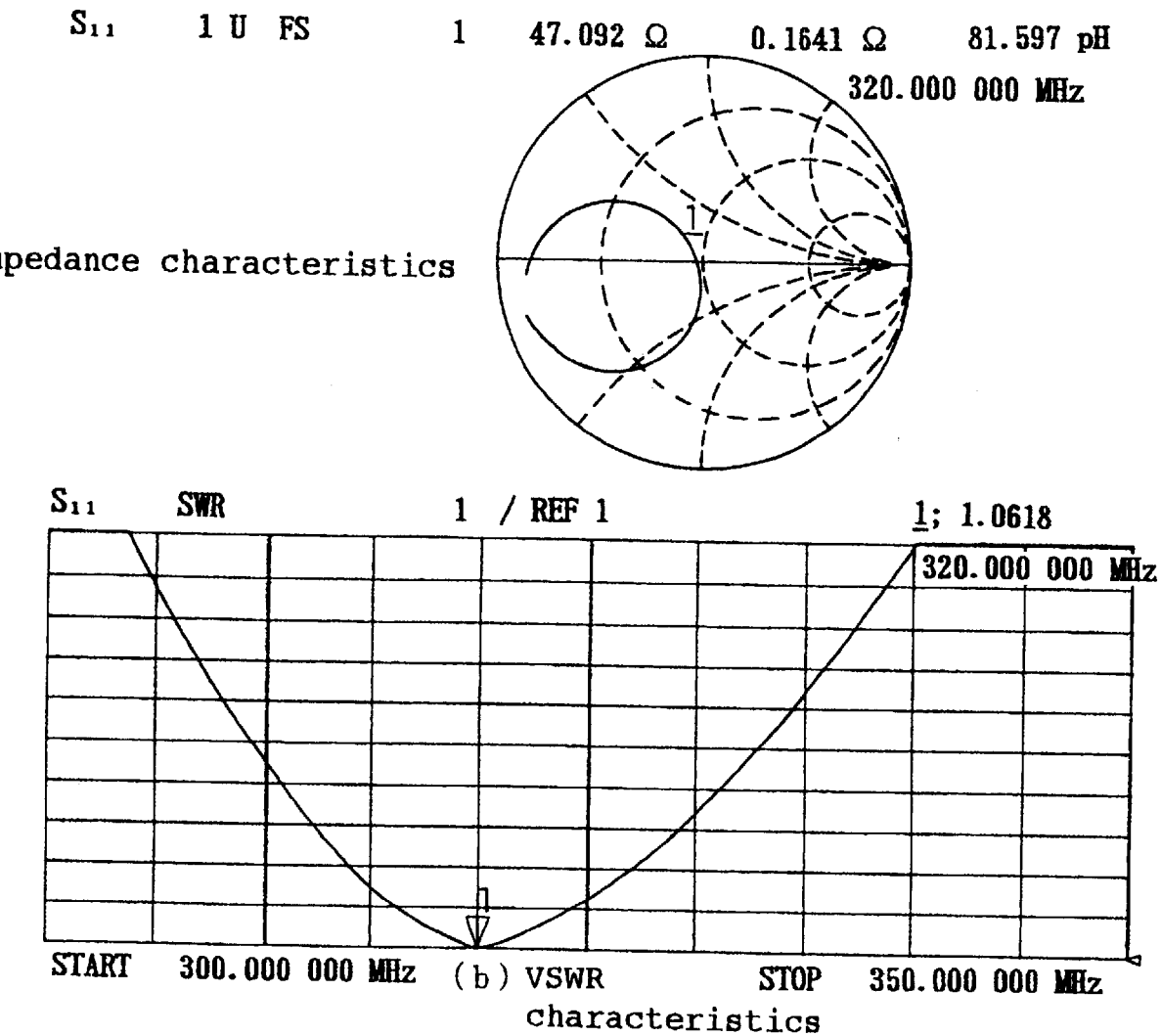
FIG. 114 shows the impedance and VSWR characteristics of the antenna shown in FIG. 113.
Figure 115:
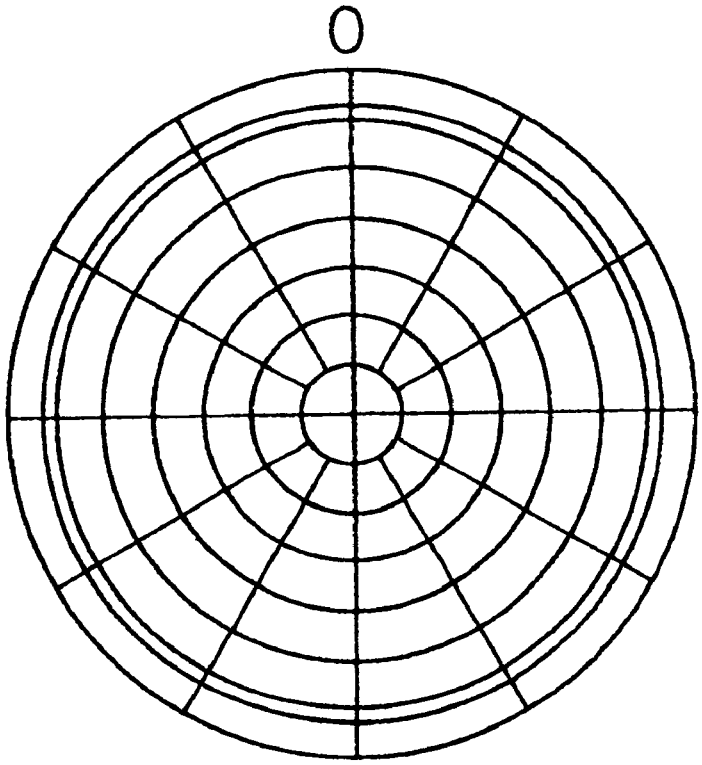
FIG. 115 shows the directional gain characteristics of the antenna shown in FIG. 113.
Figure 116:
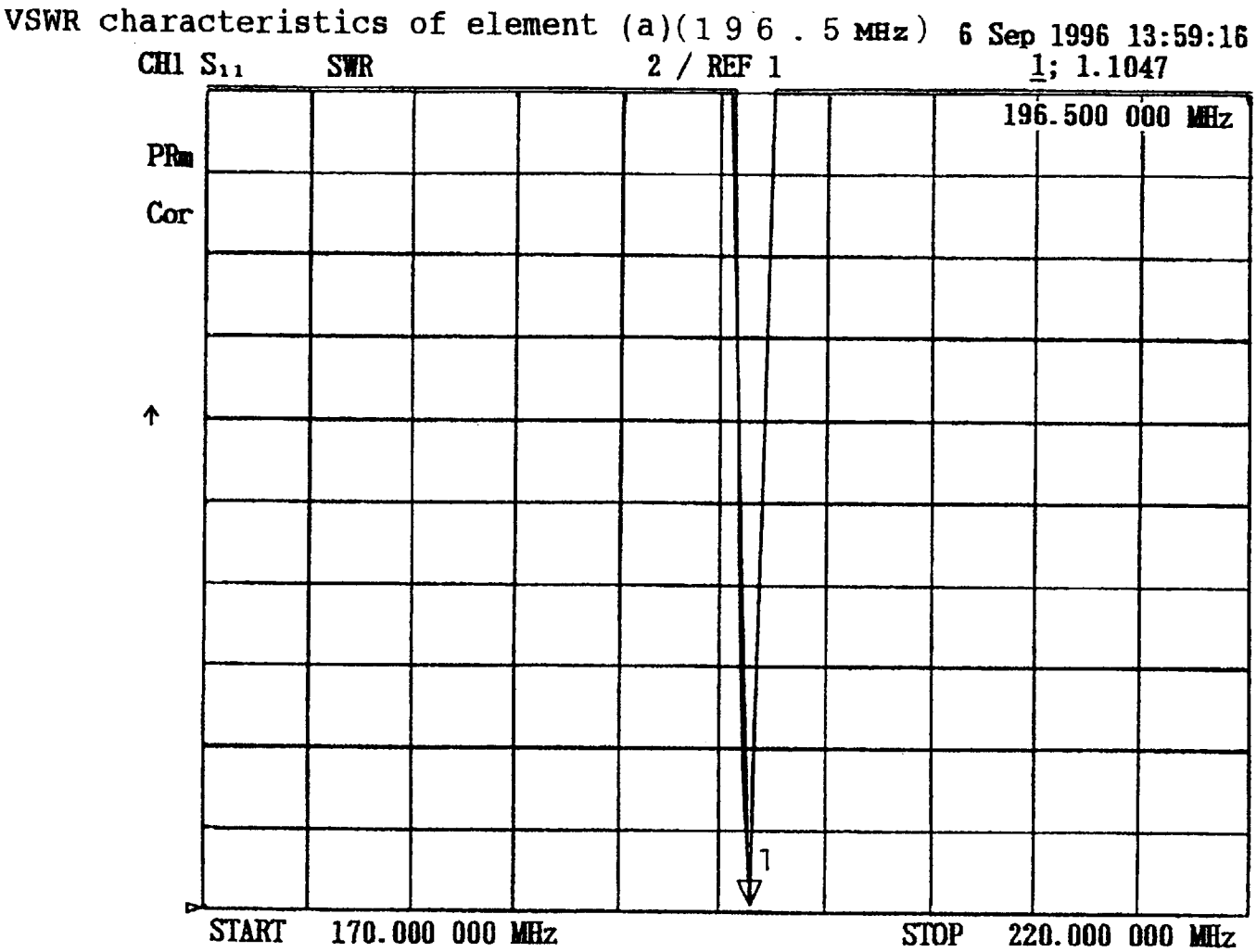
FIG. 116 shows the VSWR characteristics of an element for explaining band synthesis in a 4-element antenna.
Figure 117:
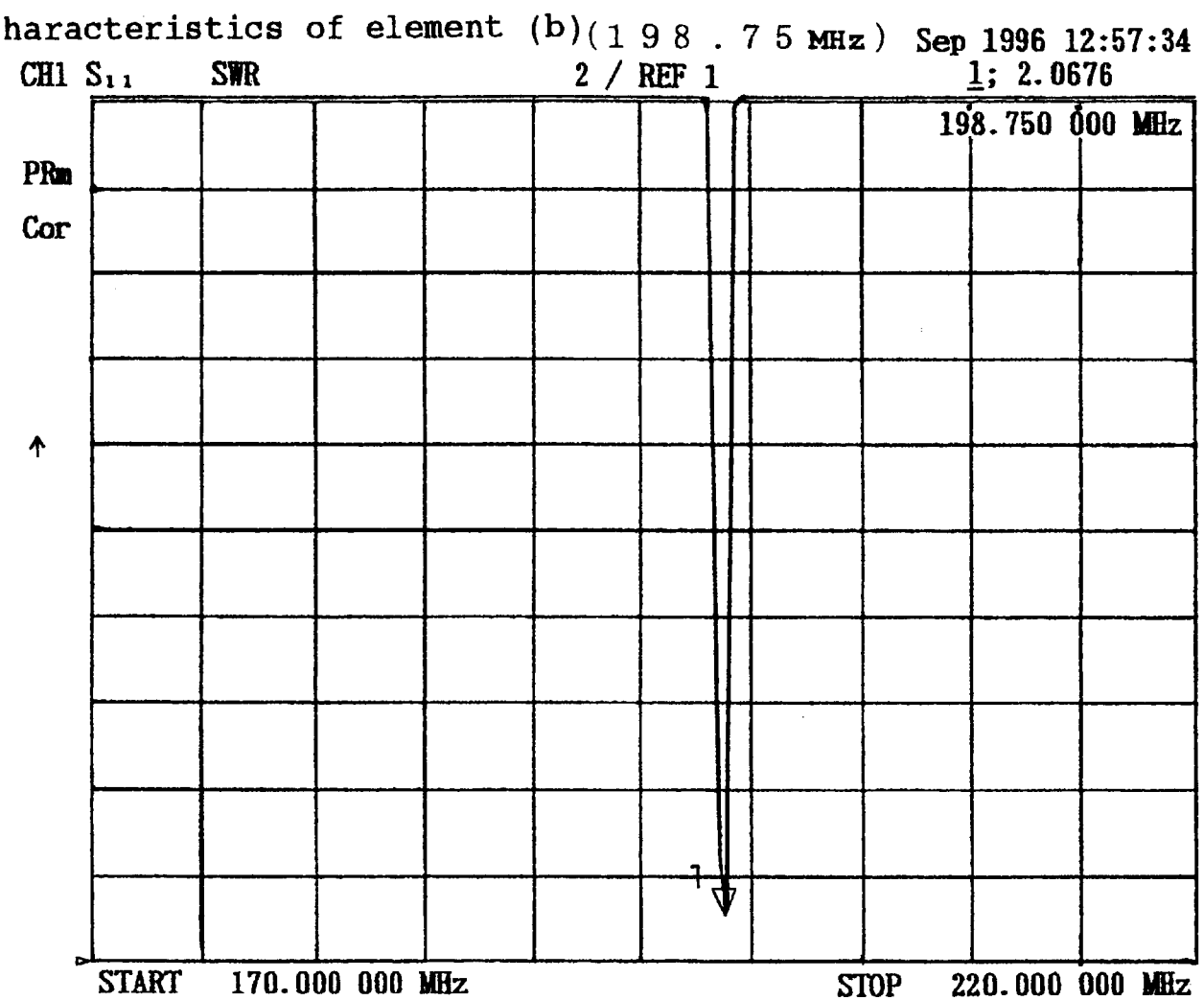
FIG. 117 shows the VSWR characteristics of another element for explaining band synthesis in the 4-element antenna.
Figure 118:
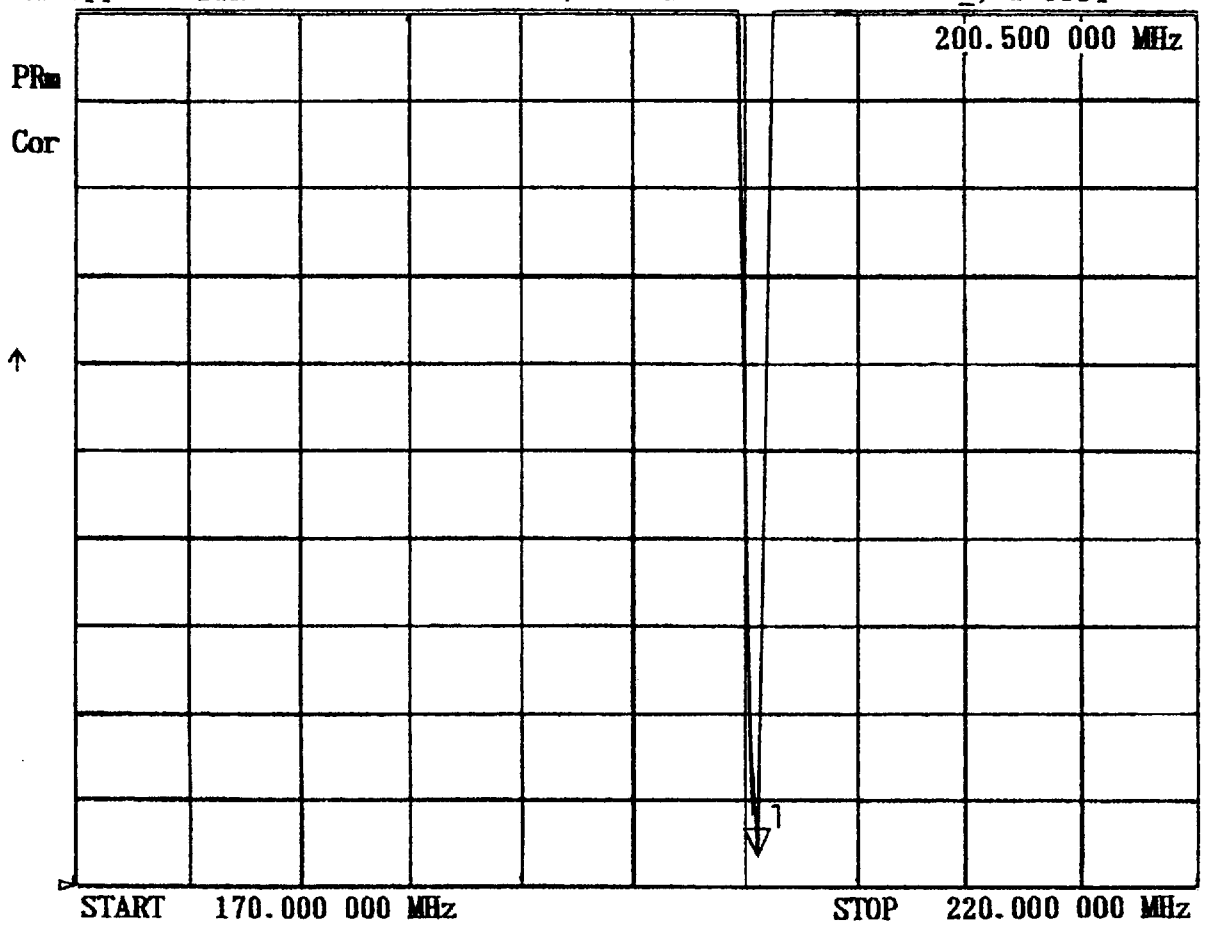
FIG. 118 shows the VSWR characteristics of another element for explaining band synthesis in the 4-element antenna.
Figure 119:
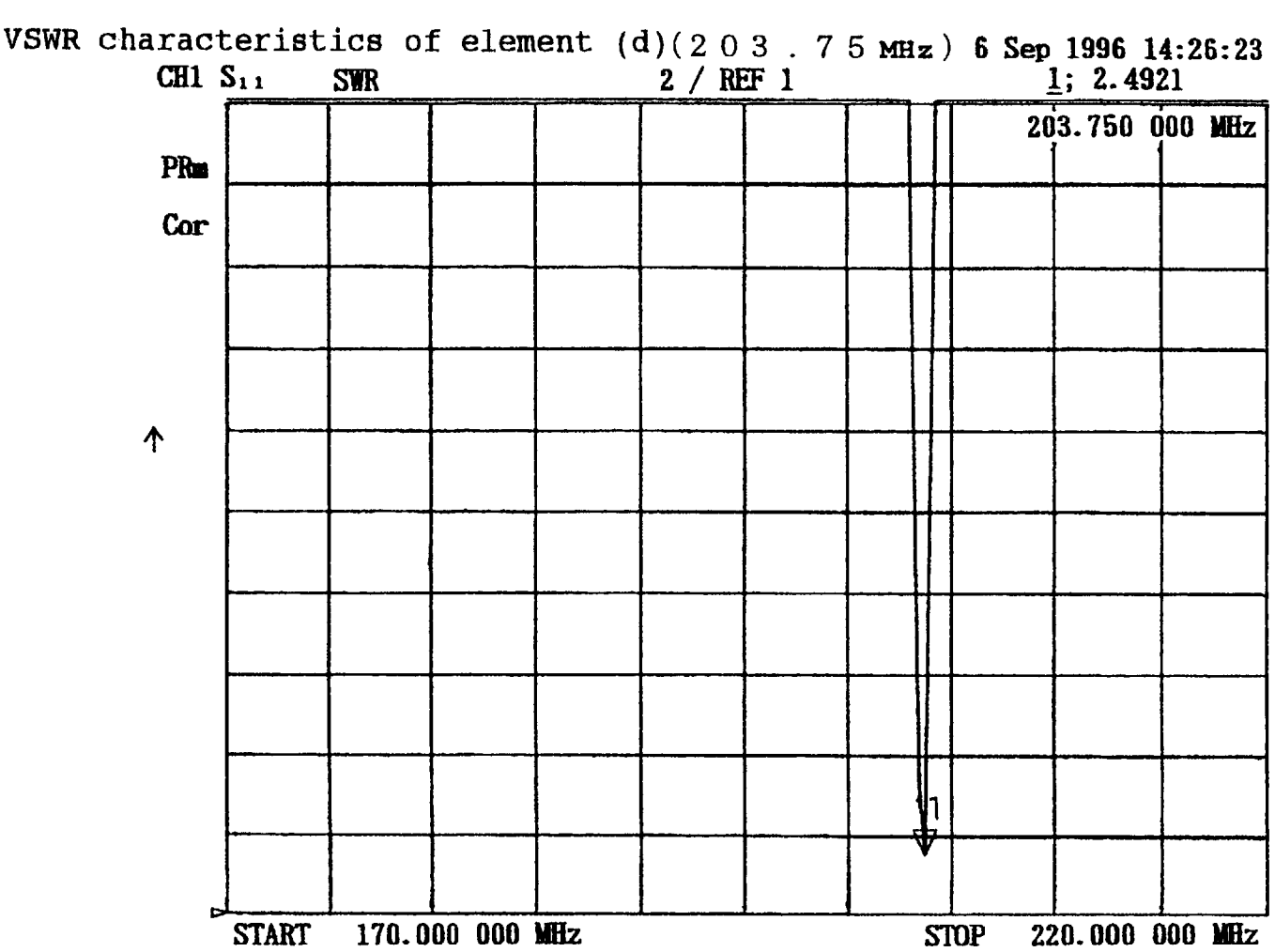
FIG. 119 shows the VSWR characteristics of another element for explaining band synthesis in the 4-element antenna.

The impedance and VSWR characteristics of the antenna of FIG. 113 are shown in FIG. 114. Its directional gain characteristics are shown in FIG. 115. As shown in FIG. 115, the antenna of FIG. 113 has a generally circular directivity with respect to a vertically polarized wave.

Needless to say, the shape and number of antenna elements are not limited to those described with respect to the above example.

It should be more preferable that the distance between the conductive earth substrate and the antenna element is a fortieth of the wavelength or more.

Figure 37:
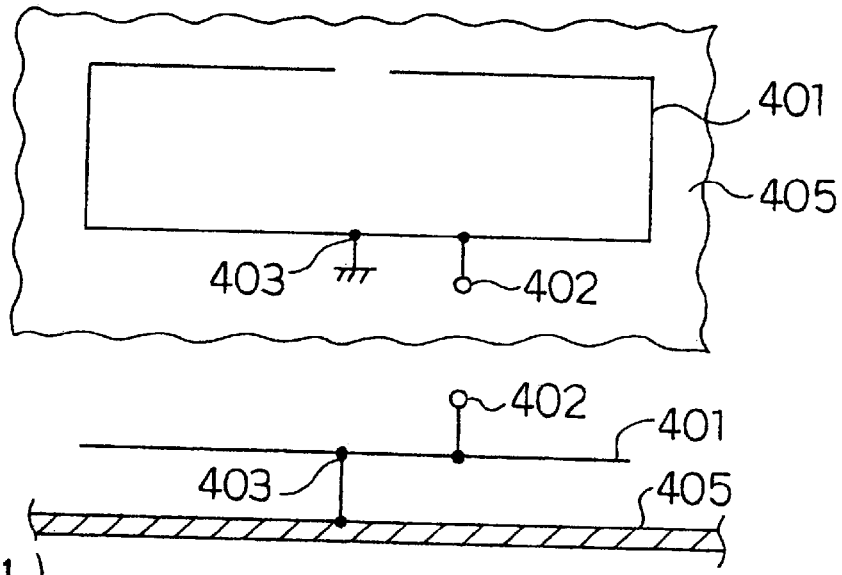
FIG. 37 is a schematic diagram showing an example of an antenna device according to the present invention.
Figure 37:
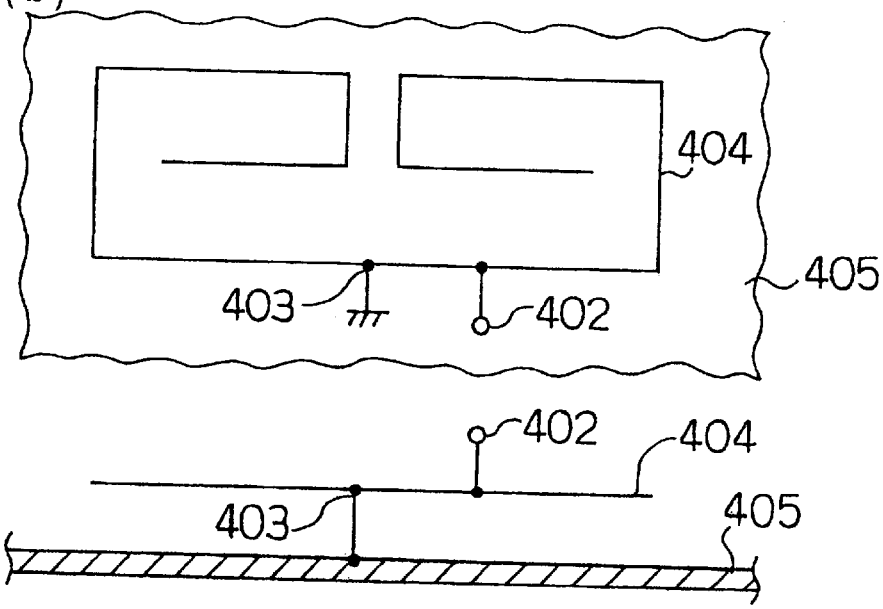

FIG. 37(*a*) shows an antenna device which comprises an antenna element 401 configured to be a dipole antenna configured by a linear conductor with four bends and located in the proximity to a conductive earth substrate 405 with the antenna plane parallel to the substrate, a feeding terminal 402 provided in place on the antenna element 401, and a point 403 connected to the conductive earth substrate 405 for grounding. FIG. 37(*b*) shows another antenna device which comprises an antenna element 404 configured by being be a dipole antenna configured by a linear conductor with eight bends and located in the proximity to a conductive earth substrate 405 with the antenna plane parallel to the substrate, a feeding terminal 402 provided in place on the antenna element 401, and a point 403 connected to the conductive earth substrate 405 for grounding. In this way, the antenna devices according to the present embodiment can reduce the installation area as well as further improve their directional gain performance when the antenna devices are located in the proximity to the conductive earth substrates with their antenna planes parallel to the conductive earth substrates 405, respectively.

Figure 38:
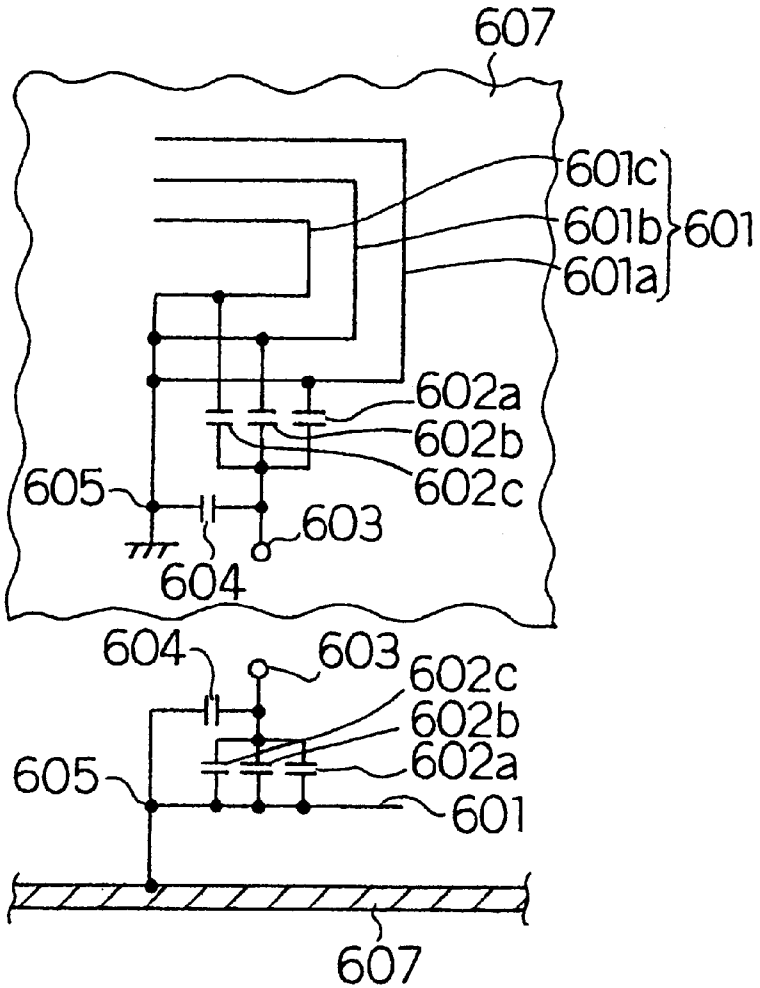
FIG. 38 is a schematic diagram showing an example of an antenna device according to the present invention.
Figure 38:
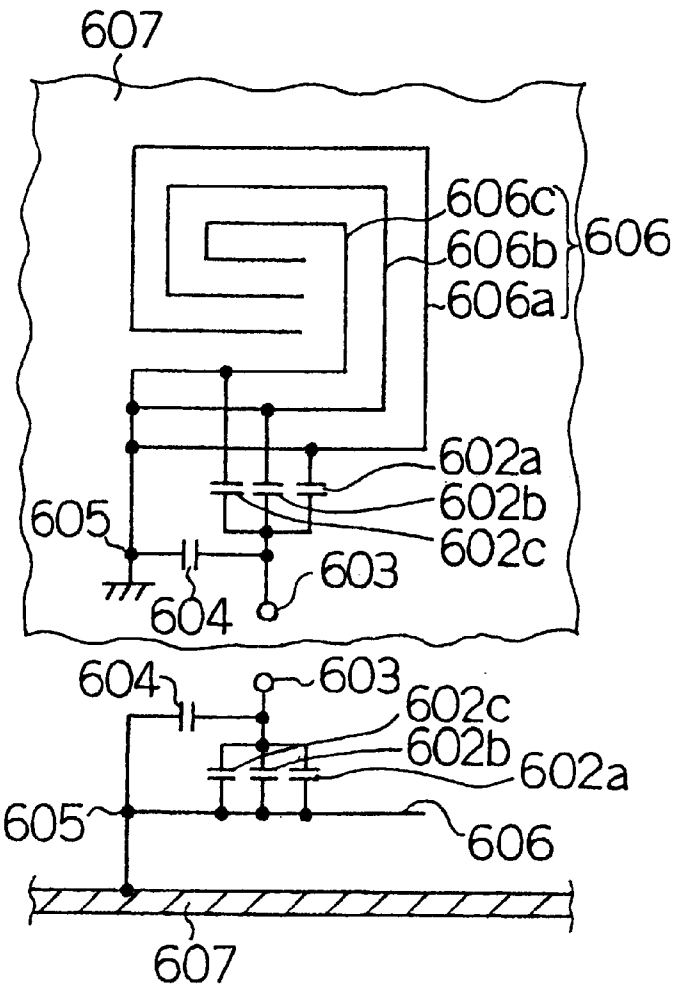

FIG. 38(*a*) shows an antenna device which comprises three monopole antenna elements 601*a,* 601*b,* and 601*c* having two bends and different lengths and being located on the same plane in the proximity to a conductive earth substrate 607, and reactance elements 602*a,* 602*b,* 602*c,* and 604 connected between the taps of the antenna elements 601*a,* 601*b,* and 601*c* and a feeding terminal 603 and between the feeding terminal 603 and a ground terminal 605, respectively, to adjust their impedance. FIG. 38(*b*) shows another antenna device which substitutes antenna elements 606*a,* 606*b,* and 606*c* having four bends for the antenna elements 601*a,* 601*b,* and 601*c* of the antenna device of FIG. 38(*a*) described above.

Figure 68:
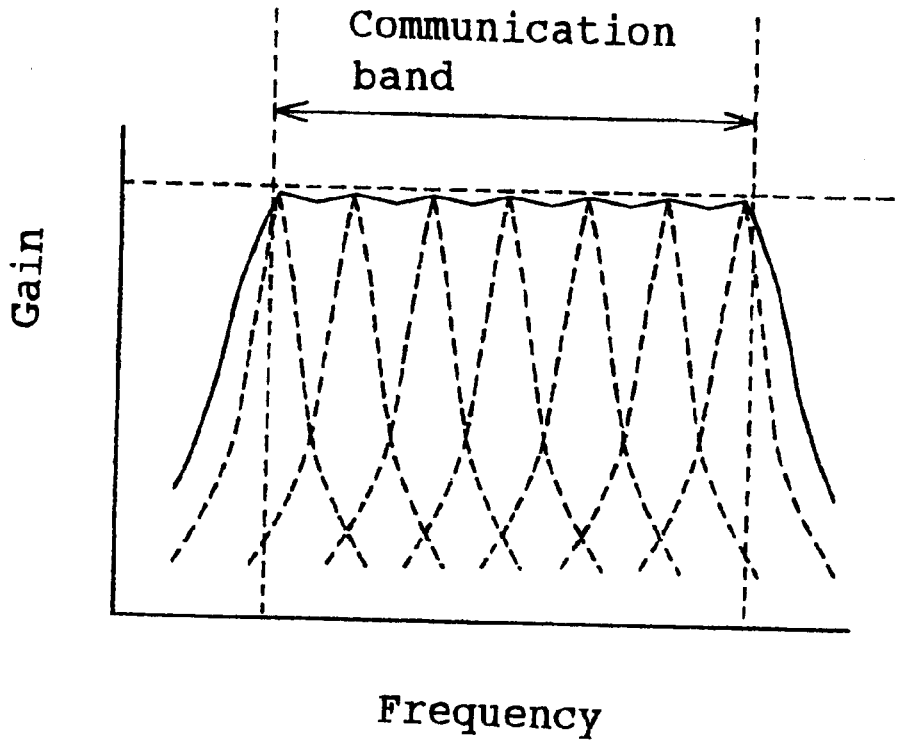
FIG. 68 shows an example of band synthesis according to the present invention.

With the configurations described above, an antenna device having a desirable bandwidth can be implemented by setting the tuning frequencies of the antenna elements at regular intervals. FIG. 68 shows an example of band synthesis performed by an antenna having seven antenna elements and it may be seen from the figure that a broadband frequency characteristic can be achieved through such band synthesis even when each antenna element has only a small bandwidth.

Figure 120:
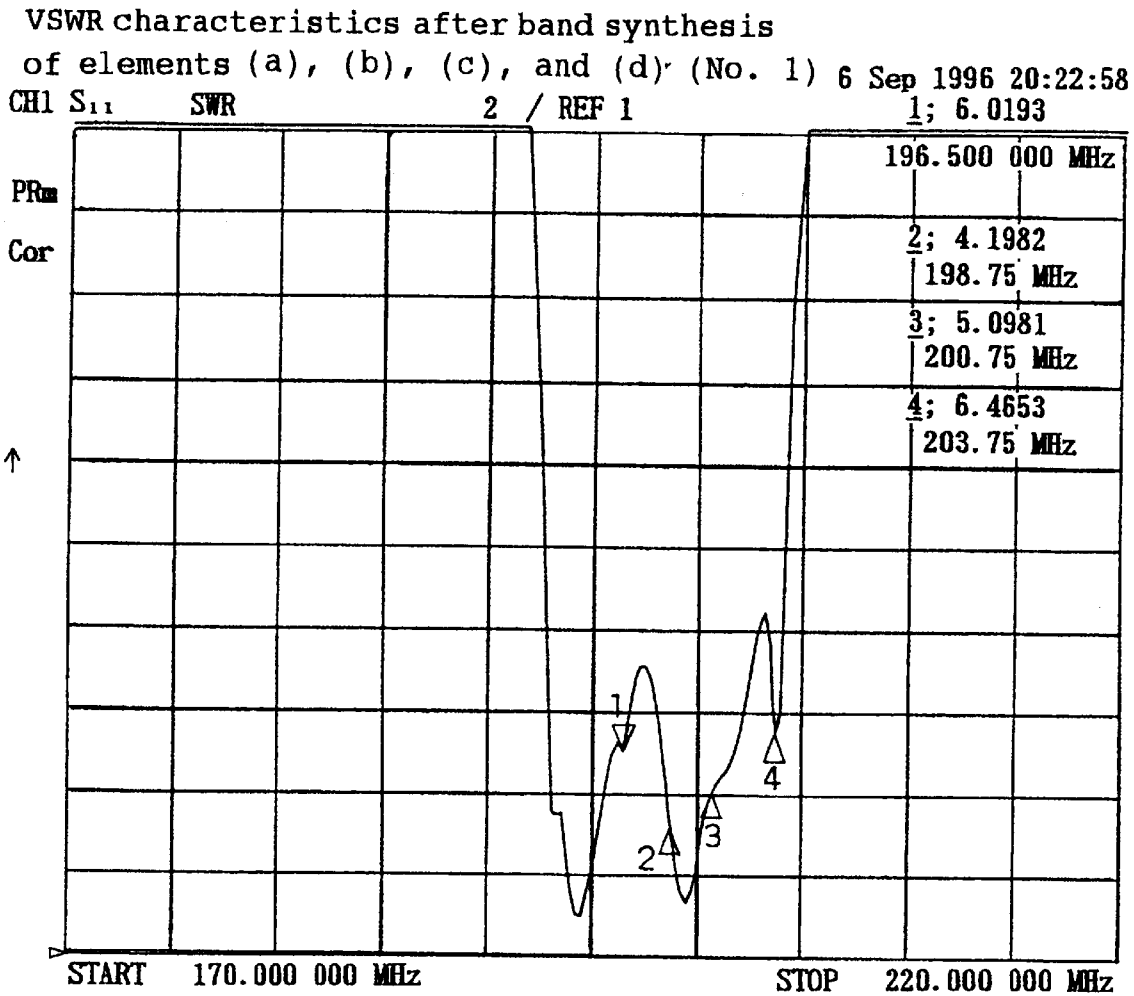
Figure 121:
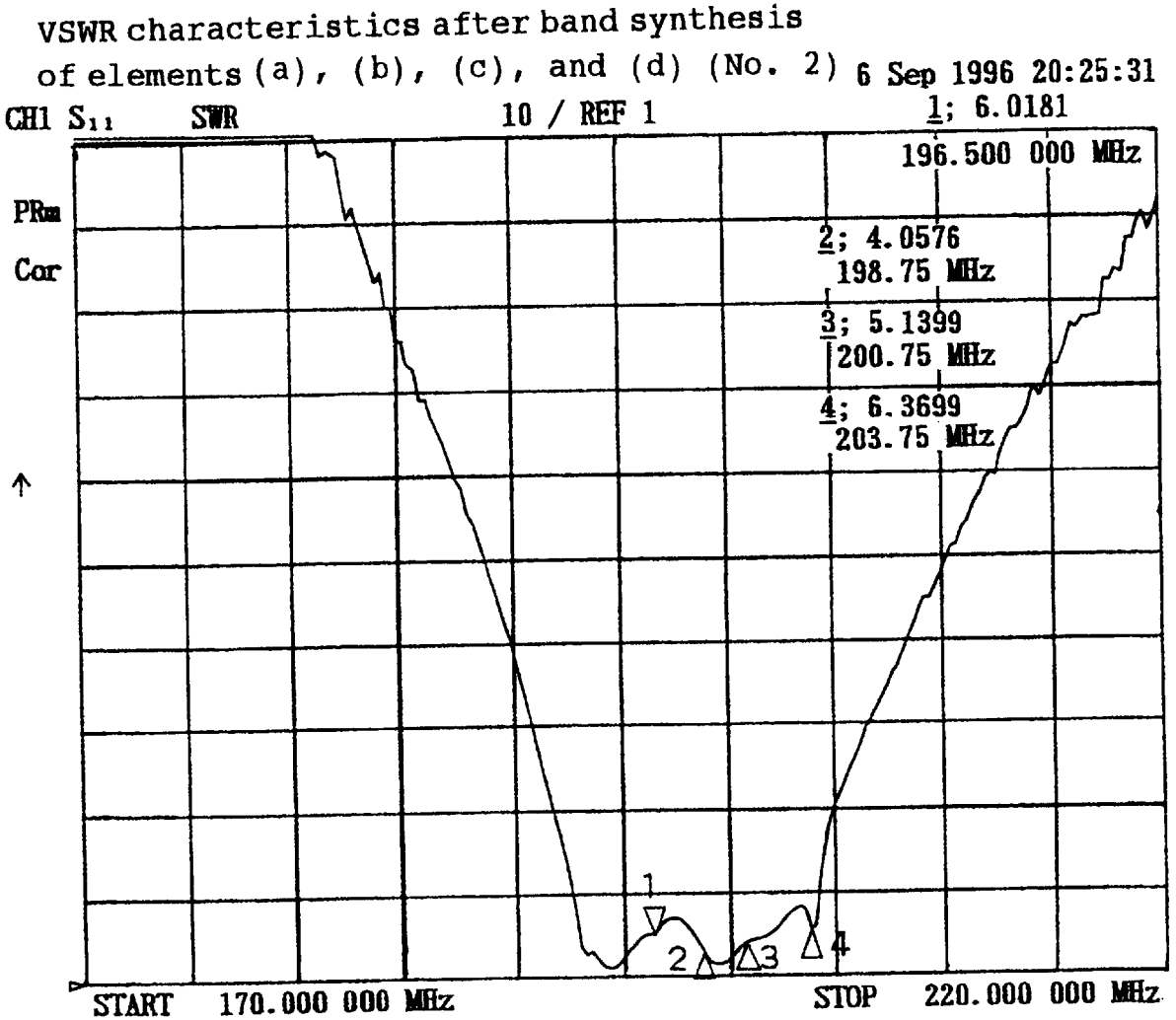

Specific examples of such band synthesis are described with respect to the VSWR characteristics shown in FIGS. 116 through 121. Namely, these examples use four antenna elements with different tuning frequencies, that is, 196.5 MHz (FIG. 116), 198.75 MHz (FIG. 117) 200.5 MHz (FIG. 118), and 203.75 MHz (FIG. 119), respectively. FIG. 120 so shows the VSWR characteristics after band synthesis of these antenna elements and it can be seen that the band has become wider than before. FIG. 121 shows the VSWR characteristics when the range of ordinates in FIG. 120 is extended (by quintuple)

Figure 39:
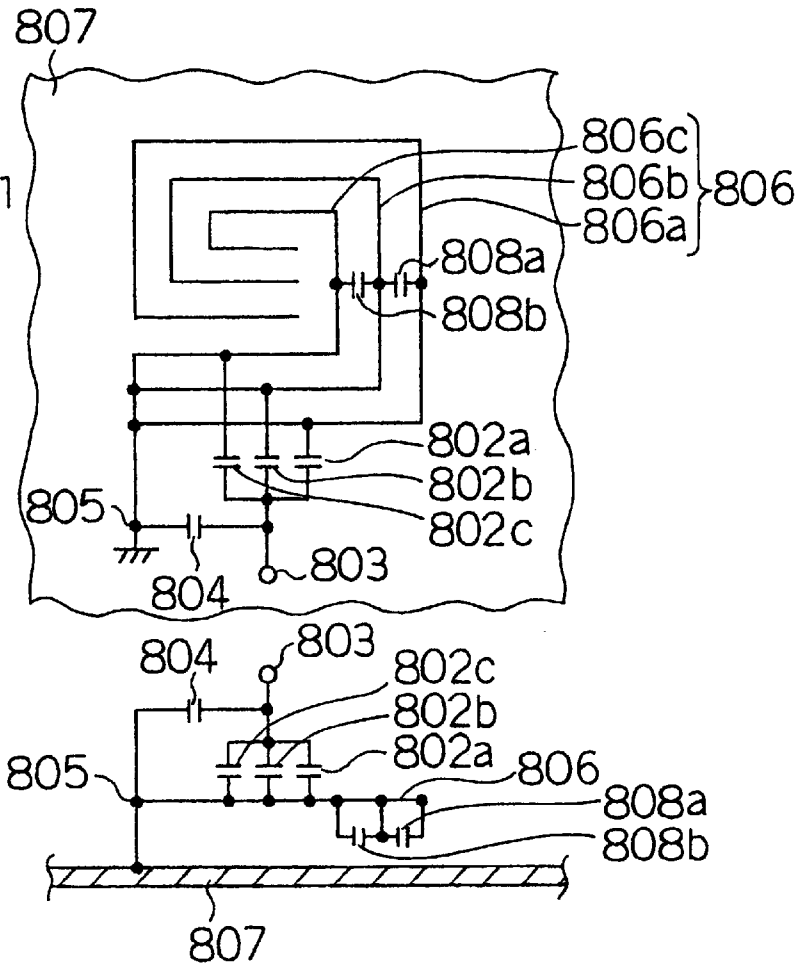
FIG. 39 is a schematic diagram showing an example of an antenna device according to the present invention.
Figure 39:
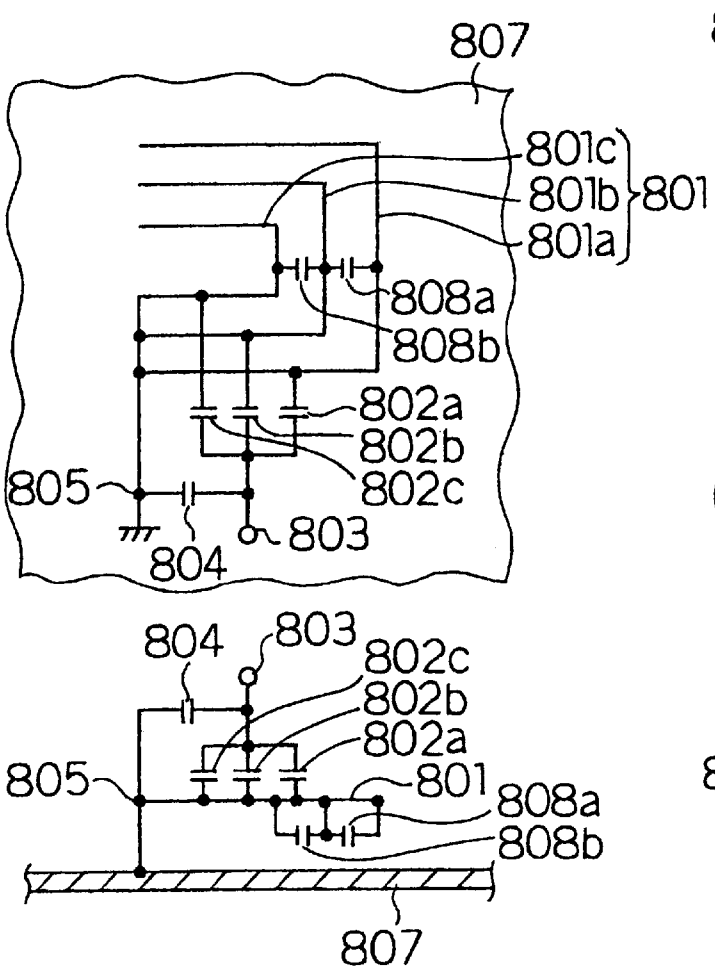

FIG. 39(*a*) shows that additional reactance elements 808*a* and 808*b* for band synthesis are provided between antenna elements 801*a,* 801*b,* and 801*c* in an antenna device having the configuration similar to that of FIG. 38(*a*) described above. FIG. 39(*b*) shows that additional reactance elements 808*a* and 808*b* for band synthesis are provided between antenna elements 806*a,* 806*b,* and 806*c* in an antenna device having the configuration similar to that of FIG. 38(*b*) described above.

Figure 40:
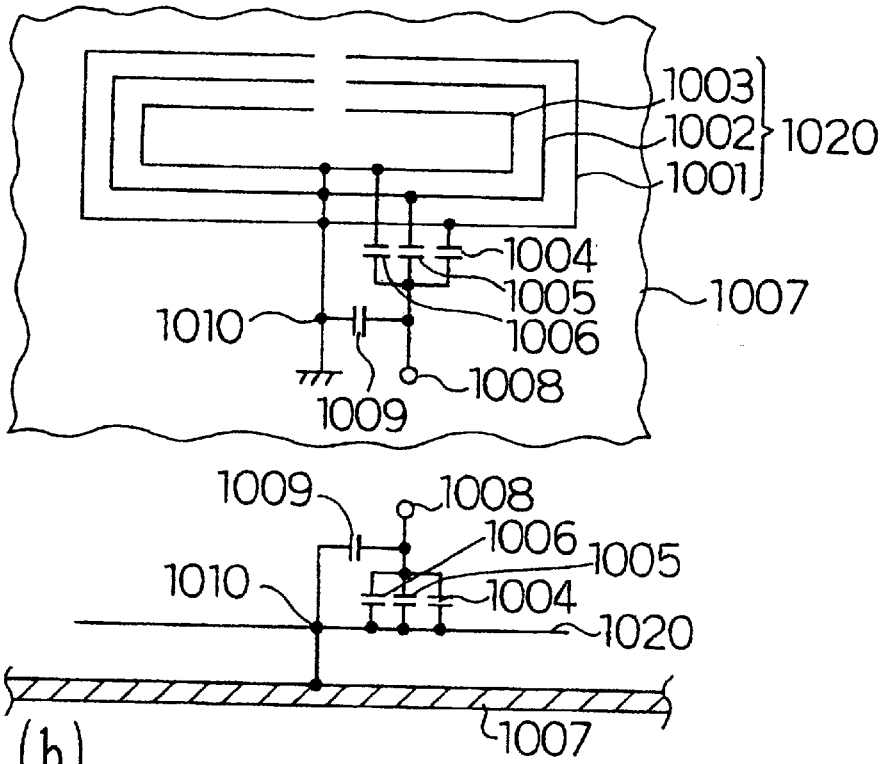
FIG. 40 is a schematic diagram showing an example of an antenna device according to the present invention.
Figure 40:
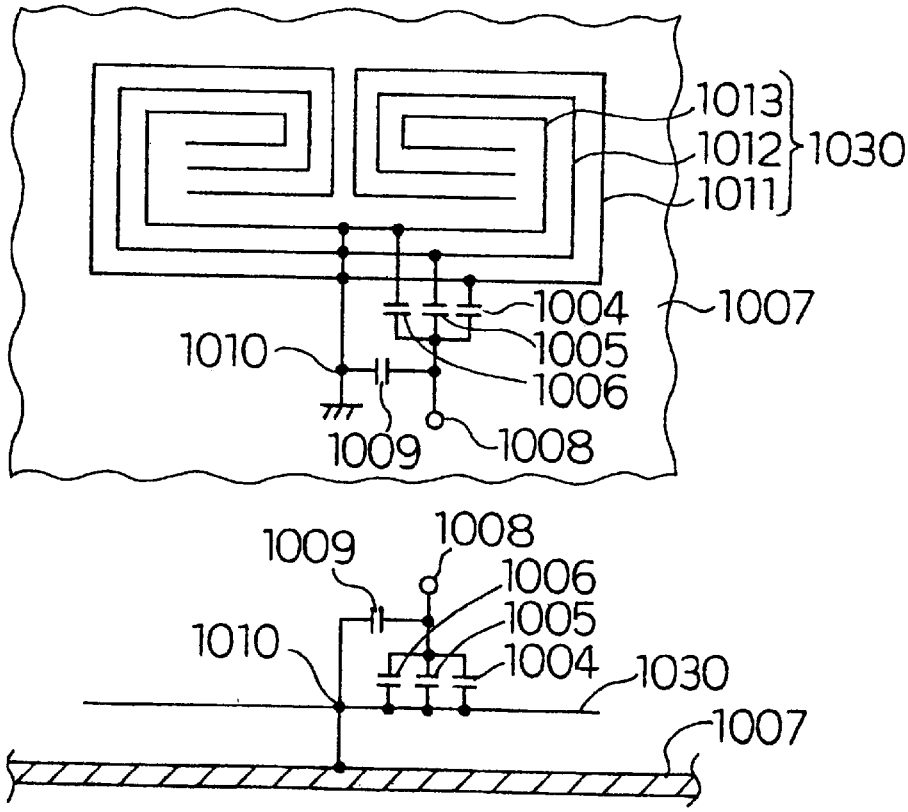

FIG. 40(*a*) shows an antenna device which comprises three dipole antenna elements 1001, 1002, and 1003 having four bends and different lengths and being located on the same plane in the proximity to a conductive earth substrate 1007, and reactance elements 1004, 1005, 1006, and 1009 connected between the taps of the antenna elements 1001, 1002, and 1003 and a feeding terminal 1008 and between the feeding terminal 1008 and a ground terminal 1010, respectively, to adjust their impedance. FIG. 40(*b*) shows another antenna device which substitutes antenna elements 1011, 1012, and 1013 having eight bends for the antenna elements 1001, 1002, and 1003 of the antenna device of FIG. 40(*a*) described above.

Figure 41:
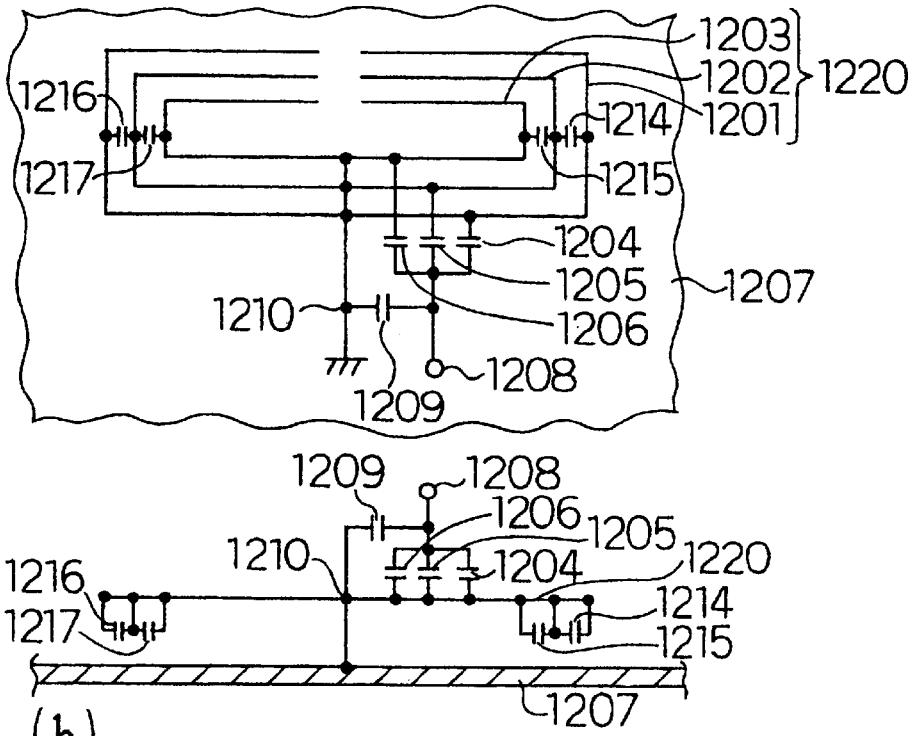
FIG. 41 is a schematic diagram showing an example of an antenna device according to the present invention.
Figure 41:
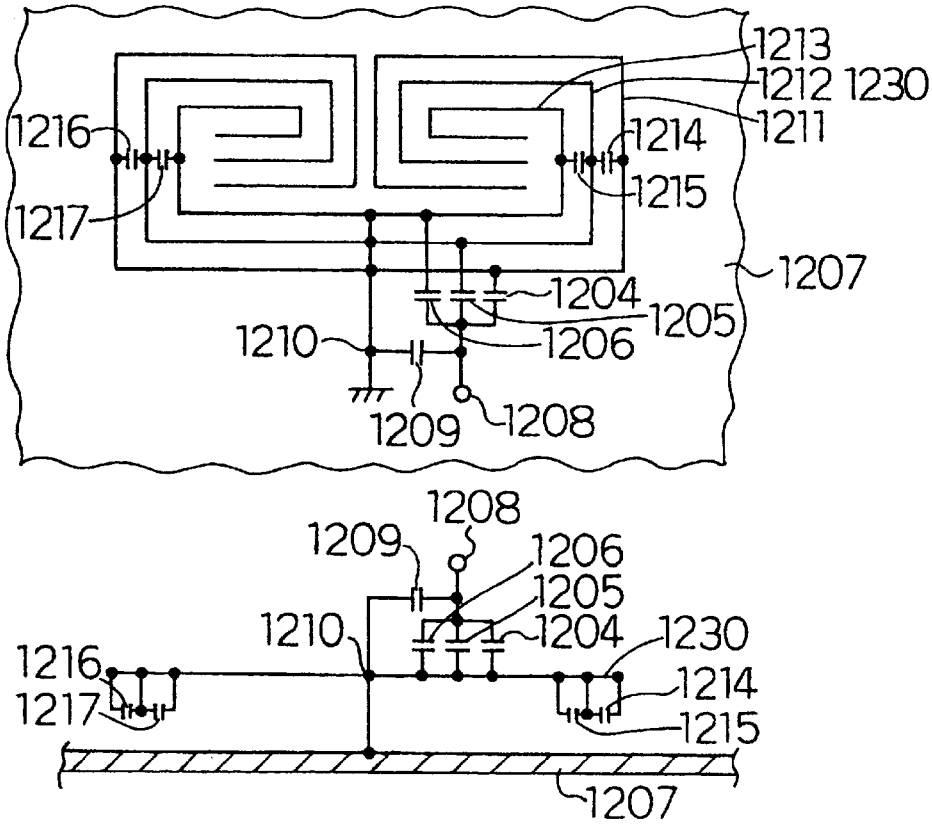

FIG. 41(*a*) shows that additional reactance elements 1214, 1215, 1216, and 1217 for band synthesis are provided between antenna elements 1201, 1202, and 1203 at two separate locations in an antenna device having the configuration similar to that of FIG. 40(*a*) described above. FIG. 41(*b*) shows that additional reactance elements 1214, 1215, 1216, and 1217 for band synthesis are provided between antenna elements 1211, 1212, and 1213 at two separate locations in an antenna device having the configuration similar to that of FIG. 40(*b*) described above.

Figure 42:
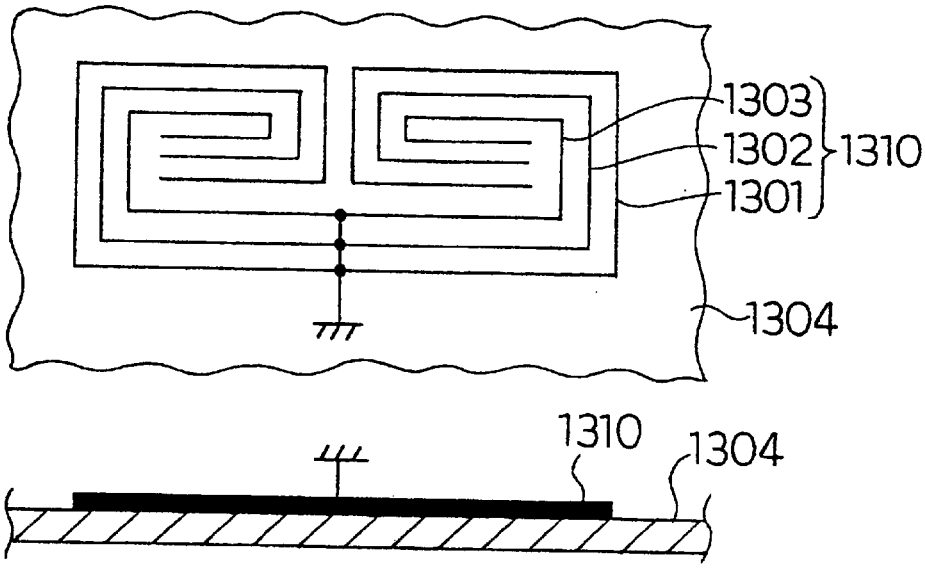
FIG. 42 is a schematic diagram showing an example of an antenna device according to the present invention.
Figure 42:
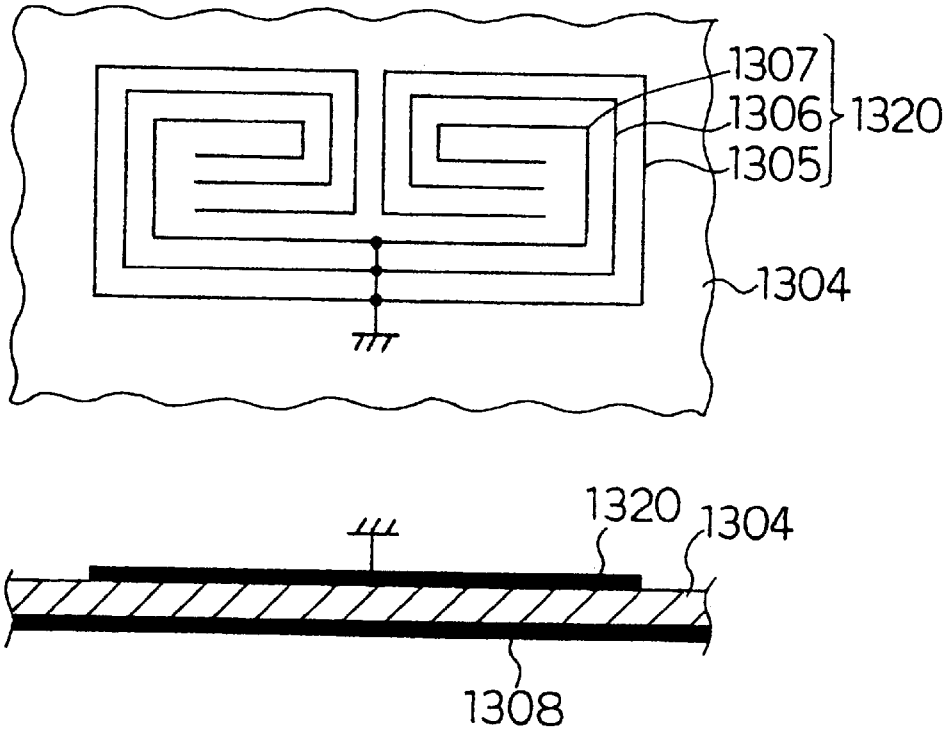

FIG. 42(*a*) shows an antenna device which comprises three dipole antenna elements 1301, 1302, and 1303 having different lengths and being formed on a printed circuit board 1304. FIG. 42(*b*) shows another antenna device of the configuration similar to that of FIG. 42(*a*) described above, which has a conductive earth substrate 1308 formed on the opposite side of the printed circuit board 1304 to the antenna element 1320. Such a configuration where a printed circuit board is used to form the antenna elements 1301, 1302, and 1303 (1305, 1306, 1307) and the conductive earth substrate 1308 can save the space necessary for an antenna device as well as allow easy fabrication of the antenna device with improved performance reliability and stability.

Figure 43:
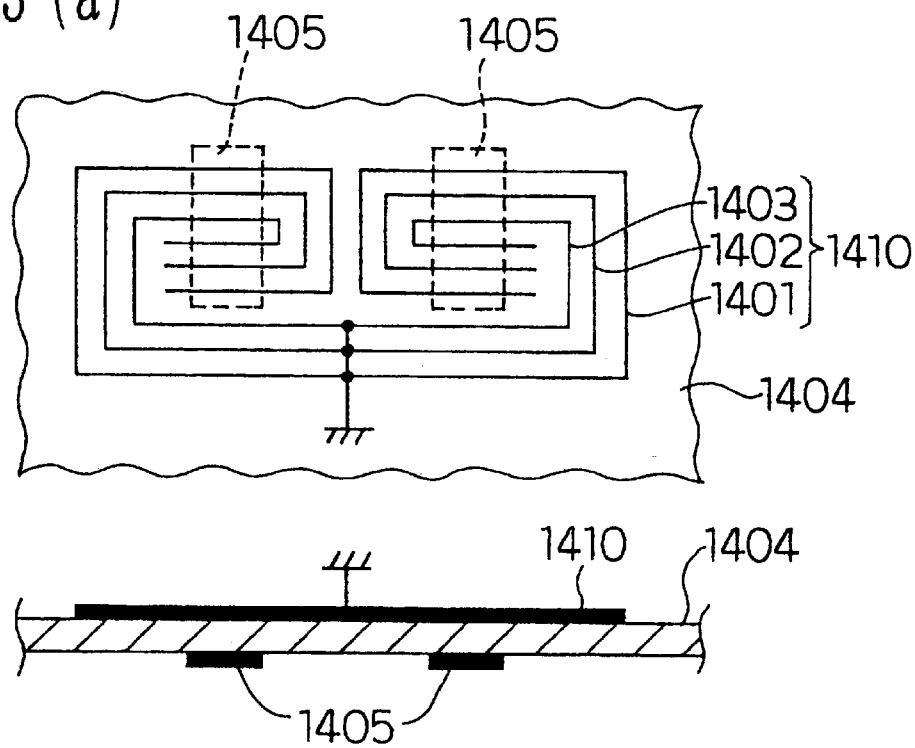
FIG. 43 is a schematic diagram showing an example of an antenna device according to the present invention.
Figure 43:
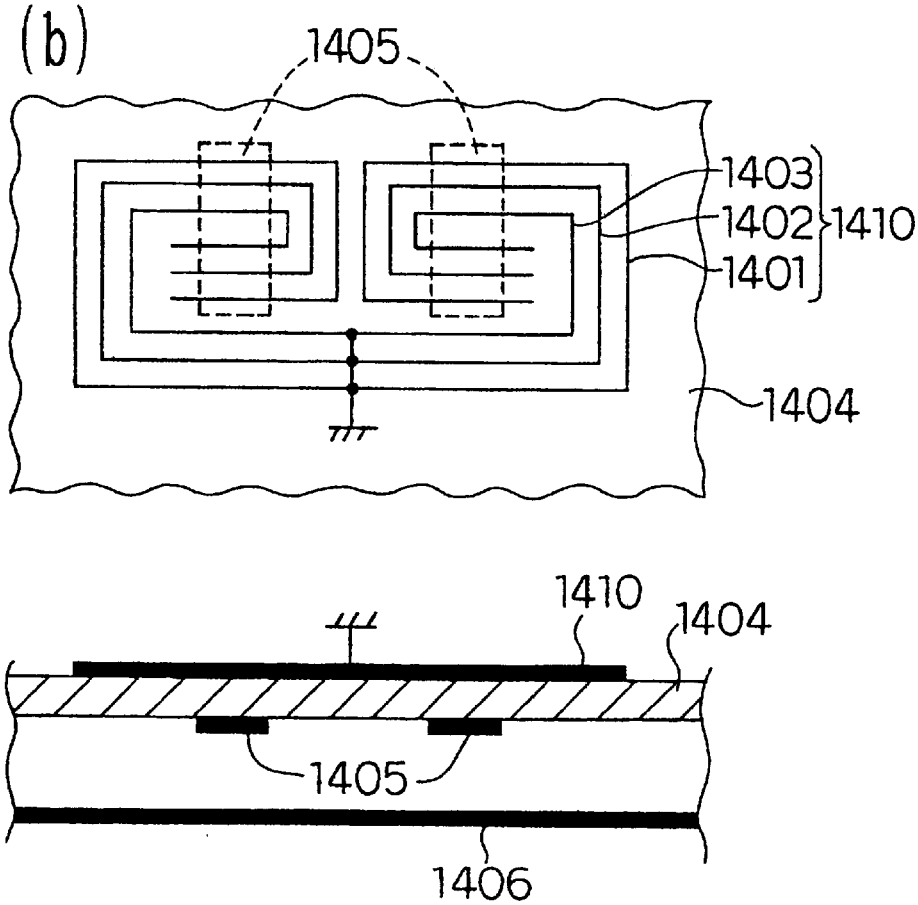

FIG. 43 shows that antenna devices of the configurations similar to those of FIG. 42(*a*) described above have a conductor for band analysis formed on the opposite side of a printed circuit board to antenna elements in a direction perpendicular to the antenna elements. Namely, FIG. 43(*a*) shows an antenna device which comprises three dipole antenna elements 1401, 1402, and 1403 having different lengths and being formed on a printed circuit board 1404 and two conductors 1405 formed on the opposite side of the printed circuit board 1404 to the antenna element 1410 in a direction perpendicular to the antenna element. FIG. 43(*b*) shows another antenna device of the configuration similar to that of FIG. 43(*a*) described above, which has a conductive earth substrate 1406 located in close proximity on the opposite side to the antenna element 1410. This conductive earth substrate 1406 may be formed on the printed circuit board by using a multilayer printing technique. The configuration described above can allow easy fabrication of elements for band synthesis.

Figure 44:
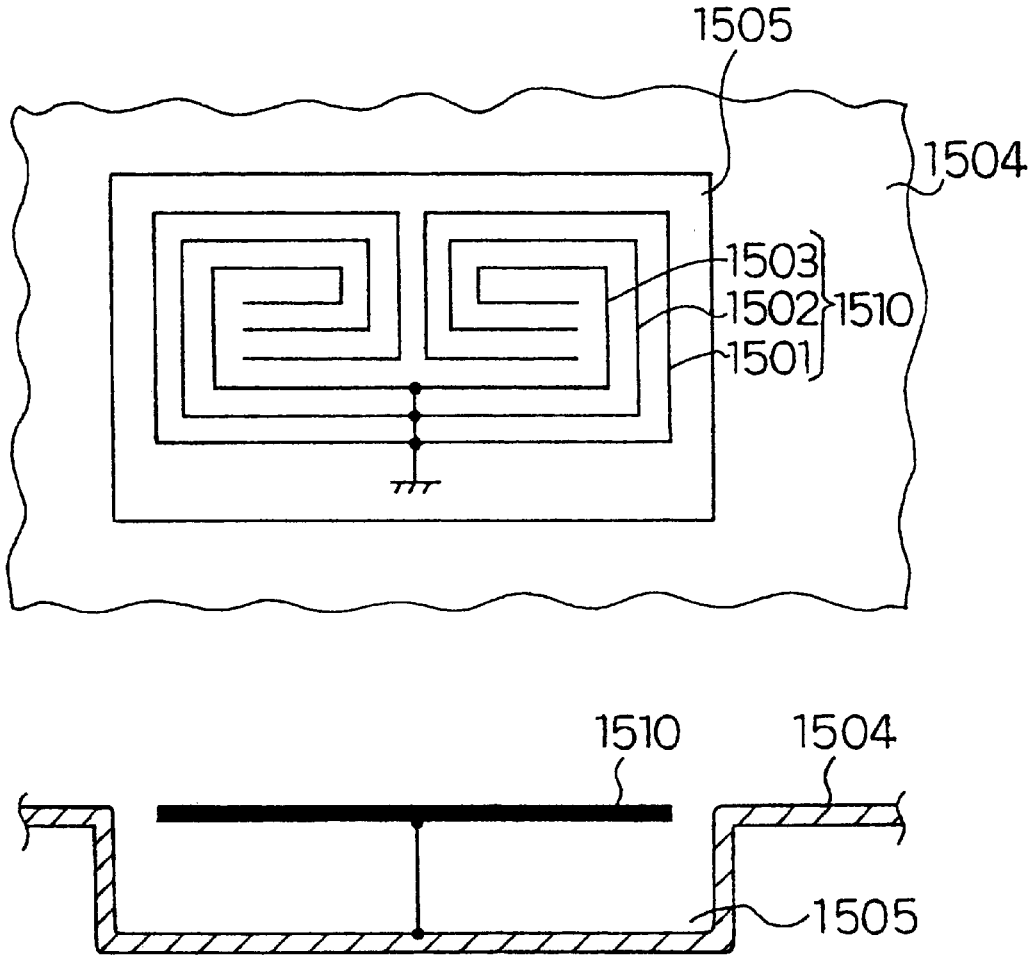
FIG. 44 is a schematic diagram showing an example of an antenna device according to the present invention.

FIG. 44 shows an antenna device which has antenna elements 1501, 1502, and 1503 located within a recess 1505 in a conductive earth substrate 1504. This configuration can eliminate any protrusion from an automobile body and improve the directional gain performance through interaction between the edge of the antenna element 1510 and the conductive earth substrate 1504 .

Figure 45:
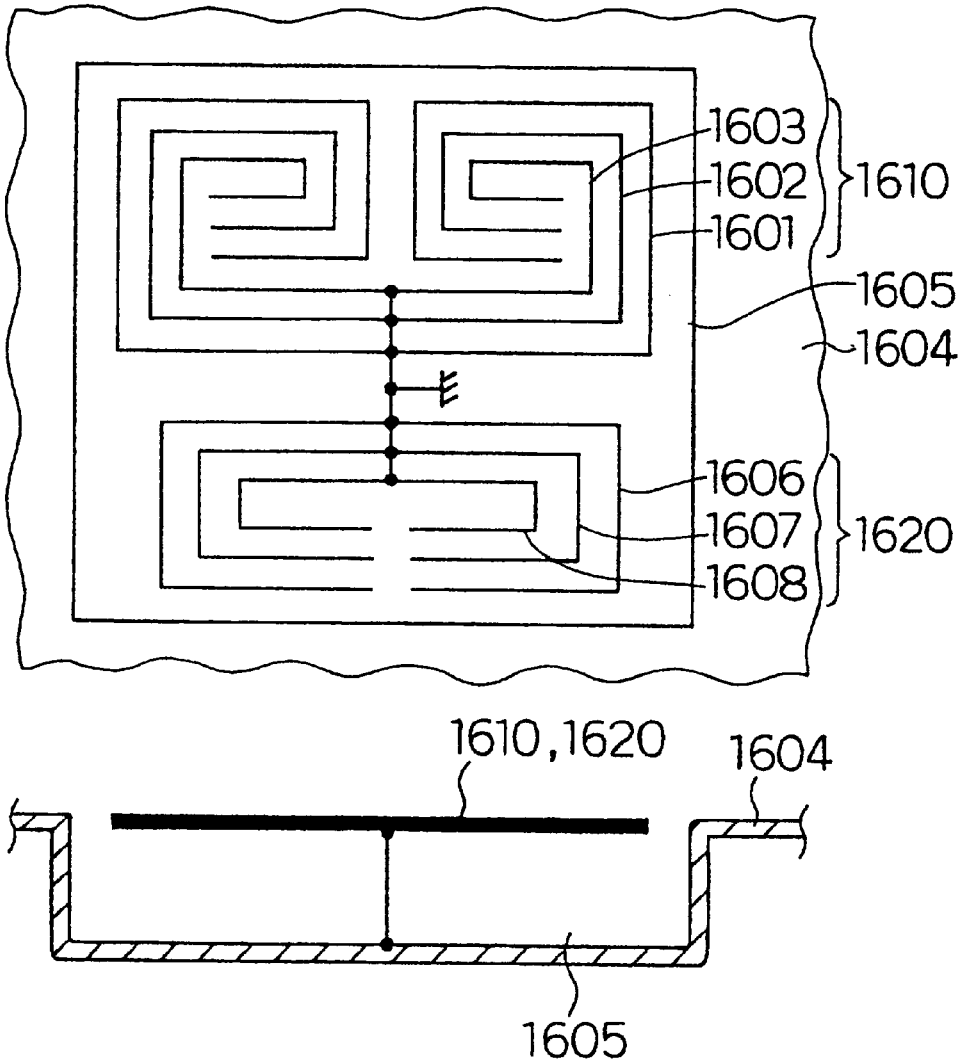
FIG. 45 is a schematic diagram showing an example of an antenna device according to the present invention.
Figure 45:
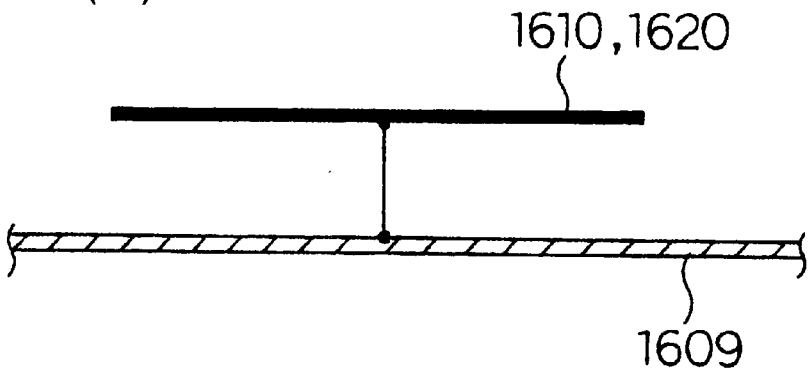

The antenna device of FIG. 45(*a*) comprises an antenna 1610 consisting of antenna elements 1601, 1602, and 1603 and an antenna 1620 consisting of antenna elements 1606, 1607, and 1608 and these antennas 1610 and 1620 are located in the same plane and within a recess 1605 in a conductive earth substrate 1604. It should be noted that the antennas 1610 and 1620 of this example are different from each other in size and shape but they may be of the same size and shape. Feeding sections of these antennas are located in the proximity of each other. FIG. 45(*b*) shows that a similar antenna is located in the proximity of a planar conductive earth substrate 1609.

Figure 46:
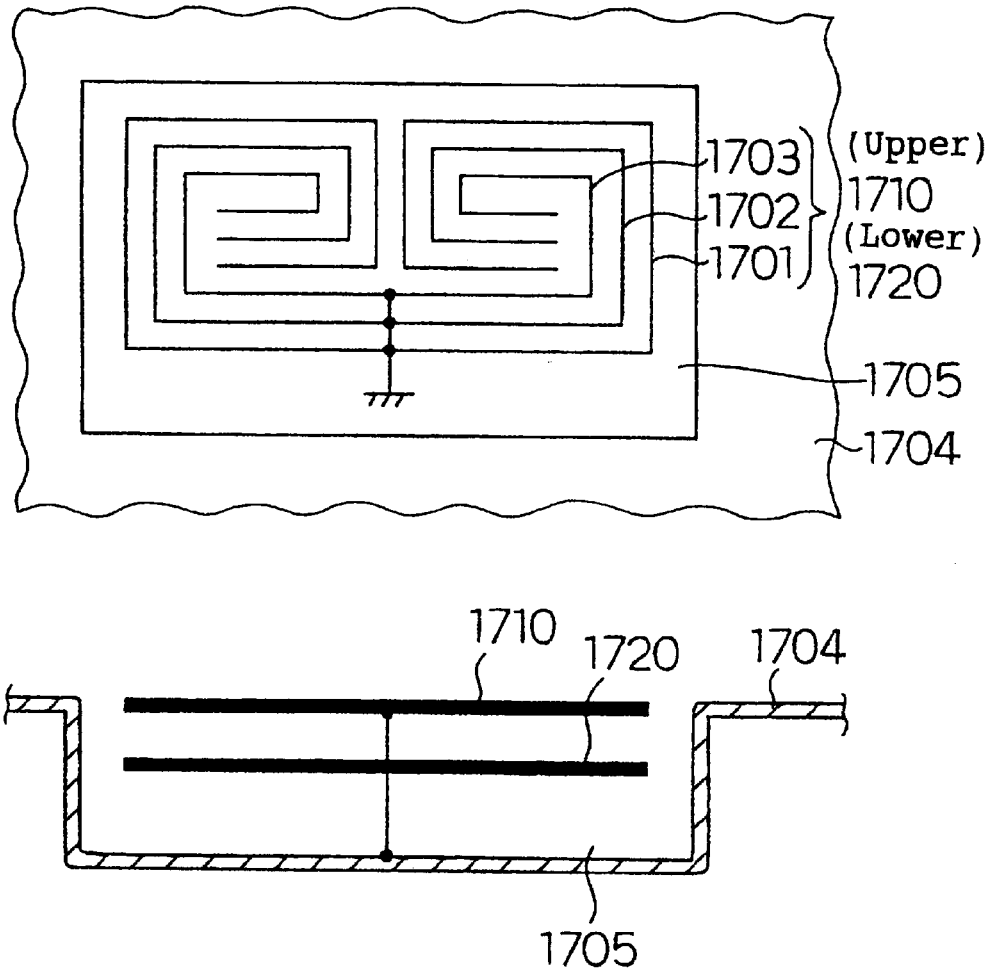
FIG. 46 is a schematic diagram showing an example of an antenna device according to the present invention.
Figure 46:
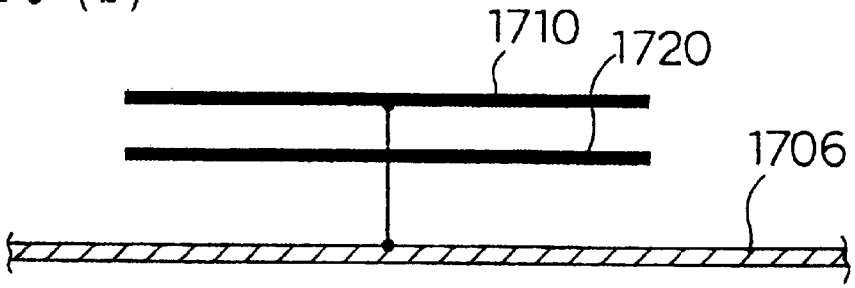
Figure 69:
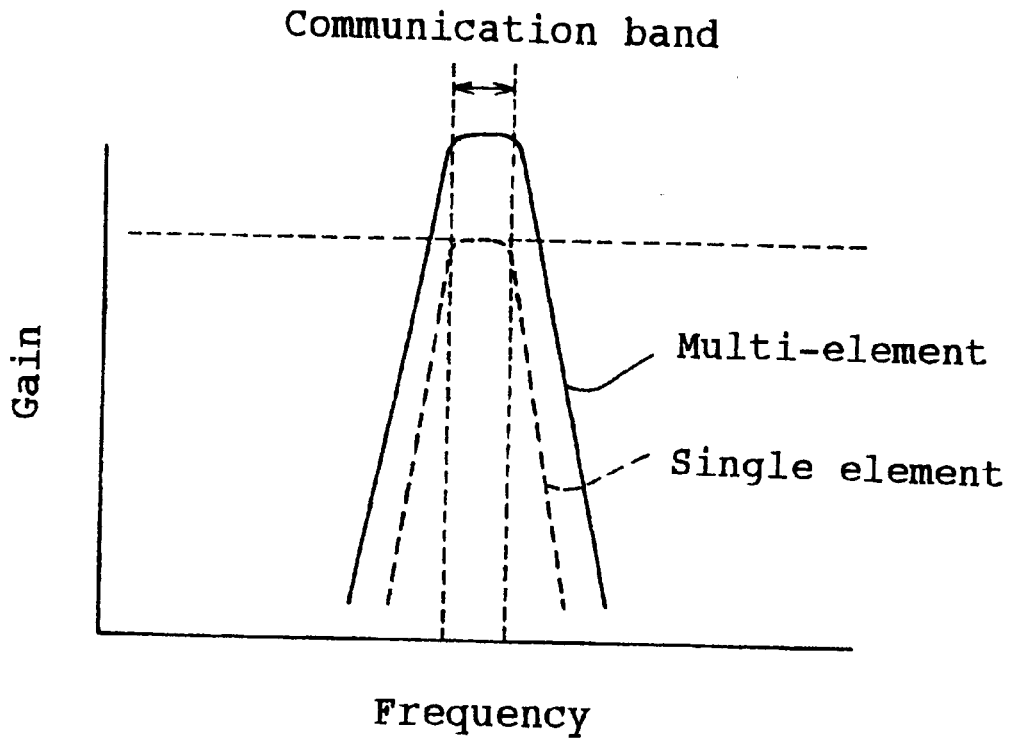
FIG. 69 shows an example of gain accumulation according to the present invention.

The antenna device of FIG. 46(*a*) comprises an upper antenna 1710 consisting of antenna elements 1701, 1702, and 1703 and a lower antenna 1720 also consisting of antenna elements 1701, 1702, and 1703 and these antennas 1710 and 1720 are located at two levels and within a recess 1705 in a conductive earth substrate 1704. It should be noted that the antennas 1710 and 1720 of this example are of the same size and shape but they may be different from each other in size and shape. FIG. 46(*b*) shows that a similar antenna is located in the proximity of a planar conductive earth substrate 1706. If the antennas are of the same size, they will have the same tuning frequency. Therefore, the bandwidth of the whole antenna device is the same as that of a single element but this example can implement a high-gain and high-selectivity antenna because the overall gain of the antenna element can be improved as compared with a single-element implementation by accumulating the gain of each antenna element, as shown FIG. 69.

Figure 47:
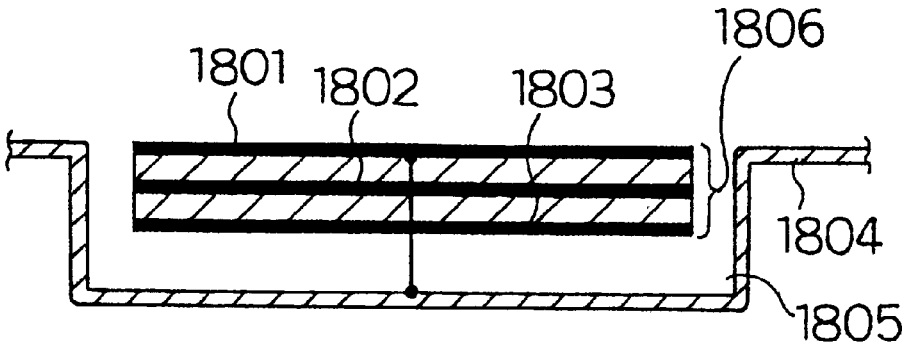
FIG. 47 is a schematic diagram showing an example of an antenna device according to the present invention.
Figure 47:
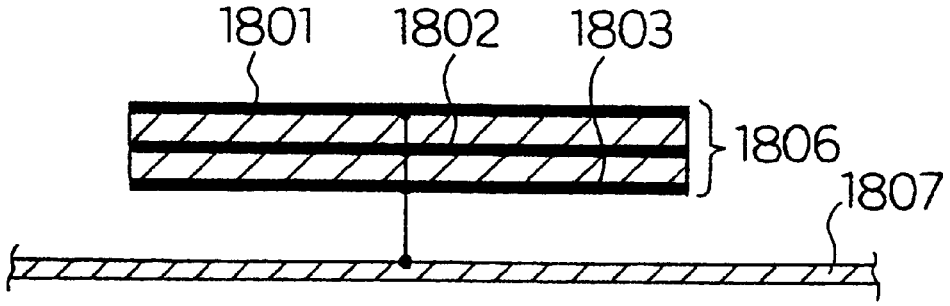

The antenna device of FIG. 47(*a*) comprises three antennas 1801, 1802, and 1803 each having one or more bends and a plurality of dipole antenna elements and these antennas are formed to be a multilayer printed circuit board 1806 and located with in a recess 1805 in a conductive earth substrate 1804. It should be noted that the three antennas 1801, 1802, and 1803 of this example are of the same size and shape but they may be different from each other in size and shape. It should be also noted that the three antennas are layered in this example but four or more antennas maybe layered. FIG. 47(*b*) shows that a similar antenna is located in the proximity of a planar conductive earth substrate 1807. As described above, a high-gain and high-selectivity antenna can be implemented easily by forming a plurality of antennas as a multilayer printed circuit board.

Figure 48:
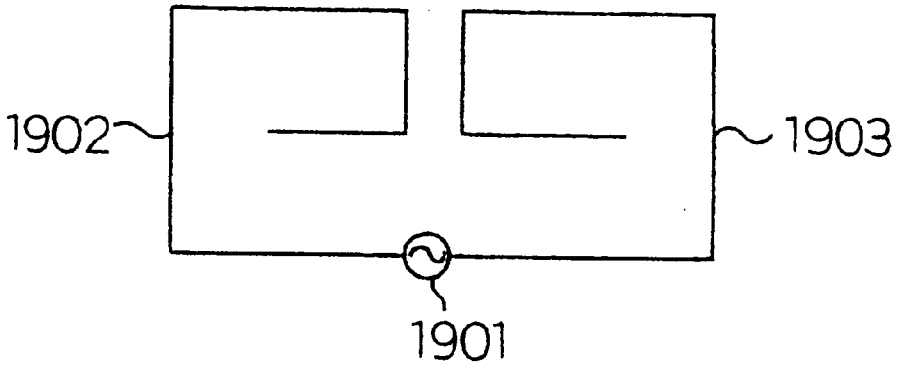
FIG. 48 is a schematic diagram showing an example of an antenna device according to the present invention.
Figure 48:
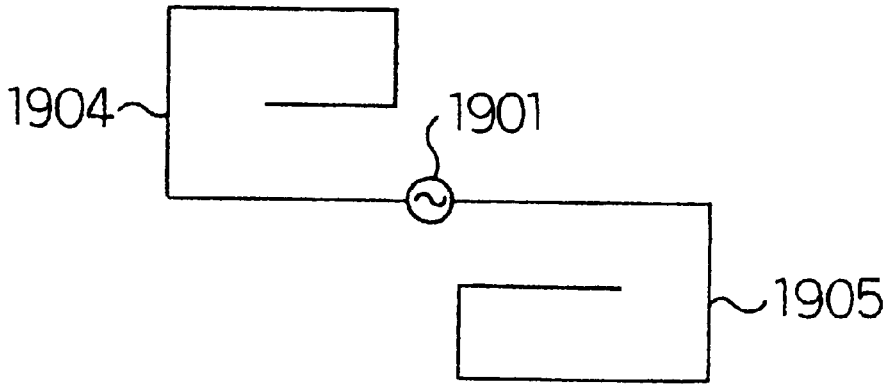

The antenna of FIG. 48 has two linear conductors each having four bends and these conductors are located opposite to each other with respect to a feeding section. Namely, FIG. 48(*a*) shows an antenna device which has two linear conductors 1902 and 1903 bending in opposite directions to each other with respect to a feeding point 1901 and FIG. 48(*b*) shows another antenna device which has two linear conductors 1904 and 1905 bending in the same direction with respect to a feeding point 1901. This shape can allow implementation of a compact planar nondirectional antenna.

Figure 49:
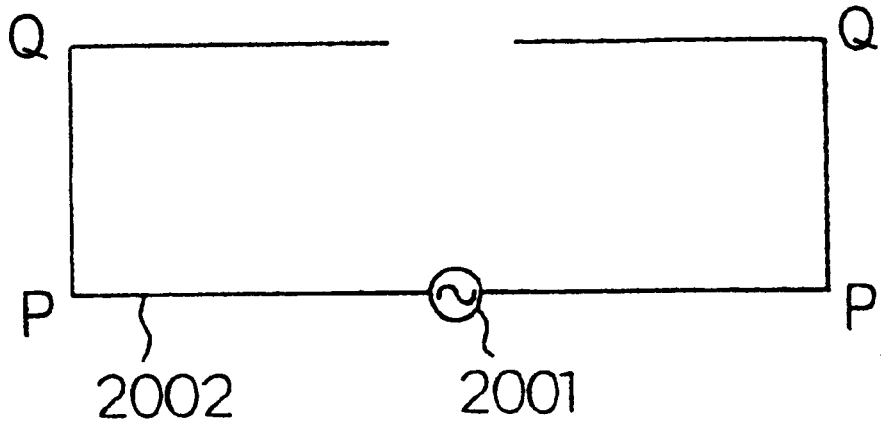
FIG. 49 is a schematic diagram showing an example of an antenna device according to the present invention.
Figure 49:
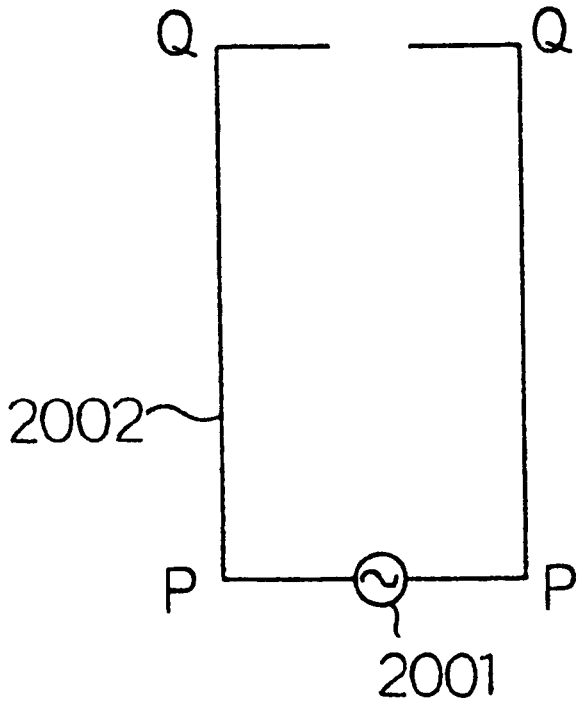

On the other hand, FIG. 49(*a*) shows an antenna device having an antenna element 2002 in which the length between a feeding section 2001 and a first bend P is relatively longer than the length between the first bend P and a second bend Q. FIG. 49(*b*) shows an antenna device having an antenna element 2002 in which the length between a feeding section 2001 and a first bend P is relatively shorter than the length between the first bend P and a second bend Q. This shape can allow the antenna device to be installed in a narrow area.

It should be noted that this example has two linear conductors located opposite to each other with respect to a feeding section but the number of linear conductors is not limited to that of this example and may be only one. In addition, the number of bends is not limited to that of this example.

It should be noted that this example has two linear conductors located opposite to each other with respect to a feeding section but the number of linear conductors is not limited to that of this example and may be only one. In addition, the number of bends is not limited to that of this example.

Figure 50:
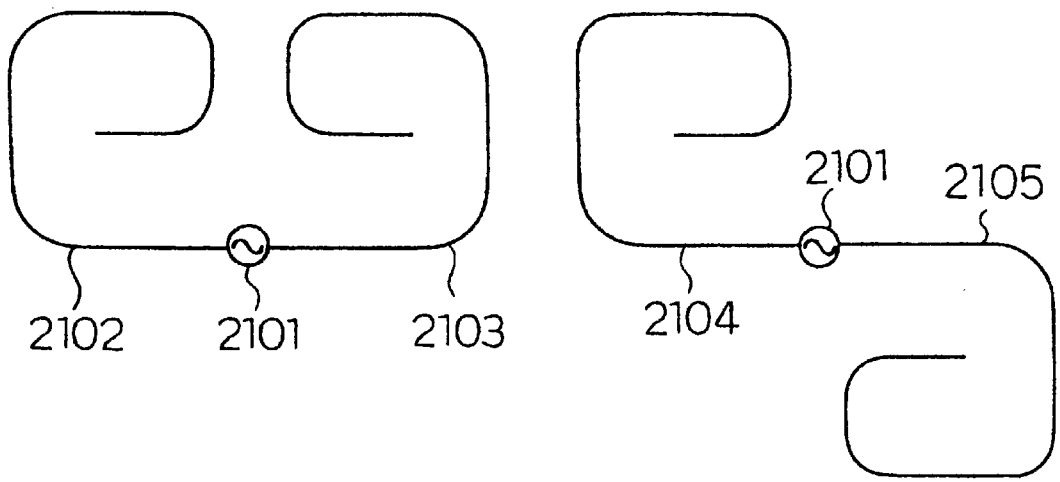
FIG. 50 is a schematic diagram showing an example of an antenna device according to the present invention.
Figure 50:
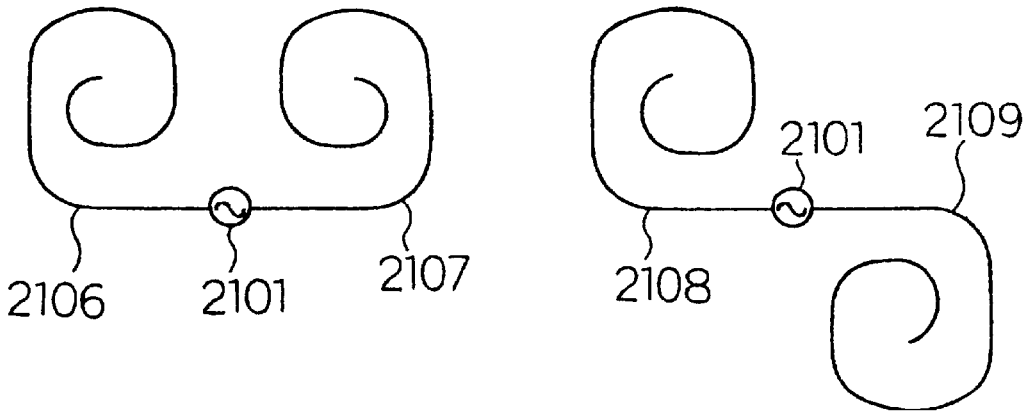

It should be also noted that the linear conductors in this example are bent but they maybe curved or spiralled. For example, as shown in FIG. 50(*a*), this example may have two linear conductors 2102 and 2103 curving in opposite directions to each other with respect to a feeding section 2101 or two linear conductors 2104 and 2105 curving in the same direction with respect to a feeding section 2101. Also, as shown in FIG. 50(*b*), this example may have two linear conductors 2106 and 2107 spiralling in opposite directions to each other with respect to a feeding section 2101 or two linear conductors 2108 and 2109 spiralling in the same direction with respect to a feeding section 2101.

When an antenna of this example is fabricated, an antenna element can be formed, of course, by working metal members but it may be formed through printed-wiring on a circuit board. Such a printed-wiring technique can allow greatly easy fabrication of an antenna, thereby to expect reducing cost, providing a more compact antenna, improving reliability and the like.

Figure 51:
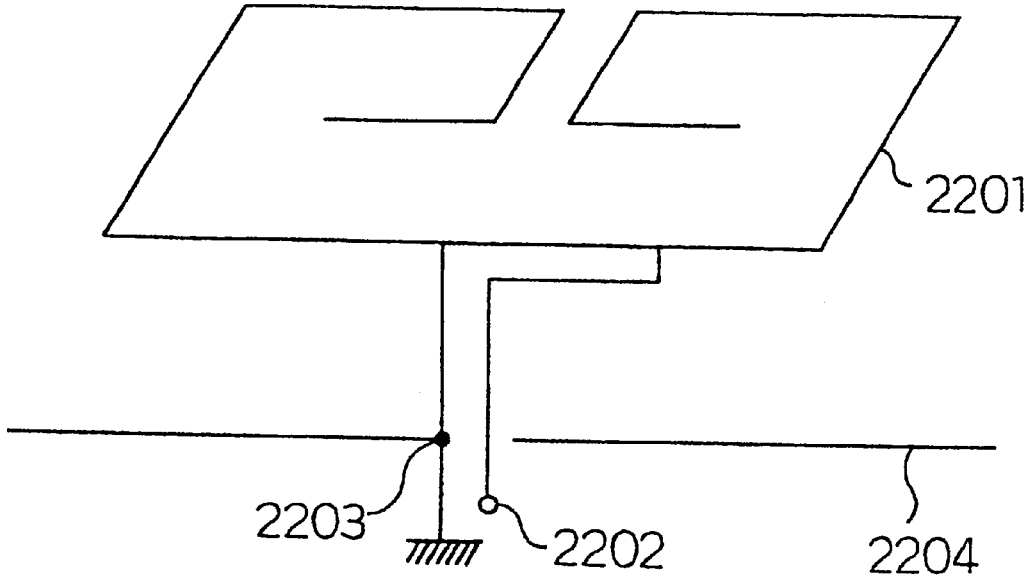
FIG. 51 is a schematic diagram showing an example of an antenna device according to the present invention.
Figure 51:
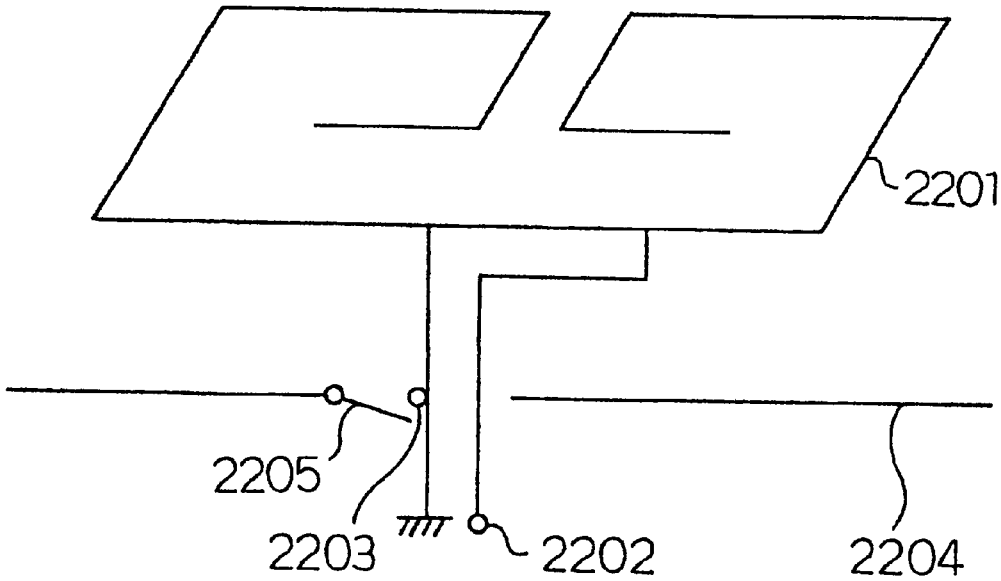

The antenna device of FIG. 51 is located in the proximity of a conductive earth substrate with its ground terminal connected to the substrate. For example, as shown in FIG. 51(*a*), an antenna element 2201 is located in the proximity of a substrate 2204 with its ground terminal 2203 connected to the substrate 2204. It should be noted that this antenna device is similar to that of FIG. 3(*b*) described above but differs therefrom in that a feeding terminal 2202 is provided on the opposite side of the conductive earth substrate 2204 to the antenna device by running the cable through the substrate. Such a configuration can provide a desired impedance characteristic and directivity.

FIG. 51(*b*) shows that a switching element is provided between a ground terminal and a conductive earth substrate in the antenna. As shown in the figure, a switching element 2205 is provided between a ground terminal 2203 of an antenna element 2201 and a conductive earth substrate 2204 to select which state, that is, whether or not the ground terminal is connected to the conductive earth substrate can effect the optimum radio-wave propagation. For this purpose, the switching element 2205 may be remotely operated to control the antenna device depending on the state of a received wave. The antenna device of this example is used for a vertically polarized wave if the ground terminal 2203 is connected to the substrate, while it is used for a horizontally polarized wave if the ground terminal is not connected to the substrate.

Figure 52:
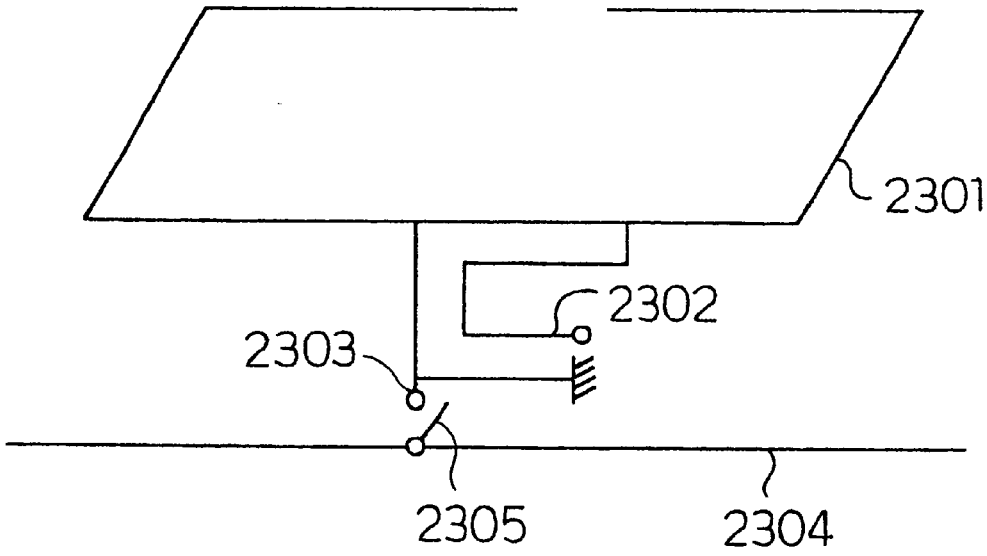
FIG. 52 is a schematic diagram showing an example of an antenna device according to the present invention.

It should be noted that the feeding terminal 2202 penetrates the conductive earth substrate 2204 in FIG. 51(*b*) but its location is not limited to this example and that, as shown in FIG. 52, a feeding terminal 2302 and a ground terminal 2303 may be not to penetrate the conductive earth substrate 2304.

Figure 53:
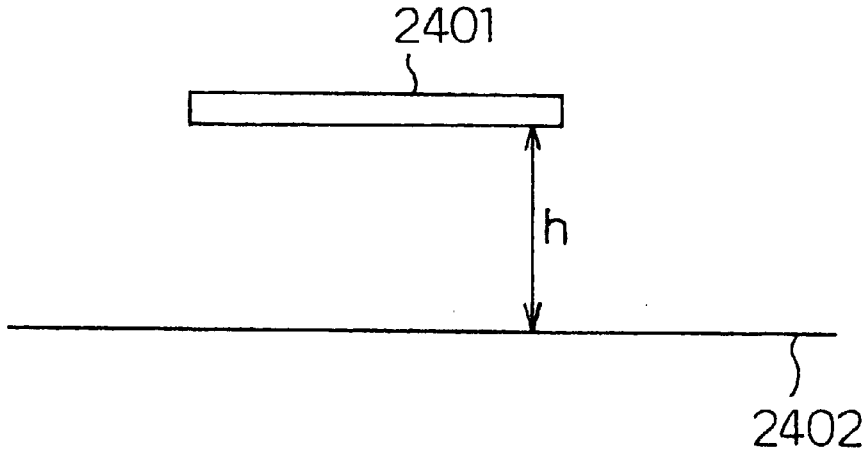
FIG. 53 shows the positional relationship between an antenna and a conductive earth substrate according to the present invention.
Figure 53:
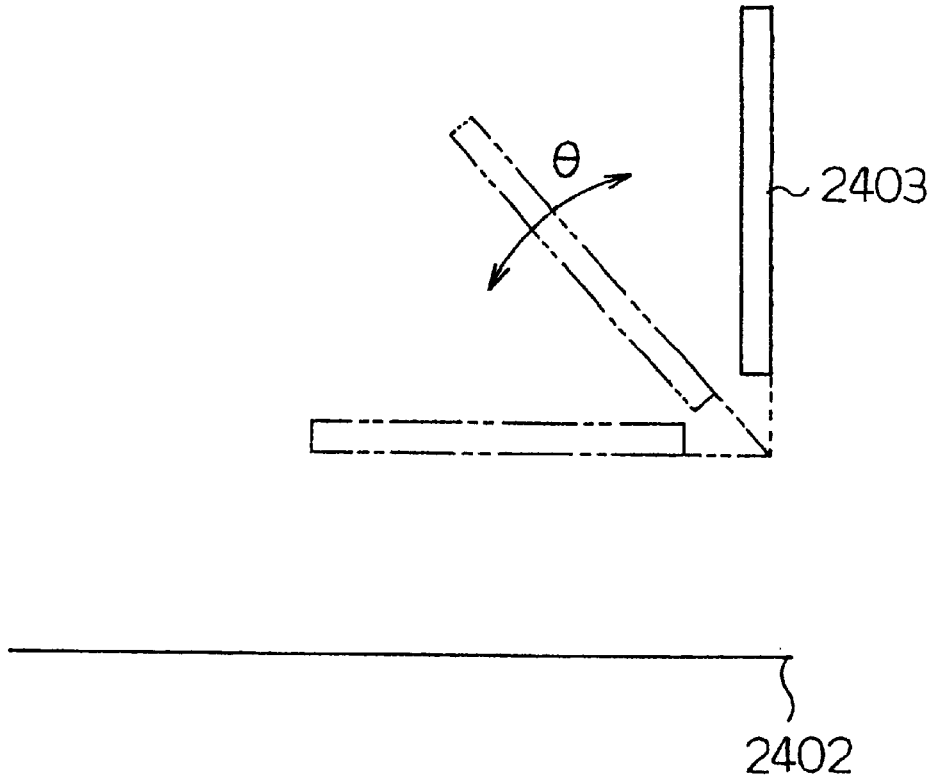

FIG. 53 shows the positional relationship between the antenna and the conductive earth substrate in the antenna device described above. As shown in FIG. 53(*a*), a conductive earth substrate 2402 and an antenna 2401 are located parallel to each other at a distance of h. The directivity of the antenna 2401 can be changed to a desired direction by controlling the distance h. The tuning frequency is raised if the antenna 2401 is closer to the conductive earth substrate 2402, while the tuning frequency is lowered if the antenna is more distant from the substrate. Therefore, the antenna device may be configured to control the distance h depending on the state of a received wave. The control of the distance h may be accomplished, for example, by using a feed or slide mechanism (not shown) to move the antenna 2401 in a direction perpendicular to the antenna plane or by inserting an insulation spacer (not shown) between the antenna 2401 and the conductive earth substrate 2402 and moving the spacer in a direction parallel to the antenna plane to adjust the length of the spacer insertion. Also, the size of the spacer maybe determined to obtain a desired antenna performance during the fabrication of the antenna. It should be noted that a spacer between the substrate and the antenna may be made of a low-permittivity material such as expanded styrol.

As shown in FIG. 53(*b*), the conductive earth substrate 2402 and the antenna 2403 may be located to form a predetermined angle θ (in this case, 90 degrees) between them. The directivity of the antenna 2403 can be controlled by adjusting the angle θ through a hinge mechanism and the like.

It should be further noted that the number of antenna elements is one according to the present embodiment but it is not limited to this example and may be two or more. It should be also noted that the substrate consists of a single conductor in this example but the body of an automobile and the like may be used as the substrate.

Figure 54:
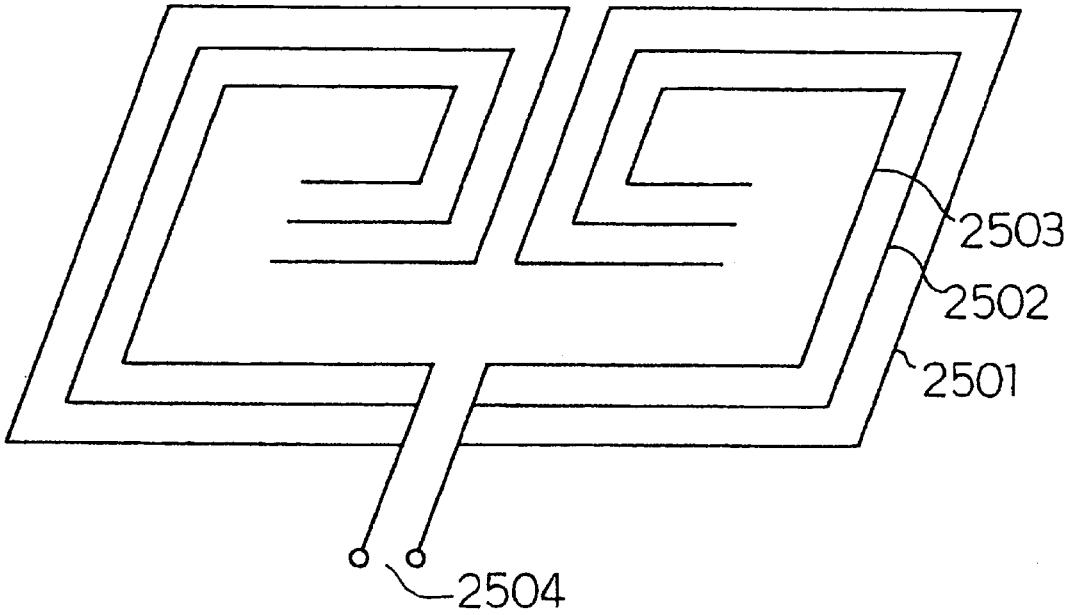
FIG. 54 is a schematic diagram showing an example of an antenna device according to the present invention.
Figure 54:
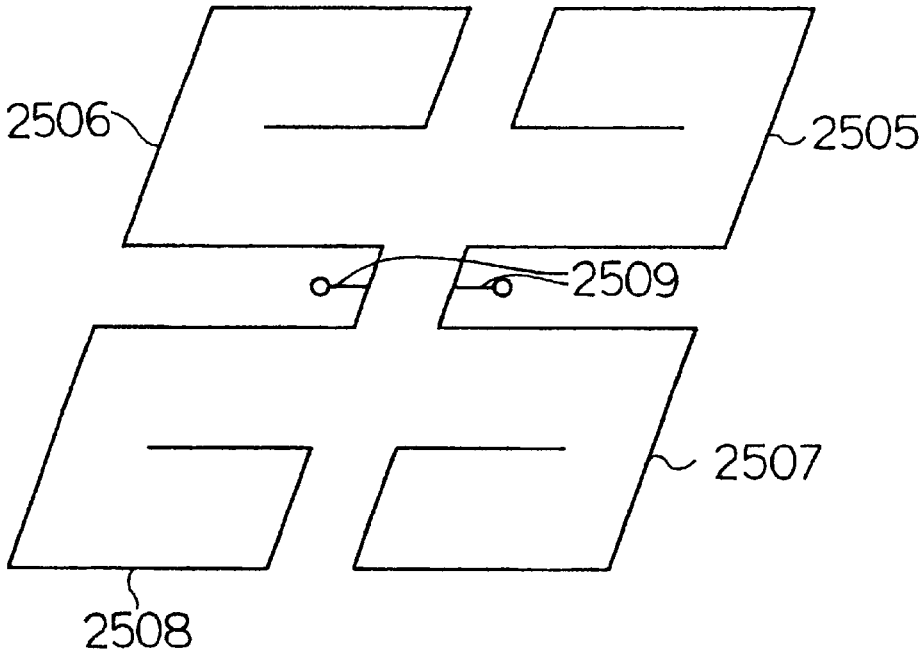

FIG. 54 shows that an antenna consists of a plurality of antenna elements arranged in a predetermined range and served by a single feeding mechanism. As shown in FIG. 54(*a*), a plurality of antenna elements 2501, 2502, and 2503 are served by a single feeding mechanism to provide an antenna consisting of the group of antenna elements. For example, a broadband antenna which covers a desired bandwidth as a whole can be implemented by covering a different bandwidth with each of the antenna elements. Particularly, in the arrangement of FIG. 54(*a*), the outer antenna element 2501 is necessarily longer than the inner antenna element 2503 and it is easy to set the longer antenna element 2501 to a lower tuning frequency and the shorter antenna element 2503 to a higher tuning frequency, so that a desired antenna covering a broad band as a whole can be implemented.

As shown in FIG. 54(*b*), a plurality of antenna elements may be separately arranged in an antenna plane without winding round each other.

If each of the antenna elements covers the same band, the efficiency of the antenna can be improved.

To provide isolation between the antenna elements, a distance between them may be determined to keep them in predetermined isolation or an isolator or reflector may be connected to each of the antenna elements.

It should be noted that the number of antenna elements is two or three according to this example but it is not limited to this example and may be any number equal to or more than two.

Figure 55:
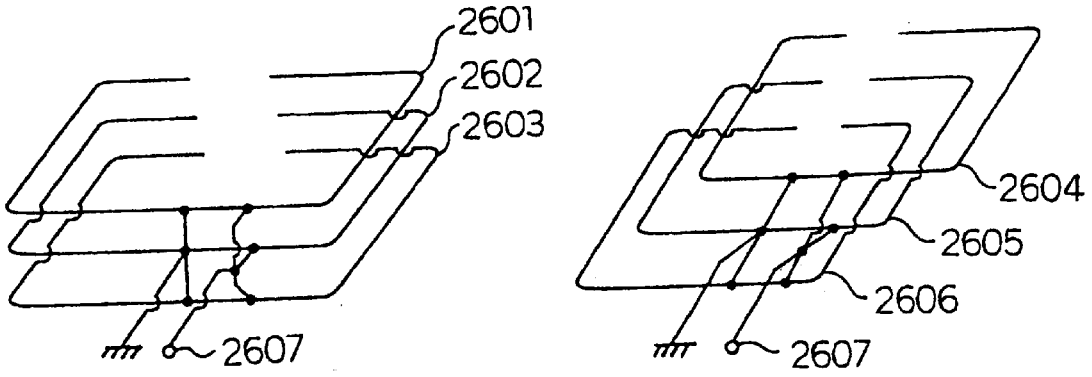
FIG. 55 is a schematic diagram showing an example of an antenna device according to the present invention.
Figure 55:
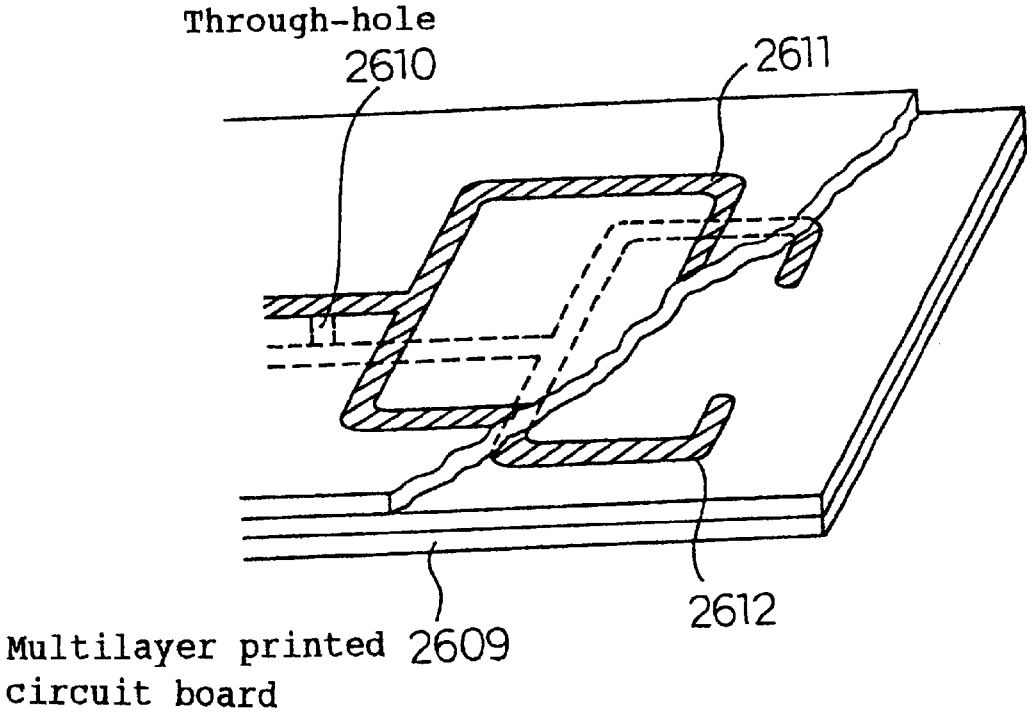

The antenna device of FIG. 55 differs from those in the preceding examples in that as shown in FIG. 55(*a*), antenna elements 2601, 2602, and 2603 or antenna elements 2604, 2605, and 2606 are layered in a direction perpendicular to the reference plane. It should be noted that the antenna elements may be arranged so that they are all exactly overlaid on the surface of projection as shown in the left of the figure or so that they are partially overlaid as shown in the right of the figure or so that they are separate from each other. FIG. 55(*b*) is a partial broken view showing an application of the present embodiment, in which antennas 2611 and 2612 are formed on a multilayer printed circuit board 2609 through a printed-wiring technique and the antennas are arranged to be partially overlaid on the horizontal plane. Both elements can be coupled in place by running a conductor through a through-hole 2610.

Figure 56:
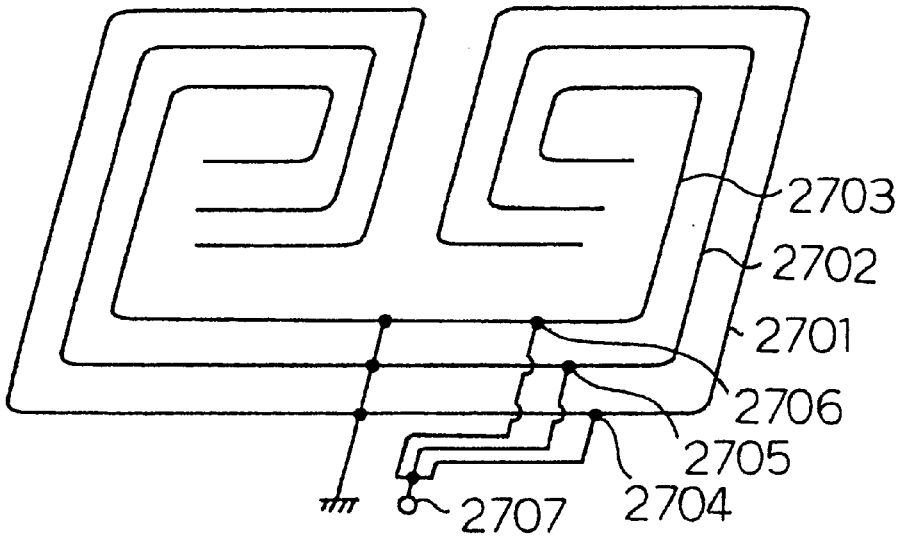
FIG. 56 is a schematic diagram showing an example of an antenna device according to the present invention.
Figure 56:
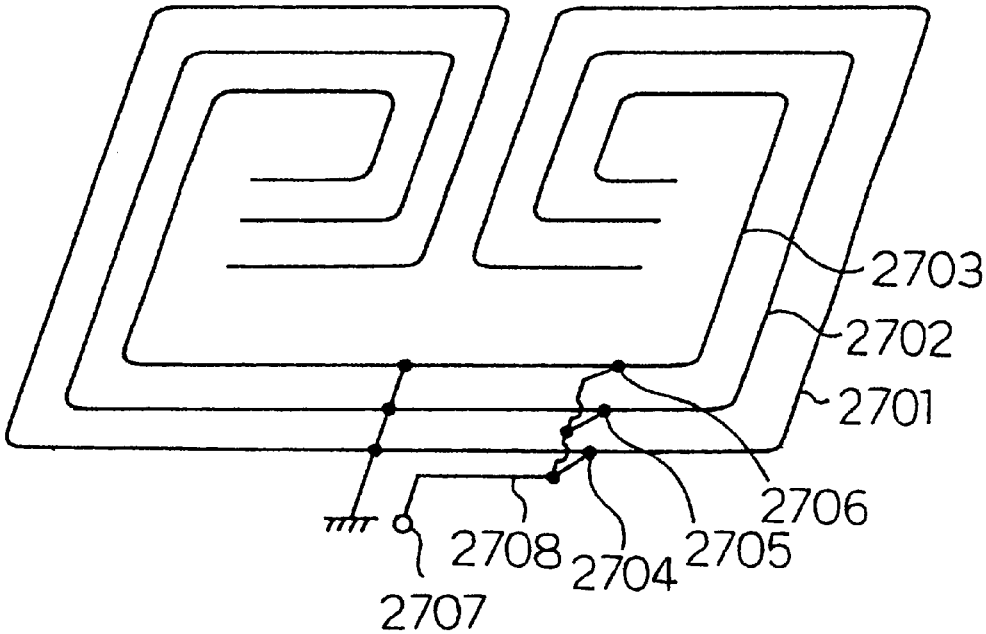

FIG. 56(*a*) shows an example of a single antenna feeding section for serving a plurality of antenna elements. As shown in FIG. 56(*a*), antenna elements 2701, 2702, and 2703 have taps 2704, 2705, and 2706 formed in place thereon, respectively, to connect them to a feeding terminal 2707. It should be noted that the direction for tapping is identical for all the antenna elements but it may be arbitrarily determined for each of them.

FIG. 56(*b*) shows an antenna having a common electrode between the tap of each antenna element and a feeding terminal. As shown in the figure, taps 2704, 2705, and 2706 are formed in place on antenna elements 2701, 2702, and 2703, respectively and a common electrode 2708 is provided between the taps and a feeding terminal 2707. This makes the configuration very simple and in addition, more space can be saved by placing the electrode 2708, for example, parallel to the outermost antenna element 2701.

Figure 57:
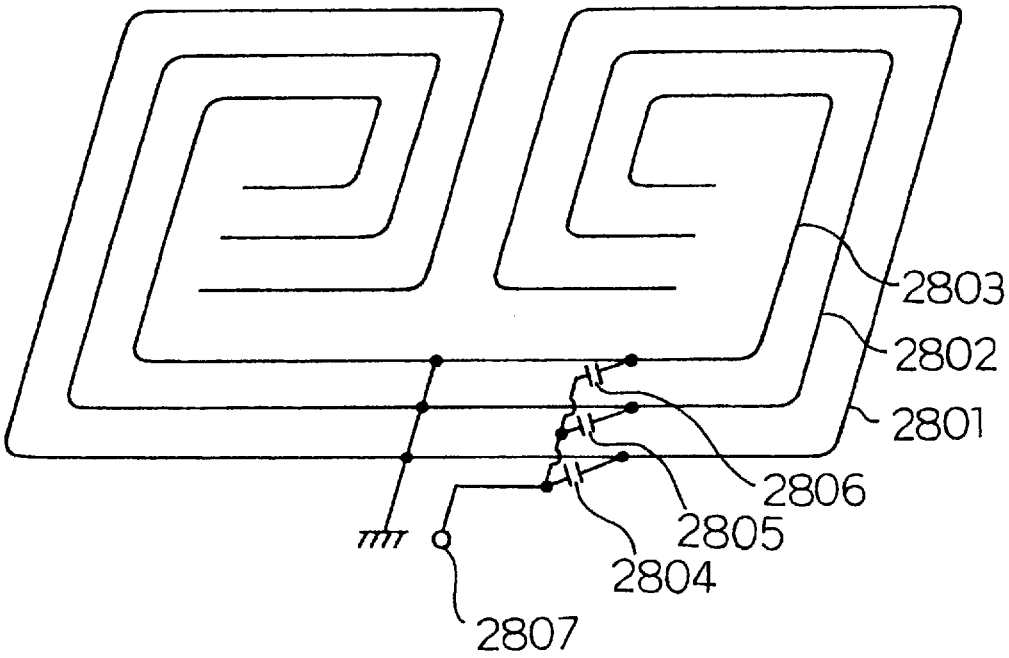
FIG. 57 is a schematic diagram showing an example of an antenna device according to the present invention.
Figure 57:
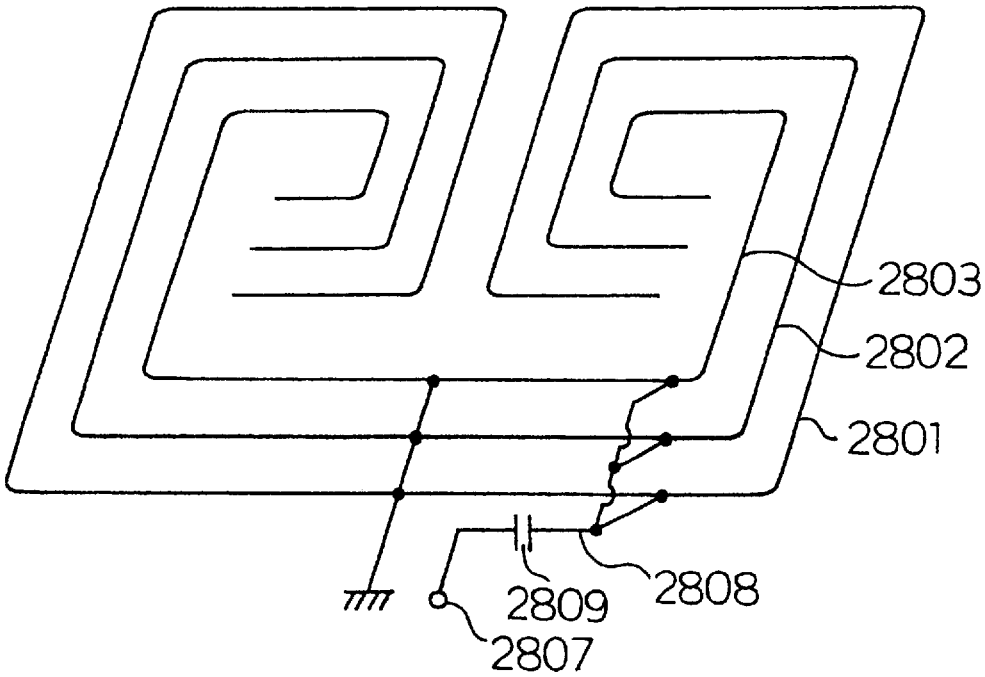

FIG. 57 shows an antenna with each antenna element tapped through a reactance element. As shown in FIG. 57(*a*), antenna elements 2801, 2802, and 2803 may be separately connected to a feeding terminal 2807 through reactance elements 2804, 2805, and 2806, respectively, or as shown in FIG. 57(*b*), a reactance element 2809 may be provided within a common electrode 2808 between a feeding terminal 2807 and taps. In the latter case, a reactance element may be provided between the feeding terminal and a ground terminal. By using a proper reactance element in this way, a desired impedance, band, and maximum efficiency can be achieved. It should be noted that a variable reactance element may be used as such a reactance element for adjustment.

Figure 58:
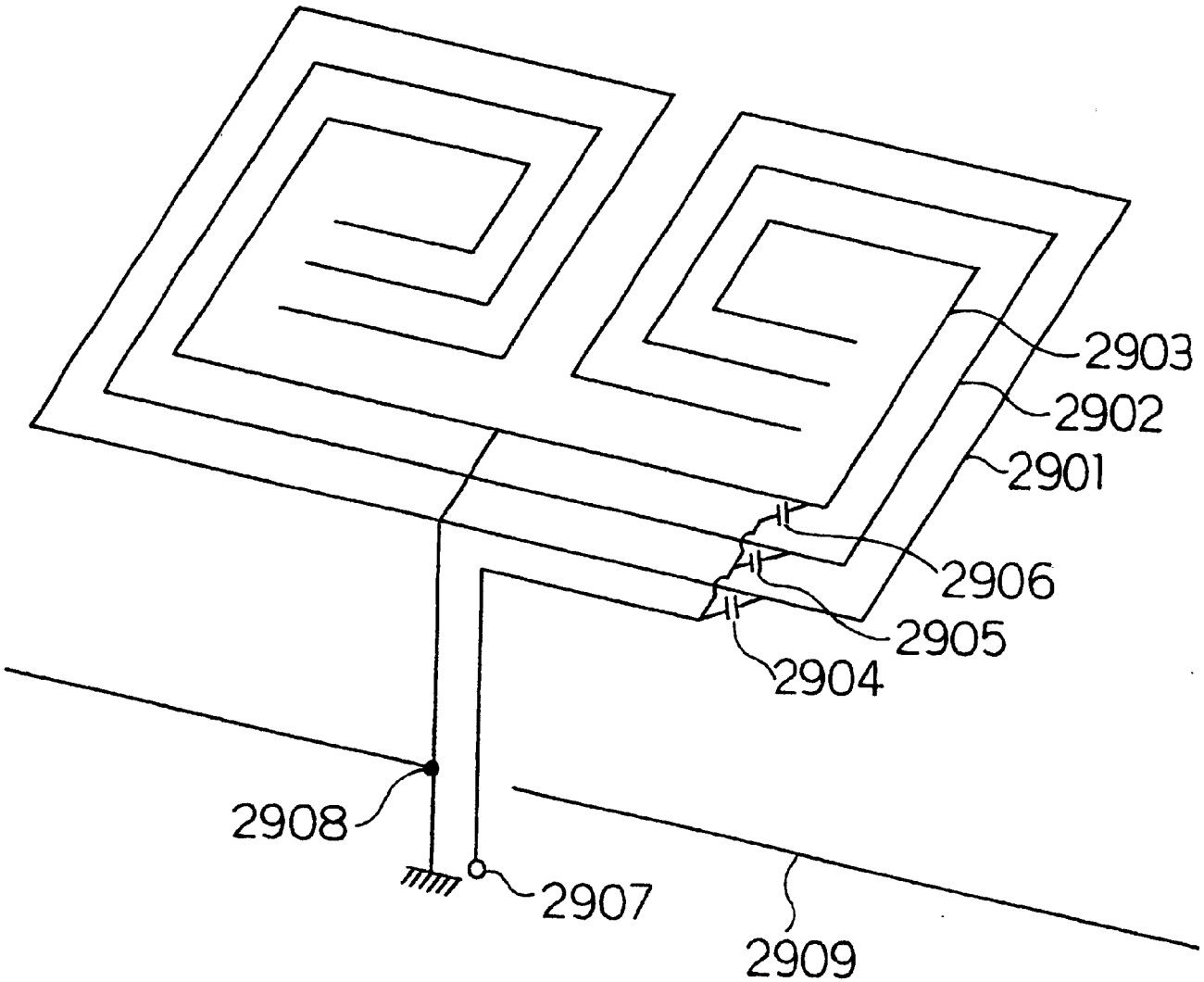
FIG. 58 is a schematic diagram showing an example of an antenna device according to the present invention.

FIG. 58 shows that an antenna consists of a plurality of antenna elements arranged in a predetermined range in the proximity of a conductive earth substrate and served by a single feeding mechanism, a ground terminal of which is connected to the conductive earth substrate. As shown in FIG. 58, a plurality of antenna elements 2901, 2902, and 2903 are served by a single feeding terminal 2907 provided on the opposite side of a conductive earth substrate 2909 to the antenna elements to provide an antenna consisting of the group of antenna elements and a ground terminal 2908 of the feeding section is connected to the conductive earth substrate 2909. This configuration can allow a compact high-gain antenna to be provided in a plane in the proximity of the conductive earth substrate.

Figure 59:
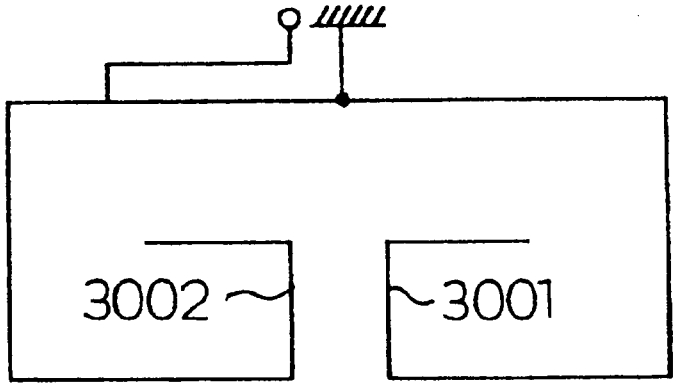
FIG. 59 is a schematic diagram showing an example of an antenna device according to the present invention.
Figure 59:
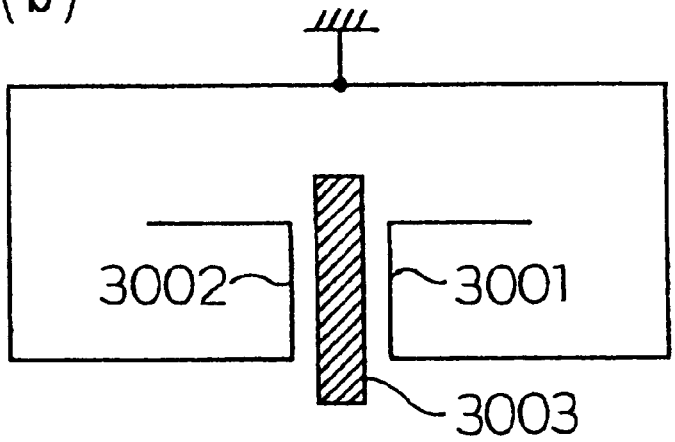
Figure 59:
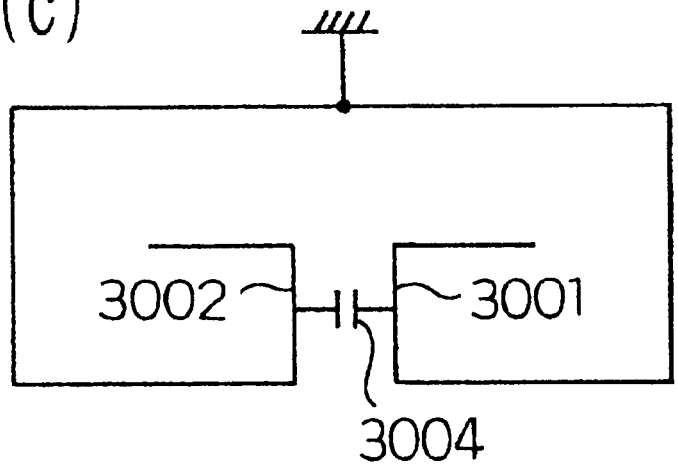

In the antenna of FIG. 59(*a*), the tuning frequency is controlled by setting a distance between opposed portions 3001 and 3002 of an antenna element near its open terminals to a predetermined value to control the coupling between them.

The coupling between the opposed portions 3001 and 3002 of the antenna element near its open terminals can be established by providing a dielectric 3003 as shown in FIG. 59(*b*) or by connecting them through a reactance element 3004 as shown in FIG. 59(*c*). For this purpose, the dielectric 3003 may be movably provided to control the coupling or the reactance element 3004 may be implemented with a variable reactance to control the coupling.

It should be noted that the number of antenna elements is one in this example but it is not limited to this example and may be two or more like the antenna shown in FIG. 54 described above.

Figure 60:
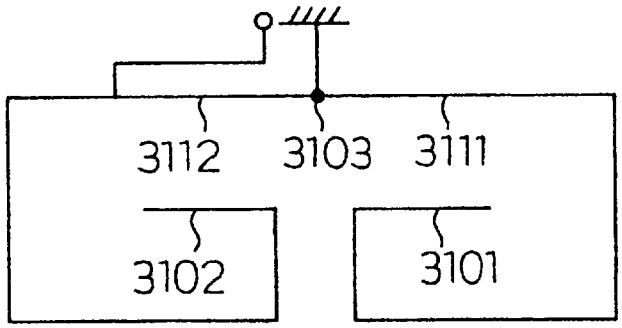
FIG. 60 is a schematic diagram showing an example of an antenna device according to the present invention.
Figure 60:
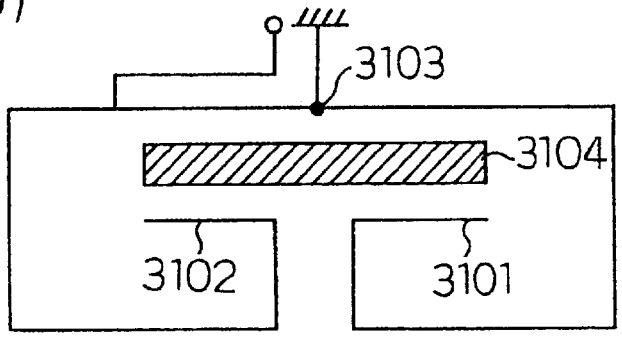
Figure 60:
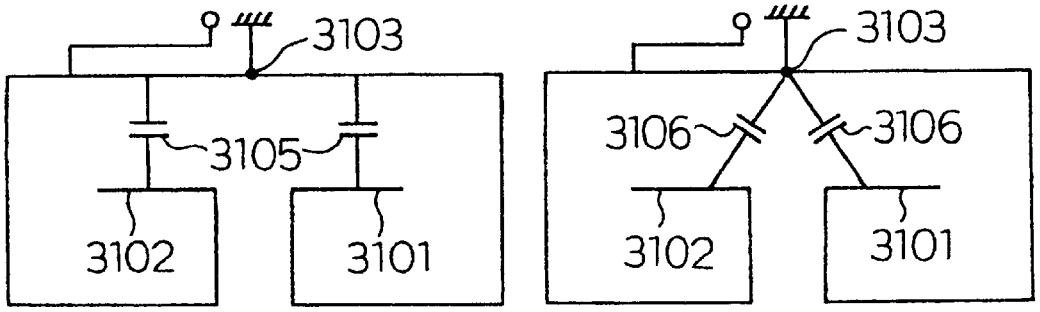

In the antenna of FIG. 60(*a*), the tuning frequency is controlled by setting a distance between open-terminal portions 3101 and 3102 of an antenna element and the neutral point 3103 or their opposed portions 3111 and 3112 near the neutral point to a predetermined value.

The coupling between the open-terminal portions of the antenna element and the neutral point or their opposed portions near the neutral point can be established, as shown in FIGS. 60(*b*) and (*c*), by providing a dielectric 3104 or by connecting them through a reactance element 3105 or 3106. For this purpose, like the thirteenth embodiment described above, the dielectric 3104 may be movably provided to control the coupling or the reactance element 3101 or 3102 may be implemented with a variable reactance to control the coupling.

It should be noted that the number of antenna elements is one also in this example but it is not limited to this example and may be two or more like the antenna shown in FIG. 54 described above.

Figure 61:
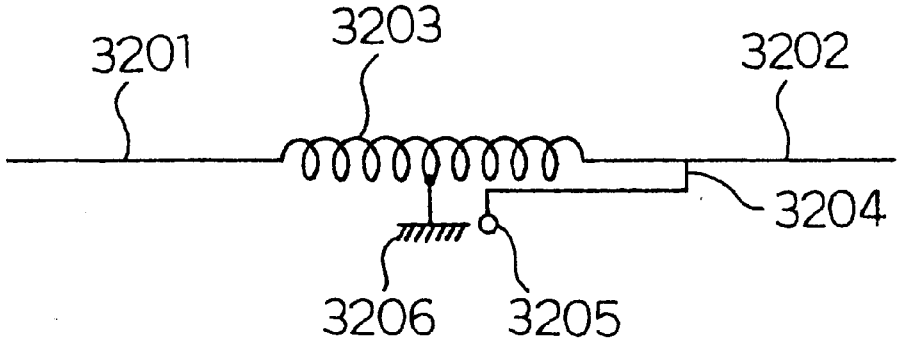
FIG. 61 is a schematic diagram showing an example of an antenna device according to the present invention.
Figure 61:
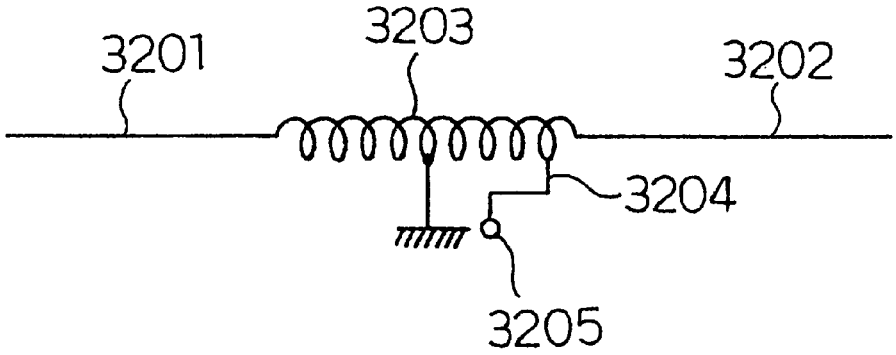

In the antenna device of FIG. 61, at least one linear conductor is connected to each end of a coil, a ground terminal is pulled out of the neutral point of the coil, and a tap is formed in place on the linear conductor or the coil to provide a feeding terminal at the end of the tapping cable. As shown in FIG. 61(*a*), a coil 3203 has a linear conductor 3201 or 3202 at each end of the coil, a ground terminal 3206 is pulled out of the neutral point of the coil 3203, and a tap 3204 is formed in place on the linear conductor (in this case, 3202) to provide a feeding terminal 3205 at the end of the tapping cable. As shown in FIG. 61(*b*), a tap 3204 may be formed in place on a coil 3203 to provide a feeding terminal 3205.

This configuration can allow the tuning frequency of the antenna to be adjusted by controlling the number of turns of coil winding and in addition, it can allow the implementation of a more compact and broadband antenna.

Figure 62:
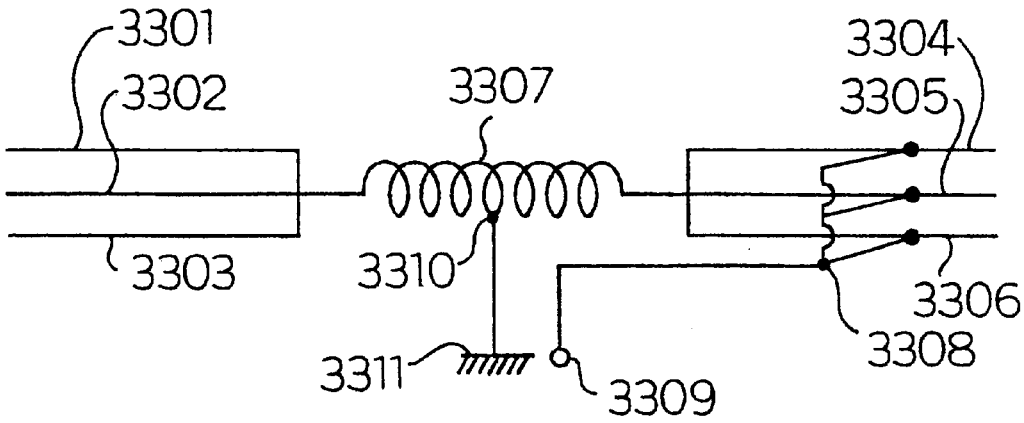
FIG. 62 is a schematic diagram showing an example of an antenna device according to the present invention.
Figure 62:
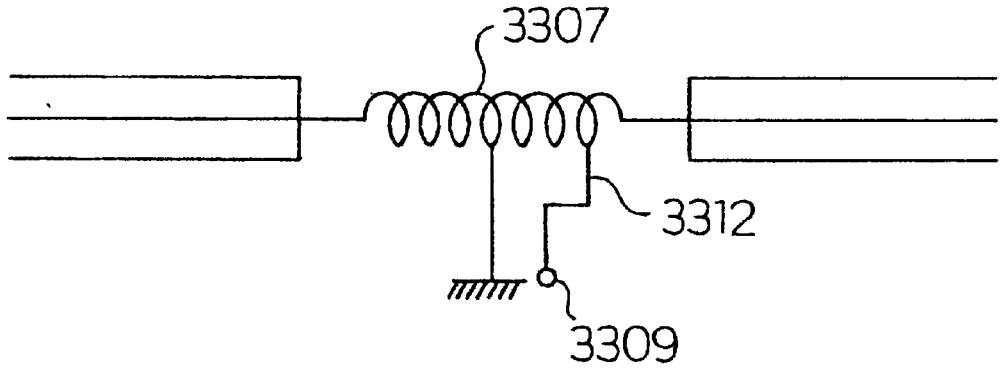

FIG. 62 shows that an antenna device has a plurality of linear conductors connected to a coil. As shown in FIG. 62(*a*), a coil 3307 has a plurality of linear conductors 3301, 3302, and 3303 or 3304, 3305, and 3306 at each end of the coil, a ground terminal 3311 is pulled out of the neutral point 3310 of the coil 3307, and a tap 3308 is formed in place on the linear conductors (in this case, 3304, 3305, and 3306) to provide a feeding terminal 3309 at the end of the tapping cable. As shown in FIG. 62(*b*), a tap 3312 may be formed in place on a coil 3307 to provide a feeding terminal 3309. It should be noted that the three linear conductors are provided on each side of the coil in this example but the number of conductors is not limited to this example and may be any number equal to or more than two.

It should be also noted that the conductors used as antenna elements in this example are all linear but the shape of each conductor is not limited to this example and any conductor may have at least one bend or curve or may be spiral.

Figure 63:
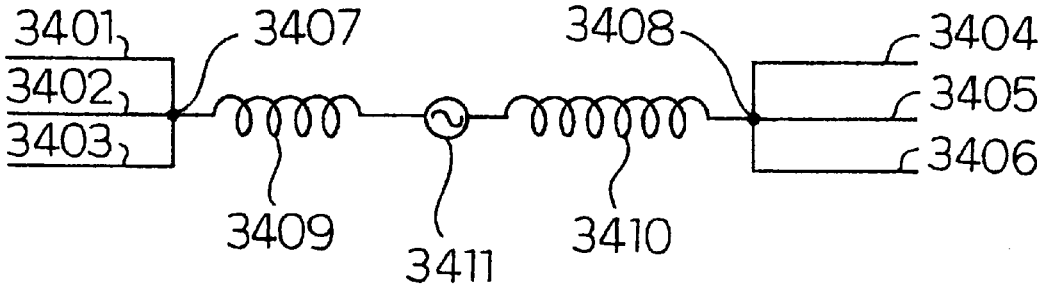
FIG. 63 is a schematic diagram showing an example of an antenna device according to the present invention.

The antenna device of FIG. 63 has one or two groups of linear conductors and each group of them is connected to a feeding section through a coil. As shown in FIG. 63, a group of linear conductors 3401, 3402, and 3403 and another group of linear conductors 3404, 3405, and 3406 are connected to common electrodes 3407 and 3408, respectively, and these electrodes are connected to a feeding section 3411 through coils 3409 and 3410, respectively. This configuration can allow the tuning frequency of the antenna to be adjusted by controlling the number of turns of coil winding and in addition, it can allow the implementation of a more compact and broadband antenna.

Figure 64:
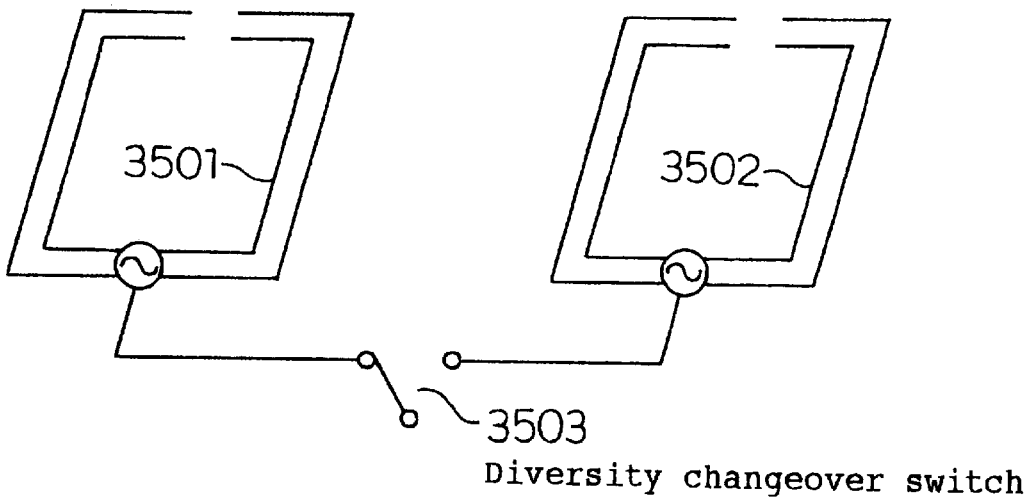
FIG. 64 is a schematic diagram showing an example of an antenna device according to the present invention.

The antenna device of FIG. 64 comprises a plurality of antennas consisting of a plurality of antenna element groups and these antennas are provided within a predetermined range for diversity reception to select one of them which can achieve the optimum receiving state. For example, in FIG. 64, two antennas 3501 and 3502 are switched by a diversity changeover switch 3503 connected to a feeding section of each antenna to select one of the antennas which can achieve the optimum radio-wave propagation. It should be noted that the number of antennas is not limited to two as described for this example but it may be three or more. It should be also noted that the type of antennas is not limited to that shown in FIG. 64 but other types of antennas as described for the preceding embodiments, different types of antennas or the like may be used.

In addition, controlling of selection of the optimum antenna from a plurality of antennas may be accomplished by controlling selection of one which can achieve the maximum receiver input or by controlling selection of one which can achieve the minimum level of multipath disturbance.

It should be further noted that a feeding section for serving each antenna element or each antenna consisting of a plurality of antenna element groups as described above may have a balance-to-unbalance transformer, a mode converter, or an impedance converter connected to it.

Figure 65:
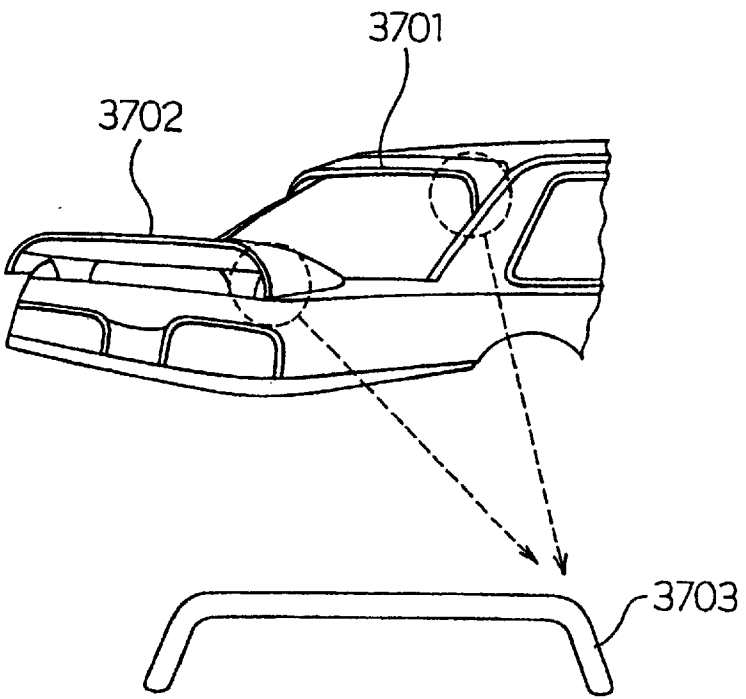
FIG. 65 is a perspective diagram showing possible locations where an antenna device according to the present invention is to be installed.
Figure 65:
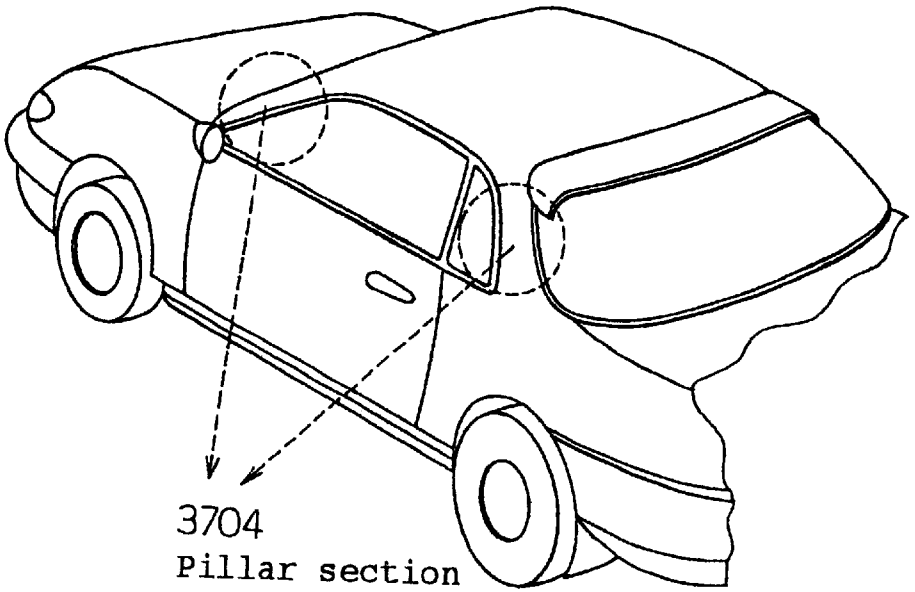

If each antenna described above is to be installed on an automobile in a vertical position, for example, it may be installed on the end 3703 of an automobile spoiler 3701 or 3702, the end 3703 of a sun visor or the like as shown in FIG. 65(*a*) or on a pillar section 3704 as shown in FIG. 65(*b*). Of course, installation locations are not limited to those described here and the antenna may be installed on any other locations which are tilted to some extent with respect to any horizontal plane. Therefore, the reception of a desired polarized wave can be made very easy by positioning the antenna at such locations.

As described above, each antenna device described above can be installed without any portion protruding from the body plane of an automobile because it can be located with its antenna plane parallel to and in the proximity of the body plane which is a conductive earth substrate and in addition, it can be installed even in a narrow space because it takes up only a small area. Therefore, its appearance can be improved with little wind soughing brought about around it and in addition, some other problems such as a risk of its being stolen and labors involved in removing it before car wash can be eliminated.

Figure 66:
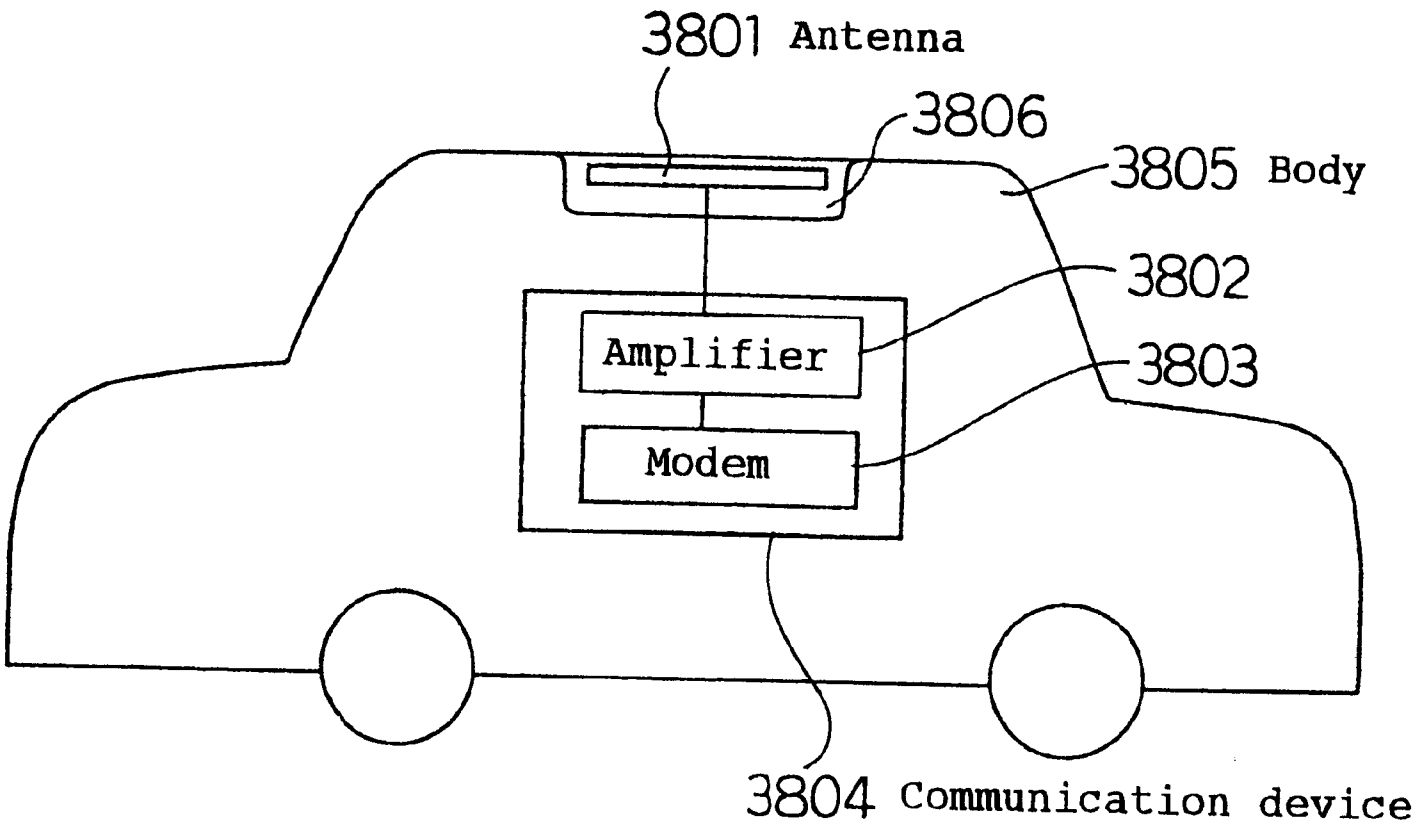
FIG. 66 is a schematic diagram showing an example of a mobile communication device with an antenna device according to the present invention.

FIG. 66 is a schematic diagram showing an example of a mobile communication device with an antenna device.

As shown in FIG. 66, an antenna 3801 according to any one of the preceding embodiments described above is installed on the ceiling of an automobile body 3805. In this case, if the antenna 3801 is located within a recess 3806 in the ceiling, any portion of the antenna will not protrude from the outline of the body 3805. The antenna 3801 is connected to a communication device 3804 which is installed inside the body 3805 and consists of an amplifier 3802, a modem 3803 and the like.

Figure 67:
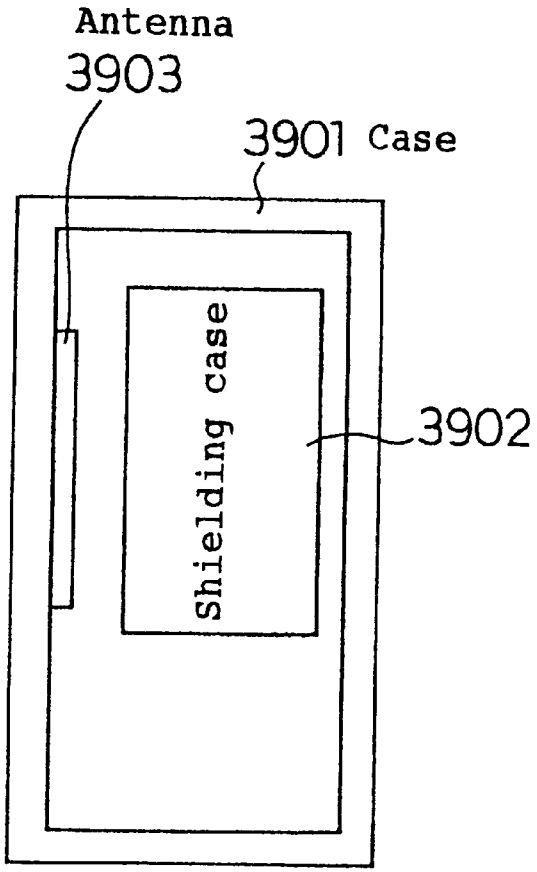
FIG. 67 is a schematic diagram showing an example of a portable telephone with an antenna device according to the present invention.
Figure 67:
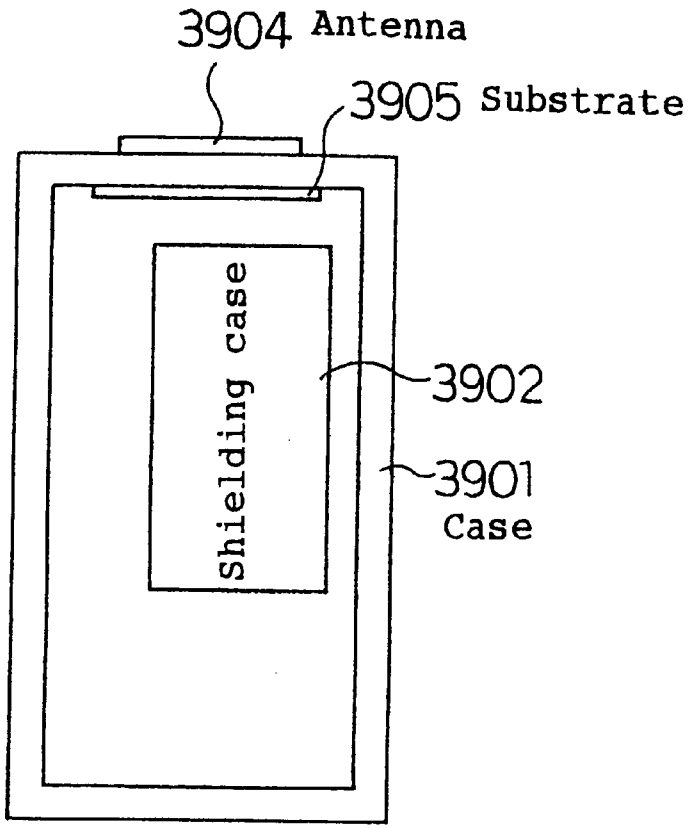

FIG. 67(*a*) shows an example in which a conductive shielding case 3902 provided inside a resinous case 3901 of a portable telephone is used as a conductive earth substrate and an antenna 3903 is located along the inner side of the case 3901 to be parallel to the shielding case 3902. FIG. 67(*b*) shows another example in which an antenna 3904 is located on the top surface outside a resinous case 3901 of a portable telephone and a conductive earth substrate 3905 is provided on the inner wall of the case 3901 opposite to the antenna 3904. In the latter case, the top of a shielding case 3902 is too small to be used as a conductive earth substrate. The antennas used in FIGS. 67(*a*) and (*b*) are preferably those having more bends or more turns of winding which can easily allow the implementation of a compact antenna.

With these configurations, the directional gain on the conductive earth substrate side is very small to the antenna and therefore, possible influence of electromagnetic waves on human body can be reduced without any degradation of antenna efficiency if the antenna device is used with the conductive earth substrate side turned to the user.

It should be noted that the antenna device is installed on an automobile in the above description but it may be installed on other vehicles such as an airplane or ship. Alternatively, it may be installed not only on such vehicles but also on the roadbed, shoulder, tollgate, or tunnel wall of any expressway such as highway, or on the wall, window or the like of any building.

It should be also noted that the antenna device is used with a mobile communication device in the above description but it may be used with any other device which receives or transmits radio waves, such as a television set, a radio-cassette player, or a radio set, for example.

It should be further noted that the antenna device is implemented in a portable telephone in the above description but it may apply to other portable radio sets, such as a PHS (Personal Handy Phone system) device, a pager, or a navigation system, for example.

Figure 70:
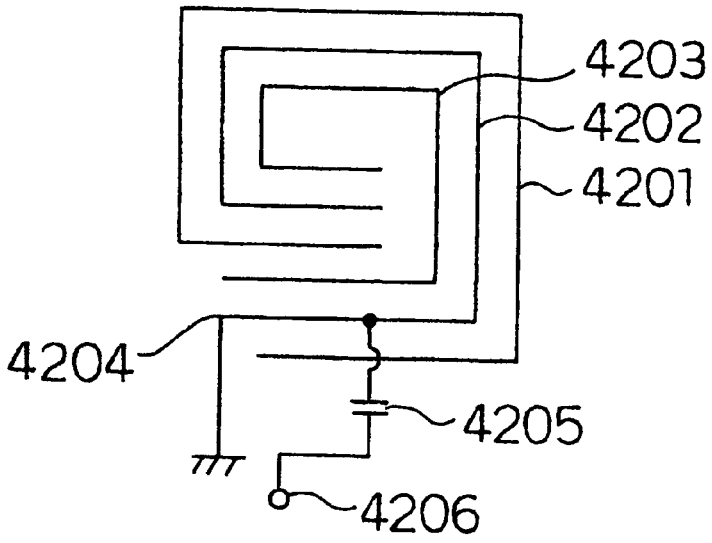
FIG. 70 is a schematic diagram showing an example of an antenna device according to the present invention.
Figure 70:
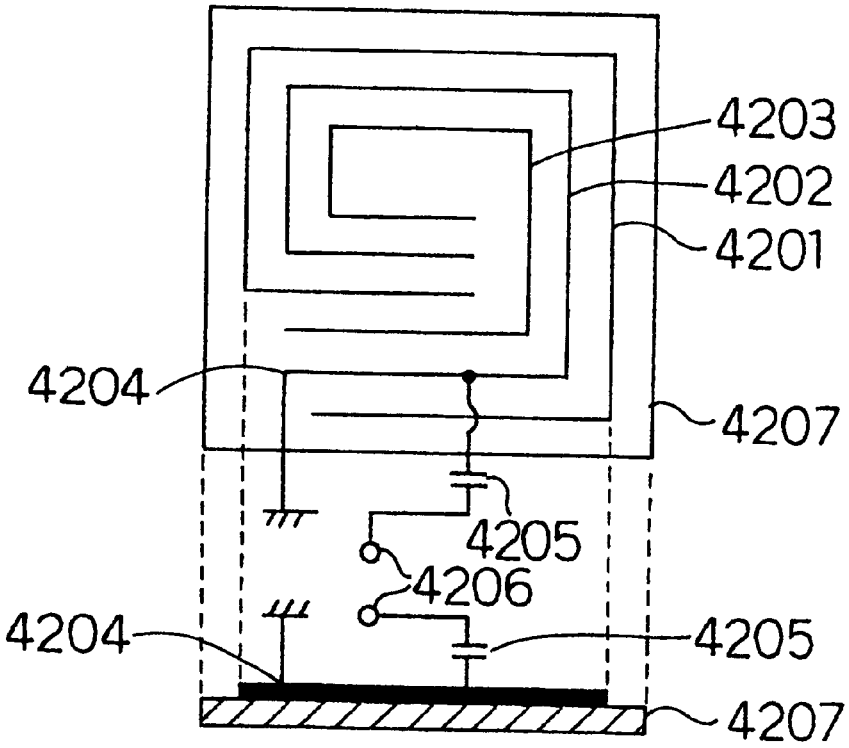

FIG. 70(*a*) shows a monopole-type broadband antenna which comprises a main antenna element 4202 having an end connected to a ground 4204, an antenna element 4201 located in the proximity of the main antenna element 4202 and having a length longer than the antenna element 4202 and no end connected to a ground, and an antenna element 4203 having a length shorter than the antenna element 4202 and no end connected to a ground. The main antenna element 4202 is provided with a tap which is connected to a feeding point 4206 through a reactance element 4205 for impedance adjustment. FIG. 70(*b*) shows another antenna device which is obtained by forming on a printed circuit board 4207 antenna elements 4201, 4202, and 4203 of the antenna device of FIG. 70(*a*) described above through a printed-wiring technique.

Figure 71:
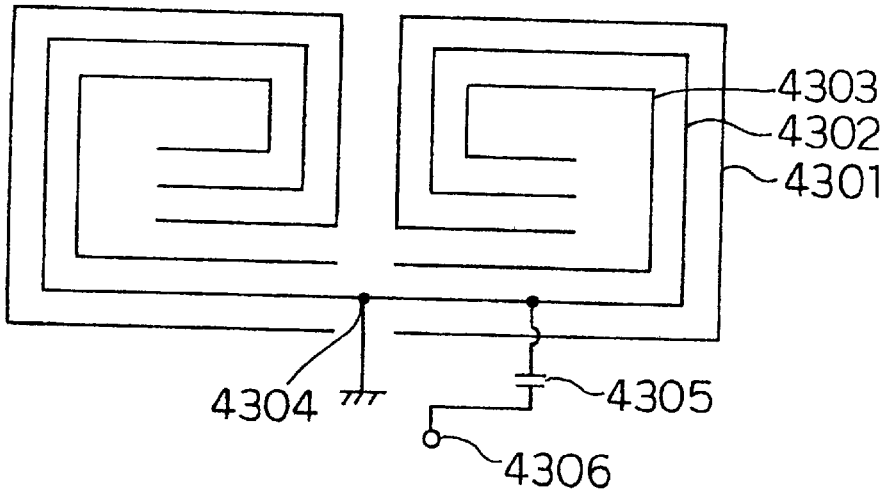
FIG. 71 is a schematic diagram showing an example of an antenna device according to the present invention.
Figure 71:
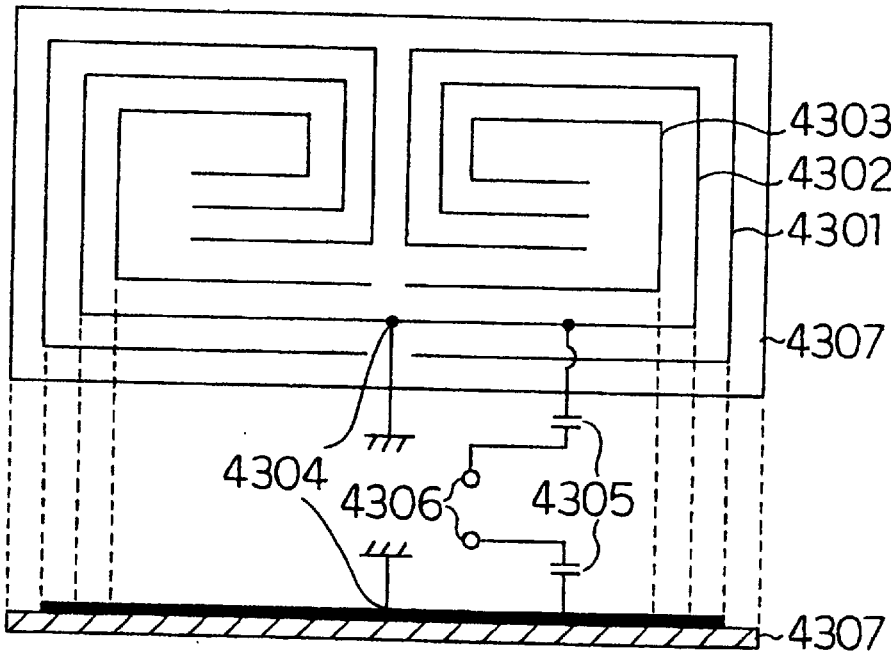

FIG. 71 shows a dipole-type antenna device of the configuration described above. Namely, FIG. 71(*a*) shows a dipole-type broadband antenna which comprises a main antenna element 4302 having the center connected to a ground 4304, an antenna element 4301 located in the proximity of the main antenna element 4302 and having a length longer than the antenna element 4302 and no portion connected to a ground, and an antenna element 4303 having a length shorter than the antenna element 4302 and no portion connected to a ground. The main antenna element 4302 is provided with a tap which is connected to a feeding point 4306 through a reactance element 4305 for impedance adjustment. FIG. 71(*b*) shows another antenna device which is obtained by forming on a printed circuit board 4307 antenna elements 4301, 4302, and 4303 of the antenna device of FIG. 71(*a*) described above through a printed-wiring technique.

These configurations can implement a broadband and high-gain antenna device which is very simple and easy to adjust.

It should be noted that a shorter antenna element and a longer antenna element are located in the proximity of a main antenna element in this example but two or more antenna elements may be located on each side of the main antenna.

Figure 72:
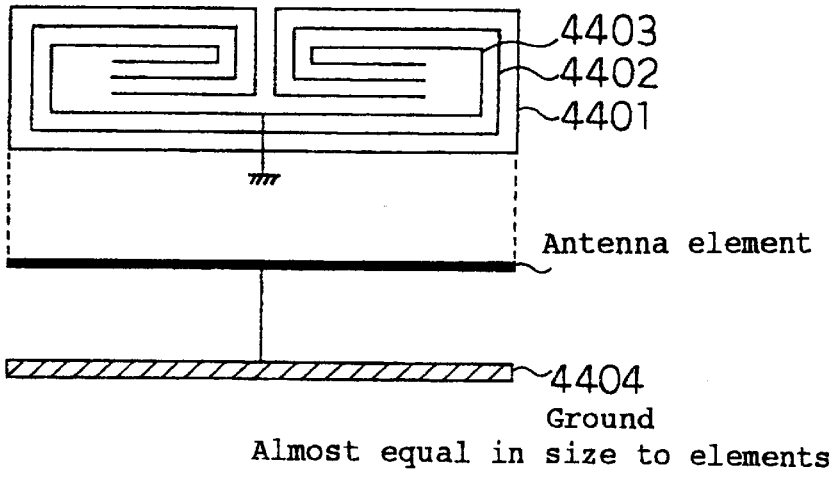
FIG. 72 is a schematic diagram showing an example of an antenna device according to the present invention.
Figure 72:
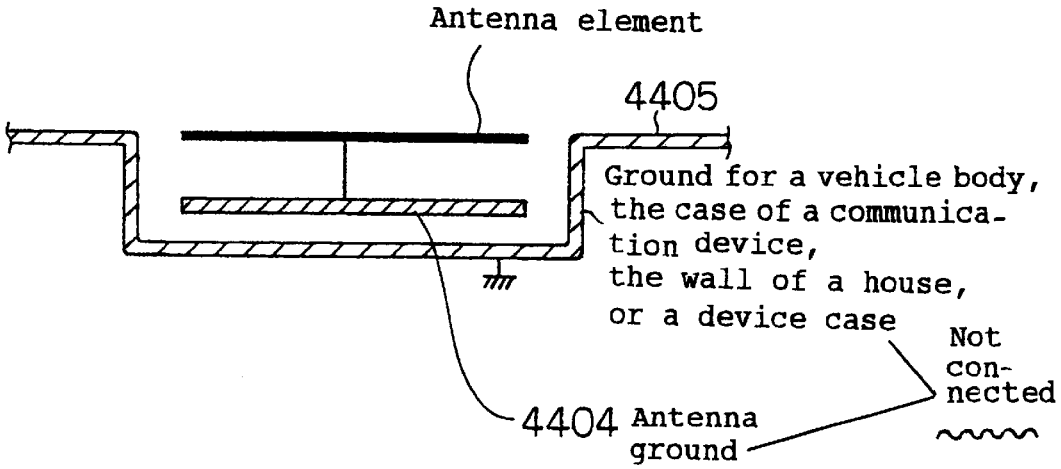

FIG. 72(*a*) shows an antenna device similar to those shown in FIG. 40 or other figures described above, in which a conductive earth substrate is located in the proximity of antenna elements and the antenna device of this example differs from those devices in that a conductive earth substrate 4404 located in the proximity of antenna elements 4401, 4402, and 4403 is almost equal in size to or smaller than the outermost antenna element 4401. Such a configuration can improve the gain for horizontally polarized waves as compared with the case where a conductive earth substrate is larger than an antenna element.

FIG. 72(*b*) shows that the antenna device of FIG. 72(*a*) described above is located within a recess in a vehicle body, the case of a communication device, the wall of a house, any other device case, or the like and that an antenna ground (conductive earth substrate) 4404 is not connected to a ground for such a case. This configuration can provide a higher gain for both horizontally and vertically polarized waves. The directional gain characteristics of this antenna device are shown in FIG. 122 for vertically polarized waves. As seen from the figure, when the distance (that is, separation) between an antenna ground and a case ground is (a) 10 mm, (b) 30 mm, (c) 80 mm, or (d) 150 mm, the shorter distance can provide the higher gain. Namely, when the antenna ground is closer to the case ground, the better performance can be obtained. It should be noted that in the example, the antenna ground 4404 is located within a recess in a vehicle body, the case of a communication device, the wall of a house, any other device case, or the like to prevent the antenna from popping out of the outer case but the antenna ground maybe located in the proximity of the flat plane of the case ground at a distance, resulting in similar effects. Even in the latter case, the antenna falls within the scope of the present invention.

It should be also noted that an antenna element of balanced type is used in this example but an antenna element of unbalanced type may result in similar effects.

Figure 73:
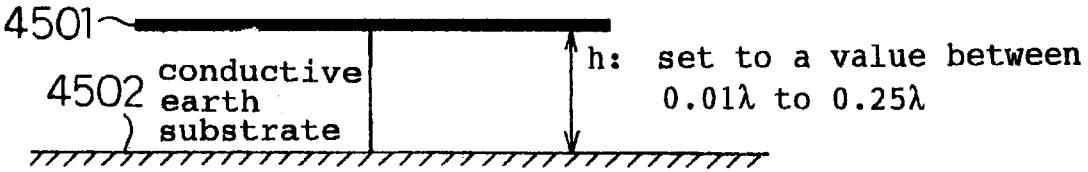
FIG. 73 is a schematic diagram showing an example of an antenna device according to the present invention.
Figure 73:
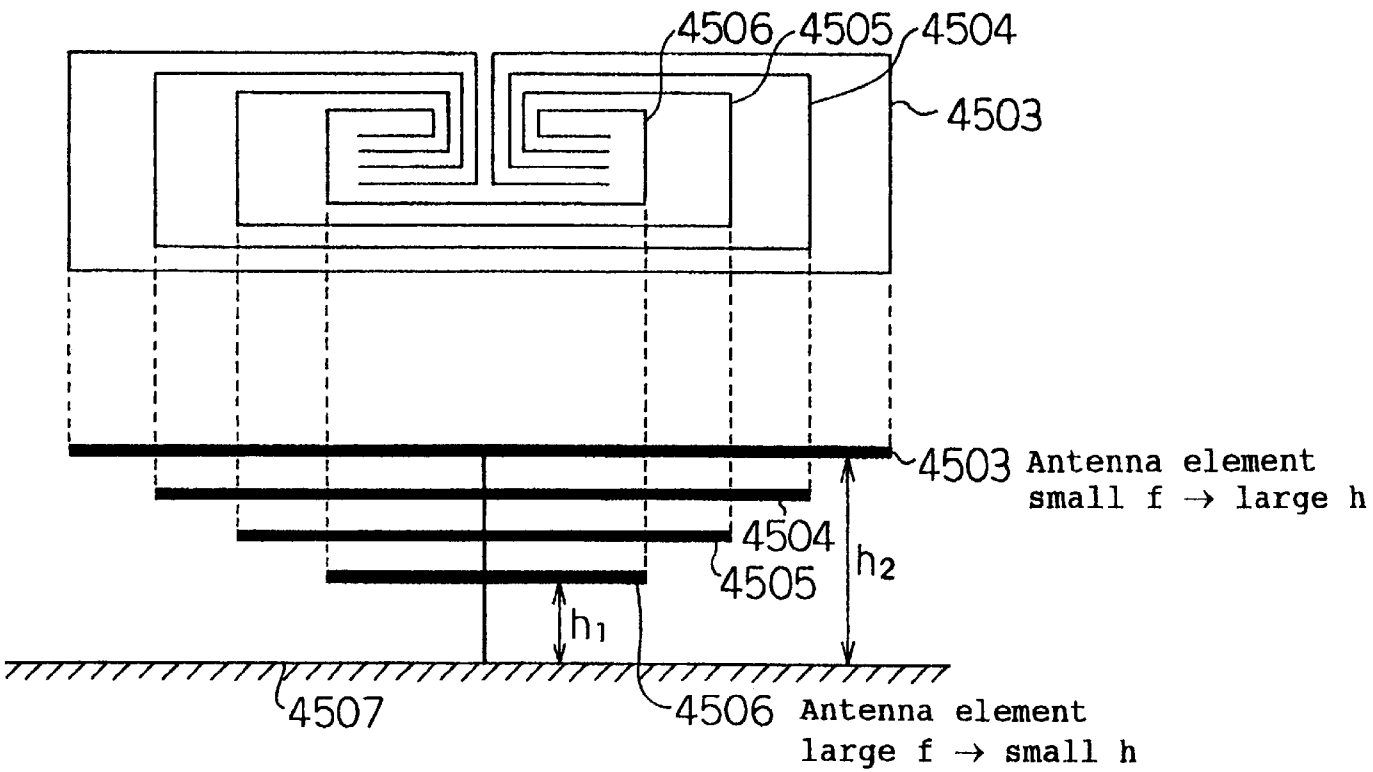

FIG. 73 shows how proximate to a conductive earth substrate an antenna element is to be located and FIG. 73(*a*) is an example where a single antenna element is located. Namely, the distance h between an antenna element 4501 (to speak properly, an antenna grounding connection) and a conductive earth substrate 4502 is set to a value within 0.01 to 0.025 times as large as a wavelength $\lambda$ for the resonance frequency f of the antenna (that is, $0.01\lambda$ to $0.25\lambda$). This configuration can implement a high-gain antenna which is very easy to adjust.

FIG. 73(*b*) is another example where four antenna elements 4503, 4504, 4505, and 4506 are located at different distances from a conductive earth substrate 4507, respectively. As shown in FIG. 73(*b*), when the antenna elements have different lengths, the shorter element can have the higher resonance frequency and the shorter wavelength. Therefore, the distance h1 for the shortest antenna element 4506 may be set to the smallest value, the distance h2 for the longest antenna element 4503 may be set to the largest value, and the distances for the medium antenna elements 4504 and 4505 may be set to values depending on the wavelengths at their resonance frequencies, respectively. Then, the distance between each of the antenna elements 4503, 4504, 4505, and 4506 and the conductive earth substrate 4507 must satisfy the condition that it falls within the range of 0.01 to 0.25 times as large as a wavelength λ for the resonance frequency f of each antenna element (that is, 0.01λ to 0.25λ).

Figure 74:
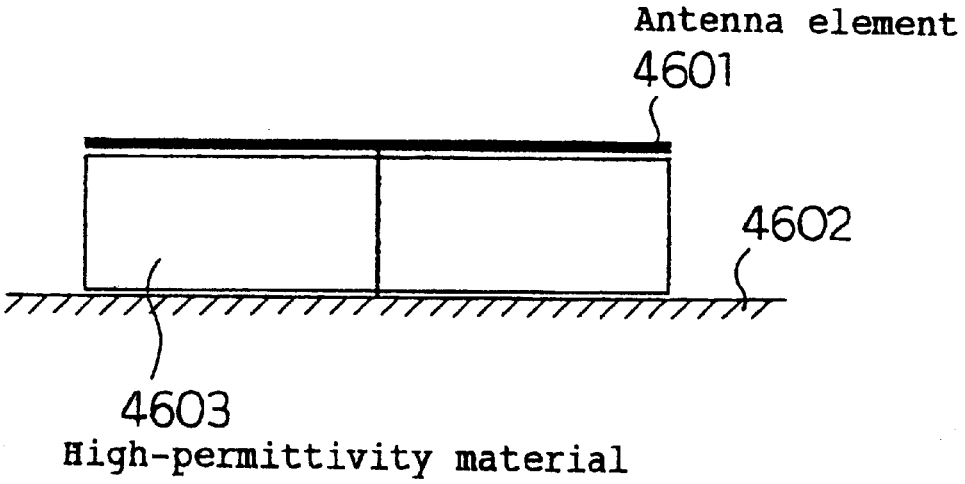
FIG. 74 is a schematic diagram showing an example of an antenna device according to the present invention.

FIG. 74 shows that a high-permittivity material is provided between an antenna element 4601 and a conductive earth substrate 4602. Therefore, this configuration can apply to any other antenna device described above where a conductive earth substrate is located in the proximity of an antenna element. It should be also noted that the distance between the antenna element and the conductive earth substrate can be reduced equivalently by providing such a high-permittivity material between them.

Figure 75:
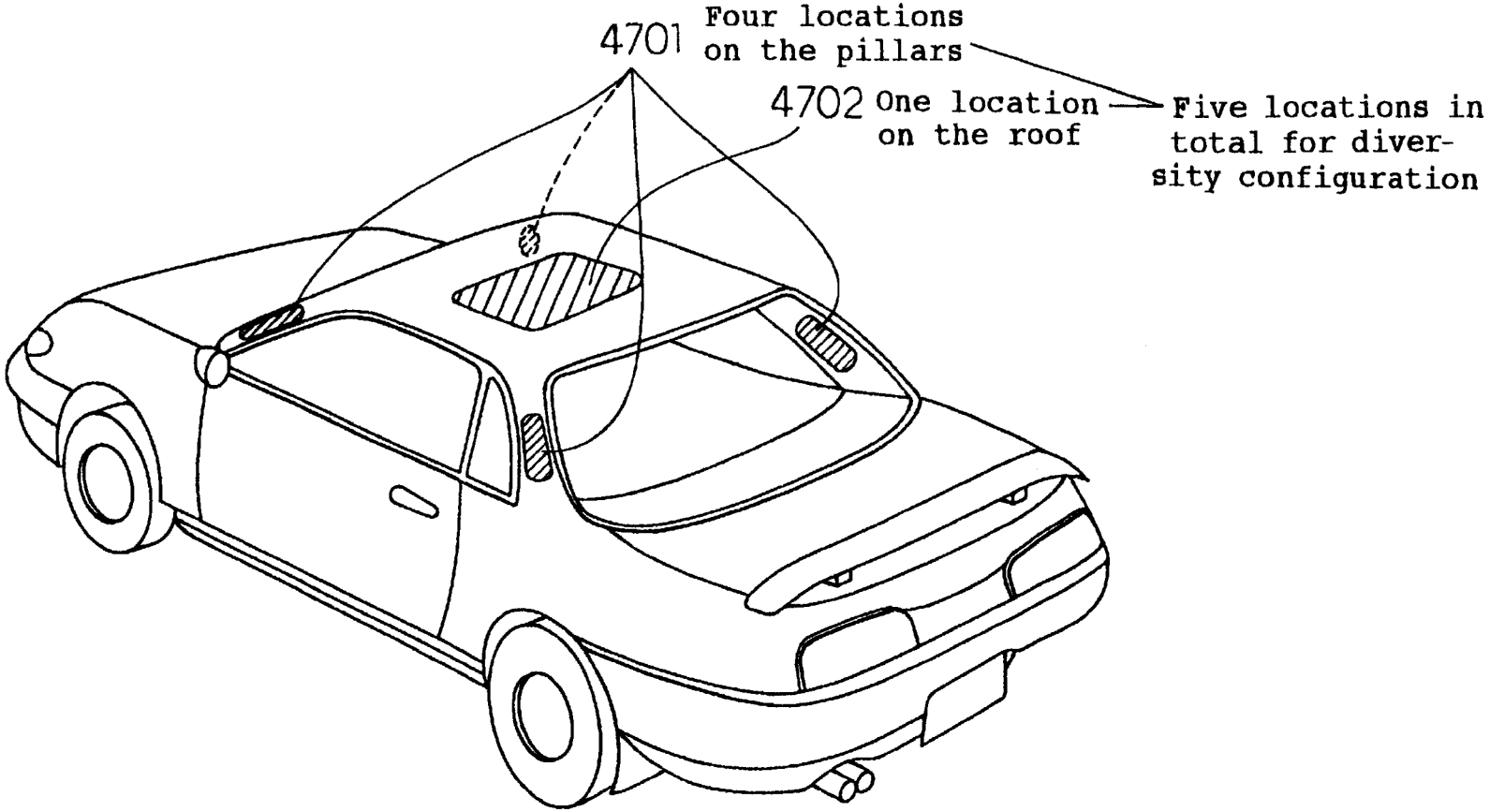
FIG. 75 is a perspective diagram showing a possible automobile application of an antenna device according to the present invention.

FIG. 75 shows that any one of the antenna devices described above is installed at five locations in total, that is, one on each of the four pillars 4701 and one on the roof, to provide a diversity configuration of these flat antennas. This configuration can offer a good capability of receiving and transmitting both horizontally and vertically polarized waves. It should be noted that the antenna device is installed at five locations in this example but it may be installed at more or less locations.

Figure 76:
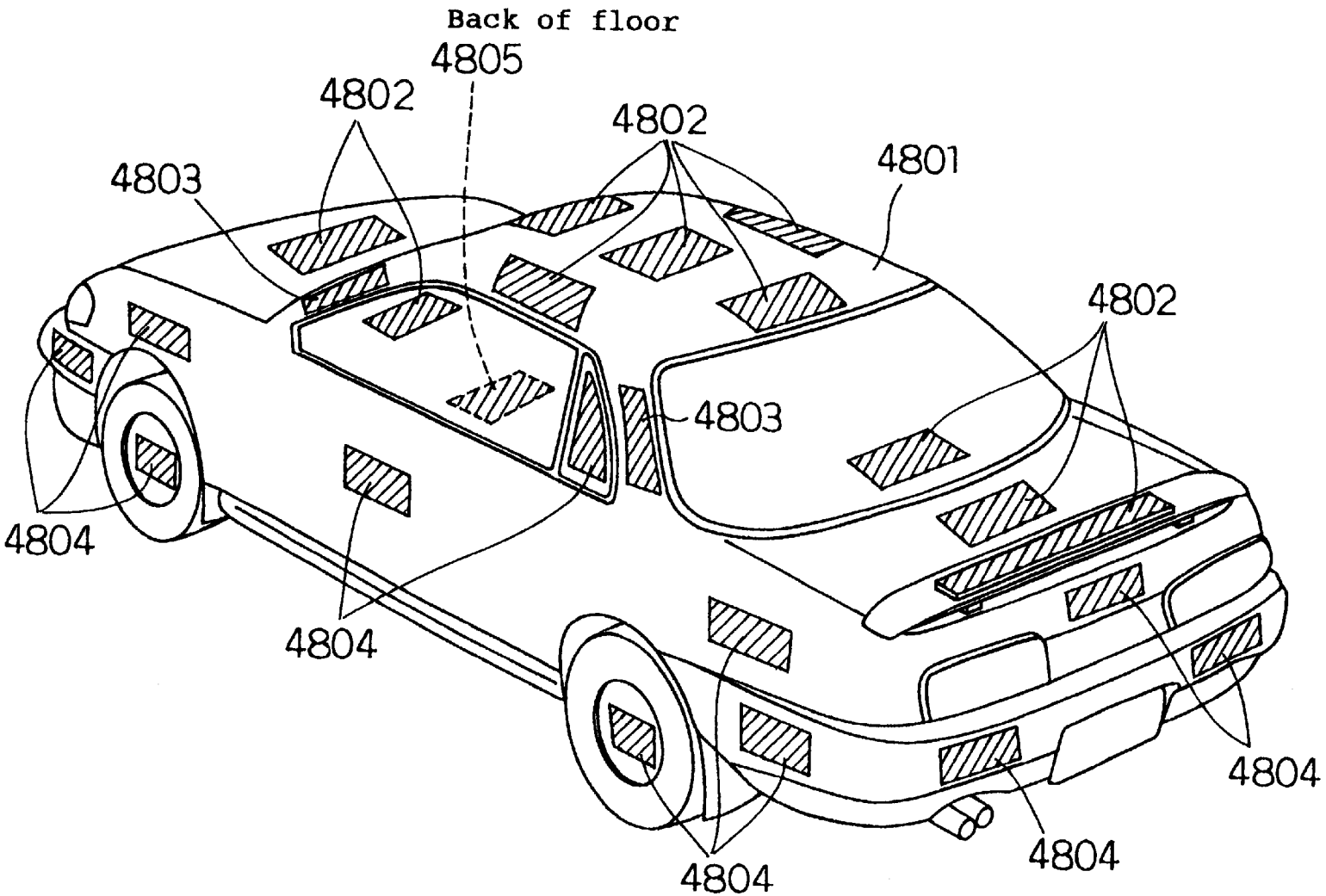
FIG. 76 is a perspective diagram showing possible locations where an antenna according to the present invention is to be installed for each part of the automobile.

FIG. 76 shows that any one of the antenna devices described above is installed at any one or more locations on the roof panel, hood, pillars, side faces, bumpers, wheels, floor, or other surface portions of an automobile body 4801. In FIG. 76, an antenna 4802 is installed at a location where the antenna plane is almost in a horizontal position, an antenna 4803 is installed at a location where the antenna plane is in a tilted position, and an antenna 4804 is installed at a location where the antenna plane is almost in a vertical position. It should be noted that this figure shows possible locations for antenna installation by way of example and all the locations shown are not provided with antennas. Of course, it should be also noted that an antenna may be installed at any location other than those shown. It should be further noted that the automobile type is not limited to such a passenger car as shown and an antenna according to the present invention may be installed on a bus, truck, or any other type of automobile.

In addition, since an antenna 4805 is installed at a location where the antenna plane is in a horizontal position, and specifically, on the back (undersurface) of the floor with its directivity facing the roadbed, it is suitable for communication with a wave source installed on the road (or embedded therein) which is to be used for communication or detection of vehicle positions.

Figure 77:
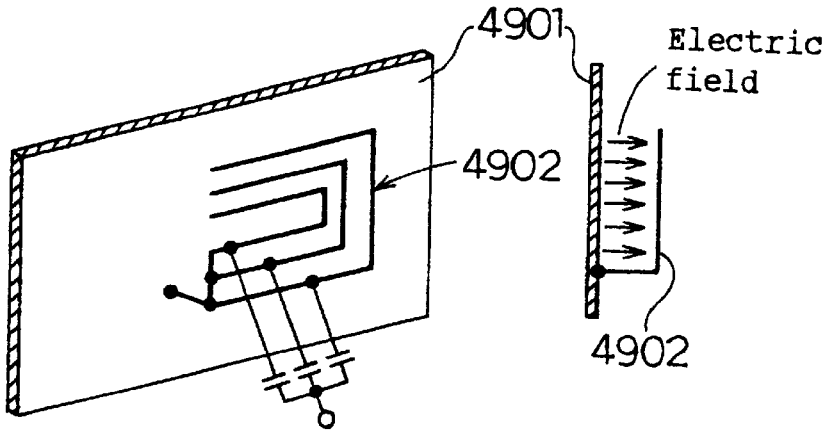
FIG. 77 is a diagram for explaining the properties of an antenna according to the present invention.
Figure 77:
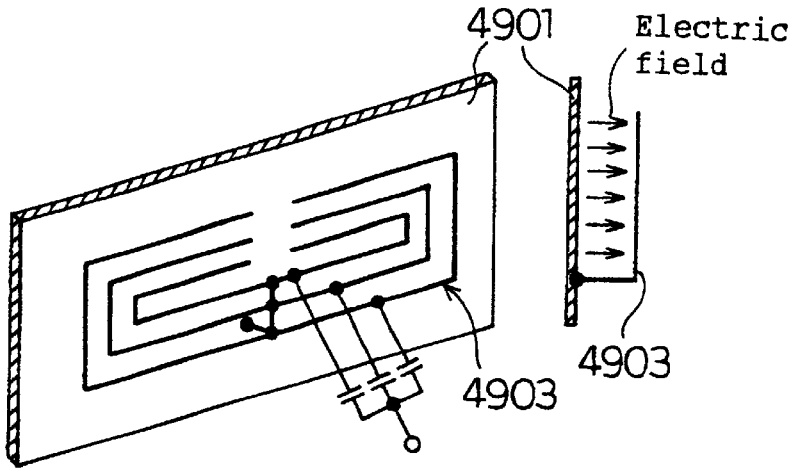

Generally, airwaves for TV or FM broadcasting mainly consist of horizontally polarized waves, while waves for portable telephone, radio communication, or the like mainly consist of vertically polarized waves. Whether an antenna is suitable for horizontally polarized waves or vertically polarized waves depends on the direction of its installation. As shown in FIG. 77(*a*), an antenna 4902 which is installed parallel to a conductive earth substrate 4901, that is, a vertical surface portion of an automobile body 4801 and comprises three antenna elements of unbalanced type with their grounded ends connected together is effective for horizontally polarized waves, since its sensitivity to horizontally polarized waves can be raised because of the horizontal electric field as shown in the right of the figure. This can be accomplished by installing an antenna 4804 as shown in FIG. 76. On the other hand, an antenna 4802 which is installed parallel to a horizontal surface portion of the automobile body 4801 is effective for vertically polarized waves, since its sensitivity to vertically polarized waves can be raised because of the vertical electric field. In addition, an antenna 4803 which is installed in a tilted position can be used regardless of the direction of polarization, since its sensitivity is balanced between horizontally and vertically polarized waves depending on the degree of tilt. FIG. 77(*b*) shows an example of antenna of balanced type, which is effective for horizontally polarized waves in a similar manner to that described above.

Figure 78:
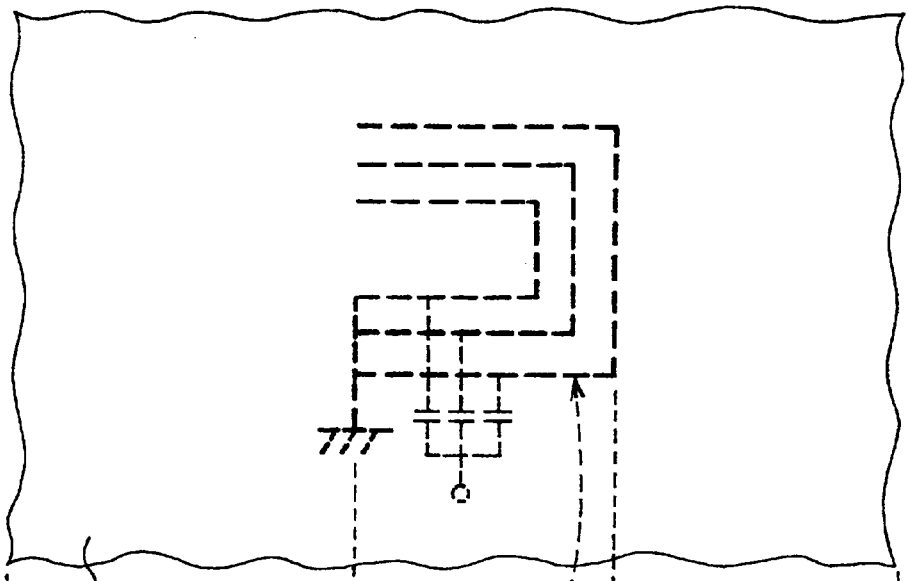
FIG. 78 is a schematic diagram showing an example of an antenna device according to the present invention.
Figure 78:
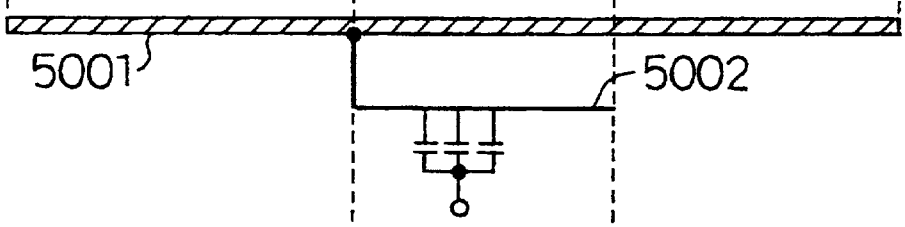
Figure 78:
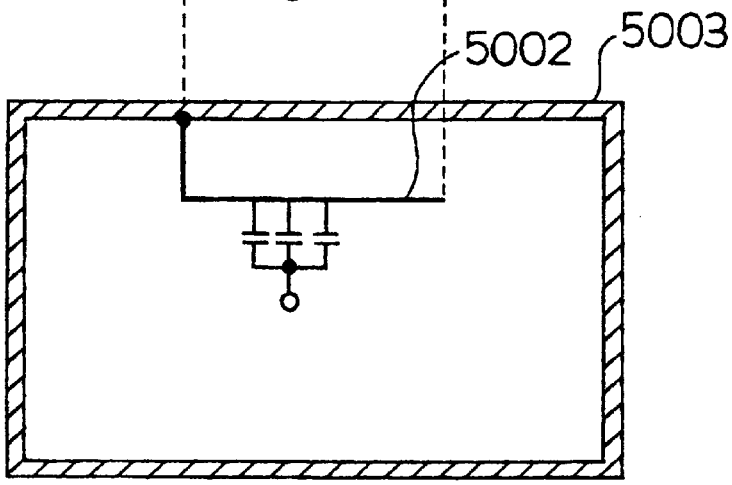

The antenna device of FIG. 78 differs from the antenna devices described above in that it receives or transmits waves from the side of its conductive earth substrate rather than from the side of its antenna elements. As shown in FIG. 78(*a*), an antenna 5002 of three antenna elements is installed parallel to a conductive earth substrate 5001 at a distance and a grounded end of the antenna 5002 is connected to the conductive earth substrate 5001, which faces toward the outside. This antenna has symmetrical directional characteristics on the upper region of the conductive earth substrate 5001 corresponding to the area covered by the antenna 5002 (on the opposite side to the antenna 5002 ) and on the lower region there of as shown in FIG. 78(*b*). Therefore, even if the antenna 5002 and the conductive earth substrate 5001 are located inversely, it can achieve the same effect as those of the antennas described above. In addition, even if a conductive earth substrate 5003 is formed as a sealed case as shown in FIG. 78(*c*), an antenna 5002 inside the conductive earth substrate 5003 can have similar characteristics and communicate with the outside through the conductive earth substrate 5003 when it is fed.

Figure 79:
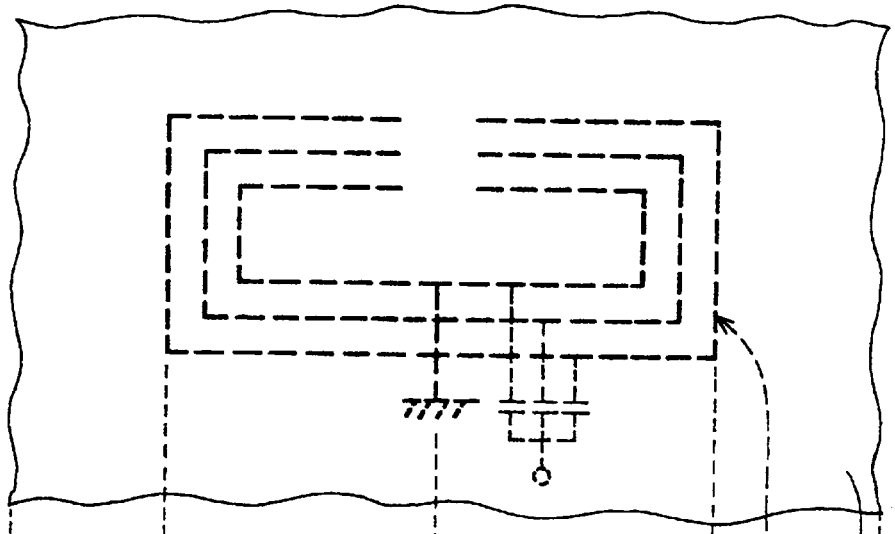
FIG. 79 is a schematic diagram showing an example of an antenna device according to the present invention.
Figure 79:
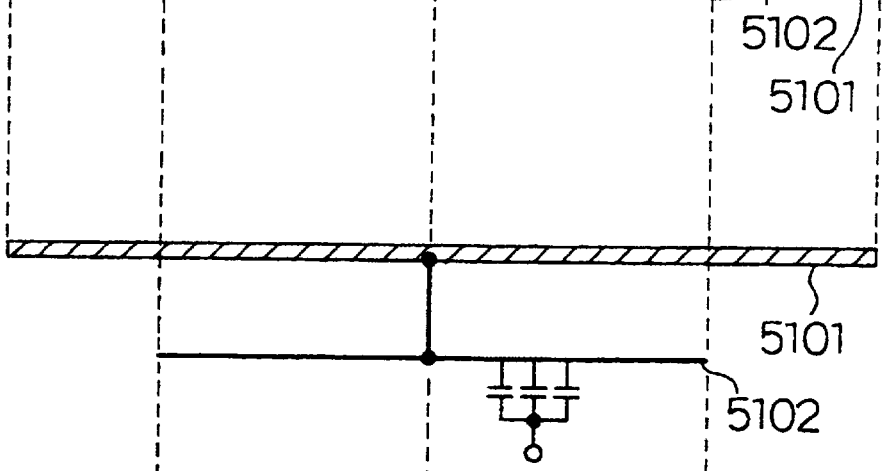
Figure 79:
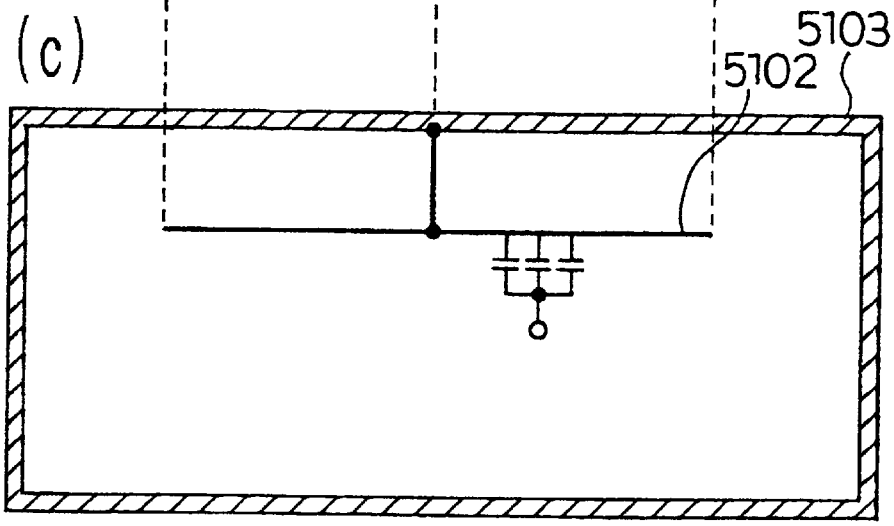

FIG. 79 shows an example of an antenna device of balanced type which can achieve the same effect as those described above, while FIG. 78 shows an antenna device of unbalanced type.

Figure 80:
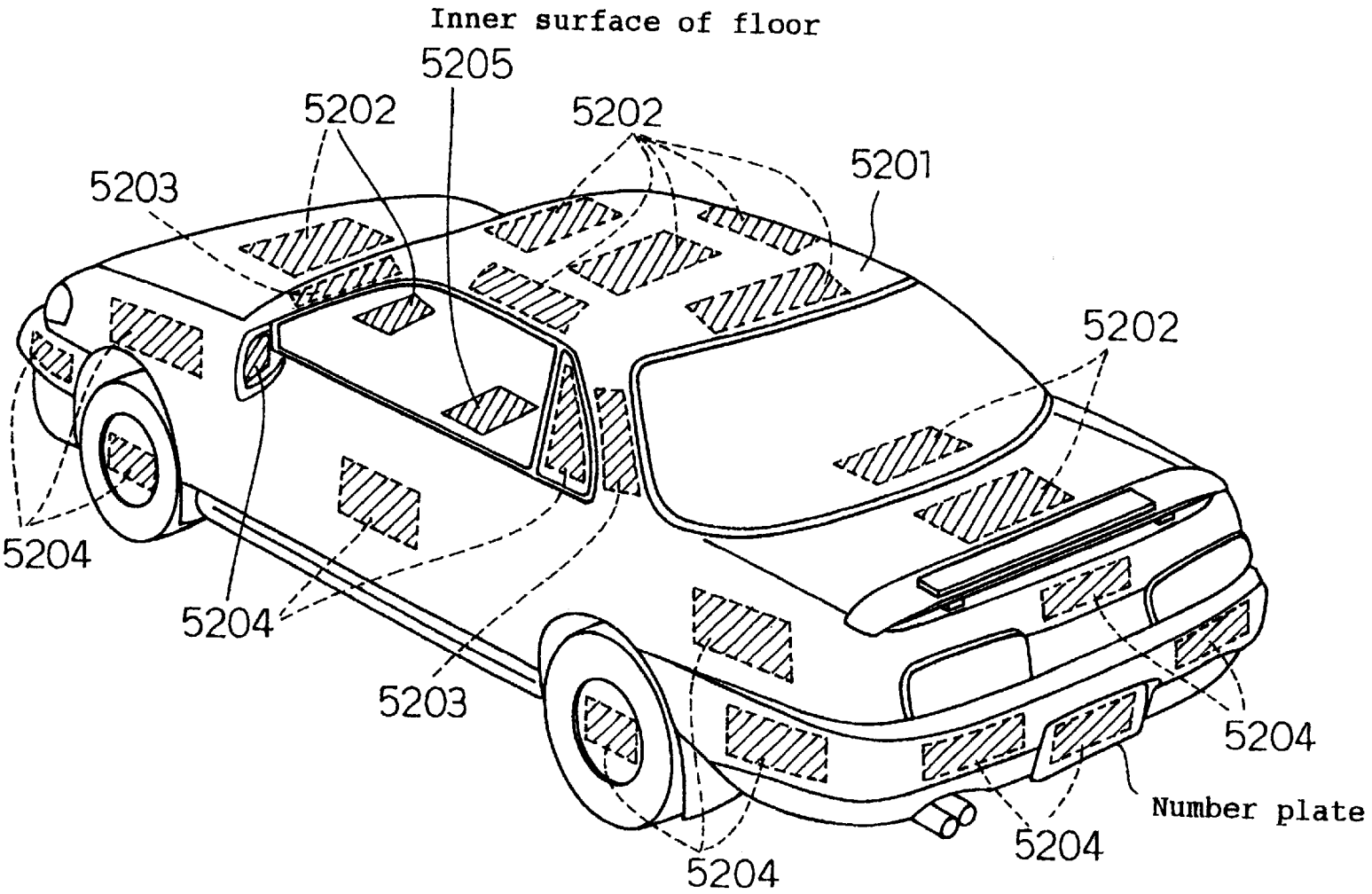
FIG. 80 is a perspective diagram showing possible locations where an antenna according to the present invention is to be installed for each part of the automobile.

FIG. 80 is a schematic diagram showing possible locations where the antenna device according to the present embodiment is to be installed for automobile applications similar to those of FIG. 76. In FIG. 80, like in FIG. 76, an antenna 5202 is installed at a location where the antenna plane is almost in a horizontal position, an antenna 5203 is installed at a location where the antenna plane is in a tilted position, and an antenna 5204 is installed at a location where the antenna plane is almost in a vertical position. In addition, since an antenna 5205 is installed at a location where the antenna plane is in a horizontal position, and specifically, on the inner surface of the floor, it is suitable for communication with a wave source installed on the road in a similar manner to that of FIG. 76. Although these antennas shown are all installed inside an automobile body 5201, they can achieve the same performance as that for the antennas installed on the outer surface of the automobile body for the reasons described above and in addition, they are very advantageous in appearance, damages, or risk of being stolen because they are not exposed to the outside of the body. Moreover, as shown in FIG. 80, the antenna device may be installed on a rearview mirror, in-car sun visor, number plate, or any other location where it cannot be otherwise installed on the outer surface, by embedding it within the inside space of such a component.

Figure 81:
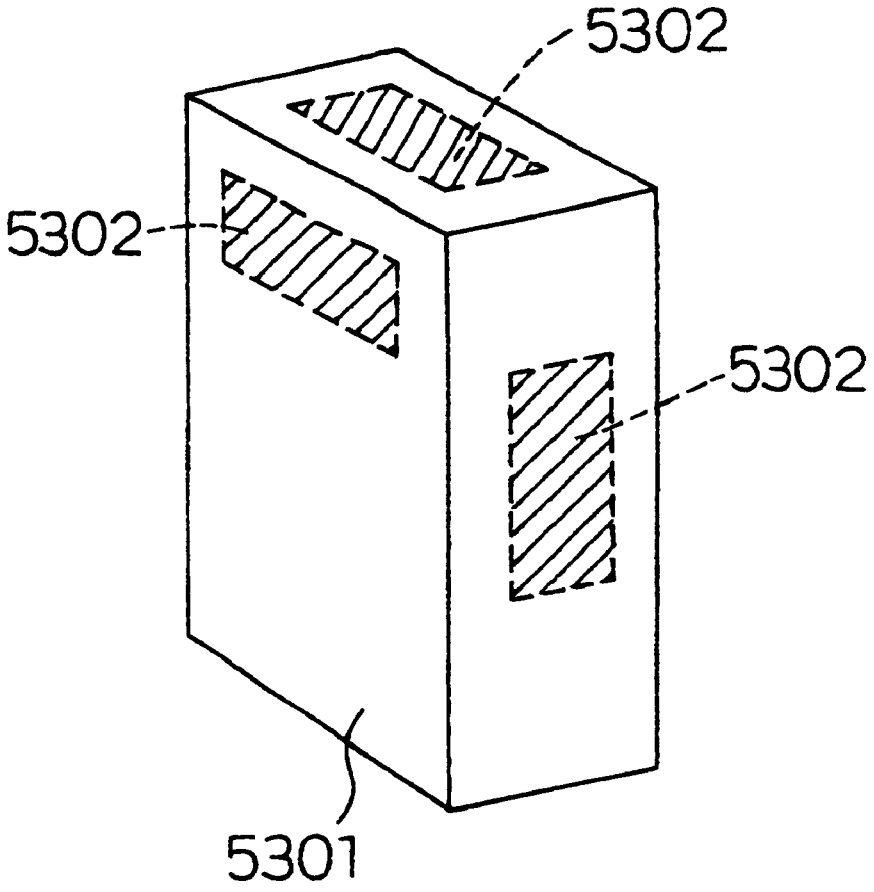
FIG. 81 is a perspective diagram showing a possible application to a portable telephone of an antenna according to the present invention.

FIG. 81 is a schematic diagram showing a possible application to a portable telephone of any of the antenna devices described above, in which an antenna 5302 is installed inside a conductive grounded case 5301 with an antenna ground connected thereto. This configuration can allow the antenna to be used in a similar manner to the case where the antenna is installed outside the grounded case 5301 and it can make the antenna very advantageous in handling because the antenna is not exposed to the outside. It should be noted that the antenna is used with a portable telephone in this example but it can also apply to a TV, PHS, or other radio set.

Figure 82:
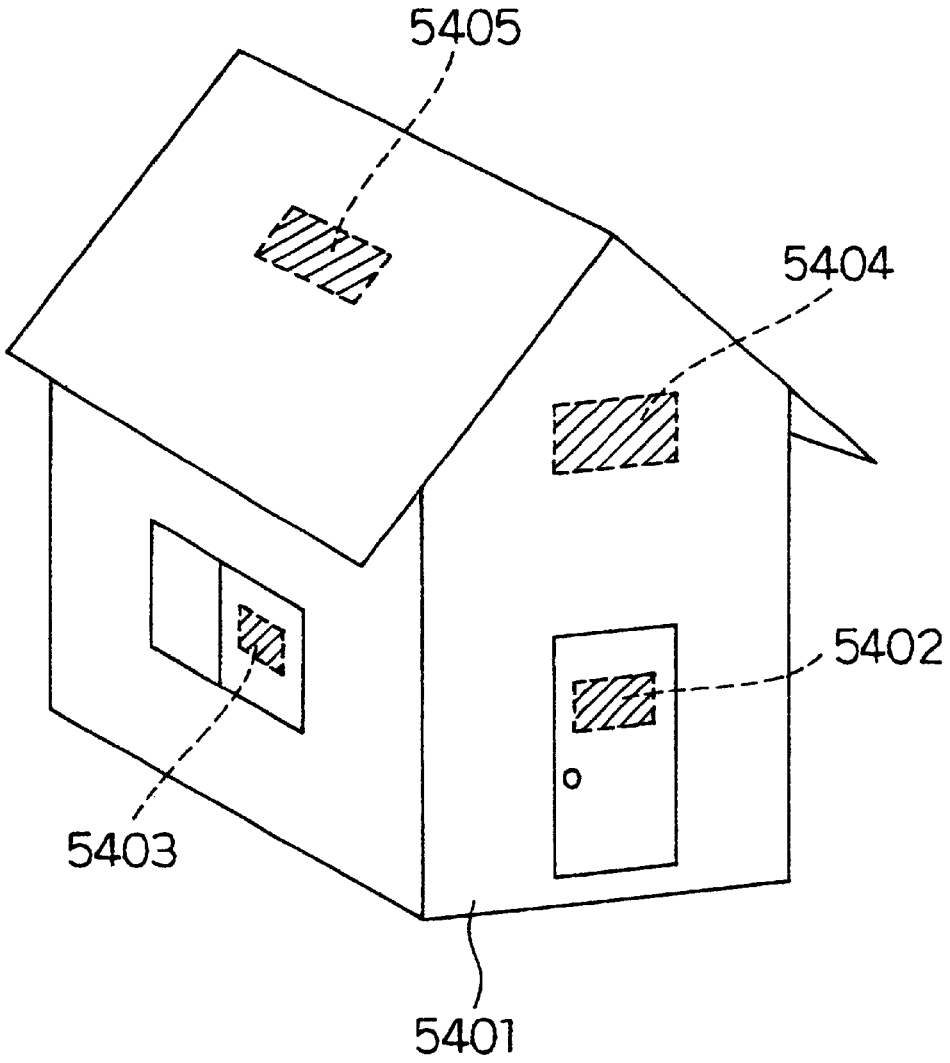
FIG. 82 is a perspective diagram showing a possible application to an ordinary house of an antenna according to the present invention.

FIG. 82 is a schematic diagram showing a possible application to an ordinary house of any of the antenna devices described above. Namely, an antenna 5402 is installed inside a conductive door of a house 5401, an antenna 5403 is installed inside a conductive window (for example, storm window), an antenna 5404 is installed inside a conductive wall, and an antenna 5405 is installed inside a conductive roof. Therefore, when an antenna is installed inside a conductive structure of the house 5401 in this way, the antenna can be protected against weather-induced damage or degradation with an elongated service life because it is not exposed to the outside.

It should be further noted that even if a house consists of nonconductive structures, such an antenna can be installed at any location by attaching a conductor to the outer surface thereof.

Figure 83:
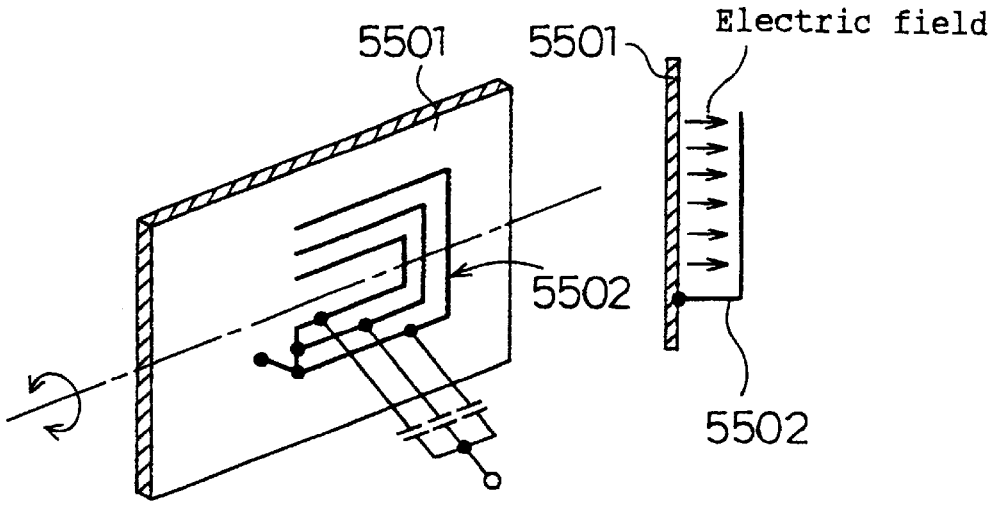
FIG. 83 is a schematic diagram showing an example of an antenna device according to the present invention.
Figure 83:
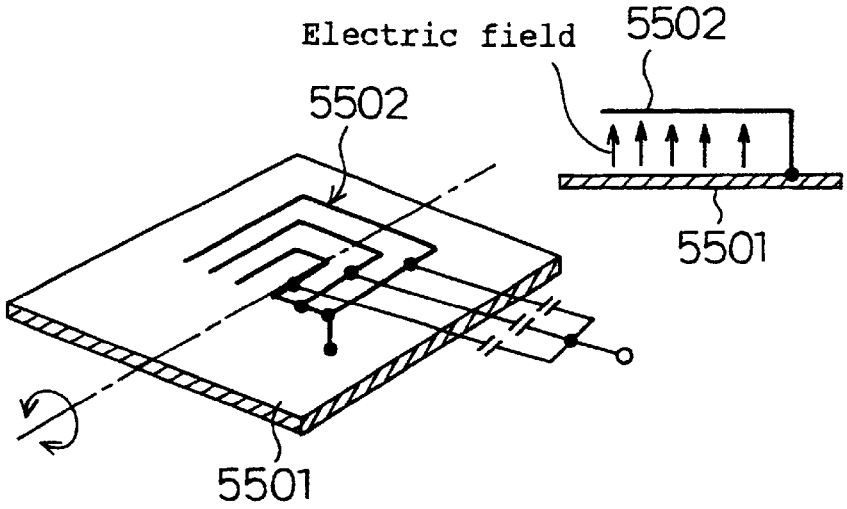
Figure 123:
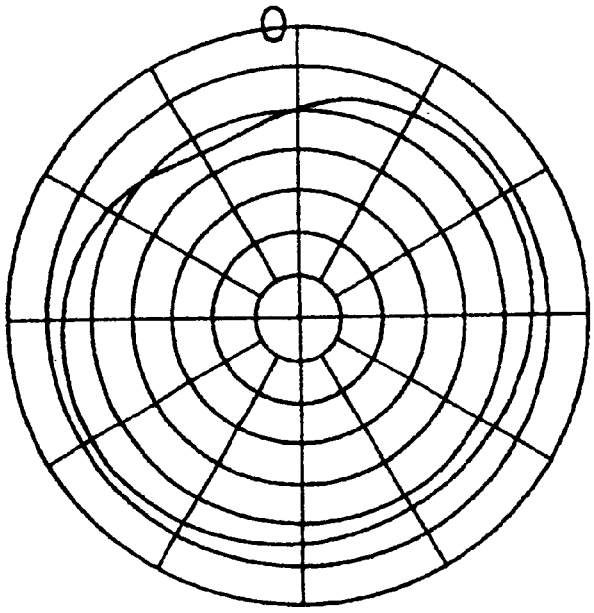
Figure 123:
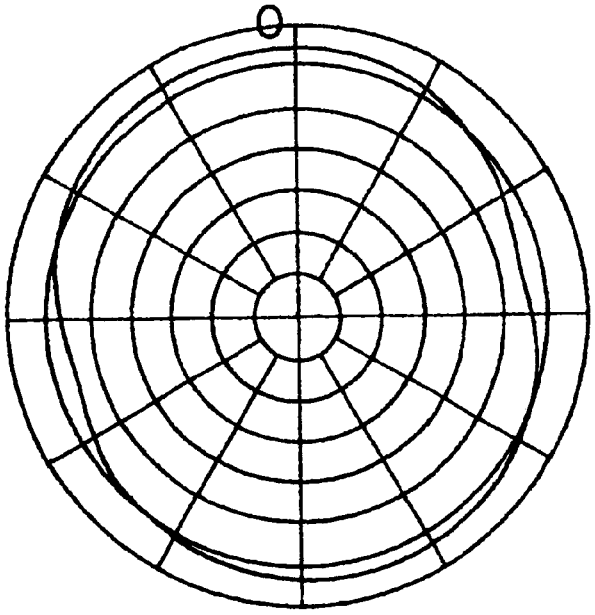
Figure 124:
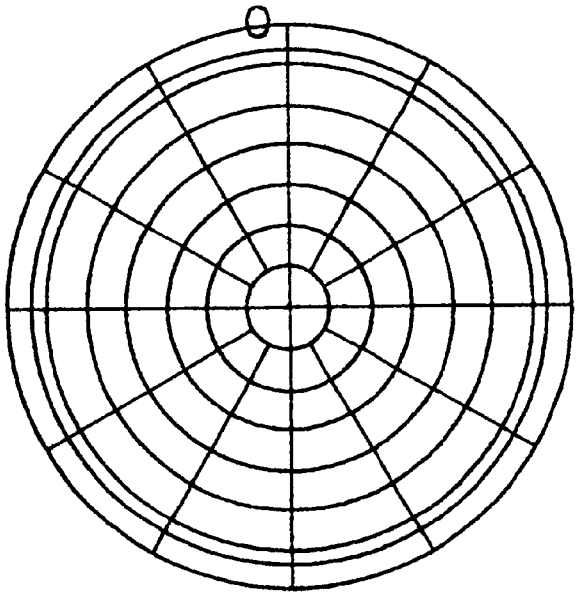
Figure 124:
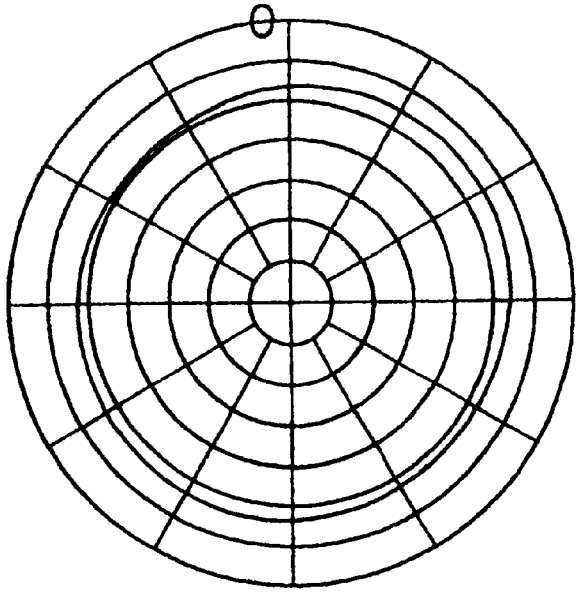

FIG. 83 shows that a conductive earth substrate 5501 and an antenna 5502 installed parallel to and in the proximity of the substrate can be turned (or rotated) together on the axis as shown by a dash-dot line. As shown in FIG. 83(*a*), when an antenna 5502 is in a vertical position, the electric field is horizontal as shown in the right of the figure and its sensitivity for horizontally polarized waves becomes high. As shown in FIG. 83(*b*), when the antenna 5502 is in a horizontal position, the electric field is in turn vertical as shown in the right of the figure and its sensitivity for vertically polarized waves becomes high and therefore, the antenna can be directed in the optimum position depending on the state of polarized waves. Of course, it may be directed in a tilted position. The directional gain characteristics of the antenna installed as shown in FIG. 83(*a*) are shown in FIG. 123 and the directional gain characteristics of the antenna installed as shown in FIG. 83(*b*) are shown in FIG. 124. As apparent from these figures, an antenna in a vertical position can exhibit a high sensitivity to horizontally polarized waves, while an antenna in a horizontal position can exhibit a high sensitivity to vertically polarized waves.

It should be noted that the conductive earth substrate 5501 and the antenna 5502 can be turned manually by operating the handle by hand or automatically by using a motor or any other drive.

Figure 84:
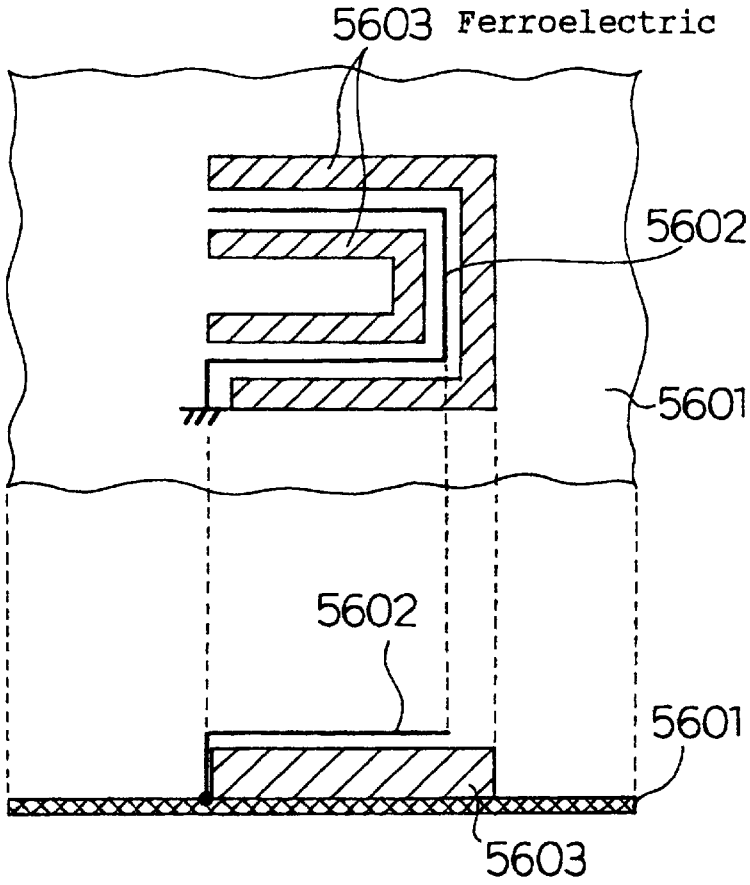
FIG. 84(*a*) is a schematic diagram showing the configuration of an example of an antenna according to the present invention and FIG. 84(*b*) is an explanatory drawing therefor.

FIG. 84(*a*) is a schematic diagram showing the configuration of another antenna device which can achieve the same effects as those described above without turning the antenna. Namely, a ferroelectric 5603 is located between a conductive earth substrate 5601 and an antenna 5602 so that it can sandwich the antenna 5602. As shown in the right of FIG. 84(*b*), this configuration can allow the electric field between a conductive earth substrate 5604 and an antenna 5605 to be extended in a horizontal direction through a ferroelectric 5606, so that the vertical component is decreased and the horizontal component is increased as compared with the case where no ferroelectric is used as shown in the left of the figure. The antenna can be set for vertically polarized waves or horizontally polarized waves depending on whether a ferroelectric is used or not. It should be noted that if the antenna is installed in a vertical position, such a ferroelectric will have an inverse effect on the antenna. It should be further noted that the ferroelectric 5603 may be installed during the manufacture or not and it may be made easily removable by providing grooves for this purpose.

Figure 85:
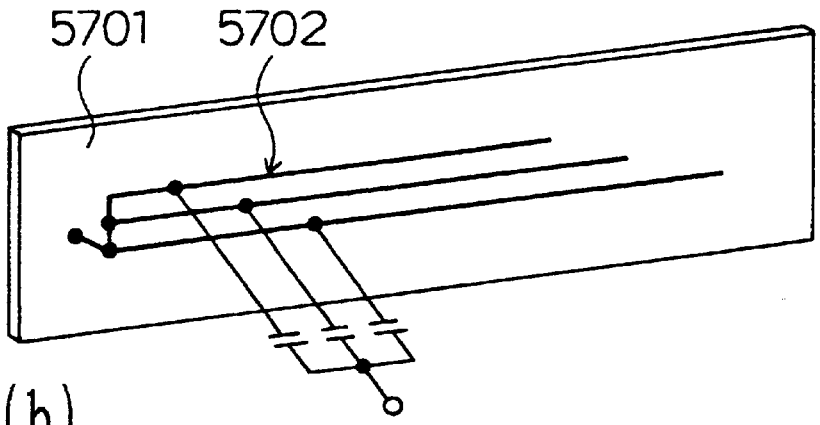
FIG. 85 is a schematic diagram showing an example of an antenna device according to the present invention.
Figure 85:
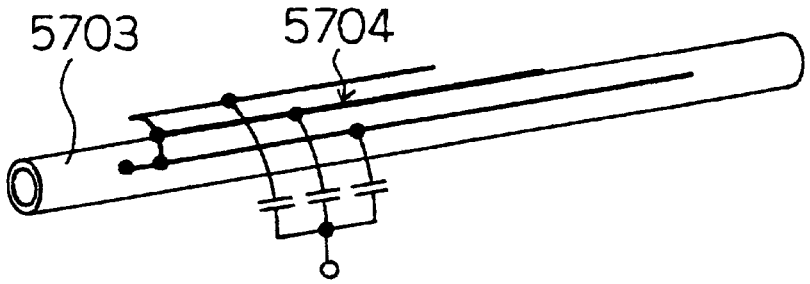
Figure 85:
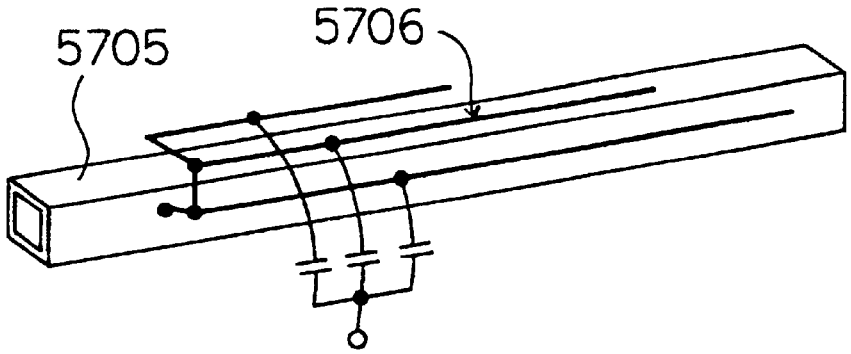

Although the antenna devices described above use bent elements which can be installed even in a narrow space, each of the antenna devices of FIG. 85 uses a linear element which can be installed on an elongate component of an automobile or an element shaped to a component.

FIG. 85(*a*) shows that a linear antenna 5702 with three elements is located in the proximity of the surface of an elongate platelike conductive earth substrate 5701. FIG. 85(*b*) shows that a linear antenna 5704 with three elements is located in the proximity of the surface of a cylindrical conductive earth substrate 5703 so that each element is at the same distance from the conductive earth substrate 5703. FIG. 85(*c*) shows that a linear antenna 5706 with three elements is located in the proximity of the surface of a quadrangular-prism conductive earth substrate 5705 so that each element is at the same distance from the conductive earth substrate 5705.

Figure 86:
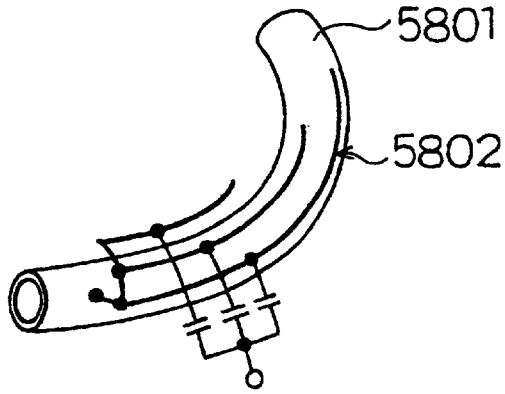
FIG. 86 is a schematic diagram showing an example of an antenna device according to the present invention.
Figure 86:
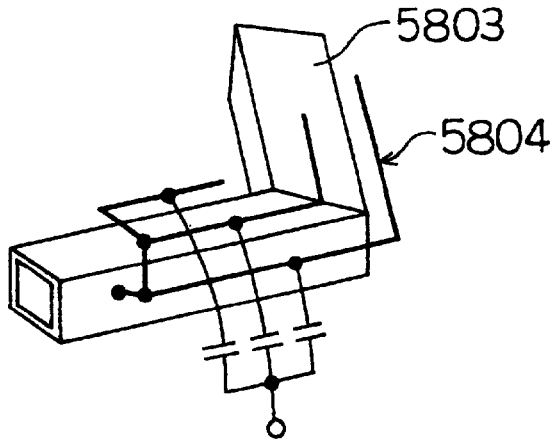
Figure 86:
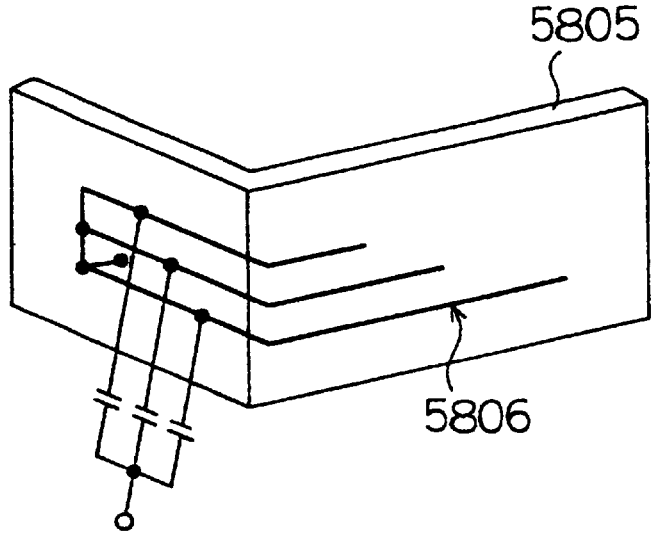

FIG. 86 shows variations of the antennas shown in FIG. 85, in which elements are curved or bent in accordance with a curved or bent conductive earth substrate. FIG. 86(*a*) shows that an antenna 5802 with three curved elements is located in the proximity of the surface of a curved cylindrical conductive earth substrate 5801 so that each element is at the same distance from the conductive earth substrate 5801. FIG. 86(*b*) shows that an antenna 5804 with three bent elements is located in the proximity of the surface of a bent quadrangular-prism conductive earth substrate 5803 so that each element is at the same distance from the conductive earth substrate 5803. FIG. 86(*c*) shows that an antenna 5806 with three bent elements is located in the proximity of the surface of a bent platelike conductive earth substrate 5805.

Figure 87:
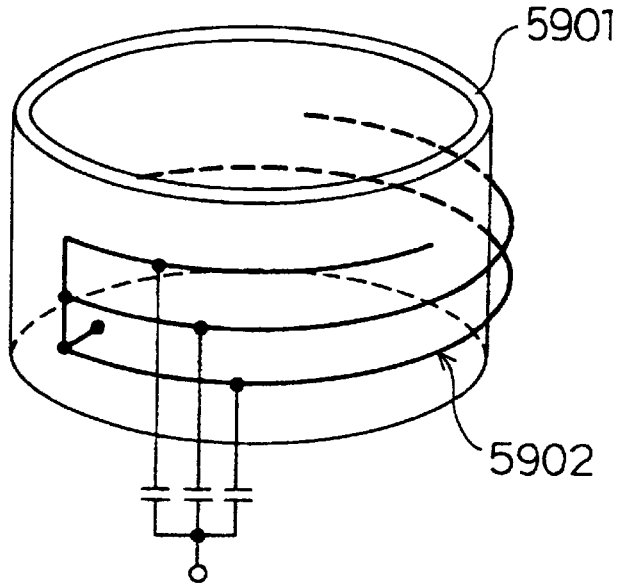
FIG. 87 is a schematic diagram showing an example of an antenna device according to the present invention.
Figure 87:
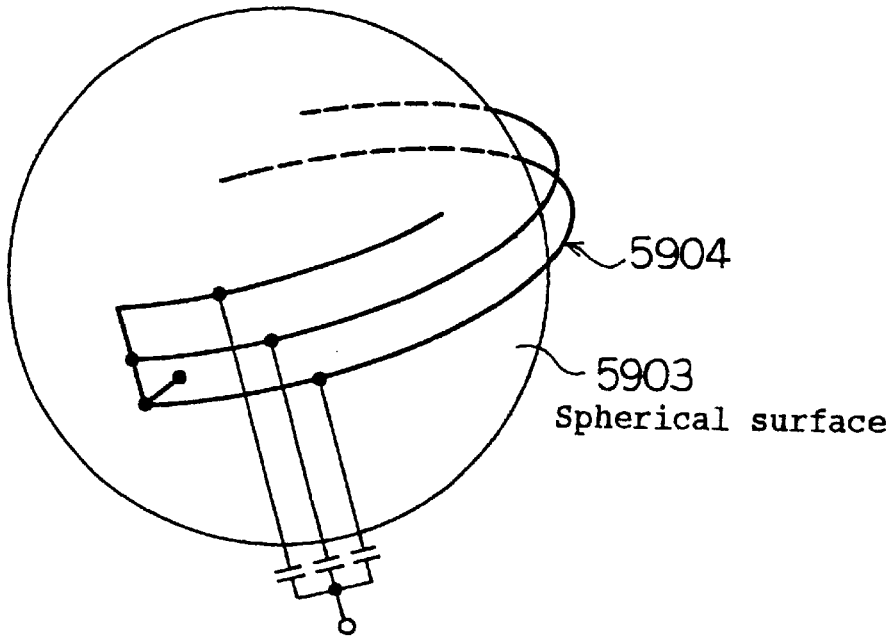

In addition, FIG. 87(*a*) shows that an antenna 5902 is located along the surface of a cylindrical conductive earth substrate 5901 and FIG. 87(*b*) shows that an antenna 5904 is located along the surface of a spherical conductive earth substrate 5903.

It should be noted that the antenna in this example is located outside a component which constitutes a conductive earth substrate but it is not limited to this example and it may be located inside a platelike component or on the inner surface of a cylindrical component.

Figure 91:
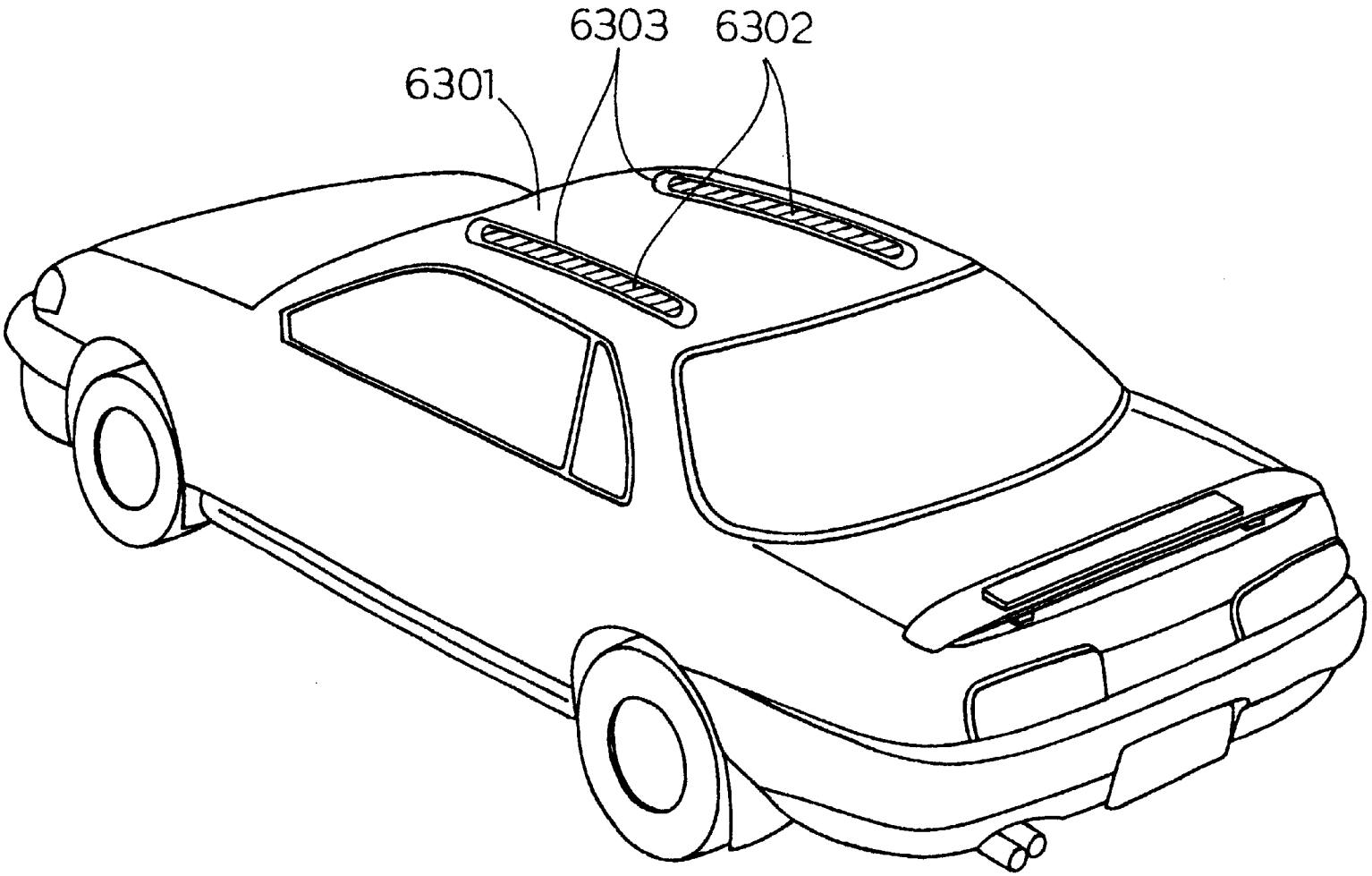
FIG. 91 shows an application of an antenna device according to the present invention.
Figure 93:
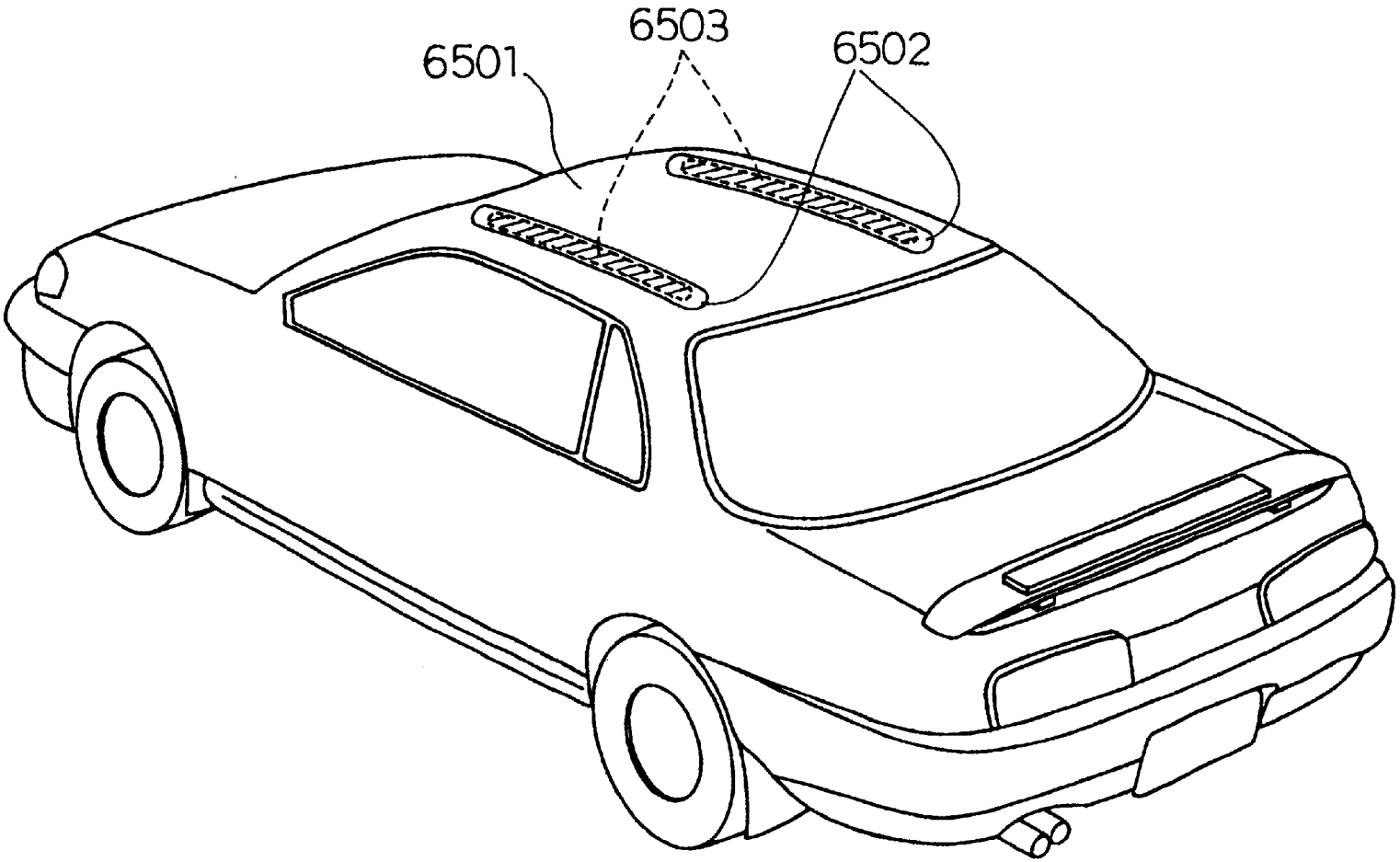
FIG. 93 shows an application of an antenna device according to the present invention.

FIGS. 91 and 93 show applications of the antenna device according to the present embodiment. FIG. 91 shows that an antenna 6302 is installed on the surface of an elongate roof rail 6303 on the roof of an automobile body 6301 and FIG. 93 shows that an antenna 6502 is installed inside an elongate roof rail 6503 on the roof of an automobile body 6501.

Figure 92:
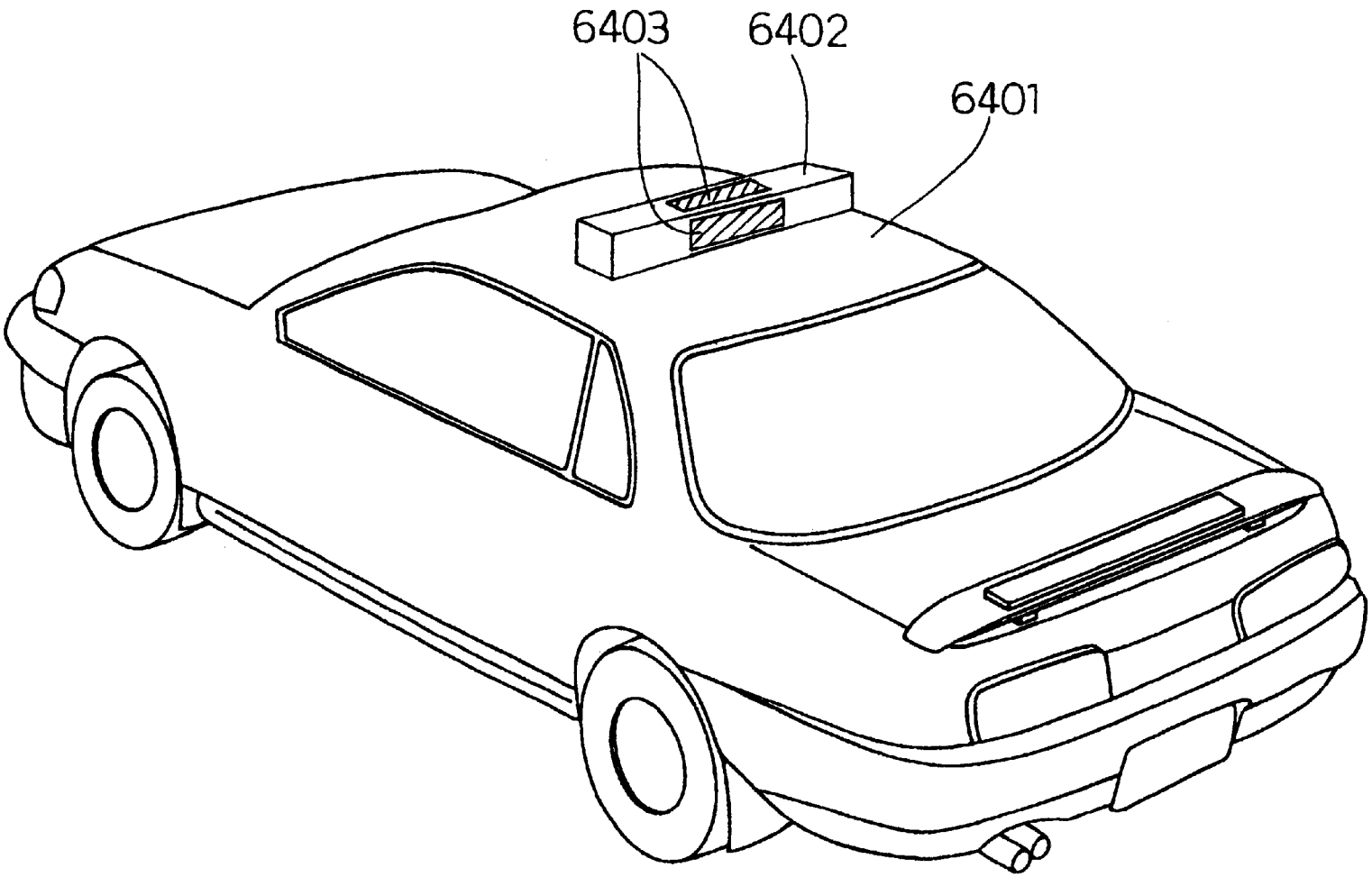
FIG. 92 shows an application of an antenna device according to the present invention.
Figure 94:
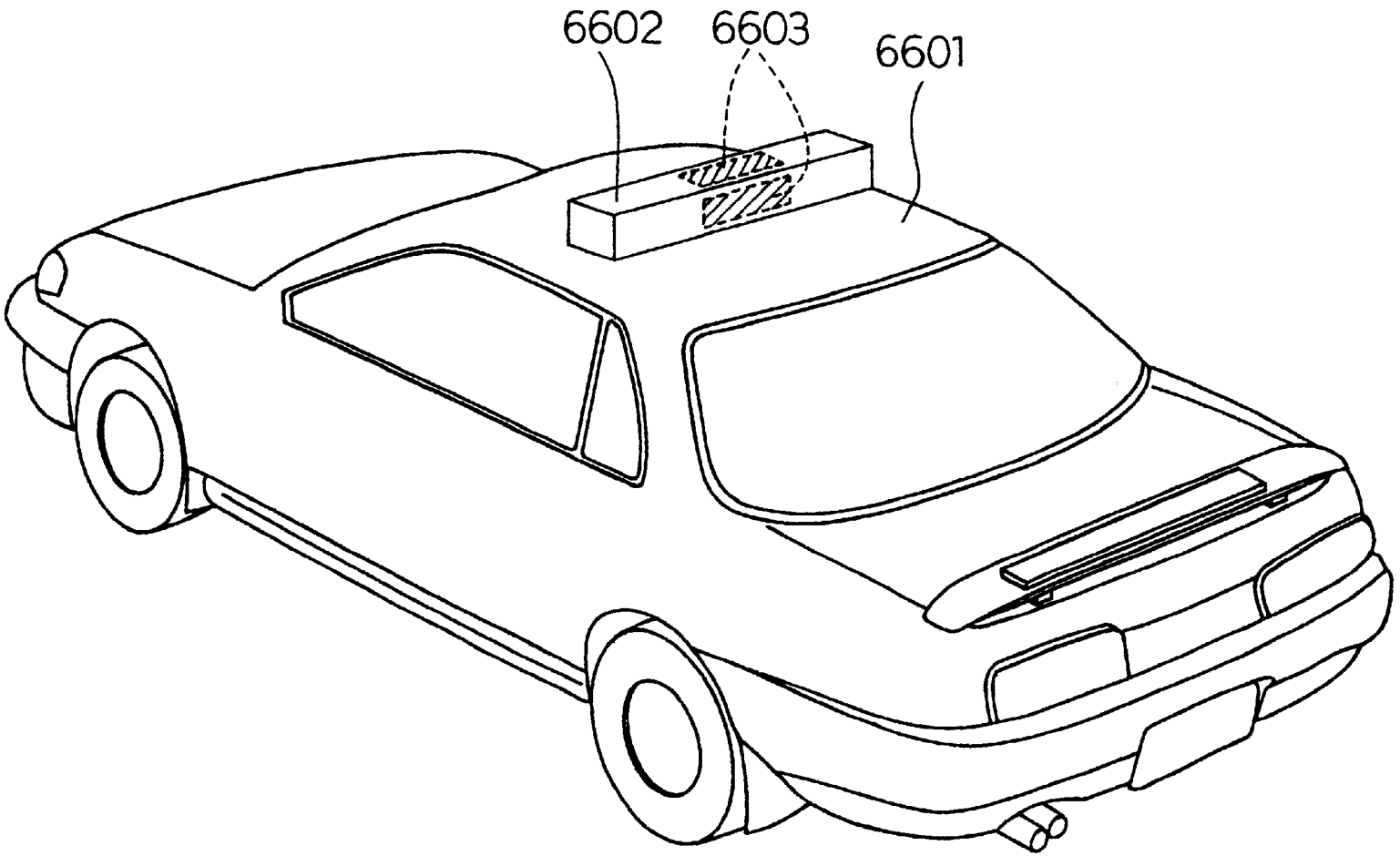
FIG. 94 shows an application of an antenna device according to the present invention.

Moreover, FIGS. 92 and 94 show other applications of the antenna device according to the present embodiment. FIG. 92 shows that an antenna 6403 is installed on the surface of an elongate roof box 6402 on the roof of an automobile body 6401 and FIG. 94 shows that an antenna 6603 is installed inside an elongate roof box 6602 on the roof of an automobile body 6601.

The antenna device shown in FIGS. 88(*a*) and 88(*b*) comprises an antenna 6002 with three longer elements and an antenna 6003 with three shorter elements with respect to a grounded point connected to a conductive earth substrate 6001 and feeding points A 6005 and B 6004 are provided for these antennas 6002 and 6003, respectively. As shown in FIG. 88(*c*), the shorter antenna 6003 is tuned to the A band of relatively higher frequencies and the longer antenna 6002 is tuned to the B band of relatively lower frequencies, and thus, such a single antenna device can accommodate two tuning bands. It should be noted that the feeding points A 6005 and B 6004 may be connected to each other.

FIGS. 89(*a*) and 89(*b*) show another example of the antenna of unbalanced type having two tuning bands. This antenna is a four-element antenna having an end connected to a conductive earth substrate 6101 and located in the proximity of the conductive earth substrate 6101 and in addition, an antenna 6102 with two relatively longer elements is provided with a feeding point B 6104 and an antenna 6103 with two relatively shorter elements is provided with a feeding point A 6105. As shown in FIG. 8[sic] (c), this configuration can accommodate two tuning bands, that is, the A band of relatively higher frequencies and the B band of relatively lower frequencies in a similar manner to that of the preceding example. It should be also noted that the feeding points A 6005 and B 6004 may be connected to each other.

FIGS. 90(*a*) and 90(*b*) show still another example of the antenna of balanced type having two tuning bands. This antenna is a four-element antenna having the midpoint connected to a conductive earth substrate 6201 and located in the proximity of the conductive earth substrate 6201 and in addition, an antenna 6202 with two relatively longer elements is provided with a feeding point B 6204 and an antenna 6203 with two relatively shorter elements is provided with a feeding point A 6205. As shown in FIG. 90(*c*), this configuration can accommodate two tuning bands, that is, the A band of relatively higher frequencies and the B band of relatively lower frequencies in a similar manner to that of the preceding examples. It should be also noted that the feeding points A 6005 and B 6004 may be connected to each other.

Like this, the antenna described above can provide an advanced antenna device which requires a minimum space for installation and which is capable of accommodating a plurality of tuning bands, and thus, such an antenna can be applicable in a narrow space such as an automobile or a portable telephone.

It should be noted that this example assumes two tuning bands but it may accommodate three or more bands. The latter case can be accomplished by providing a plurality of antennas each of which has an element length corresponding to each tuning band and providing a feeding point for each antenna.

Figure 95:
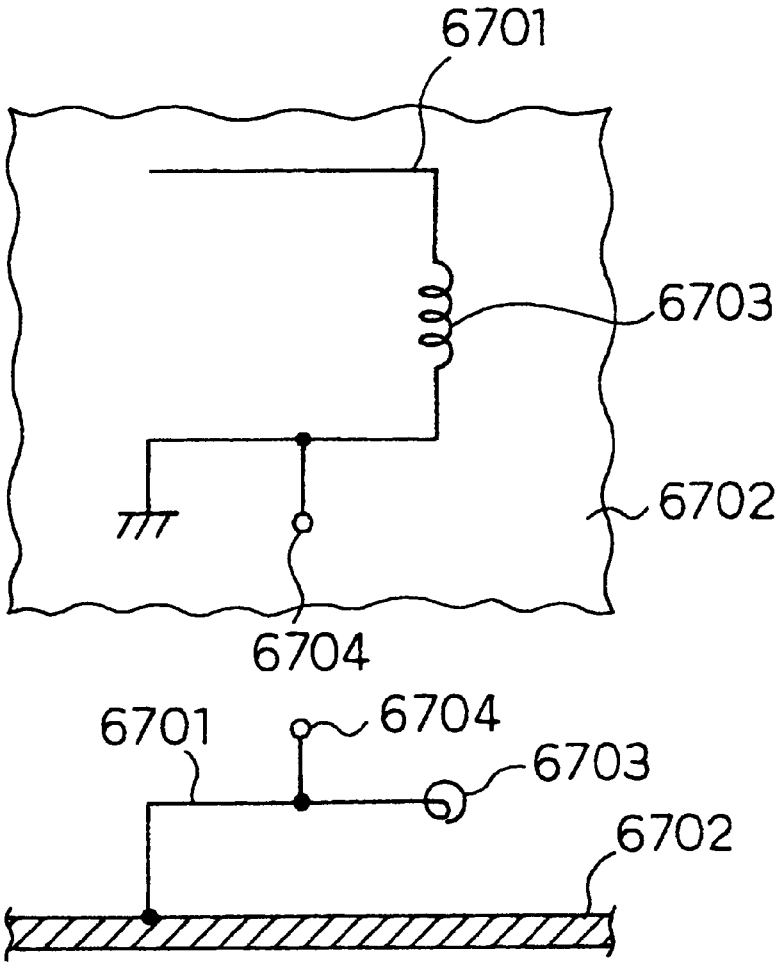
FIG. 95 is a schematic diagram showing an example of an antenna device according to the present invention.

In the antenna device of FIG. 95, a coil 6703 is provided in place on a three-edge antenna element 6701 located in the proximity of a conductive earth substrate 6702 and an end of the antenna element 6701 is connected to the conductive earth substrate 6702. In addition, a feeding section 6704 is provided on the antenna element 6701 between the coil 6703 and the conductive earth substrate 6702. This configuration can allow an electric current to concentrate in the coil and thus the antenna device can be reduced in size with the gain unchanged. For example, if the antenna element consists of a strip line, the area for the antenna can be reduced to a quarter. Moreover, its bandwidth can be narrowed with a sharp band characteristic.

Figure 96:
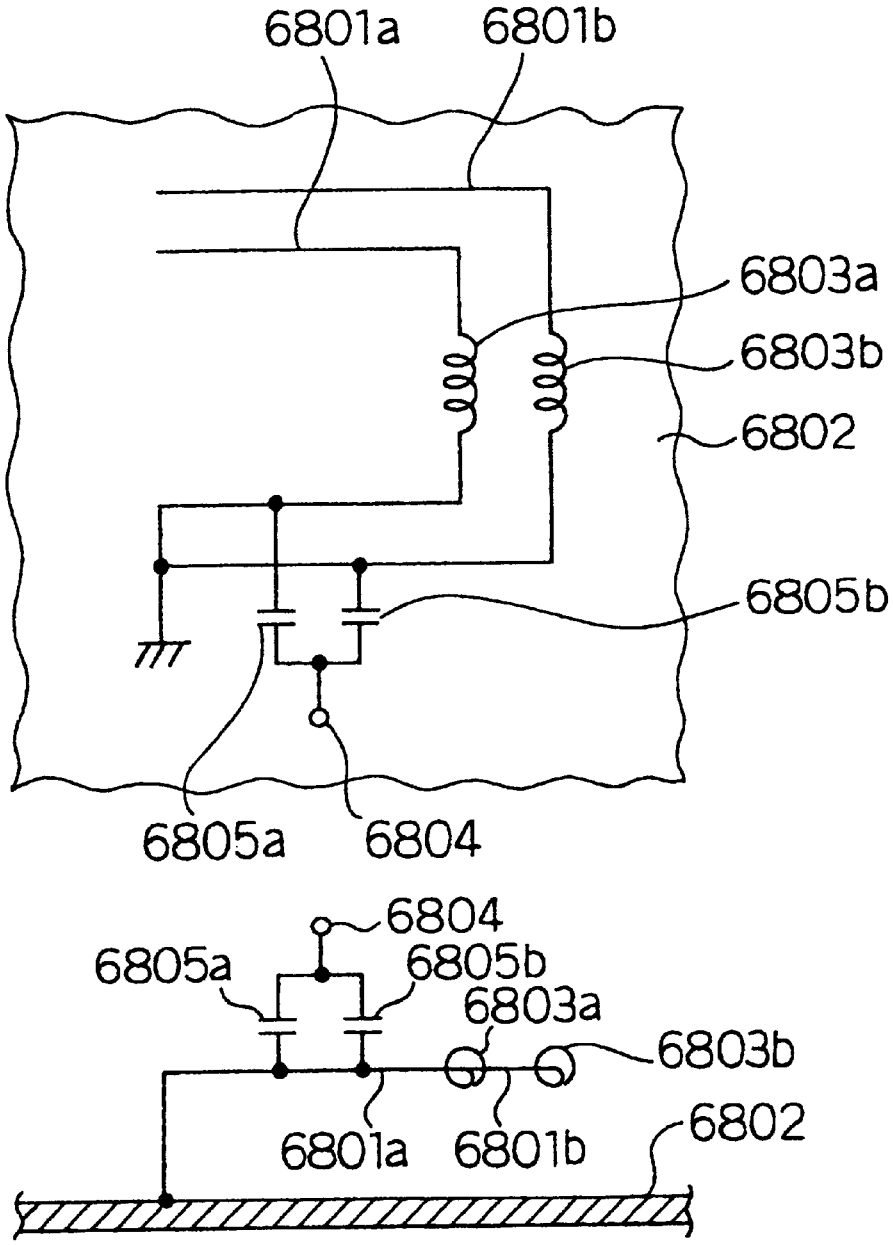
FIG. 96 is a schematic diagram showing an example of an antenna device according to the present invention.

FIG. 96 shows that two antenna elements having the configuration of FIG. 95 are connected in parallel for band synthesis. Namely, two antenna elements 6801 a and 6801*b* having different bands (lengths) and coils 6803 a and 6803*b* provided in place on the elements, respectively, are located in parallel and an end of each element is connected to a conductive earth substrate 6802. In addition, the antenna elements 6801*a* and 6801*b* are connected to a common feeding section 6804 through reactance elements 6805*a* and 6805*b,* respectively. This configuration can synthesize the bands of the two antenna elements and thus, a broadband antenna device with the same effects as those described above can be implemented.

Figure 97:
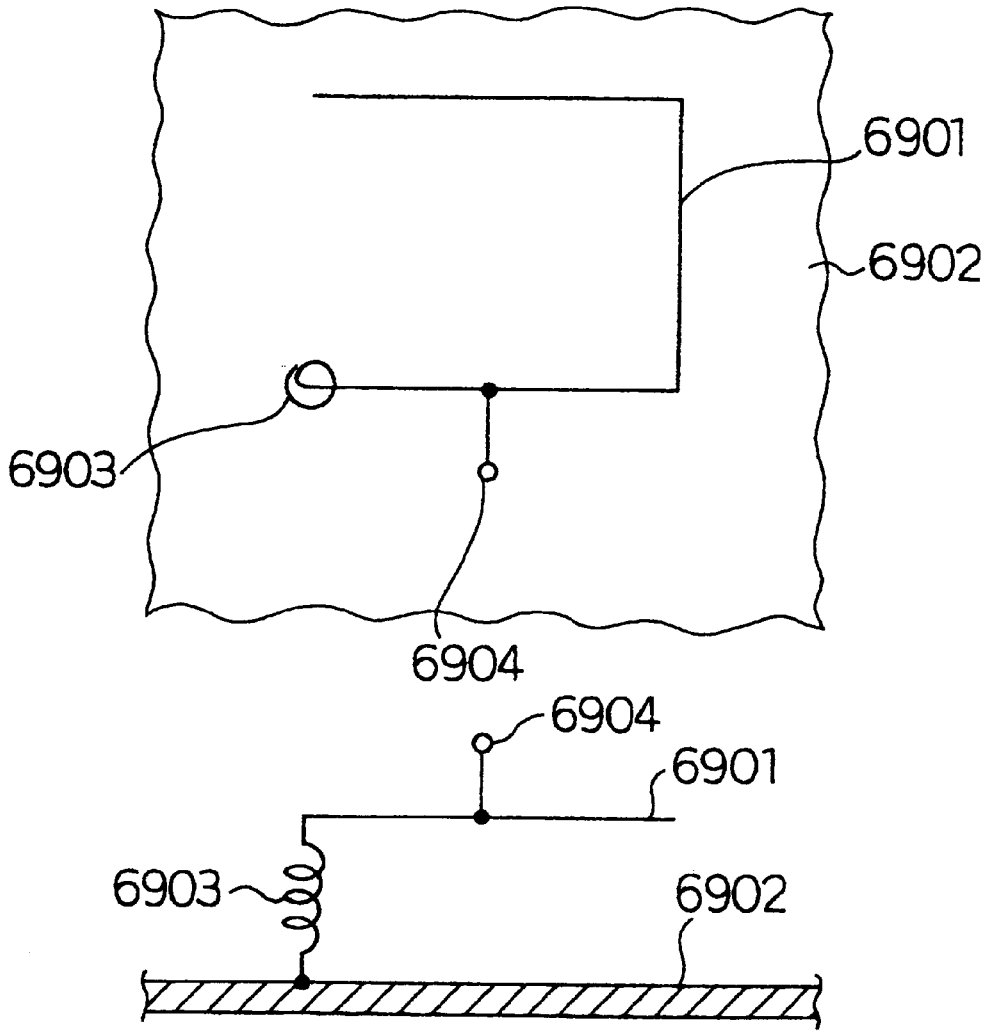
FIG. 97 is a schematic diagram showing an example of an antenna device according to the present invention.

In the antenna device of FIG. 97, a coil 6903 is provided between an end of a three-edge antenna element 6901 located in the proximity of a conductive earth substrate 6902 and the conductive earth substrate 6902 and the other end of the coil 6903 is connected to the conductive earth substrate 6902 for grounding. In addition, a feeding section 6904 is provided in place on the antenna element 6901. This configuration can allow an electric current to concentrate in the coil in a similar manner to that for the thirty-second embodiment described above and thus the antenna device can be reduced in size with the gain unchanged.

Figure 98:
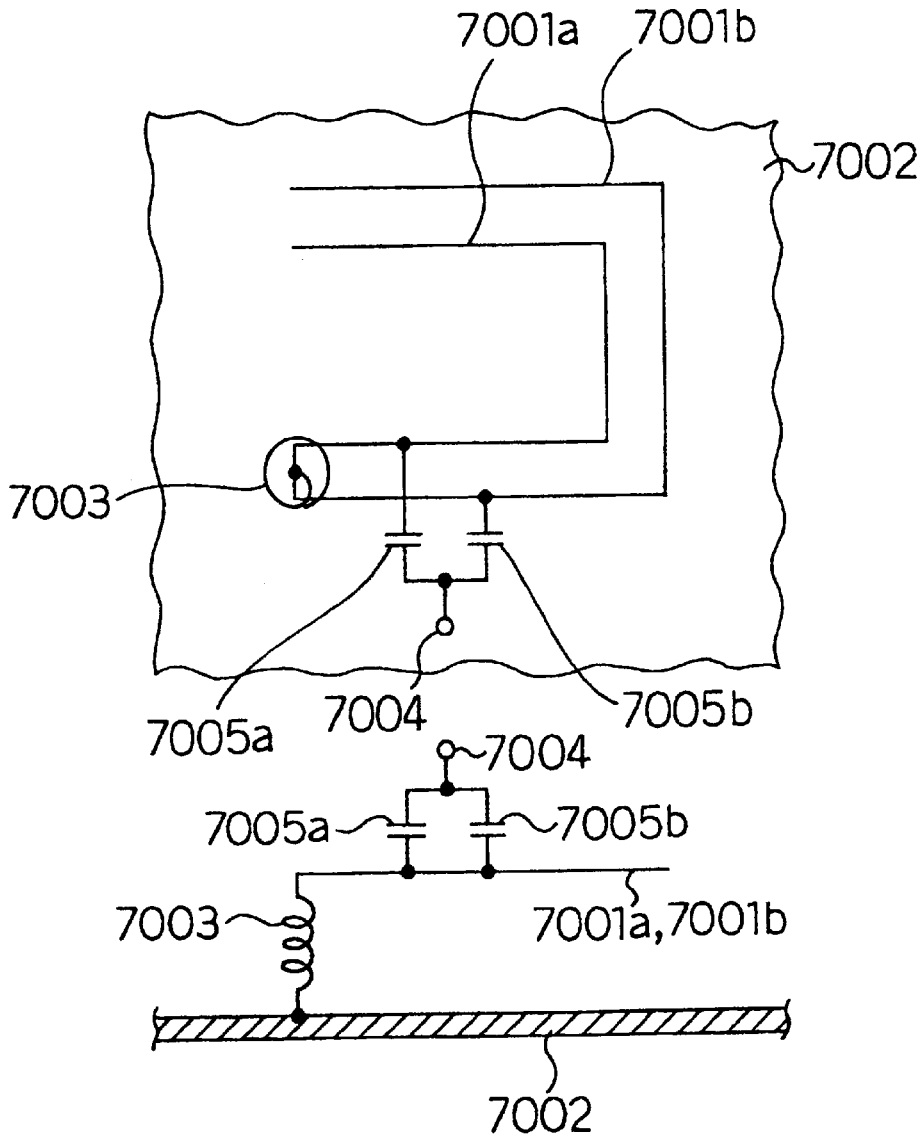
FIG. 98 is a schematic diagram showing an example of an antenna device according to the present invention.

FIG. 98 shows that two antenna elements having the configuration of FIG. 97 are connected in parallel for band synthesis. Namely, two antenna elements 7001*a* and 7001*b* having different bands (lengths) are located in parallel with an end connected to an end of a common coil 7003 and the other end of the coil 7003 is connected to a conductive earth substrate 7002. In addition, the antenna elements 7001*a* and 7001*b* are connected to a common feeding section 7004 through reactance elements 7005*a* and 7005*b,* respectively. This configuration can synthesize the bands of the two antenna elements and thus, a broadband antenna device with the same effects as those described above can be implemented. It should be noted that the single coil which is shared by the two antenna elements can contribute to a simple configuration.

Figure 99:
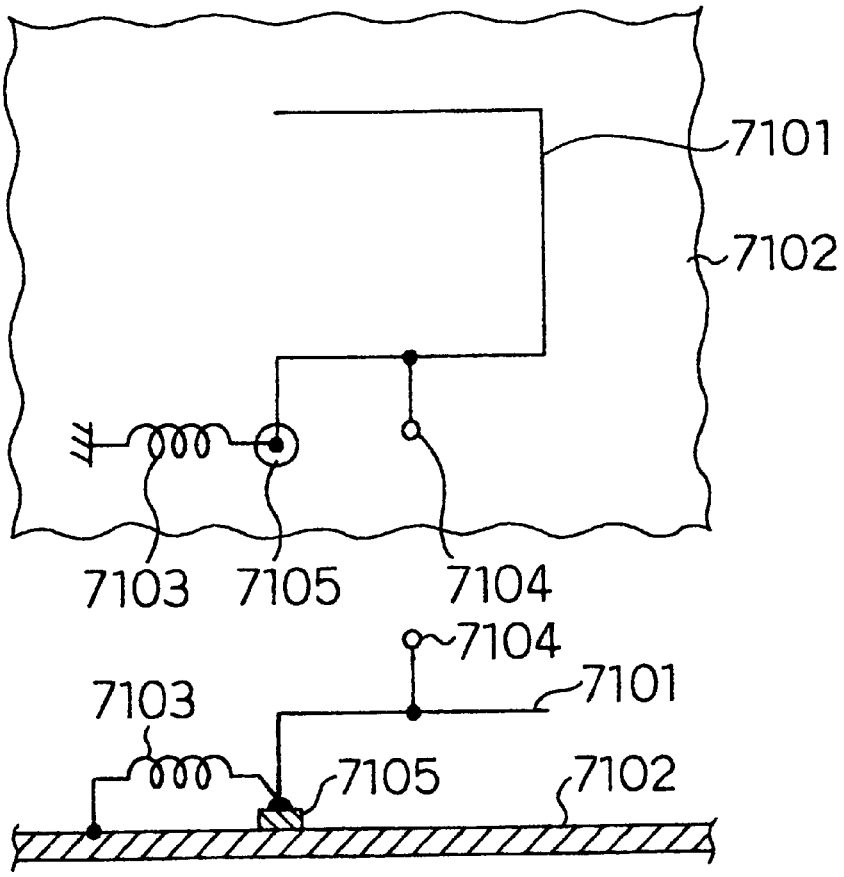
FIG. 99 is a schematic diagram showing an example of an antenna device according to the present invention.
Figure 100:
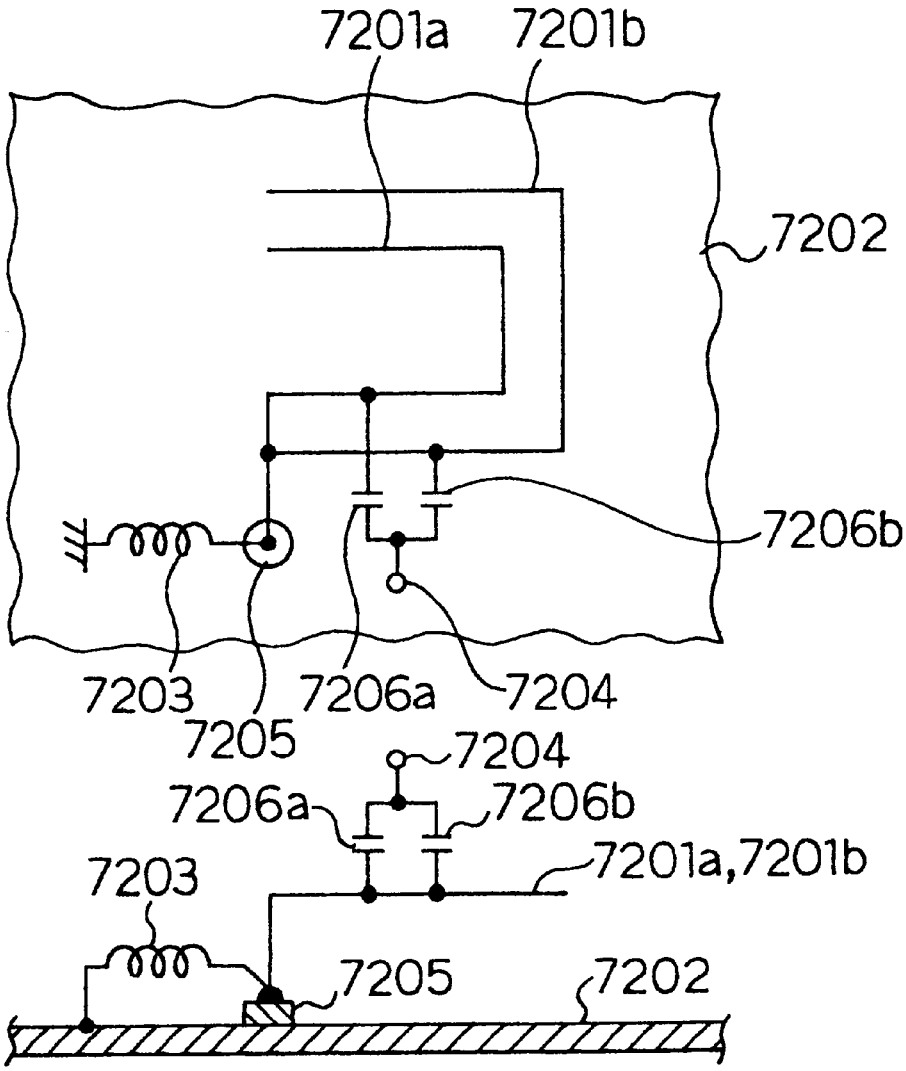
FIG. 100 is a schematic diagram showing an example of an antenna device according to the present invention.

The antenna of FIG. 99 differs from that of FIG. 97 described above in that as shown in FIG. 99, an insulator 7105 is provided on a conductive earth substrate 7102 and an antenna element 7101 and a coil 7103 are connected on the insulator 7105. This configuration can allow easy installation of a coil 7103, which is useful for its implementation, and thus the coil can be stably installed. FIG. 100 shows the configuration of two antenna elements 7201*a* and 7201*b* arranged for band synthesis. As shown in the figure, although the connection between a coil 7203 and the antenna elements becomes more complex because of the more antenna elements as compared with the preceding case, a connection point provided on an insulator 7205 on a conductive earth substrate 7202 can make the connection between the antenna elements and the coil much easier.

Figure 101:
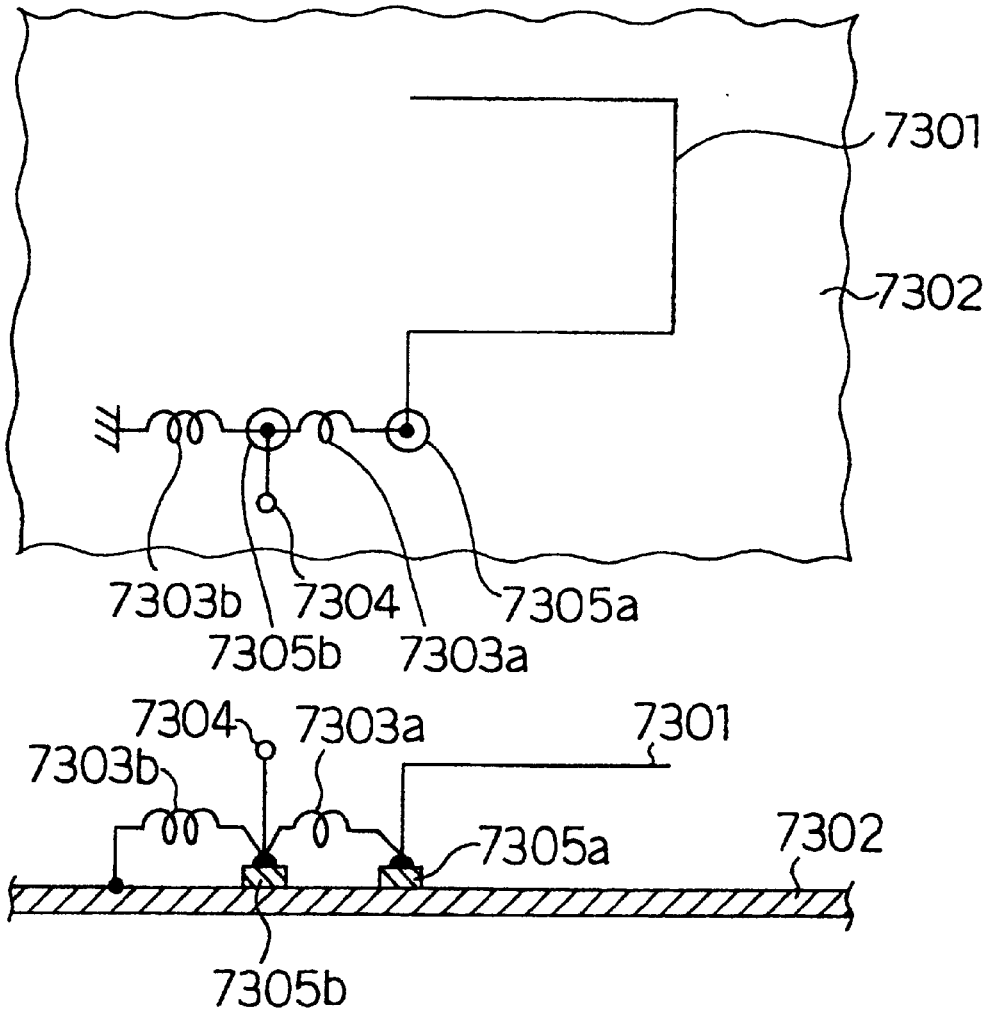
FIG. 101 is a schematic diagram showing an example of an antenna device according to the present invention.
Figure 102:
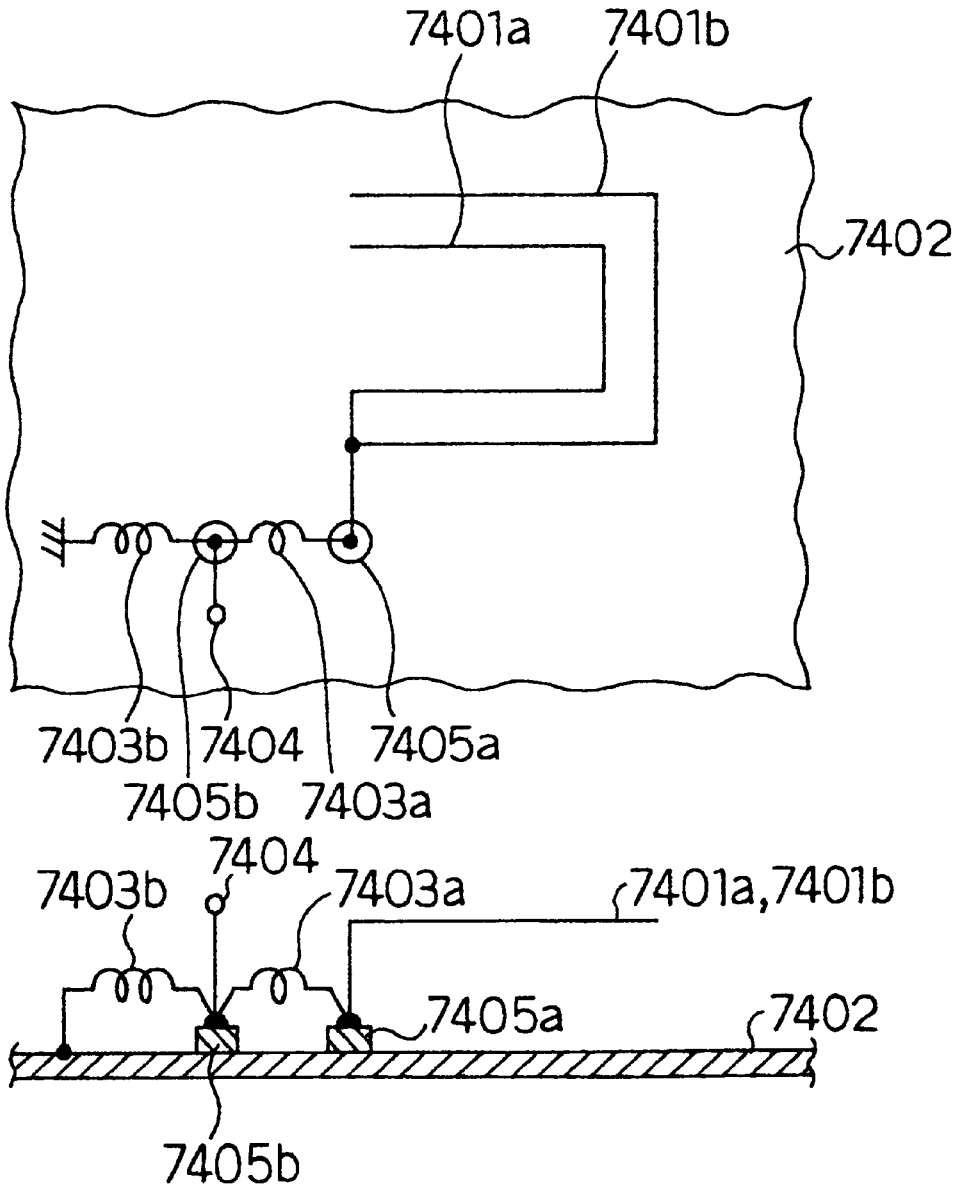
FIG. 102 is a schematic diagram showing an example of an antenna device according to the present invention.

In the antenna device of FIG. 101, two coil sections are separately provided and two insulators 7305*a* and 7305*b* are provided on a conductive earth substrate 7302 to connect antenna elements and coils. Namely, an end of a three-edge antenna element 7301 provided in the proximity of a conductive earth substrate 7302 and an end of a coil 7303*a* are connected together on an insulator 7305*a,* the other end of the coil 7303*a* and an end of another coil 7303*b* and a feeding section 7304 are connected together on another insulator 7305*a,* and the other end of the coil 7303*b* is connected to the conductive earth substrate 7302 for grounding. FIG. 102 shows an antenna device having two antenna elements 7401*a* and 7401*b* arranged for band synthesis and the antenna elements, coils, and a feeding section are connected in a similar manner to that shown in FIG. 101.

These configurations can allow easy connection to other circuit components because the feeding terminal is provided on a circuit board.

Figure 103:
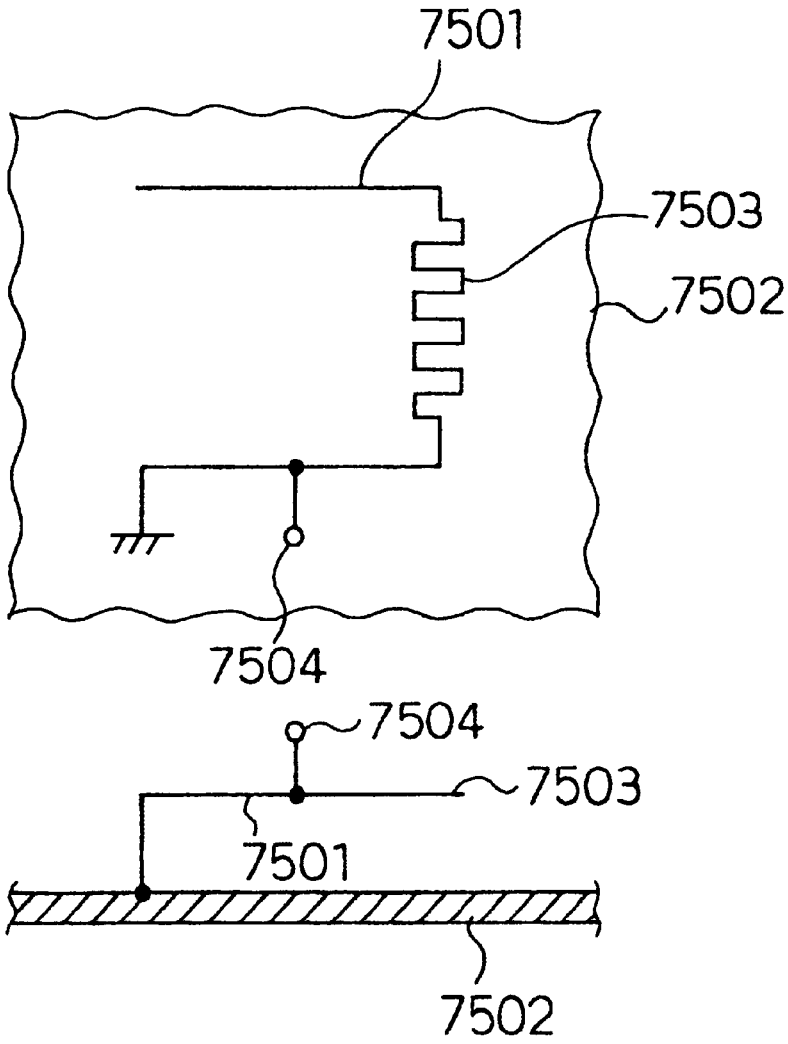
FIG. 103 is a schematic diagram showing an example of an antenna device according to the present invention.
Figure 104:
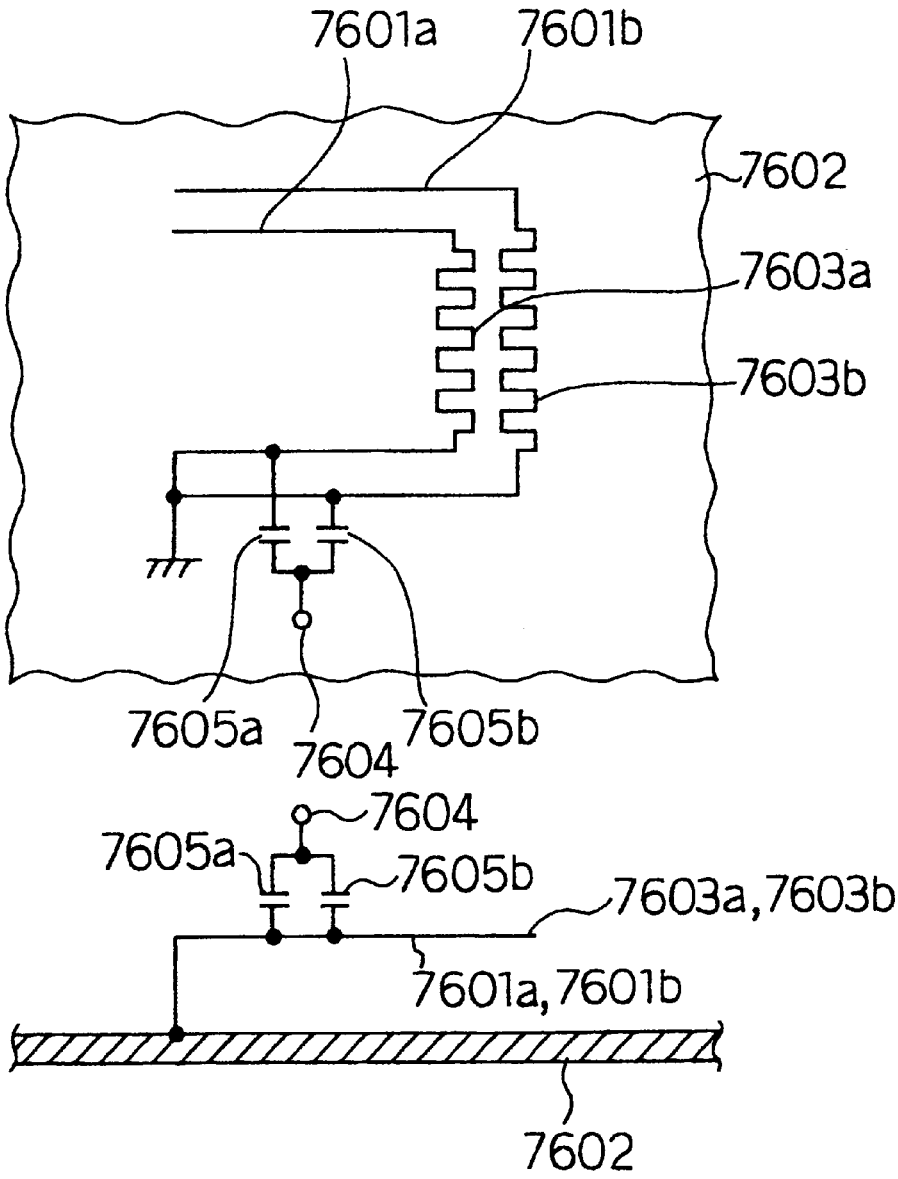
FIG. 104 is a schematic diagram showing an example of an antenna device according to the present invention.
Figure 106:
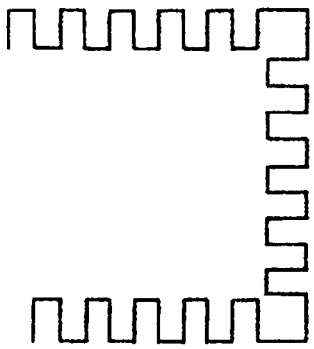
FIG. 106 is a schematic diagram showing various element patterns according to the present invention.
Figure 106:
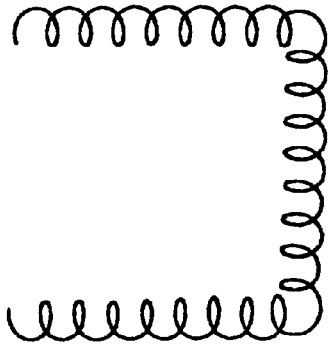
Figure 106:
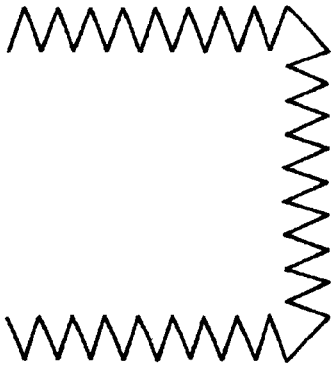

In the antenna device of FIG. 103, a zigzag pattern 7503 is inserted in an antenna element 7501 in place of the coil for the configuration of FIG. 95. Although the configuration having a coil can three-dimensionally extend, the configuration with this pattern 7503 can be formed on the same plane as the antenna element 7501 and fabricated through a printed-wiring technique. FIG. 104 shows an antenna device having two antenna elements 7601*a* and 7601*b* arranged for band synthesis and zigzag patterns 7603*a* and 7603*b* are inserted in antenna elements 7601*a* and 7601*b*, respectively. It should be noted that the zigzag patterns may be saw-toothed ones as shown in FIG. 106(*c*).

Figure 105:
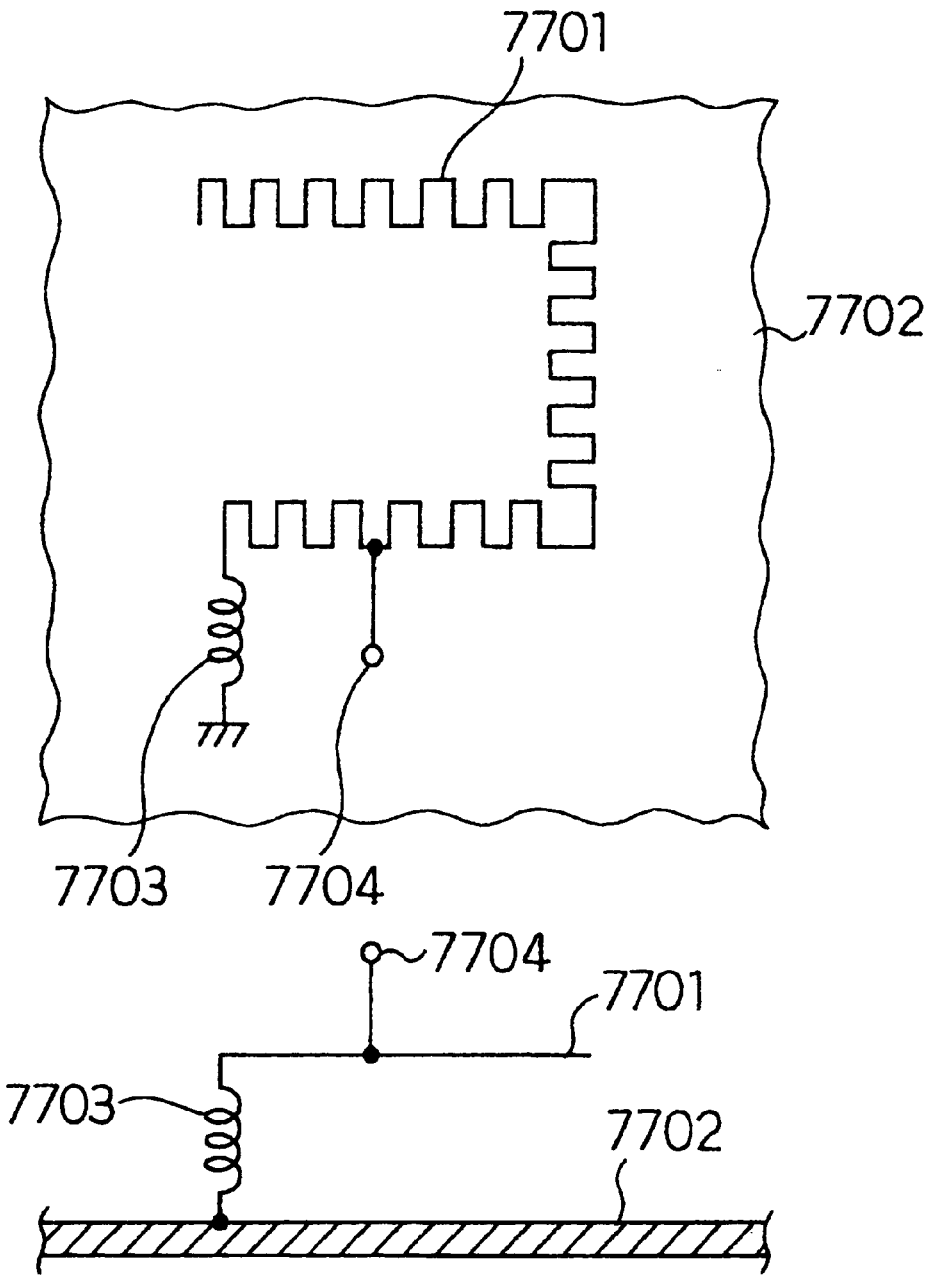
FIG. 105 is a schematic diagram showing an example of an antenna device according to the present invention.

In the antenna device of FIG. 105, the whole antenna element 7701 located in the proximity of a conductive earth substrate 7702 is formed in a zigzag pattern and an end of the antenna element 7701 is connected to an end of a coil 7703 which is grounded at the other end. In addition, a feeding section 7704 is provided in place on the zigzag antenna element. This configuration can allow the antenna device to be further reduced in size, for example, to ⅙ or ⅛, although possible losses may be increased. It should be noted that the antenna element may be formed in other patterns, for example, those shown in FIGS. 106(*b*) and (*c*). The pattern shown in FIG. 106(*b*) is a three-dimensional coil.

Figure 107:
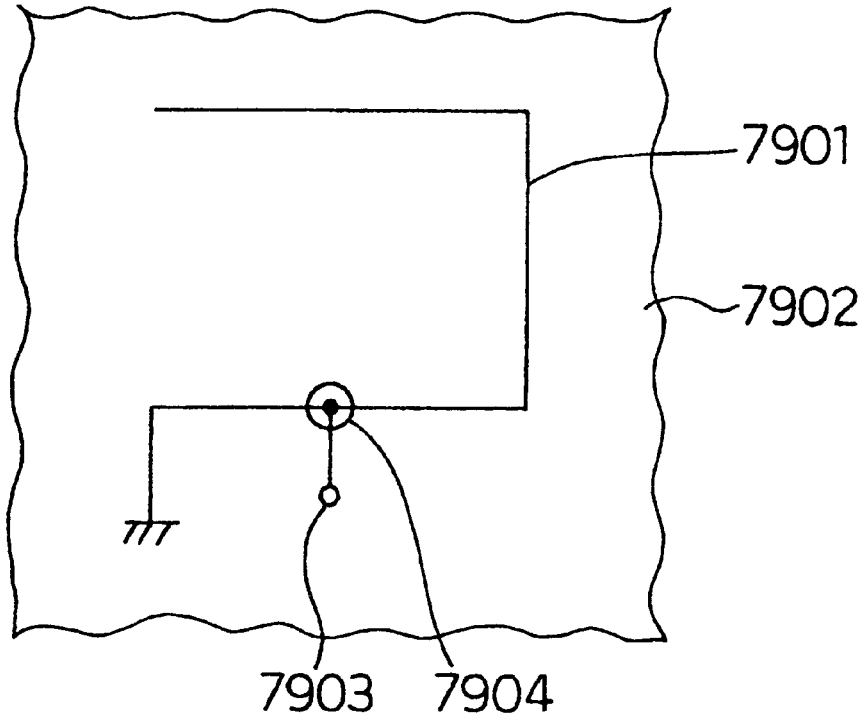
FIG. 107 is a schematic diagram showing an example of an antenna device according to the present invention.
Figure 107:
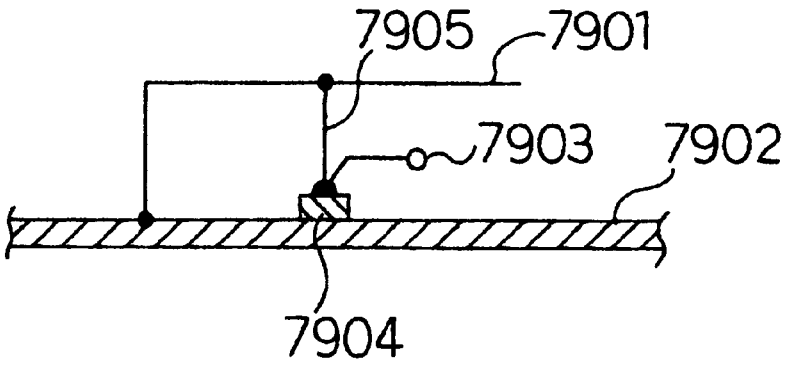

In the antenna device of FIG. 107, an insulator 7904 is provided on a conductive earth substrate 7902 and a lead 7905 from an antenna element 7901 and a feeding section 7903 are connected together on the insulator 7904. This configuration can allow easy connection with other circuit components because the feeding section 7903 is provided on a circuit board.

Figure 108:
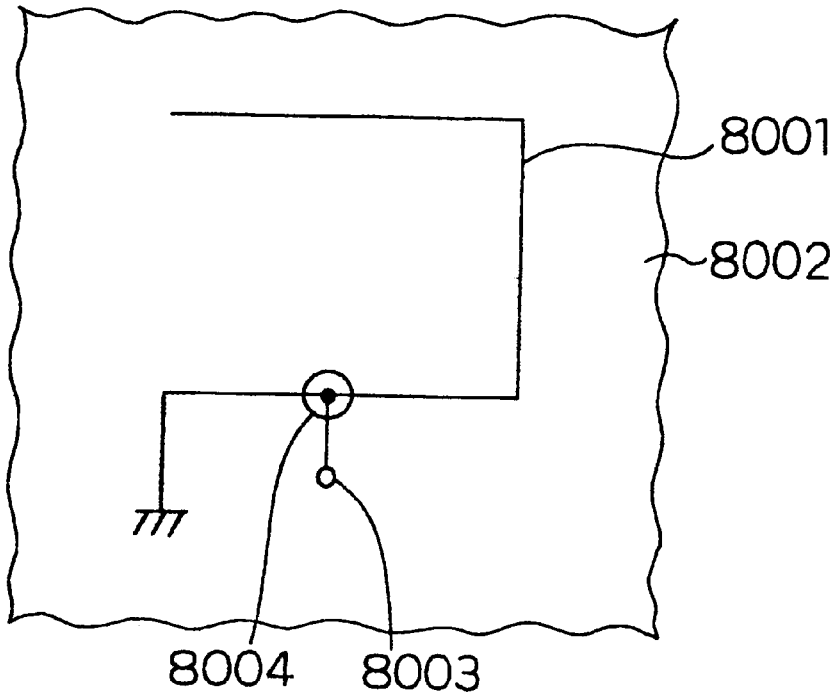
FIG. 108 is a schematic diagram showing an example of an antenna device according to the present invention.
Figure 108:
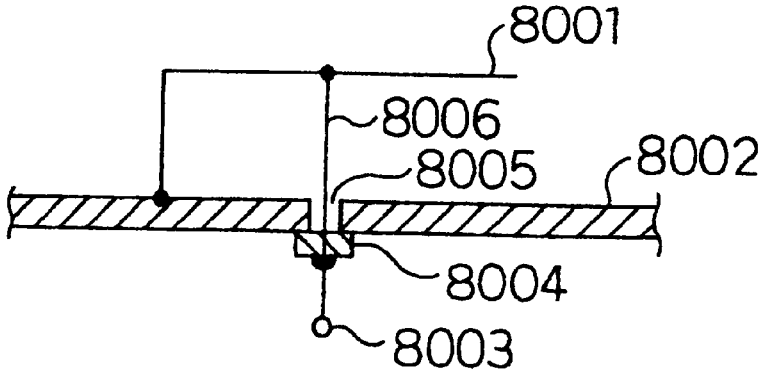

FIG. 108 shows that a through-hole 8005 is formed in a conductive earth substrate 8002 to provide an insulator 8004 on the opposite side of the conductive earth substrate 8002 to an antenna element 8001. A lead 8006 from the antenna element 8001 passes through the through-hole 8005 and the insulator 8004 and connects to a feeding section 8003 on the insulator 8004. This configuration can make it much easier than that of FIG. 107 described above to connect other circuit components to the feeding section 8003 because such circuit components can be connected on the back of the 8002.

Figure 109:
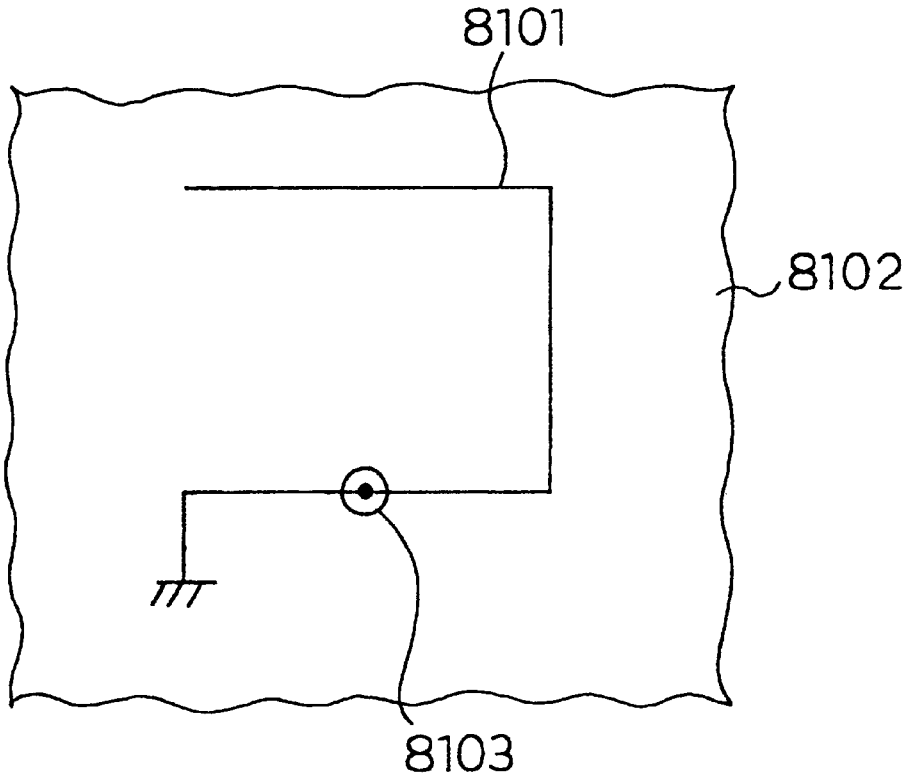
FIG. 109 is a schematic diagram showing an example of an antenna device according to the present invention.
Figure 109:
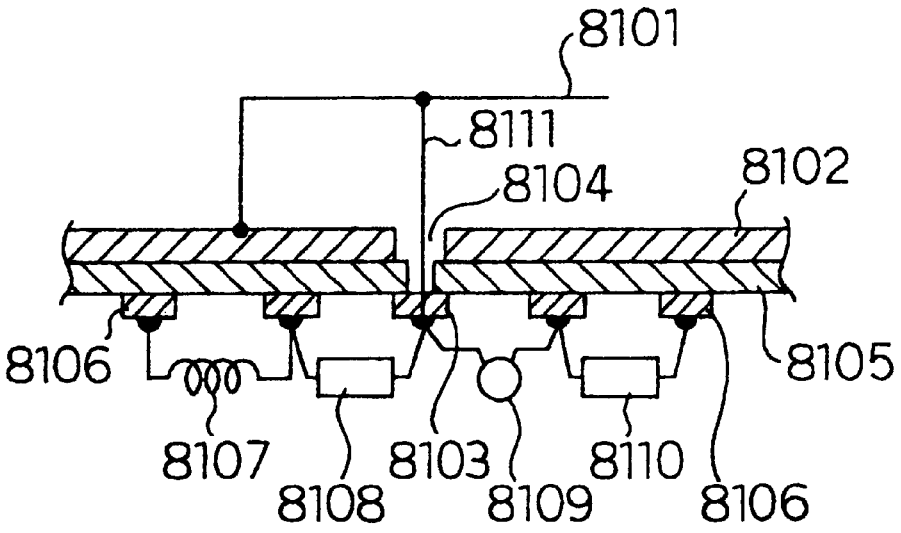

FIG. 109 shows that in addition to the configuration of FIG. 108 described above, another conductive plate is provided on the back of a conductive earth substrate (on the opposite side to an antenna element) to mount various circuit components thereon. Namely, a through-hole 8104 is formed in both a conductive earth substrate 8102 and a conductive plate 8105 to run a lead 8111 from an antenna element 8101 therethrough and an insulator 8103 is provided on the conductive plate 8105 over the through-hole 8104. In addition, a required number of insulators 8106 are provided on the conductive plate 8105 to connect various circuit components. The lead 8111 passes through the through-hole 8104 to the insulator 8103 and circuit components 8107 to 8110 are connected on the insulators 8103 and 8106.

This configuration can allow location of the circuit in the proximity of the antenna and easy shielding between the antenna and the circuit through the conductive plate, and thus, it can facilitate implementing a compact device.

Figure 110:
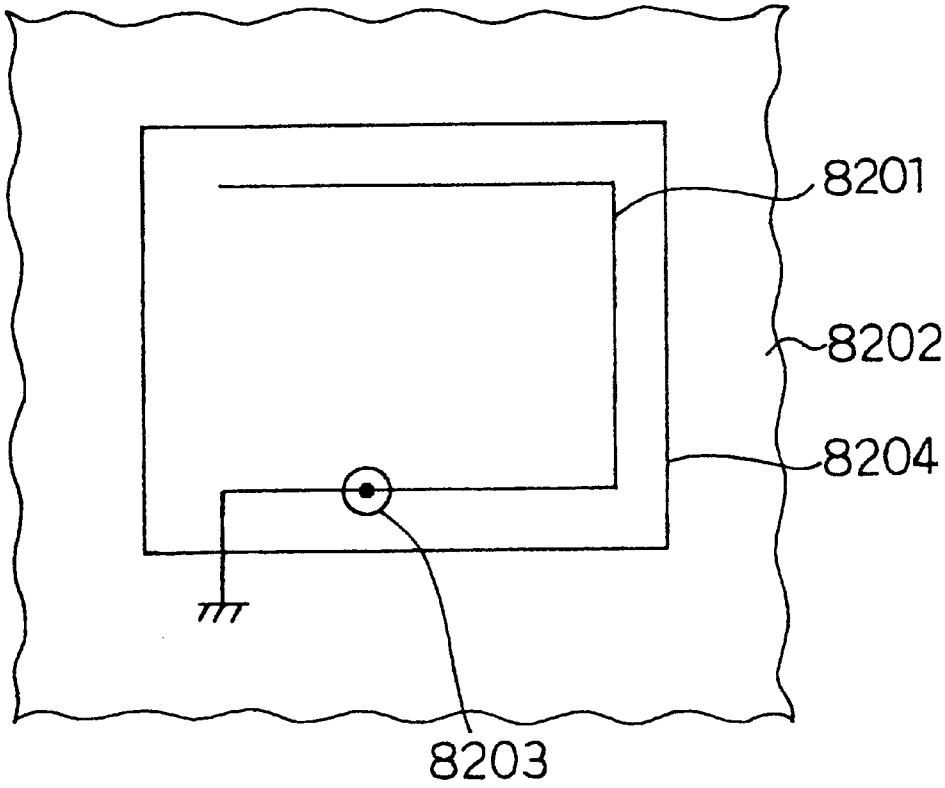
FIG. 110 is a schematic diagram showing an example of an antenna device according to the present invention.
Figure 110:
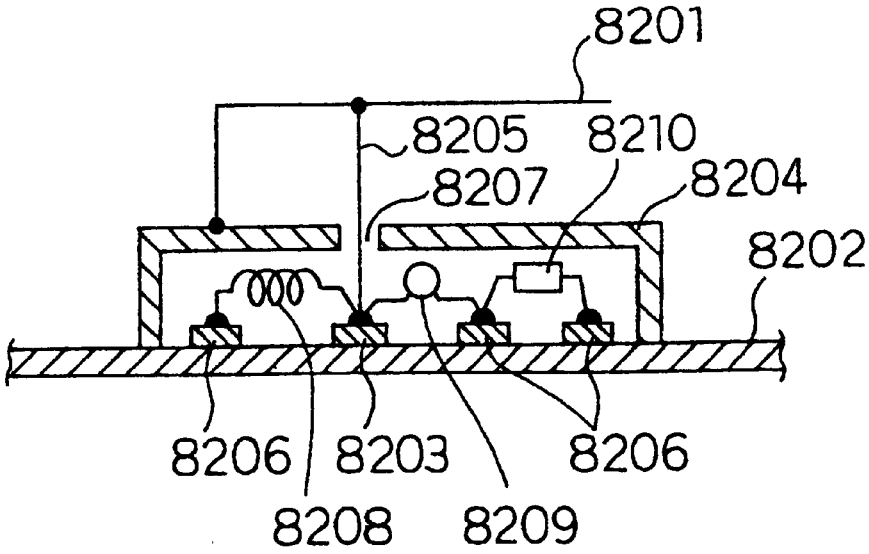

FIG. 110 shows still another example of the antenna in which circuit components are located on the same side as an antenna element. Namely, an insulator 8203 to connect a lead 8205 from an antenna element 8201 and a required number of insulators 8206 to connect various circuit components are provided on a conductive earth substrate 8202. In addition, a conductive shielding case 8204 is provided on the conductive earth substrate 8202 to shield the circuit components on the conductive earth substrate 8202 from the antenna element 8201 and a through-hole 8207 is formed for running the lead 8205 therethrough. The lead 8205 passes through the through-hole 8207 to connect to the insulator 8203 and circuit components 8208 to 8210 are connected on the insulators 8203 and 8206. An end of the antenna element 8201 is connected to the shielding case 8204 for grounding.

This configuration can allow the whole circuit to be held between the antenna element and the conductive earth substrate and to be shielded by the shielding case, and thus, it can facilitate implementing a more compact device than the configuration of FIG. 109 described above.

Figure 111:
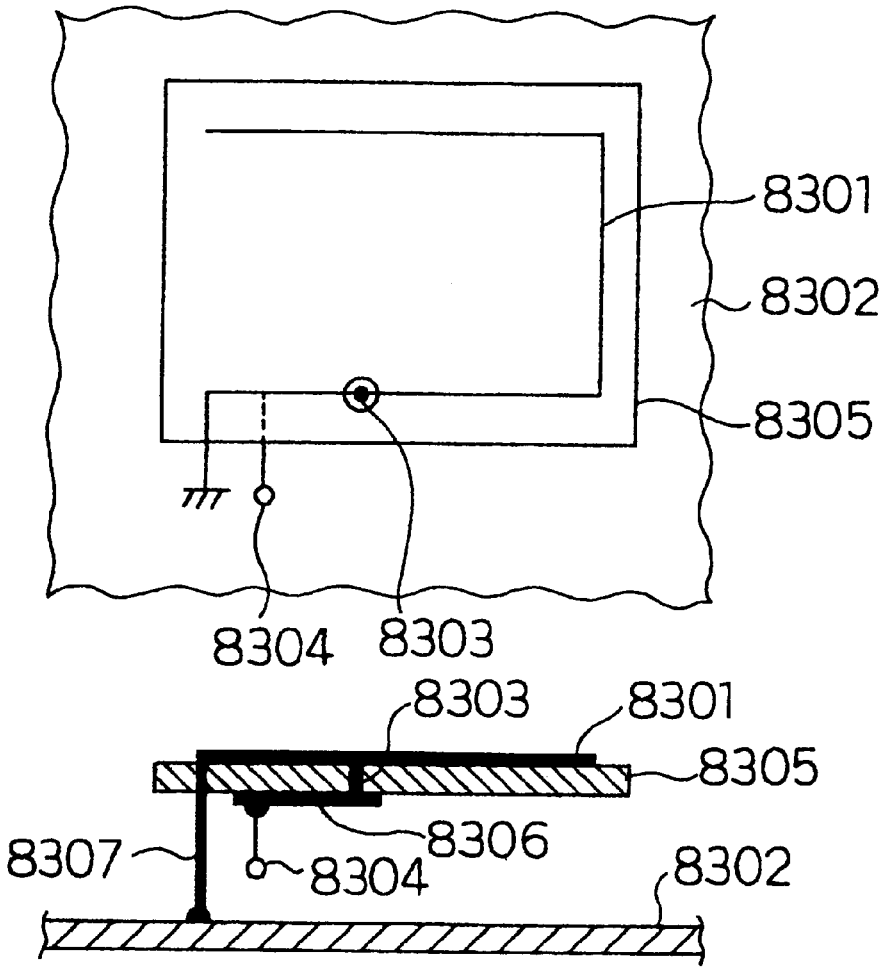
FIG. 111 is a schematic diagram showing an example of an antenna device according to the present invention.

In the antenna device of FIG. 111, an antenna element 8301 is formed on one side of an insulation plate 8305 and one end 8307 of the antenna element 8301 passes through the insulation plate 8305. A lead 8303 from a point in the antenna element 8301 also passes through the insulation plate 8305 and another lead 8306 formed on the opposite side of the insulation plate 8305 and parallel to the antenna element 8305[sic] is connected to the lead 8303 for connecting a feeding section 8304 to the lead 8306. It should be noted that the feeding section 8304 is provided in the proximity of the end 8307 of the antenna element 8301. In addition, the insulation plate 8305 is located parallel to a conductive earth substrate 8302, to which the end 8307 of the antenna element 8301 is connected.

This configuration can facilitate connecting coaxial cables because the grounded end of the antenna element is close to the feeding section.

Figure 112:
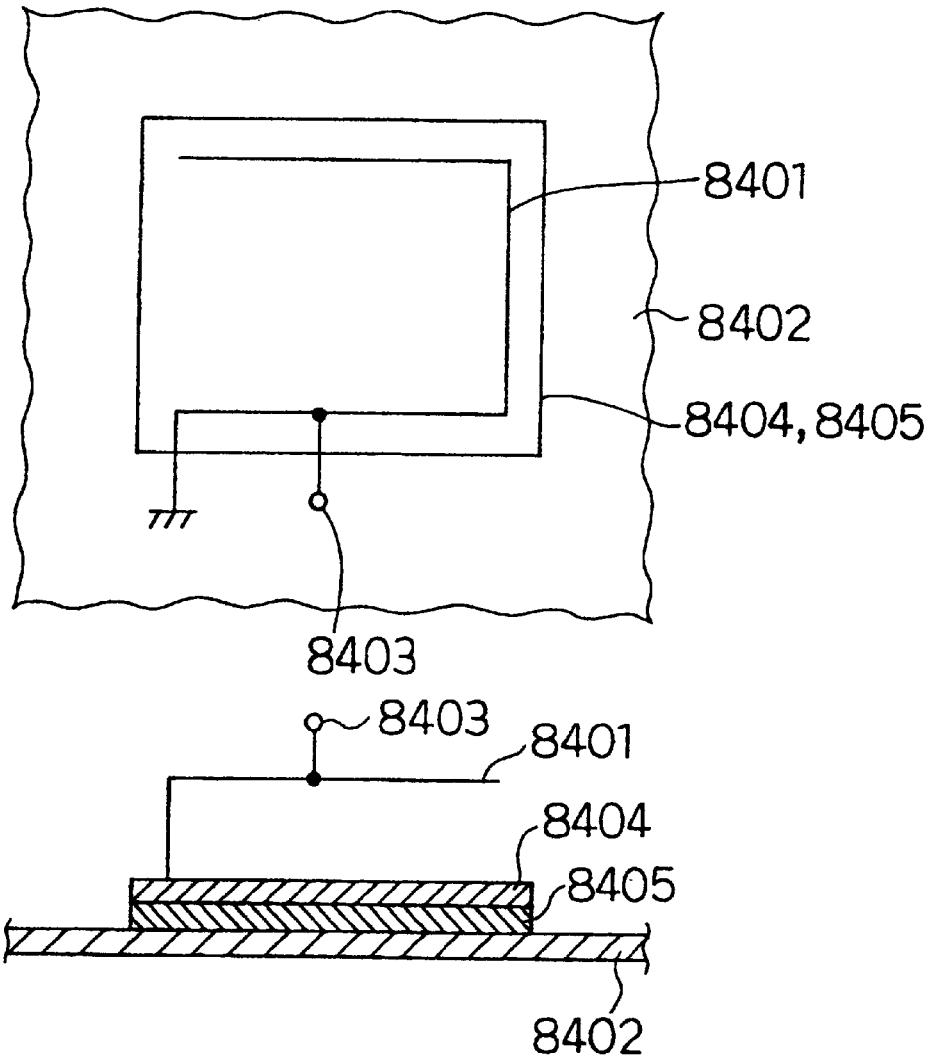
FIG. 112 is a schematic diagram showing an example of an antenna device according to the present invention.

In the antenna device of FIG. 112, a conductive earth substrate 8404 is provided on another broader conductive earth substrate 8402 through an insulation plate 8405 and an antenna element 8401 is located in the proximity of the conductive earth substrate 8404. It should be noted that an end of the antenna element 8401 is connected to the conductive earth substrate 8404 for grounding. It should be preferable that the conductive earth substrate 8404 is equal to the antenna element 8401 in size. Specifically, the conductive earth substrate 8402 may be the body of an automobile or carriage, the metal case for a receiver or communication device, or any metal structure of a house and it may be installed inside or outside the room or compartment.

This configuration can achieve a nearly horizontal elevation angle with the maximum gain and thus, it will be suitable for receiving communication waves (vertically polarized waves) which come from a lateral direction.

It should be noted that any of the antenna devices shown in FIGS. 95 through 112 can be installed at such locations as shown in FIGS. 65, 75, 76, 80, 81, and 82 to operate properly.

It should be also noted that one or two antenna elements are used in any of the antenna devices shown in FIGS. 95 through 112 but of course, three or more antenna elements may be used.

It should be further noted that antenna elements used in any of the antenna devices shown in FIGS. 95 through 112 are in a three-edge shape but they may be in a loop or any other shape.

It should be further noted that insulators used to provide connection points in any of the antenna devices shown in FIGS. 107 through 112 may apply to any other antenna devices according to the preceding embodiments described above.

Next, other embodiments of the present invention which are devised mainly to improve the gain will be described below.

Figure 126:
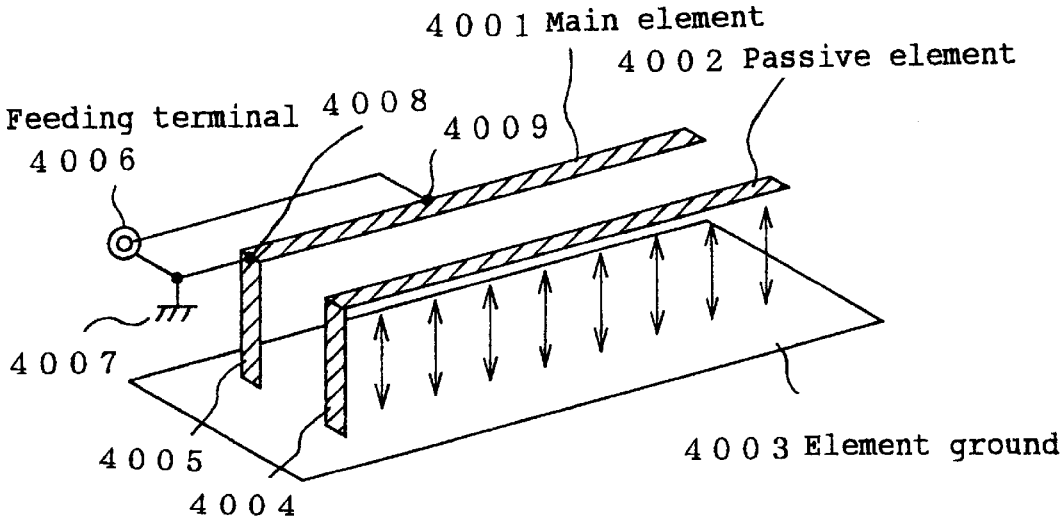

FIG. 126 is a perspective view showing an embodiment according to the present invention.

In the figure, the reference numeral 4003 designates a conductive earth substrate, to which a main element 4001 is connected through a first ground connection 4005 so that it is substantially parallel to the substrate. The connection between the main element 4001 and the first ground connection 4005 is connected to another ground 4007. In addition, a feeding terminal 4006 is connected to a point in the main element 4001 and a grounding terminal of the feeding terminal 4006 is connected to the ground 4007.

A passive element 4002 is also connected to the conductive earth substrate 4003 through a second ground connection 4004 along the main element 4001.

As seen from the graphs shown in FIGS. 139 and 149[sic], the gain can be improved by providing such a passive element 4002 in this way. In the figure, the line with white squares indicates an ideal monopole antenna, the line with black squares indicates a one-element antenna, and the line with black circles indicates an embodiment according to the present invention. It can be seen from the figure that the gain characteristics are improved for a specific narrow-band.

Figure 127:
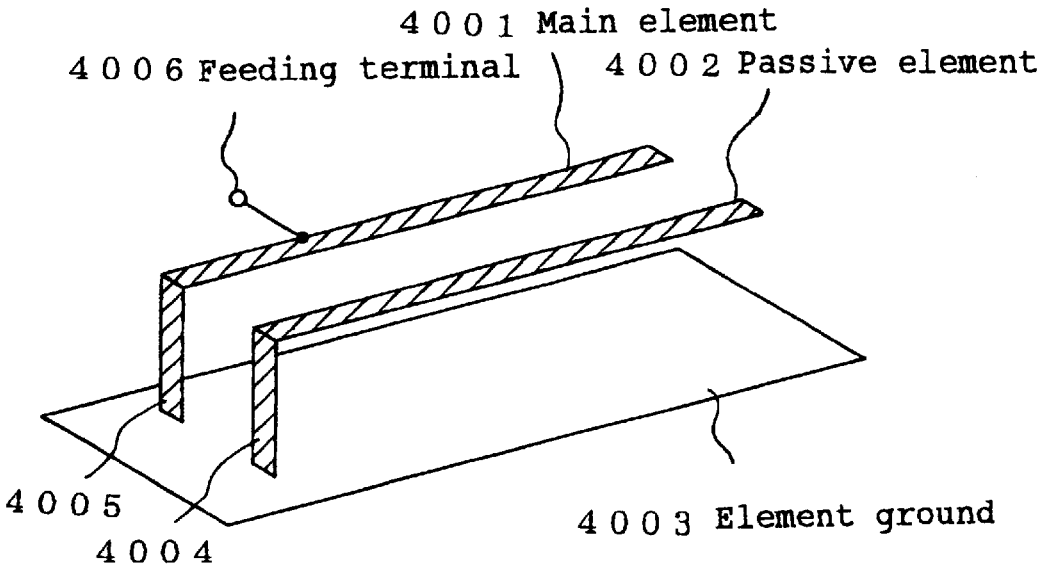

FIG. 127 shows another embodiment according to the present invention, which differs from the embodiment of FIG. 126 in that a feeding terminal 4006 is grounded with a conductive earth substrate 4003. It should be noted that the embodiment of FIG. 126 can achieve a better gain than this embodiment.

Figure 128:
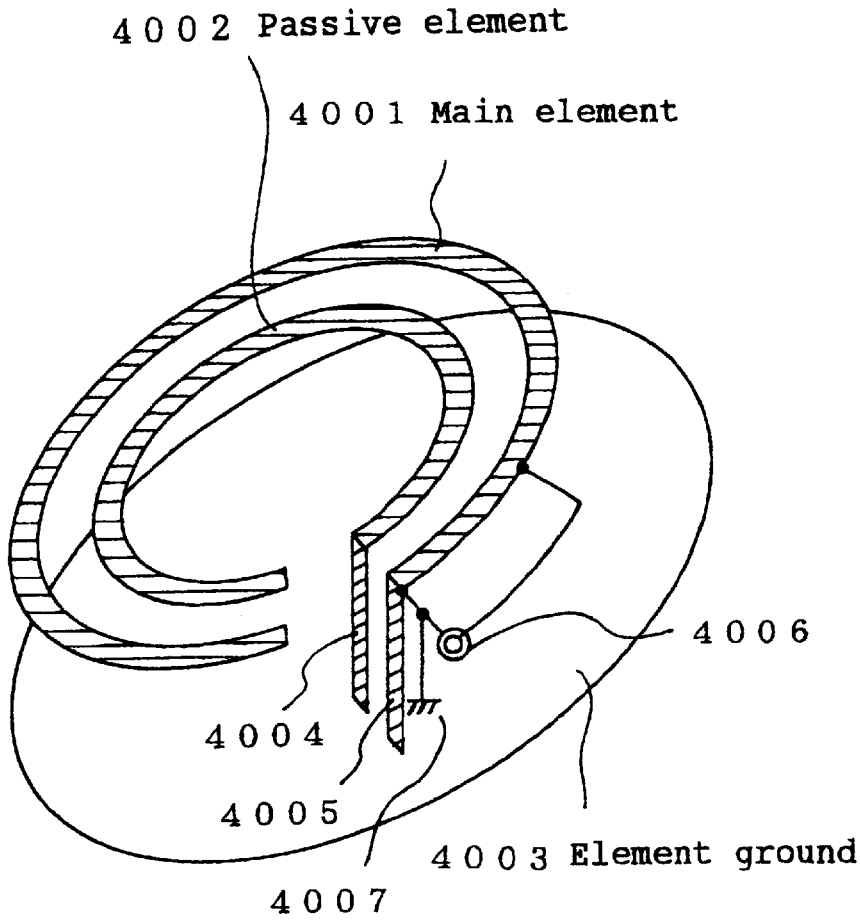

FIG. 128 shows still another embodiment according to the present invention and a main element 4001 and a passive element 4002 are both formed in a circular shape in this embodiment, while they are formed in a straight shape in the embodiment of FIG. 126. It should be noted that the passive element 4002 may be located inside or outside the main element 4001.

Figure 129:
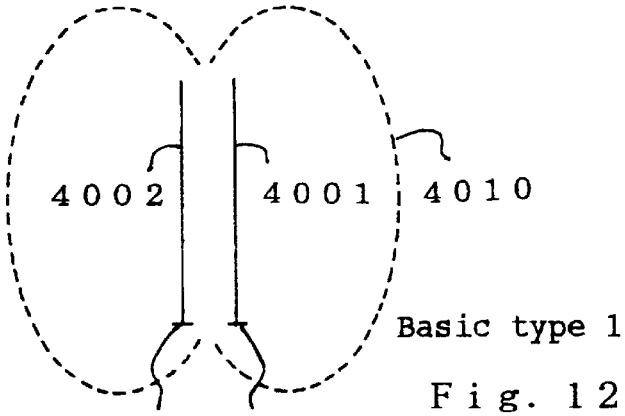
Figure 129:
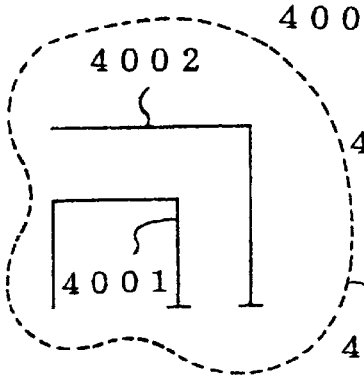
Figure 129:
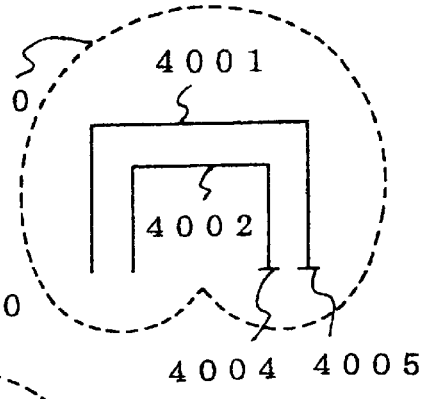
Figure 129:
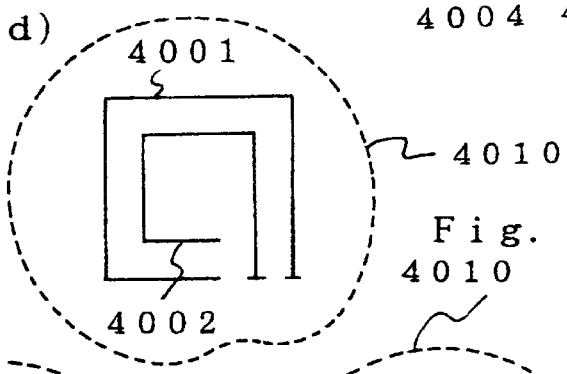
Figure 129:
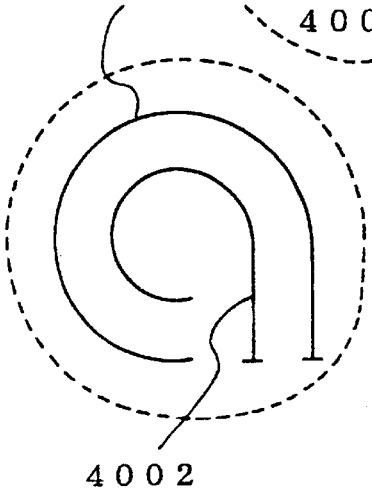
Figure 129:
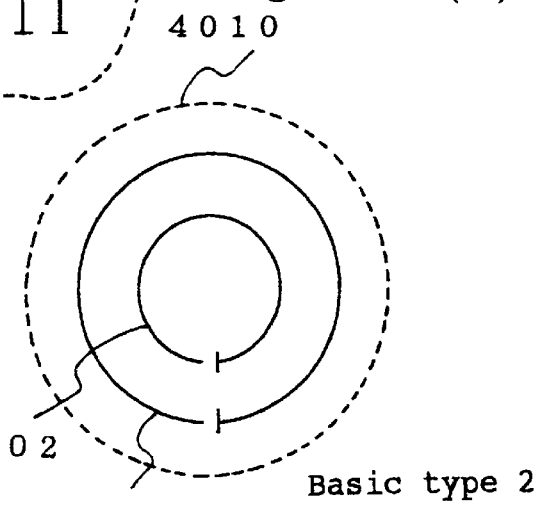

FIG. 129 shows various types of the main element 4001 and the passive element 4002 as plan views taken in a direction perpendicular to the conductive earth substrate 4003. Specifically, FIG. 129(*a*) shows a straight type, FIGS. 129(*b*) through (*d*) show bent types, and FIGS. 129(*e*) and (*f*) show circular types. In addition, the reference numeral 4010 designates the directivity of each type. As seen from the figures, such an approximately circular type as shown in FIG. 129(*f*) can achieve the best omnidirection. Conversely, if a specific directivity is desired, another type of elements which can achieve that directivity may be selected.

Figure 130:
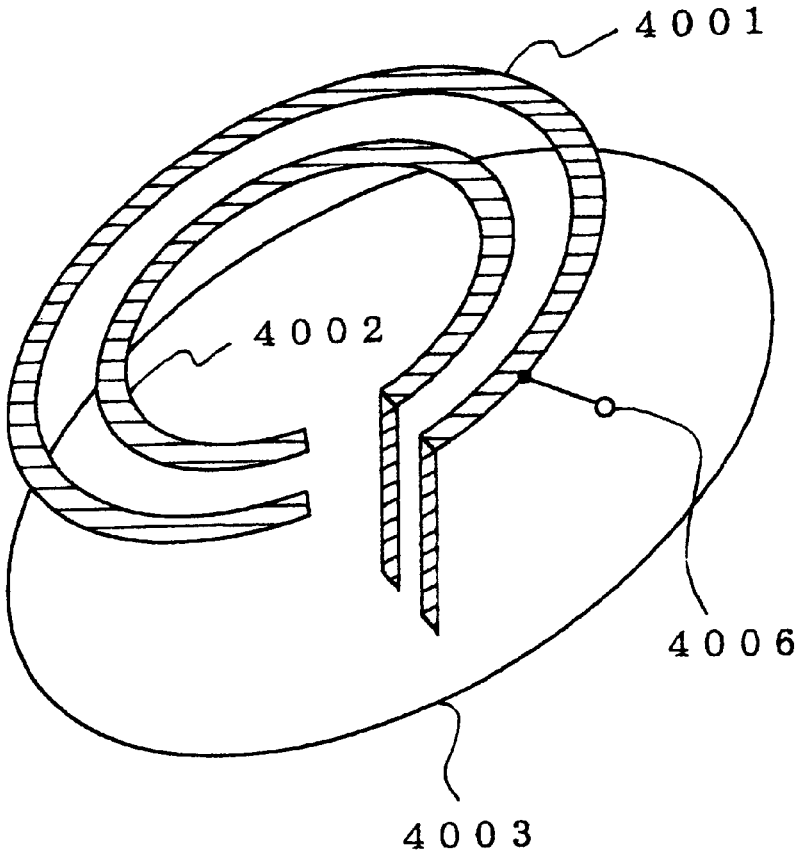

FIG. 130 shows a circular type, in which a feeding terminal 4006 is grounded with a conductive earth substrate 4003.

Figure 131:
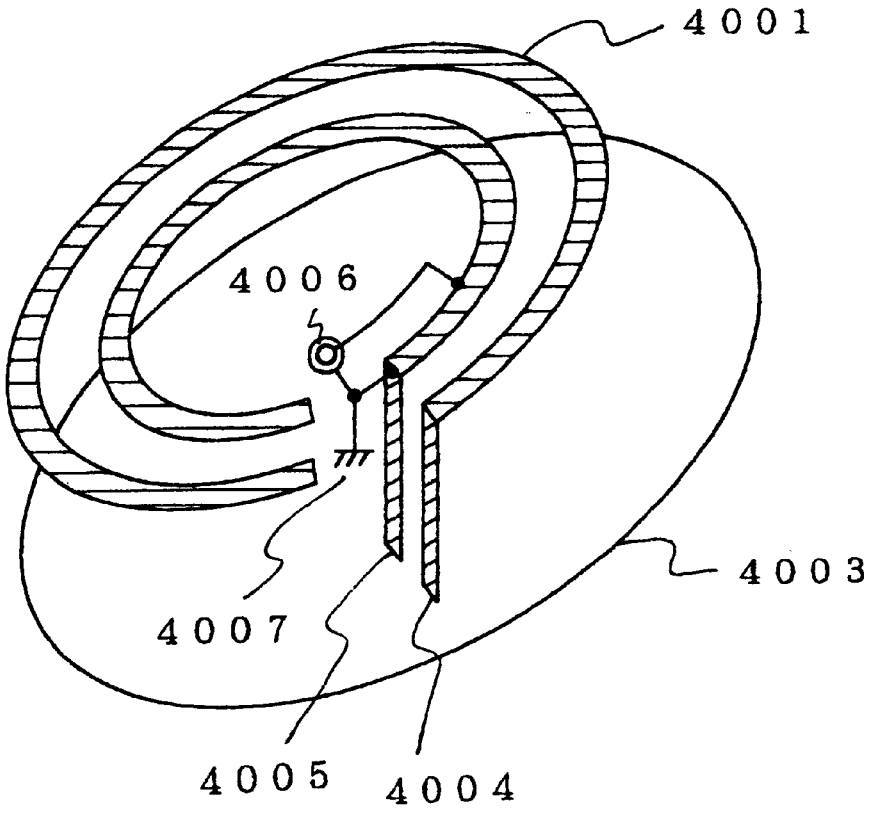

FIG. 131 shows another circular type, in which a feeding terminal 4006 is grounded with a specifically provided ground 4007 rather than a conductive earth substrate 4003.

FIG. 132 shows another embodiment according to the present invention, in which a larger ground 4012 such as an automobile body is provided under a conductive earth substrate 4003 through an insulator 406011[sic]. It should be preferable that the size and shape of the insulator 4011 are equal to those of the outer main element 4001. If a passive element 4002 is provided as the outer element, it should be preferable that the size and shape of the passive element 4002 are equal to those of the insulator 4011. It should be also preferable that the distance between the main element 4001 and the passive element 4002 is approximately $1/600\lambda$., the distance between both elements 4001 and 4002 and the conductive earth substrate 4003 is approximately $1/20\lambda$., and the thickness of the insulator 4011 is approximately $1/60\lambda$.. FIG. 133 shows that the ground connections 4004 and 4005 in FIG. 128 can be formed as a single connection plate 4013. This configuration can provide a simpler antenna device for a narrower band.

FIG. 134 shows that two passive elements 4002, 4002[sic] are provided, one on each side of a main element 4001. This configuration can provide two gain peaks as shown in FIG. 134(*b*).

FIG. 135 shows that two circular main elements 4001 are provided in parallel and a common feeding terminal 4006 is connected to them through a capacitor 4014. This configuration can accomplish band synthesis. FIG. 135(*b*) shows the result of such band synthesis.

FIG. 136 shows that two passive elements 4003[sic], 4003 are provided, one on each side of the two main elements 4001 shown in FIG. 135. This configuration can provide such an improved band synthesis gain as shown in FIG. 136(*b*) as compared with the example of FIG. 135.

FIG. 137 shows that a passive element 4003 is provided between the two main elements 4001, 4001[sic] shown in FIG. 135.

FIG. 138 shows that a circular main element 4001 is provided on the top surface of a printed circuit board 4015 and a passive element 4002 is provided on the undersurface of the printed circuit board 4015. The main element 4001 and the passive element 4002 are located in opposed positions with respect to each other. A conductive earth substrate 4003 as described above is provided parallel to the printed circuit board 4015.

Next, several embodiments of a digital television broadcasting receiving device, in which any of the above-mentioned antenna devices according to the present invention is used, will be described below.

(Embodiment 10)

FIG. 138[sic] is a block diagram showing the configuration of a digital television broadcasting receiving device according to the embodiment 10 of the present invention. In FIG. 138[sic], the reference numeral 6001 designates an input means, 6002 designates a delay means, 6003 designates a synthesis means, 6004 designates a reception means, 6005 designates a demodulation means, 6007 designates a delayed wave estimation means, 6008 designates a positional information determination means, and 6009 designates a vehicle information detection means. The operation for receiving digital television broadcasting at a vehicle will be described below with reference to FIG. 141.

A television broadcasting wave is converted to an electric signal by the input means 6001 such as a receiving antenna and then supplied to the delay means 6002 and the synthesis means 6003. The television broadcasting wave converted to such an electric signal is delayed by the delay means 6002 in accordance with a delay control signal from a synthesis control means 6006 and then supplied to the synthesis means 6003. In the synthesis means 6003, in accordance with a synthesis control signal from the synthesis control means 6006, a signal from the input means 6001 and another signal from the delay means 6002 are provided with a predetermined gain for each signal and synthesized together and then supplied to the reception means 6004. As a synthesis technique used for this purpose, addition, maximum selection, or other simple operations can be used.

The reception means 6004 extracts only signals within a necessary band from those supplied by the synthesis means 6003 and converts them to signals of frequencies which can be handled by the demodulation means 6005. Thus converted signals are supplied to the demodulation means 6005, which in turn demodulates them for output. The demodulation means 6005 supplies demodulation information to the delayed wave estimation means 6007, which estimates a delayed wave contained in the received wave based on the demodulation information supplied by the demodulation means 6005.

The operations for demodulation and delayed wave estimation will be described below. In the ground wave digital broadcasting which is now being standardized in Japan, orthogonal frequency-division multiplexing (OFDM) is used for modulation and the demodulation means 6005 performs OFDM demodulation to decode transmitted codes. During the decoding process, frequency analysis is performed through an operation such as FFT. The transmission characteristics of a received signal can be estimated by using various pilot signals contained in the received signal for data demodulation. For example, a delay time can be detected by detecting dip locations and the number of dips in frequency components which are obtained from the FFT frequency analysis.

FIG. 147 shows an example of the frequency analysis performed for OFDM and the frequency characteristics may be flat when no delayed wave exists, while the frequency components may have some dips as shown in FIG. 147 when some delayed waves exist. Alternatively, a delayed wave can be detected by observing any variation in or lack of pilot signals. The delay time of a disturbance wave can be estimated based on erroneous data positional information obtained through an error correction process performed after the FFT operation. It should be noted that the Japanese digital broadcasting has been described in the above paragraphs but this technique may apply also to analog broadcasting or foreign digital broadcasting.

Next, the operations for synthesis control and delay control will be described below. The synthesis control means 6006 provides a signal to control the delay means 6002 and the synthesis means 6003 based on estimated delayed wave information supplied by the delayed wave estimation means 6007. The configuration of the synthesis control means 6006 which comprises a gain control means 6061 and a delay time control means 6062 will be described below. The gain control means 6061 establishes a synthesis gain in the synthesis means 6003 based on delayed wave information supplied by the delayed wave estimation means 6007. This establishing operation will be described below with reference to FIG. 148. In FIG. 148, the axis of abscissas shows the magnitude of a delayed wave and the axis of ordinates shows a ratio of the gain of a signal supplied by the input means 6001 (signal A gain) to the gain of a signal supplied by the delay means 6002 (signal B gain) (=signal A gain/signal B gain). The synthesis gain is controlled so that both gains can be identical when the level of a delayed wave is large and in particular, it is equal to the level of a direct wave or so that a difference between both gains can be obtained by decreasing the gain of a signal supplied by the delay means or that of a signal supplied by the input means when the level of a delayed wave is small or, when the level of a delayed wave is larger than that of a direct wave. In addition, if the gain control is accomplished based on the delay time of a delayed wave supplied by the delayed wave estimation means 6007, the gain difference becomes larger for the case of a large delay time (the curve a in FIG. 148) than the case of a small delay time (the curve b in FIG. 148).

Next, the operation of the delay time control means 6062 will be described below. It controls the establishment of a delay time to be used by the delay means 6002 so that the delay means 6002 delays the time by a length almost equal to the delay time estimated by the delayed wave estimation means 6007. For example, the relationship between error rates of a delayed wave and a demodulated signal is shown in FIG. 149. As shown in the figure, because the error rate may deteriorate abruptly when a delay time is small (point B: approximately 2.5 $\mu$s or less), such a deterioration in error rate can be effectively avoided by using a fixed delay time, for example, a delay time exceeding the point B in FIG. 149, rather than a delay time estimated by the delayed wave estimation means 6007 when the estimated delay time is small. It should be noted that such a delay time to be established here must be at most shorter than a guard period added to an OFDM signal. In order to prevent such a deterioration in error rate from occurring due to the small delay time of a delayed wave, the delay means 6002 can always establish a predetermined delay time. For this purpose, any influence of a short delay time can be eliminated by setting such a delay time to a value nearly twice as large as the point B. If a signal is received by a single antenna as shown in FIG. 141, a delay time smaller than the reciprocal of the bandwidth of a received signal can be added to the signal to decrease the noise level of the received signal with an improved error rate. This is because dips caused by the added signal will appear outside the signal bandwidth. For example, if the signal bandwidth is 500 kHz, an added delay time must be established to be 2 $\mu$s or less. The operation for adding a signal with a short delay time as described above can be effective in improving the reception level of signal bandwidth for narrowband broadcasting which is used as broadcasting services for mobile reception.

Next, the usage of the vehicle information detection means 6009 will be described below. The vehicle information detection means 6009 detects information on a moving reception vehicle. For example, this means may consist of a speed (vehicle speed) detection means 6091 which detects the speed of a moving reception vehicle and a position detection means 6092 which detects the position of such a vehicle. It goes without saying that the vehicle information detection means 6009 can be implemented by a navigation system and that the position detection means can be implemented by using a GPS system or by detecting locations through a PHS, a portable telephone set, or a traffic control system such as VICS. Detected vehicle information is supplied to the positional information determination means 6008.

The positional information determination means 6008 checks which broadcast station covers the current location and estimates the delay time and the strength of a wave received at the receiving location, taking account of the distance from such a station as well as possible reflections from mountains and buildings. To this end, this means has previously obtained information including the transmission frequency and location or transmission power of each transmitting station such as a broadcast station or relay station or downloaded it through any communication means such as broadcasting or telephone into its storage to compare it with the positional information supplied by the vehicle information detection means 6009. From this information, the delay time and magnitude of a wave received at that receiving location can be estimated.

Moreover, the delay time and magnitude of a received wave can be obtained more accurately, by marking in a map information including the location, magnitude, and height of each building located near the receiving location in addition to the location of each broadcasting station and taking account of possible reflections therefrom. It goes without saying that a navigation system can be used to handle such information on the transmitting stations, buildings, and mountains. It should be also noted that a delayed wave can be tracked more quickly because the following delayed wave can be estimated by knowing the speed of a moving reception vehicle through the speed detection means 6091.

The synthesis control means 6006 controls the synthesis gain and the delay time based on the delayed wave information supplied by the positional information determination means 6008 as described above. These control operations can be performed in a similar manner to those based on the delayed wave information supplied by the delayed wave estimation means 6007. In addition, the information from the delayed wave estimation means 6007 can be used in combination with that from the positional information determination means 6008 and then the gain and delay time may be controlled only if these two kinds of delay information are similar to each other or they may be controlled to remain unchanged or they may be controlled in accordance with the information containing a larger level of delayed wave if these two kinds of delay information are quite different from each other. It should be noted that in the description above, the vehicle information detection means 6009 is provided for mobile reception but both mobile and stationary reception can be accomplished by using the position detection means 6092 only.

The configuration described above has only one input means as shown in FIG. 141 but another configuration shown in FIG. 142 which has a plurality of input means and a plurality of delay means corresponding to the input means, respectively, is also effective for mobile reception. Each input means of this configuration is provided with a different input signal because it is affected by a different level of multipath interference even when it receives the same broadcasting wave. This may cause dips at different locations (frequencies) and different depths as shown in FIG. 147. Therefore, a plurality of different input signals can be added together to provide another dip at a different location and depth, resulting in a lower signal error rate. The reception operation of the device shown in FIG. 142 is almost identical to that described for FIG. 141. Under the control of the delay means 6002 and the synthesis means 6003, a desired delay time is established with the delay means 1 through N in a relative manner and the gain can be set in accordance with the delayed signal. If the distance between a plurality of antenna locations is sufficiently shorter than the wavelength of the baseband, the level of received signals can be improved by adding a plurality of input signals within the baseband.

As described above, the digital television broadcasting receiving device according to the embodiment 10 can reduce signal dips through synthesis of signals, resulting in an improved error rate of digital data. Any deterioration in error rate can be avoided by establishing a delay time to prevent any influence of a signal with a shorter delay time. In addition, signal dips can be avoided more accurately by producing an accurate delayed wave through the delayed wave estimation means, the vehicle information detection means, and the positional information determination means and thus, the error rate can be further improved.

Signals received through a plurality of antennas can be switched depending on their error conditions. The antenna switching conditions for changing over from one antenna to another will be described below with reference to FIG. 150. First, the C/N ratio of an input signal and the length of a past period such as a frame period thereof are determined and antenna switching is not performed if the C/N ratio is large and the error rate is low. If an error is a burst one of very short period and does not continue for a while even when the error rate is high, antenna switching is not performed. If the C/N level of an input signal is lowered or if a high error rate continues for a while, antenna switching is performed. The timing for antenna switching may be set to a guard interval appended to an OFDM signal. Alternatively, such an antenna switching timing may be calculated from a combination of vehicle speed information and positional information. It should be noted that the timing for antenna switching may be set to a guard interval appended to an OFDM signal. This can allow optimum antenna switching in accordance with varying reception conditions during the mobile reception. It should be also noted that by providing an antenna 6011 and an amplification means 6012 as components of the input means shown in FIGS. 141 and 142, any signal attenuation or matching loss due to distribution can be avoided to perform the succeeding operation accurately.

(Embodiment 11)

FIG. 143 is a block diagram showing the configuration of a digital television broadcasting receiving device according to the embodiment 11[sic] of the present invention. In FIG. 143, the reference numeral 6001 designates an input means, 6002 designates a delay means, 6003 designates a synthesis means, 6004 designates a reception means, 6005 designates a demodulation means, 6007 designates a delayed wave estimation means, 6008 designates a positional information determination means, and 6009 designates a vehicle information detection means. The configuration of the embodiment 11 as shown in FIG. 143 differs from that of the embodiment 10 described above in that the reception means 6004 is connected directly to the input means 6001. The operation for receiving digital television broadcasting at a vehicle according to the embodiment 11 will be described below.

A television broadcasting wave is converted to an electric signal by the input means 6001 such as a receiving antenna and then supplied to the reception means 6004. The reception means 6004 extracts only signals within a necessary band from those supplied by the input means 6001 and supplies them to the delay means 6002 and the synthesis means 6003. Those signals supplied by the reception means 6004 are delayed by the delay means 6002 in accordance with a delay control signal from a synthesis control means 6006 and then supplied to the synthesis means 6003. In the synthesis means 6003, in accordance with a synthesis control signal from the synthesis control means 6006, a signal from the reception means 6004 and another signal from the delay means 6002 are weighted with a predetermined gain added to each signal and synthesized together and then supplied to the demodulation means 6005. As a synthesis technique used for this purpose, addition, maximum selection, or other simple operations can be used in a similar manner to that for the embodiment 10 described above. The demodulation means 6005 demodulates them for output.

In a similar manner to that for the embodiment 10, a delayed wave is estimated in the delayed wave estimation means 6007 and the positional information determination means 6008 from demodulation information supplied by the demodulation means 6005 and mobile reception information supplied by the vehicle information detection means 6009, respectively, and then supplied to the synthesis control means 6006, which in turn controls the delay and synthesis operations by producing control signals to be supplied to the delay means 6002 and the synthesis means 6003. The detailed operations of the synthesis control means and the vehicle information detection means performed during the reception operation described above are identical to those for the embodiment 10. In the receiving device according to the embodiment 11, the operations of the delay means 6002 and the synthesis means 6003 can be simplified because the frequencies and bands are limited by the reception means 1, but the same effects as those of the embodiment 10 can be achieved.

As shown in FIG. 144, a plurality of input means 6001, a plurality of reception means 6004, and a plurality of delay means 6002 can be provided for reception. The operation of this configuration shown in FIG. 144 is identical to that for the preceding embodiment described above and will not be described here in detail. Because a plurality of input means 6001, a plurality of reception means 6004, and a plurality of delay means 6002 are provided, each input means of this configuration is provided with a different input level due to a different condition of interference even when it receives the same broadcasting wave. This may cause dips at different locations (frequencies) and different depths as shown in FIG. 147. Therefore, a plurality of different input signals can be added together to provide another dip at a different location and depth, resulting in a lower signal error rate.

(Embodiment 12)

FIG. 145 is a block diagram showing the configuration of a digital television broadcasting receiving device according to the embodiment 12[sic] of the present invention. In FIG. 145, the reference numeral 6001 designates an input means, 6004 designates a reception means, 6005 designates a demodulation means, 6007 designates a delayed wave estimation means, 6055 designates a demodulation control means, 8[sic] designates a positional information determination means, and 9[sic] designates a vehicle information detection means. The operation for receiving digital television broadcasting at a moving vehicle or a fixed location will be described below with reference to FIG. 145.

A television broadcasting wave is converted to an electric signal by the input means 6001 such as a receiving antenna and then supplied to the reception means 6004. The reception means 6004 extracts only signals within a necessary band from those supplied by the input means 6001 and supplies them to the demodulation means 6005. The demodulation means demodulates the signals supplied by the reception means 6004 to provide digital signals for output and supplies the demodulation conditions to the delayed wave estimation means 6007.

Now, the operation of the demodulation means 6005 will be described below. More specifically, the operation of the demodulation means 6005 consisting of a frequency analysis means 6051, an adjustment means 6052, and a decoding means 6053 will be described. A signal supplied by the reception means 6004 is frequency-analyzed by the frequency analysis means 6051 which performs an FFT, real FFT, DFT, or FHT frequency analysis technique to convert it to a signal on the frequency axis and such a converted signal is supplied to the adjustment means 6052. The adjustment means 6052 operates on the signal on the frequency axis from the frequency analysis means 6051 based on a control signal supplied by the demodulation adjustment means [sic] 6055. That operation may be accomplished by performing a transfer function on a signal supplied by the frequency analysis means 6051 based on the signal from the demodulation control means 6055, by performing an arithmetic operation through filtering, by emphasizing a specific frequency component, or by interpolating a possibly missing frequency component. The signal supplied by the adjustment means 6052 is decoded by the decoding means 6053 into a digital code. The delayed wave estimation means 6007 estimates a delayed wave based on a signal from the demodulation means 6005. Such reference signals include a frequency spectrum supplied by the frequency analysis means 6051 and a pilot signal obtained during the decoding process in the decoding means 6053. The frequency spectrum of a received signal has dips or the like in response to the presence of delayed waves as shown in FIG. 147. Since the frequency spectrum becomes flat in the ODFM modulation which is usually used for digital television broadcasting, the magnitude of a delayed wave and the delay time can be estimated. The magnitude of a delayed wave and the delay time also can be estimated from any change in phase or missing of a pilot signal. The demodulation control means 6055 controls the adjustment means 6052 based on delayed wave information supplied by the delayed wave estimation means 6007 or the positional information determination means 6008. Such a control can be accomplished by supplying a control parameter determined in accordance with the adjustment means 6052 and for example, by supplying a transfer function determined by the demodulation control means 6055 in accordance with a delayed wave when the transfer function is to be applied to the adjustment means 6052. Alternatively, a filter factor is supplied when filtering is to be performed or an interpolation value is supplied when interpolation is to be performed. The positional information determination means 6008 and the vehicle information detection means 6009 are identical to those for the embodiments 10 and 11 described above and will not be described here in detail.

As described above, according to the present embodiment, accurate decoding can be accomplished with an improved error rate of received digital signals, since the adjustment means 6052 serves to reduce any influence of delayed waves.

FIG. 146 shows the configuration having a plurality of input means 6001. This configuration requires the same number of reception means as that of the input means as well as a plurality of frequency analysis means. However, it does not necessarily require a plurality of adjustment means nor a plurality of decoding means and it may do with a single adjustment means and a single decoding means by selecting signals to be processed thereby. It should be noted that for simplicity, only a single frequency analysis means 6051, a single adjustment means 6052, and a single decoding means 6053 are shown in FIG. 146 but the present embodiment actually comprises the same number of these means as that of the input means as described above.

In the configuration of FIG. 146, the magnitude of a delayed wave and the delay time can be estimated for each input means because a frequency analysis operation is performed for each input means. Therefore, the adjustment means 6052 can select a signal of the best reception conditions. In addition, an appropriate adjustment can be performed on each signal through such a transfer function, filtering, or interpolation technique as described above to decode such a signal in the decoding means 6053. The decoding means 53[sic] or the adjustment means 6052 can select only signals having a frequency spectrum of good reception conditions among the frequency-analyzed signals from these input means and thus, satisfactory decoding of digital codes can be accomplished. From the foregoing, the configuration of FIG. 146 can correct reception errors by providing a plurality of input means.

It should be noted that in the different digital television broadcasting receiving devices according to the present invention, the maximum gain can be achieved with respect to a wave having a different plane of polarization by designing each antenna element to have a different angle when an antenna consists of a plurality of antenna elements.

INDUSTRIAL APPLICABILITY

As apparent from the foregoing, the present invention provides an antenna device and a communication system with such an antenna which can improve the reception sensitivity with a reduced transmission loss and which can be implemented at a lower cost.

Also, the present invention provides an antenna device which has better gain characteristics.

In a digital television broadcasting receiving device according to the present invention (such as claim 38) disturbance due to delayed waves contained in input signals can be reduced with an improved error rate after demodulation by delaying input signals immediately after the input or after the reception and then synthesizing them.

Also, a digital television broadcasting receiving device according to the present invention (such as claim 39), disturbance due to delayed waves can be eliminated properly with an improved error rate after demodulation by estimating the delay time and magnitude of delay from a demodulated signal or a signal being demodulated to control such delay and synthesis operations and then controlling the delay and synthesis operations based on the estimated delay time and magnitude of delay.

What is claimed is:

1. An antenna device comprising:

a conductive earth substrate;

a receiving element located in the proximity of said conductive earth substrate and having a receiving terminal; and a transmitting element located in the proximity of said receiving element and having a transmitting terminal, characterized in that an end of said receiving element and an end of said transmitting element are connected to said conductive earth substrate for grounding through a common portion and the frequency band of said receiving element is different from that of said transmitting element.

2. The antenna device according to claim 1, characterized in that said receiving element and/or said transmitting element consists of a plurality of elements.

3. The antenna device according to claim 1, characterized in that said receiving element and said transmitting element are formed together on one side of a common circuit board.

4. The antenna device according to claim 3, characterized in that a receiving amplifier is provided on said common circuit board between said receiving element and said receiving terminal.

5. The antenna device according to claim 4, characterized in that said receiving amplifier is provided on the opposite side of said common circuit board to said receiving element and said receiving amplifier is connected to said receiving element via a through-hole provided in said common circuit board.

6. The antenna device according to claim 3, characterized in that a transmitting amplifier is provided on said common circuit board between said transmitting element and said transmitting terminal.

7. The antenna device according to claim 6, characterized in that said transmitting amplifier is provided on the opposite side of said common circuit board to said transmitting element and said transmitting amplifier is connected to said transmitting element via a through-hole provided in said common circuit board.

8. The antenna device according to claim 3, characterized in that a receiving amplifier and a transmitting amplifier are provided on said common circuit board between said receiving element and said receiving terminal and between said transmitting element and said transmitting terminal, respectively.

9. The antenna device according to claim 3, characterized in that said receiving terminal and said transmitting terminal are implemented as a single common terminal by using a common component.

10. A communication system comprising:

an antenna device according to claim 9;

a communication device having a power supply section to supply electric power to said receiving amplifier of said antenna device and capable of both transmitting and receiving; and a feeding line for connecting a common terminal of said antenna device to a signal input/output section of said communication device, characterized in that a direct-current blocking capacitor is provided between a common component of said antenna element and said common terminal and at the input/output terminal of said communication device, respectively, and electric power is supplied by said power supply section to a receiving amplifier of said antenna device through said feeding line.

11. The communication system according to claim 10, characterized in that said power supply section is controlled to turn on/off by using a switch signal to change over to the transmission operation in said communication device.

12. The antenna device according to claim 1, characterized in that said receiving element and said transmitting element are formed separately on opposite sides of a common circuit board.

13. The antenna device according to claim 1, characterized in that said receiving element and/or said transmitting element and/or said receiving terminal and/or said transmitting terminal is provided with a trap circuit having a predetermined resonance frequency.

14. The antenna device according to claim 1, characterized in that said receiving element and/or said transmitting element and/or said receiving terminal and/or said transmitting terminal is provided with a band-pass circuit having a resonance frequency substantially equal to that of the antenna.

15. A communication system comprising:

an antenna device according to claim 1, a communication device having a receiving amplifier and a transmitting amplifier;

a receiving connection line for connecting the receiving terminal of said antenna device to said receiving amplifier of said communication device; and a transmitting connection line for connecting the transmitting terminal of said antenna device to said transmitting amplifier of said communication device.

16. The antenna device according to claim 1, characterized in that at said receiving terminal and/or said transmitting terminal, a low-pass circuit is provided to pass signals of lower frequencies including a tuning frequency of the antenna and to block signals of frequencies higher than the tuning frequency of the antenna.

17. The antenna device according to claim 1, characterized in that at said receiving terminal and/or said transmitting terminal, a high-pass circuit is provided to pass signals of higher frequencies including a tuning frequency of the antenna and to block signals of frequencies lower than the tuning frequency of the antenna.

18. An antenna device comprising:

a conductive earth substrate;

an antenna element having an end connected to said conductive earth substrate for grounding and formed on a common circuit board; and a feeding terminal pulled out of said antenna element, characterized in that a resonant circuit is inserted between said feeding terminal and the other end of said antenna element which is not grounded, and said antenna element and said resonant circuit are located together on one side of said common circuit.

19. The antenna device according to claim 18, characterized in that said antenna element consists of a plurality of elements and said resonant circuit is inserted within each of said plurality of elements in a similar manner.

20. The antenna device according to claim 18 or 19, characterized in that said resonant circuit is a parallel circuit having an inductor and a capacitor section.

21. The antenna device according to claim 20, characterized in that said capacitor section is a series circuit having a capacitor and a voltage-variable capacitor element.

22. A communication system comprising:

an antenna device according to claim 21;

a receiver having a receiving channel setting circuit which generates a bias voltage for said voltage-variable capacitor element of said antenna device; and a feeding line for connecting a signal input section of said receiver to a feeding terminal of said antenna device, characterized in that said voltage-variable capacitor element of said antenna device is connected to said feeding terminal, a direct-current blocking capacitor is provided between said antenna element and said feeding terminal and at the input terminal of a receiving amplifier of said receiver, respectively, and a receiving channel is established by varying the bias voltage generated by said receiving channel setting circuit.

23. A communication system comprising:

an antenna device having a conductive earth substrate, an antenna element formed on a common circuit board located in the proximity of said conductive earth substrate, and a receiving amplifier provided on said common circuit board between said antenna element and a feeding terminal;

a receiver having a power supply section to supply electric power to said receiving amplifier of said antenna device; and a feeding line for connecting said feeding terminal of said antenna device to a signal input section of said receiver, characterized in that a direct-current blocking capacitor is provided between said receiving amplifier of said antenna device and said feeding terminal and at the input terminal of a receiving amplifier of said receiver, respectively, and electric power is supplied by said power supply section to said receiving amplifier of said antenna device through said feeding line.

24. The communication system according to claim 23, characterized in that said receiver comprises a power control section for controlling said power supply section to turn on/off.

25. A communication system comprising:

an antenna device having a conductive earth substrate, a receiving element having a receiving terminal formed on a common circuit board located in the proximity of said conductive earth substrate, a transmitting element having a transmitting terminal formed on said common circuit board located in the proximity of said receiving element, and a transmitting/receiving changeover circuit provided on said common circuit board and capable of switching said receiving terminal and said transmitting terminal;

a feeding line connected to said transmitting/receiving changeover circuit; and a communication device connected to said feeding line and capable of both transmitting and receiving, characterized in that said transmitting/receiving changeover circuit of said antenna device is controlled by using a switch signal to change over to the transmission operation in said communication device.

26. The antenna device according to claim 1, 18, 23 or 25, characterized in that the area of said conductive earth substrate is substantially equal to the external area of said antenna element.

27. The antenna device according to claim 1, 18, 23 or 25, characterized in that said conductive earth substrate is provided in the proximity of and facing the body earth substrate of a stationary device, mobile device, or automotive vehicle, while appropriate insulation is kept.

28. The antenna device according to claim 1, 18, 23 or 25, characterized in that the antenna body is provided at various important locations on an automobile, train, or airplane.

29. An antenna device comprising:

a conductive earth substrate;

a main antenna element connected to said conductive earth substrate through a first ground connection to be substantially parallel to said conductive earth substrate;

a feeding terminal connected to a point in said main antenna element wherein a grounding terminal of said feeding terminal is connected to said first ground connection; and a passive element connected to said conductive earth substrate through a second ground connection along said main antenna element.

30. The antenna device according to claim 29, characterized in that said main antenna element and said passive element are in a circular shape when they are taken in a direction substantially perpendicular to said conductive earth substrate.

31. The antenna device according to claim 29, characterized in that a ground terminal of a feeding terminal for said main element is connected to the connection between said main element and said ground connection.

32. The antenna device according to claim 29, characterized in that said conductive earth substrate is fixed on a conductive structure larger than said conductive earth substrate through an insulator and the size and shape of said conductive earth substrate are equal to those of said main element or said passive element whichever is outer.

33. The antenna device according to claim 29, characterized in that said first ground connection connected to said main element and said second ground connection connected to said passive element constitute a single plate-like ground connection.

34. The antenna device according to claim 29, characterized in that two passive elements are provided, one on each side of said main element.

35. An antenna device according to claim 29, characterized in that a plurality of main elements are provided and a common feeding terminal is connected to said plurality of main elements to enable band synthesis.

36. The antenna device according to claim 29, characterized in that said main element and said passive element are patterned at opposite locations on the face and the back of a printed circuit board, respectively.

37. A digital television broadcasting receiving device comprising:

input means which is an antenna device according to claim 1, 18, 23, or 29 and converts electromagnetic waves into electric signals;

delay means for receiving a signal from said input means and delaying it;

synthesis means for synthesizing a signal from said delay means and a signal from said input means;

reception means for performing frequency conversion on a signal from said synthesis means; and demodulation means for converting a signal from said reception means into a baseband signal, characterized in that the delay time used in said delay means and the synthesis ratio used in said synthesis means can be established arbitrarily.

38. The digital television broadcasting receiving device according to claim 37, characterized in that said device has a plurality of antenna elements and each antenna element is installed so that it can have the maximum gain for an electric wave of different polarization planes.

39. A digital television broadcasting receiving device comprising:

input means which is an antenna device according to claim 1, 18, 23, 25, or 29 and converts electromagnetic waves into electric signals;

delay means for receiving a signal from said input means and delaying it;

synthesis means for synthesizing a signal from said delay means and a signal from said input means;

reception means for performing frequency conversion on a signal from said synthesis means;

demodulation means for converting a signal from said reception means into a baseband signal;

delayed wave estimation means for receiving a signal indicating the demodulation conditions from said demodulation means and estimating a delayed wave contained in a signal from said input means; and synthesis control means for controlling said synthesis means and said delay means in accordance with a signal from said delayed wave estimation means, characterized in that either the signal synthesis ratio used in said synthesis means or the delay time used in said delay means can be controlled in accordance with a signal from said synthesis control means.

40. The digital television broadcasting receiving device according to claim 39, characterized in that said device has a plurality of antenna elements and each antenna element is installed so that it can have the maximum gain for an electric wave of different polarization planes.

41. A digital television broadcasting receiving device comprising:

input means which is an antenna device according to claim 1, 18, 23, 25, or 29 and converts electromagnetic waves into electric signals;

reception means for performing frequency conversion on a signal from said input means;

delay means for receiving a signal from said reception means and delaying it;

synthesis means for synthesizing a signal from said delay means and a signal from said reception means; and demodulation means for converting a signal from said synthesis means into a baseband signal, characterized in that the delay time used in said delay means and the synthesis ratio used in said synthesis means can be established arbitrarily.

42. The digital television broadcasting receiving device according to claim 41, characterized in that said device has a plurality of antenna elements and each antenna element is installed so that it can have the maximum gain for an electric wave of different polarization planes.

43. A digital television broadcasting receiving device comprising:

input means which is an antenna device according to claim 1, 18, 23, 25, or 29 and converts electromagnetic waves into electric signals;

reception means for performing frequency conversion on a signal from said input means;

delay means for receiving a signal from said reception means and delaying it;

synthesis means for synthesizing a signal from said delay means and a signal from said reception means;

demodulation means for converting a signal from said synthesis means into a baseband signal;

delayed wave estimation means for receiving a signal indicating the demodulation conditions from said demodulation means and estimating a delayed wave contained in a signal from said input means; and synthesis control means for controlling said synthesis means and said delay means in accordance with a signal from said delayed wave estimation means, characterized in that either the signal synthesis ratio used in said synthesis means or the delay time used in said delay means can be controlled in accordance with a signal from said synthesis control means.

44. The digital television broadcasting receiving device according to claim 43, characterized in that said device has a plurality of antenna elements and each antenna element is installed so that it can have the maximum gain for an electric wave of different polarization planes.

45. A digital television broadcasting receiving device comprising:

input means which is an antenna device according to claim 1, 18, 23, 25, or 29 and converts electromagnetic waves into electric signals;

reception means for performing frequency conversion on a signal from said input means;

demodulation means for converting a signal from said synthesis means into a baseband signal;

delayed wave estimation means for receiving information on the demodulation conditions from said demodulation means and estimating a delayed wave contained in a signal from said input means; and demodulation control means for controlling said demodulation means based on delayed wave information from said delayed wave estimation means, characterized in that a transfer function to be handled by said demodulation means is controlled based on a control signal from said demodulation control means.

46. The digital television broadcasting receiving device according to claim 45, characterized in that said device has a plurality of antenna elements and each antenna element is installed so that it can have the maximum gain for an electric wave of different polarization planes.

* * * * *

UNITED STATES PATENT AND TRADEMARK OFFICE

CERTIFICATE OF CORRECTION

PATENT NO. : 6,639,555 B2
DATED : October 28, 2003
INVENTOR(S) : Joji Kane et al.

It is certified that error appears in the above-identified patent and that said Letters Patent is hereby corrected as shown below:

Title page,
Item [56], References Cited, U.S. PATENT DOCUMENTS, insert:

| | | | |
|---|---|---|---|
| --6,057,803 | 5/2000 | Kane, et al. | 343/713 |
| 5,929,825 | 7/1999 | Nui, et al. | 343/895 |
| 6,118,406 | 9/2000 | Josypenko | 343/700 |
| 2,520,988 | 9/1950 | Everitt | 343/713 |
| 4,801,944 | 1/1989 | Madnick, et al. | 343/744 |
| 4,823,143 | 4/1989 | Ohe, et al. | 343/713 |
| 4,873,530 | 10/1989 | Takeuchi, et al. | 343/713 |
| 4,958,167 | 9/1990 | Schroeder | 343/713 |
| 5,177,493 | 1/1993 | Kawamura | 343/713 |
| 5,442,368 | 8/1995 | Harada, et al. | 343/713 |
| 5,457,467 | 10/1995 | Schenkyr, et al. | 343/713 |
| 5,572,226 | 11/1996 | Tuttle | 343/726 |
| 5,680,144 | 10/1997 | Sanad | 343/700 |
| 4,791,423 | 12/1988 | Yokoyama, et al. | 343/700 |
| 5,043,738 | 8/1991 | Shapiro, et al. | 343/700 |
| 5,124,733 | 6/1992 | Haneishi | 343/700 |
| 5,153,600 | 10/1992 | Metzler, et al. | 343/700 |
| 5,568,155 | 10/1996 | Tsunekawa, et al. | 343/700 |
| 6,166,694 | 12/2000 | Ying | 343/702 -- |

FOREIGN PATENT DOCUMENTS, insert:

| | | |
|---|---|---|
| --EP | 847,103 | 6/1998 |
| EP | 884,796 | 12/1998 |
| EP | 531,164 | 3/1993 |
| EP | 831,545 | 3/1998-- |

UNITED STATES PATENT AND TRADEMARK OFFICE

CERTIFICATE OF CORRECTION

PATENT NO. : 6,639,555 B2
DATED : October 28, 2003
INVENTOR(S) : Joji Kane et al.

It is certified that error appears in the above-identified patent and that said Letters Patent is hereby corrected as shown below:

Item [56], cont'd,
OTHER PUBLICATIONS, insert:

--Chinese First Office Action in 98810848.8, dated September 13, 2002

European Search Report in EP 00 12 1779, dated November 14, 2002--

Signed and Sealed this

First Day of June, 2004

JON W. DUDAS
*Acting Director of the United States Patent and Trademark Office*